US008107862B2

(12) United States Patent
Hattori et al.

(10) Patent No.: US 8,107,862 B2
(45) Date of Patent: Jan. 31, 2012

(54) IMAGE FORMING DEVICE HAVING DEVELOPER VIBRATION ELEMENT

(75) Inventors: Tomoaki Hattori, Nagoya (JP); Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 84 days.

(21) Appl. No.: 12/391,354

(22) Filed: Feb. 24, 2009

(65) Prior Publication Data

US 2009/0162106 A1 Jun. 25, 2009

Related U.S. Application Data

(63) Continuation of application No. PCT/JP2007/066965, filed on Aug. 24, 2007.

(30) Foreign Application Priority Data

Aug. 28, 2006 (JP) ..... 2006-230474
Aug. 28, 2006 (JP) ..... 2006-230481
Sep. 14, 2006 (JP) ..... 2006-249018
Sep. 14, 2006 (JP) ..... 2006-249060

(51) Int. Cl.
*G03G 15/08* (2006.01)

(52) U.S. Cl. ..... 399/265; 399/289

(58) Field of Classification Search ..... 399/265, 399/289–293
See application file for complete search history.

(56) References Cited

U.S. PATENT DOCUMENTS 3,633,544 A * 1/1972 Weiler ..... 118/629
4,558,941 A 12/1985 Nosaki et al.
4,598,991 A 7/1986 Hosoya et al.
5,027,157 A * 6/1991 Hotomi et al.
5,734,955 A 3/1998 Gruber et al.
5,899,608 A * 5/1999 Eklund et al. ..... 399/266
6,175,707 B1 * 1/2001 Eklund et al. ..... 399/265
6,934,496 B2 8/2005 Sakuma et al.
6,941,098 B2 9/2005 Miyaguchi et al.
7,187,892 B2 3/2007 Horike et al.

FOREIGN PATENT DOCUMENTS

JP 53-110835 9/1978
JP 59-181371 10/1984
JP 59-181375 10/1984
JP 60-000473 A 1/1985
JP 60-115962 A 6/1985

(Continued)

OTHER PUBLICATIONS

International Search Report for Application No. PCT/JP2007/066965 mailed Apr. 2005.

(Continued)

*Primary Examiner* — David M Gray
*Assistant Examiner* — Laura Roth
(74) *Attorney, Agent, or Firm* — Banner & Witcoff, Ltd.

(57) ABSTRACT

An image forming apparatus includes a developer containing casing, a developer transport body, transport electrodes, and a developer vibrating section. The developer containing casing is a box-like member in which a developer is contained. The developer transport body has a developer transport surface, and is disposed within the developer containing casing. The plurality of transport electrodes are provided along the developer transport surface. These transport electrodes are configured such that they can transport the developer in a predetermined developer transport direction on the developer transport surface upon application of traveling-wave voltages. The developer vibrating section is configured to be able to vibrate the developer which is to be transported on the developer transport surface.

10 Claims, 39 Drawing Sheets

FOREIGN PATENT DOCUMENTS

| | | | | |
|---|---|---|---|---|
| JP | 63-013068 | | | 1/1988 |
| JP | 63-013074 | | | 1/1988 |
| JP | 63-013075 | | | 1/1988 |
| JP | 63-013078 | | | 1/1988 |
| JP | 4-191762 | A | | 7/1992 |
| JP | 04-204570 | | | 7/1992 |
| JP | 05-031146 | | | 5/1993 |
| JP | 05-197312 | | | 8/1993 |
| JP | 09-197807 | | | 7/1997 |
| JP | 10-319699 | | | 12/1998 |
| JP | 10319699 | A | * | 12/1998 |
| JP | 2-226276 | A | | 9/1999 |
| JP | 2002-351218 | | | 12/2002 |
| JP | 2003-015417 | | | 1/2003 |
| JP | 2003-050499 | A | | 2/2003 |
| JP | 2003-265982 | A | | 9/2003 |
| JP | 2004-157259 | | | 6/2004 |
| JP | 2004-240069 | A | | 8/2004 |
| JP | 2005-062809 | | | 10/2005 |
| JP | 2005-275127 | | | 10/2005 |
| JP | 2006-091560 | A | | 4/2006 |

OTHER PUBLICATIONS

JP Office Action dtd Feb. 9, 2010, JP Appln. 2006-249018, partial English translation.

JP Office Action dtd Feb. 9, 2010, JP Appln. 2006-249060, partial English translation.

JP Office Action dtd Sep. 29, 2009, JP Appln. 2006-230481, partial English translation.

JP Office Action dtd Sep. 29, 2009, JP Appln. 2006-249018, partial English translation.

JP Office Action dtd Sep. 29, 2009, JP Appln. 2006-249060, partial English translation.

* cited by examiner

IMAGE FORMING DEVICE HAVING DEVELOPER VIBRATION ELEMENT

This application is a continuation application of prior application no. PCT/JP2007/066965, filed Aug. 24, 2007, which claims priority to Japanese patent application nos. 2006-230474, filed Aug. 28, 2006; 2006-230481, filed Aug. 28, 2006; 2006-249018, filed Sep. 14, 2006; and 2006-249060, filed Sep. 14, 2006; the entire subject matter and contents of which are incorporated herein by reference.

TECHNICAL FIELD

The present invention relates to an image forming apparatus.

BACKGROUND ART

[1] Many mechanisms for transporting toner (developer) by means of traveling-wave electric fields are conventionally known for use in image forming apparatus.

A mechanism (hereinafter, referred to as a "developer electric-field transport apparatus") capable of transporting charged developer by means of traveling-wave electric fields as mentioned above includes a casing (container) and a developer transport member.

The toner is stored in the casing. Further, the developer transport member is accommodated within the casing. A large number of strip-shaped electrodes are provided in a row on the developer transport member.

By virtue of the developer electric-field transport apparatus having such a configuration, the developer is supplied from the casing to the developer transport member in a small amount at a time. Meanwhile, polyphase AC voltages are sequentially applied to the plurality of strip-shaped electrodes, whereby traveling-wave electric fields are generated on the developer transport member. By the action of the traveling-wave electric fields, the toner supplied to the developer transport member is transported in a predetermined direction.

[2] Many so-called "electric-field curtain" mechanisms for transporting developer by use of an electric field are conventionally known for use in image forming apparatus.

Such an electric-field curtain mechanism includes a container for storing the developer. A large number of electrodes are disposed within the container. These electrodes are provided on a plate-like member accommodated within the container. These electrodes are connected to a polyphase (e.g., three-phase) AC power supply.

The electric-field curtain mechanism is configured such that it can transport the developer in a charged state when polyphase AC voltages are applied to the electrodes.

In the electric-field curtain mechanism having such a configuration, polyphase AC voltages are output from the AC power supply, and applied to the plurality of electrodes. Thus, electrical fields which can move the developer in a predetermined direction are generated.

By means of the electric fields, the developer within the container is transported on the plate-like member in the predetermined direction. As a result of the developer being supplied to an object to which the developer to be supplied, an image is formed at a predetermined developing section. After that, the developer falls down from the plate-like member.

DISCLOSURE OF THE INVENTION

[1] In the above-mentioned conventional developer electric-field transport apparatus, the developer transport member may fail to uniformly transport the developer. This becomes remarkable when the developer aggregates within the casing of the developer electric-field transport apparatus.

When the developer aggregates within the casing as described above, non-uniformity arises in the amount of the developer supplied to the developer transport member. As a result, non-uniformity arises in the amount of the developer transported on the developer transport member, whereby a formed image becomes non-uniform in terms of density.

The present invention has been conceived for solving the above problems. An object of the invention is to provide a developer supply apparatus in which transport and supply of developer by means of traveling-wave electric fields can be performed more uniformly, and an image forming apparatus which includes the developer supply apparatus, whereby generation of density non-uniformity is suppressed effectively, and satisfactory images can be formed.

[1-1]

(1) An image forming apparatus of the present invention comprises an electrostatic-latent-image carrying body and a developer supply apparatus.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer supply apparatus is disposed in such a manner as to face the electrostatic-latent-image carrying body. The developer supply apparatus is configured to be able to supply the latent-image forming surface with a developer in a charged state.

Specifically, the developer supply apparatus comprises a developer containing casing, a developer transport body, a plurality of transport electrodes, and a developer vibrating section.

The developer containing casing is a box-like member. The developer containing casing is configured to be able to contain the developer therein. The developer containing casing has an opening portion formed at a position where the casing faces the electrostatic-latent-image carrying body.

The developer transport body has a developer transport surface parallel with the main scanning direction. This developer transport body is disposed within the developer containing casing such that the developer transport surface faces the electrostatic-latent-image carrying body via the opening portion.

The plurality of transport electrodes are provided along the developer transport surface such that they face the latent-image forming surface. These transport electrodes are arrayed along the sub-scanning direction. The transport electrodes are configured in such a manner as to be able to transport the developer in a predetermined developer transport direction on the developer transport surface upon application of traveling-wave voltages.

That is, the developer transport body is configured to be able to transport the developer on the developer transport surface in the predetermined developer transport direction (toward the latent-image forming surface or a position (developing position) where the latent-image forming surface and the developer transfer face each other) when predetermined voltages are applied to the plurality of transport electrodes.

The developer vibrating section is configured to be able to vibrate the developer stored in the developer containing casing. Specifically, the developer vibrating section is configured to be able to vibrate the developer which is to be transported on the developer transport surface. This developer vibrating section may be disposed such that it can vibrate the developer which is to be transported on the developer transport surface, for example, at a position near the furthest upstream portion of the developer transport surface with respect to the developer transport direction.

The above-described "position near the furthest upstream portion of the developer transport surface with respect to the developer transport direction" may be any position so long as the developer which faces the furthest upstream portion of the developer transport surface is satisfactorily fluidized by the developer vibrating section disposed at the position.

That is, the developer vibrating section is provided at such a position that the developer satisfactorily fluidized by means of vibration applied by the developer vibrating section can come into contact with the furthest upstream portion of the developer transport surface.

Specifically, the developer vibrating section may be provided at, for example, a position corresponding to the furthest upstream portion of the developer transport surface with respect to the developer transport direction. That is, the developer vibrating section may be provided at a position at which the developer vibrating section overlaps the furthest upstream portion of the developer transport surface with respect to the horizontal direction or the vertical direction. Alternatively, the developer vibrating section may be provided at a position at which the developer vibrating section faces the furthest upstream portion of the developer transport surface.

The image forming apparatus of the present invention having the above configuration operates as described below in formation of an image.

An electrostatic latent image in the form of an electric-potential distribution is formed on the latent-image forming surface of the electrostatic-latent-image carrying body. The latent-image forming surface on which the electrostatic latent image is formed moves along the sub-scanning direction.

Meanwhile, the developer which is stored in the developer containing casing and is to be transported on the developer transport surface is vibrated by the developer vibrating section. As a result, the developer is fluidized. That is, a satisfactory fluidity is imparted to the developer.

Further, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in a direction along the sub-scanning direction.

A portion of the developer within the developer containing casing having been satisfactorily fluidized as described above, the portion being located near the developer transfer surface, is transported on the developer transport surface in the predetermined developer transport direction by means of the traveling-wave electric field. That portion of the developer is supplied to a position (the above-described developing position) where the latent-image forming surface and the developer transport surface (which are parallel with each other) face each other.

In this manner, the developer supply apparatus supplies the developer in a charged state to the latent-image forming surface on which the electrostatic latent image is formed. Thus, the electrostatic latent image is developed (rendered visible) with the developer.

According to the image forming apparatus of the present invention having such a configuration, the developer which is to be transported on the developer transport surface is effectively fluidized. Thus, on the developer transport surface, the developer can be transported as uniformly as possible. At that time, application of large stresses, such as compressive force and shearing force, on the developer can be suppressed to the greatest possible extent.

Thus, according to the present invention, the transport and supply of the developer by means of the traveling-wave electric field can be performed more uniformly. Therefore, according to the present invention, there can be provided an image forming apparatus which can effectively suppress generation of density non-uniformity and which can form a satisfactory image.

The developer vibrating section may be provided in a bottom plate of the developer containing casing.

By virtue of this configuration, the developer within the developer containing casing can be satisfactorily fluidized through employment of a very simple apparatus structure.

The developer vibrating section may be provided within the developer containing casing such that the developer vibrating section is separated from an inner wall surface of a bottom portion of the developer containing casing and the developer transport body.

By virtue of this configuration, the developer vibrating section, which vibrates, is separated from the developer containing casing and the developer transport body. Therefore, vibration generated by the developer vibrating section is not transmitted directly to the developer containing casing and the developer transport body.

Accordingly, by virtue of such a configuration, there is prevented, to the greatest possible extent, a change in a predetermined positional relation between the latent-image forming surface of the electrostatic-image carrying body and the developer transport surface of the developer transport body, which change would otherwise result from vibration of the developer vibrating section.

Thus, it is possible to satisfactorily fluidize the developer to thereby render uniform the state of transport of the developer on the developer transport surface, while suppressing adverse influence on development of the electrostatic latent image to the greatest possible extent.

The developer vibrating section may be provided at least at a position corresponding to a lowest portion of the developer containing casing.

By virtue of the image forming apparatus having such a configuration, even when the storage amount of the developer within the developer containing casing decreases, the developer at the bottom portion of the developer containing casing can be satisfactorily fluidized. Thus, even in such a case, transport of the developer to the position which faces the latent-image forming surface can be performed properly.

Therefore, such a configuration enables satisfactory image formation by the developer even in the above-described case.

(2) A developer supply apparatus of the present invention is configured to be able to supply a developer in a charged state to a developer carrying surface of a developer carrying body along a predetermined developer transport direction. The developer carrying surface is a surface which is parallel to a predetermined main scanning direction and which can carry the developer thereon.

The developer carrying body has the developer carrying surface and is configured such that the developer carrying surface can move along a sub-scanning direction orthogonal to the main scanning direction.

The developer carrying body may be an electrostatic-latent-image carrying body having a latent-image forming surface configured to be able to form an electrostatic latent image thereon by means of electric-potential distribution.

Alternatively, the developer carrying body may be a recording medium (paper) which is transported along the sub-scanning direction.

Alternatively, the developer carrying body may be a roller, a sleeve, or a belt member (a developing roller, a developing sleeve, an intermediate transfer belt, etc.) which is configured and disposed so as to be able to transfer the developer onto the recording medium or the electrostatic-latent-image carrying body by means of facing the recording medium or the electrostatic-latent-image carrying body.

The developer supply apparatus of the present invention comprises a developer containing casing, a developer transport body, and a plurality of transport electrodes.

The developer containing casing is a box-like member. The developer containing casing is configured to be able to contain the developer therein. The developer containing casing has an opening portion formed at a position where the casing faces the developer carrying body.

The developer transport body has a developer transport surface parallel with the main scanning direction. This developer transport body is disposed within the developer containing casing such that the developer transport surface faces the developer carrying body via the opening portion.

The plurality of transport electrodes are provided along the developer transport surface such that they face the developer carrying surface. These transport electrodes are arrayed along the sub-scanning direction. The transport electrodes are configured in such a manner as to be able to transport the developer in the developer transport direction on the developer transport surface upon application of traveling-wave voltages.

That is, the developer transport body is configured to be able to transport the developer on the developer transport surface in the predetermined developer transport direction (toward the opening portion, the developer carrying surface, or a position (developing position) where the developer carrying surface and the developer transfer face each other) when predetermined voltages are applied to the plurality of transport electrodes.

The developer vibrating section is configured to be able to vibrate the developer which is stored in the developer containing casing and which is to be transported on the developer transport surface. This developer vibrating section may be disposed such that it can vibrate the developer which is to be transported on the developer transport surface, at a position near the furthest upstream portion of the developer transport surface with respect to the developer transport direction.

In the developer supply apparatus of the present invention having such a configuration, the developer within the developer containing casing is vibrated by the developer vibrating section. As a result, the developer can be fluidized.

Further, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in a direction along the sub-scanning direction.

A portion of the developer within the developer containing casing having been fluidized as described above, the portion being located near the developer transfer surface, is transported on the developer transport surface in the predetermined developer transport direction by means of the traveling-wave electric field. That portion of the developer is supplied to a position (the above-described developing position) where the developer carrying surface and the developer transport surface (which are parallel with each other) face each other.

In this manner, the developer supply apparatus supplies the developer in a charged state to the developer carrying surface, which moves along the sub-scanning direction. Thus, the developer is carried on the developer carrying surface.

According to the developer supply apparatus of the present invention such a configuration, the developer which is to be transported on the developer transport surface is effectively fluidized. At that time, application of large stresses, such as compressive force and shearing force, on the developer can be suppressed to the greatest possible extent.

Thus, according to the developer supply apparatus of the present invention, the transport and supply of the developer by means of the traveling-wave electric field can be performed more uniformly.

The developer vibrating section may be provided in a bottom plate of the developer containing casing.

By virtue of this configuration, the developer within the developer containing casing can be satisfactorily fluidized through employment of a very simple apparatus structure.

The developer vibrating section may be provided within the developer containing casing such that the developer vibrating section is separated from an inner wall surface of a bottom portion of the developer containing casing and the developer transport body.

By virtue of such a configuration, there is prevented, to the greatest possible extent, a change in a predetermined positional relation between the developer carrying surface of the developer carrying body and the developer transport surface of the developer transport body, which change would otherwise result from vibration of the developer vibrating section.

Thus, adverse influence of a change in the positional relation on transfer of the developer onto the developer carrying surface (development or image formation by the developer) can be suppressed to the greatest possible extent.

The developer vibrating section may be provided at least at a position corresponding to a lowest portion of the developer containing casing.

By virtue of the developer supply apparatus having such a configuration, even when the storage amount of the developer within the developer containing casing decreases, the developer at the bottom portion of the developer containing casing can be satisfactorily fluidized. Thus, even in such a case, transport of the developer to the position which faces the latent-image forming surface can be performed properly.

(3) An image forming apparatus of the present invention comprises an electrostatic-latent-image carrying body and a developer supply apparatus. The electrostatic-latent-image carrying body is configured and disposed in the same manner as described in section (1) above.

The developer supply apparatus is configured to be able to supply the latent-image forming surface with a developer in a charged state. This developer supply apparatus comprises a developer containing casing, a developer transport body, a plurality of transport electrodes, and a developer vibrating section, and is disposed in such a manner as to face the electrostatic-latent-image carrying body.

The developer containing casing is a box-like member, and is configured to be able to contain the developer therein. The developer containing casing has an opening portion formed at a position where the casing faces the electrostatic-latent-image carrying body.

The developer transport body has a developer transport surface parallel with the main scanning direction.

The developer transport body may be disposed within the developer containing casing such that the developer transport surface faces the electrostatic-latent-image carrying body via the opening portion. Alternatively, the developer transport body may be disposed on the inner wall surface of the developer containing casing at a position at which the developer transport body is located adjacent to the opening portion and/or faces the opening portion.

The plurality of transport electrodes are provided along the developer transport surface. These transport electrodes are arrayed along the sub-scanning direction. The transport electrodes are configured in such a manner as to be able to transport the developer in a predetermined developer transport direction on the developer transport surface upon application of traveling-wave voltages.

That is, the developer transport body is configured to be able to transport the developer on the developer transport surface in the developer transport direction (toward the opening portion, the latent-image forming surface, or a position (developing position) where the latent-image forming surface and the developer transfer face each other) when predetermined voltages are applied to the plurality of transport electrodes.

The developer vibrating section is configured to be able to vibrate the developer stored in the developer containing casing. Specifically, the developer vibrating section is configured to be able to vibrate the developer which is to be transported on the developer transport surface.

The developer vibrating section may be disposed at a position near the furthest upstream portion of the developer transport surface with respect to the developer transport direction. The above-described "position near the furthest upstream portion of the developer transport surface with respect to the developer transport direction" may be any position so long as the developer which faces the furthest upstream portion of the developer transport surface can be satisfactorily fluidized by the developer vibrating section disposed at the position.

Specifically, the developer vibrating section may be provided at, for example, at a position corresponding to the furthest upstream portion of the developer transport surface with respect to the developer transport direction. That is, the developer vibrating section may be provided at a position at which the developer vibrating section overlaps the furthest upstream portion of the developer transport surface with respect to the horizontal direction or the vertical direction. Alternatively, the developer vibrating section may be provided at a position at which the developer vibrating section faces the furthest upstream portion of the developer transport surface.

In the image forming apparatus of the present invention having such a configuration, the developer which is stored in the developer containing casing and is to be transported on the developer transport surface is vibrated by the developer vibrating section. As a result, the developer is fluidized.

Further, predetermined traveling-wave voltages are applied to the plurality of transport electrodes. As a result, a traveling-wave electric field which travels in the developer transport direction along the sub-scanning direction is formed in the vicinity of the developer transport surface of the developer transport body.

By means of the traveling-wave electric field, a portion of the developer within the developer containing casing having been satisfactorily fluidized as described above, the portion being located near the developer transfer surface, is transported on the developer transport surface in the developer transport direction (toward the opening portion, the latent-image forming surface, or the position (the developing position) where the latent-image forming surface and the developer transport surface face each other).

According to the image forming apparatus of the present invention, the developer which is to be transported on the developer transport surface is effectively fluidized. Thus, on the developer transport surface, the developer can be transported as uniformly as possible. At that time, application of large stresses, such as compressive force and shearing force, on the developer can be suppressed to the greatest possible extent.

Thus, according to the present invention, the transport and supply of the developer by means of the traveling-wave electric field can be performed more uniformly. Therefore, according to the present invention, there can be provided an image forming apparatus which can effectively suppress generation of density non-uniformity and which can form a satisfactory image can be provided.

The developer vibrating section may be provided in a bottom plate of the developer containing casing.

By virtue of this configuration, the developer within the developer containing casing can be satisfactorily fluidized through employment of a very simple apparatus structure.

The developer vibrating section may be provided within the developer containing casing such that the developer vibrating section is separated from an inner wall surface of a bottom portion of the developer containing casing and the developer transport body.

By virtue of this configuration, the developer vibrating section, which vibrates, is separated from the developer containing casing and the developer transport body. Therefore, vibration generated by the developer vibrating section is not transmitted directly to the developer containing casing and the developer transport body.

The developer vibrating section may be provided at least at a position corresponding to a lowest portion of the developer containing casing.

By virtue of the image forming apparatus having such a configuration, even when the storage amount of the developer within the developer containing casing decreases, the developer at the bottom portion of the developer containing casing can be vibrated satisfactorily. Thus, even in such a case, transport of the developer to the position which faces the latent-image forming surface can be performed properly.

Therefore, such a configuration enables satisfactory image formation by the developer even in the above-described case.

(4) A developer supply apparatus of the present invention is configured to be able to supply a developer in a charged state to a developer carrying surface of a developer carrying body along a predetermined developer transport direction.

The developer carrying body is configured and disposed in the same manner as described in section (2) above. Further, the developer carrying surface is a surface which is parallel to a predetermined main scanning direction and which can carry the developer thereon.

The developer supply apparatus of the present invention comprises a developer containing casing, a developer transport body, and a plurality of transport electrodes.

The developer containing casing is a box-like member, and is configured to be able to contain the developer therein. The developer containing casing has an opening portion formed at a position where the casing faces the developer carrying body.

The developer transport body has a developer transport surface parallel with the main scanning direction.

The developer transport body may be disposed within the developer containing casing such that the developer transport surface faces the developer carrying body via the opening portion. Alternatively, the developer transport body may be disposed on the inner wall surface of the developer containing casing at a position at which the developer transport body is located adjacent to the opening portion and/or faces the opening portion.

The plurality of transport electrodes are provided along the developer transport surface. These transport electrodes are arrayed along the sub-scanning direction. The transport electrodes are configured in such a manner as to be able to transport the developer in the developer transport direction on the developer transport surface upon application of traveling-wave voltages.

That is, the developer transport body is configured to be able to transport the developer on the developer transport surface in the predetermined developer transport direction (toward the opening portion or the developer carrying surface) when predetermined voltages are applied to the plurality of transport electrodes.

The developer vibrating section is configured to be able to vibrate the developer which is stored in the developer containing casing and is to be transported on the developer transport surface.

The developer vibrating section may be disposed at a position near the furthest upstream portion of the developer transport surface with respect to the developer transport direction.

In the developer supply apparatus of the present invention having such a configuration, the developer within the developer containing casing is vibrated by the developer vibrating section. As a result, the developer is fluidized.

Further, predetermined traveling-wave voltages are applied to the plurality of transport electrodes arrayed in the sub-scanning direction. As a result, a traveling-wave electric field which travels along the sub-scanning direction is formed in the vicinity of the developer transport surface of the developer transport body.

By means of the traveling-wave electric field, a portion of the developer within the developer containing casing having been fluidized as described above, the portion being located near the developer transfer surface, is transported on the developer transport surface in the predetermined developer transport direction (toward the opening portion or the developer carrying surface).

According to the developer supply apparatus of the present invention having such a configuration, the developer which is to be transported on the developer transport surface is effectively fluidized. At that time, application of large stresses, such as compressive force and shearing force, on the developer can be suppressed to the greatest possible extent.

Thus, according to the developer supply apparatus of the present invention, the transport and supply of the developer by means of the traveling-wave electric field can be performed more uniformly.

The developer vibrating section may be provided in a bottom plate of the developer containing casing.

By virtue of this configuration, the developer within the developer containing casing can be satisfactorily fluidized through employment of a very simple apparatus structure.

The developer vibrating section may be provided within the developer containing casing such that the developer vibrating section is separated from an inner wall surface of a bottom portion of the developer containing casing and the developer transport body.

By virtue of this configuration, transmission of vibration generated by the developer vibrating section directly to the developer containing casing and the developer transport body can be suppressed effectively.

The developer vibrating section may be provided at least at a position corresponding to a lowest portion of the developer containing casing.

By virtue of the developer supply apparatus having such a configuration, even when the storage amount of the developer within the developer containing casing decreases, the developer at the bottom portion of the developer containing casing can be vibrated satisfactorily.

[1-2]

(1) An image forming apparatus of the present invention comprises an electrostatic-latent-image carrying body and a developer supply apparatus.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer supply apparatus is disposed in such a manner as to face the electrostatic-latent-image carrying body. The developer supply apparatus is configured to be able to supply the latent-image forming surface with a developer in a charged state. Specifically, the developer supply apparatus comprises a developer containing casing, a developer transport body, a plurality of transport electrodes, and a gas supply section.

The developer containing casing is a box-like member which includes a developing-section counter plate and a gas-permeable bottom plate. The developing-section counter plate has an opening portion formed at a position where the counter plate faces the electrostatic-latent-image carrying body. The gas-permeable bottom plate is configured to prevent passage of the developer therethrough and permit passage of a gas therethrough. The developer containing casing is configured to be able to contain the developer therein.

The developer transport body has a developer transport surface parallel with the main scanning direction. This developer transport body is disposed within the developer containing casing such that the developer transport surface faces the electrostatic-latent-image carrying body via the opening portion of the developing-section counter plate.

The plurality of transport electrodes are provided along the developer transport surface such that they face the latent-image forming surface. These transport electrodes are arrayed along the sub-scanning direction. The transport electrodes are configured in such a manner as to be able to transport the developer in a predetermined developer transport direction on the developer transport surface upon application of traveling-wave voltages.

The gas supply section is configured to blow a gas into the interior of the developer containing casing via the gas-permeable bottom plate, to thereby fluidize the developer within the developer containing casing.

The image forming apparatus of the present invention having such a configuration operates as described below in formation of an image.

An electrostatic latent image in the form of an electric-potential distribution is formed on the latent-image forming surface of the electrostatic-latent-image carrying body. The latent-image forming surface on which the electrostatic latent image is formed moves along the sub-scanning direction.

Meanwhile, the gas supply section blows the gas into the interior of the developer containing casing via the gas-permeable bottom plate. As a result, the developer within the developer containing casing is fluidized.

Further, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in a direction along the sub-scanning direction.

A portion of the developer within the developer containing casing having been fluidized as described, the portion being located near the developer transfer surface, is transported on the developer transport surface in the predetermined developer transport direction by means of the traveling-wave electric field. That portion of the developer is supplied to a position (the developing position) where the latent-image forming surface and the developer transport surface (which are parallel with each other) face each other.

In this manner, the developer supply apparatus supplies the developer in a charged state to the latent-image forming surface on which the electrostatic latent image is formed. Thus, the electrostatic latent image is developed (rendered visible) with the developer.

According to the image forming apparatus of the present invention having such a configuration, a mechanical or thermal stress caused by a compressive force or shearing force at the time when the developer is fluidized is very small. Therefore, according to the present invention, the transport and supply of the developer by means of the traveling-wave electric field can be performed more uniformly.

Therefore, according to the present invention, there can be provided an image forming apparatus which can form a satisfactory image, while effectively suppressing the generation of density non-uniformity.

The gas-permeable bottom plate may be provided at least at a position near the furthest upstream portion of the developer transport surface with respect to the developer transport direction.

The above-described "position near the furthest upstream portion of the developer transport surface with respect to the developer transport direction" may be any position so long as the developer which faces the furthest upstream portion of the developer transport surface can be satisfactorily fluidized upon placement of the gas-permeable bottom plate at the position.

That is, the gas-permeable bottom plate may be provided at such a position that the developer satisfactorily fluidized by means of inflow of the gas from the gas-permeable bottom plate can come into contact with the furthest upstream portion of the developer transport surface.

Specifically, the gas-permeable bottom plate may be provided at, for example, at a position corresponding to the furthest upstream portion of the developer transport surface with respect to the developer transport direction.

That is, the gas-permeable bottom plate may be provided at a position at which the gas-permeable bottom plate overlaps the furthest upstream portion of the developer transport surface with respect to the horizontal direction or the vertical direction. Alternatively, the gas-permeable bottom plate may be provided at a position at which the gas-permeable bottom plate faces the furthest upstream portion of the developer transport surface.

In such a configuration, the gas is blown into the developer containing casing from the gas supply section via the gas-permeable bottom plate. Thus, the developer within the developer containing casing located near the furthest upstream portion of the developer transport surface with respect to the developer transport direction is fluidized.

By virtue of such a configuration, the developer can be supplied to the furthest upstream portion of the developer transport surface as uniformly as possible.

Thus, the transport of the developer on the developer transport surface by means of the traveling-wave electric field and the supply of the developer to the latent-image forming surface on which the latent image is formed can be performed uniformly with further reduced non-uniformity.

The image forming apparatus may be configured as follows: the present image forming apparatus further comprises an exhaust section. This exhaust section is configured to exhaust the gas from the developer containing casing. An exhaust port which communicates with the exhaust section is provided in the developer containing casing at a position different from that of the opening portion.

In such a configuration, when the developer within the developer containing casing is to be fluidized, the gas from the gas supply section is blown into the developer containing casing via the gas-permeable bottom plate. Meanwhile, the gas within the developer containing casing is exhausted by the exhaust section via the exhaust port provided at a position different from that of the opening portion.

In the image forming apparatus of the present invention having such a configuration, a negative pressure is generated within the developer containing casing at a position different from that of the opening portion.

Thus, when the gas from the gas supply section is blown into the developer containing casing via the gas-permeable bottom plate, spouting of the developer from the opening portion together with the gas can be suppressed effectively. That is, accidental leakage of the developer from the developer containing casing can be suppressed to the greatest possible extent.

The exhaust port may be diagonally positioned in relation to the gas-permeable bottom plate. The "diagonally posited" expresses the positional relation between one end side and the other end side of the developer containing casing with respect to the vertical direction and the front-rear direction.

For example, needless to say, one end of a diagonal line of the developer containing casing in a side sectional view and its vicinity and the other end opposite the one end and its vicinity are "diagonally positioned" in relation to each other.

In such a configuration, the gas from the gas supply section is blown into the developer containing casing via the gas-permeable bottom plate provided at a position corresponding to the furthest upstream portion of the developer transport surface with respect to the developer transport direction. Thus, the developer within the developer containing casing is fluidized.

Meanwhile, the gas within the developer containing casing is exhausted by the exhaust section via the exhaust port which is provided at a position different from that of the opening portion and which is diagonally positioned in relation to the gas-permeable bottom plate.

That is, in such a configuration, the gas is blown into the developer containing casing from a first position corresponding to the furthest upstream portion of the developer transport surface with respect to the developer transport direction, and the gas within the developer containing casing is exhausted from a second position which differs from that of the opening portion and is diagonally located in relation to the first position.

In the image forming apparatus of the present invention having such a configuration, a negative pressure is generated within the developer containing casing at a position different from that of the opening portion.

Thus, when the gas from the gas supply section is blown into the developer containing casing via the gas-permeable bottom plate, spouting of the developer from the opening portion together with the gas can be suppressed effectively. That is, accidental leakage of the developer from the developer containing casing can be suppressed to the greatest possible extent.

The image forming apparatus may be configured as follows: the present image forming apparatus further comprises a gas circulation passage. This gas circulation passage is configured to connect the exhaust port and the gas-permeable bottom plate outside the developer containing casing. The gas supply section and the exhaust section are formed by a pump interposed in the gas circulation passage.

In such a configuration, when the developer within the developer containing casing is to be fluidized, the pump is driven. As a result, the gas within the developer containing casing is exhausted from the exhaust port provided at a position corresponding to an upstream end portion of the gas circulation passage with respect to the gas flow direction.

Meanwhile, the gas is blown into the developer containing casing from the gas-permeable bottom plate provided at a position corresponding to a downstream end portion of the gas circulation passage with respect to the gas flow direction.

By virtue of such a configuration, through employment of a very simple apparatus structure, the developer within the developer containing casing can be fluidized, and the accidental leakage of the developer from the developer containing casing can be suppressed effectively.

The gas-permeable bottom plate may be provided at least at a position corresponding to a lowest portion of the developer containing casing.

By virtue of the image forming apparatus having such a configuration, even when the storage amount of the developer within the developer containing casing decreases, the developer at the bottom portion of the developer containing casing can be vibrated satisfactorily.

Thus, even in such a case, transport of the developer to the position which faces the latent-image forming surface can be performed properly. Therefore, such a configuration enables satisfactory image formation by the developer even in the above-described case.

(2) A developer supply apparatus of the present invention is configured to be able to supply a developer in a charged state to a developer carrying surface of a developer carrying body along a predetermined developer transport direction. The developer carrying surface is a surface which is parallel to a predetermined main scanning direction and which can carry the developer thereon.

The developer carrying body has the developer carrying surface and is configured such that the developer carrying surface can move along a sub-scanning direction orthogonal to the main scanning direction.

The developer carrying body may be an electrostatic-latent-image carrying body having a latent-image forming surface configured to be able to form an electrostatic latent image thereon by means of electric-potential distribution.

Alternatively, the developer carrying body may be a recording medium (paper) which is transported along the sub-scanning direction.

Alternatively, the developer carrying body may be a roller, a sleeve, or a belt member (a developing roller, a developing sleeve, an intermediate transfer belt, etc.) which is configured and disposed so as to be able to transfer the developer onto the recording medium or the electrostatic-latent-image carrying body by means of facing the recording medium or the electrostatic-latent-image carrying body.

The developer supply apparatus of the present invention comprises a developer containing casing, a developer transport body, and a plurality of transport electrodes.

The developer containing casing is a box-like member which includes a developing-section counter plate and a gas-permeable bottom plate.

The developing-section counter plate has an opening portion formed at a position where the counter plate faces the developer carrying body. The gas-permeable bottom plate is configured to prevent passage of the developer therethrough and permit passage of a gas therethrough. The developer containing casing is configured to be able to contain the developer therein.

The developer transport body has a developer transport surface parallel with the main scanning direction. This developer transport body is disposed within the developer containing casing such that the developer transport surface faces the developer carrying body via the opening portion of the developing-section counter plate.

The plurality of transport electrodes are provided along the developer transport surface such that they face the developer carrying surface. These transport electrodes are arrayed along the sub-scanning direction. The transport electrodes are configured in such a manner as to be able to transport the developer in the developer transport direction on the developer transport surface upon application of traveling-wave voltages.

In the developer supply apparatus of the present invention having such a configuration, the gas can be blown into the developer containing casing via the gas-permeable bottom plate. Therefore, the developer within the developer containing casing can be fluidized.

Further, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in a direction along the sub-scanning direction.

A portion of the developer within the developer containing casing having been fluidized as described above, the portion being located near the developer transfer surface, is transported on the developer transport surface in the predetermined developer transport direction by means of the traveling-wave electric field. That portion of the developer is supplied to the position (the developing position) where the developer carrying surface and the developer transport surface (which are parallel with each other) face each other.

In this manner, the developer supply apparatus supplies the developer in a charged state to the developer carrying surface, which moves along the sub-scanning direction. Thus, the developer is carried on the developer carrying surface.

According to the developer supply apparatus of the present invention having such a configuration, a mechanical or thermal stress caused by a compressive force or shearing force at the time when the developer is fluidized is very small. Therefore, according to the present invention, it becomes possible to provide a developer supply apparatus which can perform the transport and supply of the developer by means of the traveling-wave electric field more uniformly.

Preferably, the gas-permeable bottom plate is provided at least at a position corresponding to the furthest upstream portion of the developer transport surface with respect to the developer transport direction.

By virtue of such a configuration, the developer is supplied to the furthest upstream portion of the developer transport surface as uniformly as possible. Thus, the transport of the developer on the developer transport surface and the supply of the developer to the developer carrying surface can be performed uniformly with further reduced non-uniformity.

The developer supply apparatus may further comprise a gas supply section. This gas supply section is configured to blow a gas into the interior of the developer containing casing via the gas-permeable bottom plate, to thereby fluidize the developer within the developer containing casing.

In such a configuration, the gas supply section blows the gas into the interior of the developer containing casing via the gas-permeable bottom plate. As a result, the developer within the developer containing casing is fluidized.

The developer supply apparatus may be configured as follows: the present developer supply apparatus further comprises an exhaust section. This exhaust section is configured to exhaust the gas from the developer containing casing. Further, an exhaust port is provided in the developer containing casing at a position different from that of the opening portion. The exhaust section is provided such that it communicates with the exhaust port.

In such a configuration, the gas within the developer containing casing is exhausted to the outside via the exhaust port. That is, a negative pressure can be generated within the developer containing casing at a position different from that of the opening portion.

In the developer supply apparatus of the present invention having such a configuration, when the gas is blown into the developer containing casing via the gas-permeable bottom plate, spouting of the developer from the opening portion together with the gas can be suppressed effectively. That is, accidental leakage of the developer from the developer containing casing can be suppressed to the greatest possible extent.

The exhaust port may be diagonally positioned in relation to the gas-permeable bottom plate.

In such a configuration, the gas is blown into the developer containing casing via the gas-permeable bottom plate from a first position corresponding to the furthest upstream portion of the developer transport surface with respect to the developer transport direction. Meanwhile, the gas within the developer containing casing is exhausted via the exhaust port from a second position which is diagonally located in relation to the first position.

That is, the gas can be blown into the developer containing casing, and a negative pressure can be generated within the developer containing casing at a position separated from the opening portion.

In the developer supply apparatus of the present invention having such a configuration, when the gas is blown into the developer containing casing via the gas-permeable bottom plate, spouting of the developer from the opening portion together with the gas can be suppressed effectively. That is, accidental leakage of the developer from the developer containing casing can be suppressed to the greatest possible extent.

The developer supply apparatus may be configured as follows: the present developer supply apparatus comprises a gas circulation passage. This gas circulation passage is configured to connect the exhaust port and the gas-permeable bottom plate outside the developer containing casing. The gas supply section and the exhaust section are formed by a pump interposed in the gas circulation passage.

By virtue of the developer supply apparatus of the present invention having such a configuration, fluidization of the developer within the developer containing casing and suppression of accidental leakage of the developer can be realized through employment of a very simple apparatus structure.

The gas-permeable bottom plate may be provided at least at a position corresponding to a lowest portion of the developer containing casing.

By virtue of such a configuration, even when the storage amount of the developer within the developer containing casing decreases, the developer at the bottom portion of the developer containing casing can be vibrated satisfactorily.

[1-3]

(1) An image forming apparatus of the present invention comprises an electrostatic-latent-image carrying body and a developer supply apparatus.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer supply apparatus is disposed in such a manner as to face the electrostatic-latent-image carrying body. The developer supply apparatus is configured to be able to supply the latent-image forming surface with a developer in a charged state. Further, this developer supply apparatus is configured such that it can be attached to and detached from the main body of the image forming apparatus.

The developer supply apparatus comprises a developer containing casing, a developer transport body, a plurality of transport electrodes, and a vibration body.

The developer containing casing is a box-like member, and is configured to be able to contain the developer therein. The developer containing casing has an opening portion formed at a position where the casing faces the electrostatic-latent-image carrying body.

The developer transport body has a developer transport surface parallel with the main scanning direction. This developer transport body is disposed within the developer containing casing such that the developer transport surface faces the electrostatic-latent-image carrying body via the opening portion.

The plurality of transport electrodes are provided along the developer transport surface such that they face the latent-image forming surface. These transport electrodes are arrayed along the sub-scanning direction. The transport electrodes are configured in such a manner as to be able to transport the developer in a predetermined developer transport direction on the developer transport surface upon application of traveling-wave voltages.

The vibration body is disposed in a space inside the developer containing casing.

The main body includes a vibration-body vibrating section. This vibration-body vibrating section is configured such that it can vibrate the vibration body. Further, the vibration-body vibrating section is provided such a position that, when the developer supply apparatus is attached to the main body, the vibration-body vibrating section is located at a position outside the developer containing casing and corresponding to the vibration body.

The image forming apparatus of the present invention having such a configuration operates as described below in formation of an image.

The developer supply apparatus is attached to the main body of the image forming apparatus. As a result, the vibration body provided in the developer supply apparatus is disposed at a position corresponding to the vibration-body vibrating section provided on the main body.

Further, an electrostatic latent image in the form of an electric-potential distribution is formed on the latent-image forming surface of the electrostatic-latent-image carrying body. The latent-image forming surface on which the electrostatic latent image is formed moves along the sub-scanning direction.

Meanwhile, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in the developer transport direction along the sub-scanning direction.

At that time, the vibration body is vibrated by the vibration-body vibrating section provided on the main body. Due to vibration of the vibration body, the developer is vibrated within the developer containing casing. As a result, a satisfactory fluidity can be imparted to the developer (which is to be transported on the developer transport surface) within the developer containing casing.

A portion of the developer satisfactorily fluidized within the developer containing casing, the portion being located near the developer transfer surface, receives the action of the traveling-wave electric field. As a result, that portion of the developer is transported on the developer transport surface in the developer transport direction toward the developing position. The developing position is a position at which the latent-image forming surface and the developer transport surface (which are parallel with each other) face in the closest proximity to each other.

In this manner, the developer in a charged state is supplied to the developing position by the developer supply apparatus. Thus, the electrostatic latent image on the latent-image forming surface is developed (rendered visible) with the developer.

According to the image forming apparatus of the present invention having such a configuration, the developer (which is to be transported on the developer transport surface) within the developer containing casing of the developer supply apparatus which can be attached to and detached from the main body is effectively fluidized.

By virtue of this, on the developer transport surface, the developer can be transported as uniformly as possible. At that time, application of large stresses, such as aggregation force and shearing force, on the developer can be suppressed to the greatest possible extent.

Thus, according to the developer supply apparatus of the image forming apparatus of the present invention, the transport and supply of the developer by means of the traveling-wave electric field can be performed more uniformly. Therefore, according to the image forming apparatus of the present invention, generation of density non-uniformity is effectively suppressed, and a satisfactory image can be formed.

The vibration body may be disposed at a bottom portion of the space inside the developer containing casing.

In the image forming apparatus of the present invention having such a configuration, the vibration body is vibrated at the bottom portion of the space inside the developer containing casing. Due to the vibration of the vibration body, the developer at the bottom of the space is vibrated.

Thus, a satisfactory fluidity can be imparted to the developer stored within the developer containing casing. The developer stored within the developer containing casing refers to the developer contained within the developer containing casing, excluding the developer on the developer transport surface. That is, the developer stored within the developer containing casing refers to the developer stored at the bottom portion of the space inside the developer containing casing.

According to the image forming apparatus of the present invention having such a configuration, fluidization of the developer stored within the developer containing casing by the vibration body can be performed more reliably.

The vibration body may be configured to be able to vibrate the entirety of the developer stored in the developer containing casing.

Alternatively, the vibration body may be configured to be able to vibrate at least a predetermined developer transport start area of a developer pool.

The developer pool refers to an ensemble of the developer stored within the developer containing casing. Further, the developer transport start area refers to the uppermost end portion of the developer pool within the developer containing casing, the end portion located on the downstream side with respect to the developer transport direction. The position of the developer transport start area changes depending on the amount of the developer pool (the amount of the developer stored within the developer containing casing).

For example, a plurality of vibration bodies may be provided. The vibration-body vibrating section is configured and disposed such that the vibrating states of the plurality of vibration bodies are controlled in accordance with the amount of the developer pool.

In the above-described configurations, by means of vibration of the vibration body, a satisfactory fluidity is imparted to the developer (which is to be transported on the developer transport surface) in the developer transport start area, at which transfer of the developer starts.

Thus, according to the above-described configurations, the developer in the developer transport start area within the developer containing casing of the developer supply apparatus which can be attached to and detached from the main body is satisfactorily fluidized. Therefore, the operation of rendering uniform the transport and supply of the developer by means of the traveling-wave electric field can be performed more reliably.

(2) An image forming apparatus of the present invention comprises an electrostatic-latent-image carrying body and a developer supply apparatus. The electrostatic-latent-image carrying body is configured in the same manner as described in section (1) above.

The developer supply apparatus is disposed in such a manner as to face the electrostatic-latent-image carrying body. The developer supply apparatus is configured to be able to supply the latent-image forming surface with a developer in a charged state.

Specifically, the developer supply apparatus comprises a developer containing casing, a developer transport body, a plurality of transport electrodes, and a developer vibrating section.

The developer containing casing is a box-like member, and is configured to be able to contain the developer therein. The developer containing casing has an opening portion formed at a position where the casing faces the electrostatic-latent-image carrying body.

The developer transport body has a developer transport surface parallel with the main scanning direction. This developer transport body is disposed within the developer containing casing such that the developer transport surface faces the electrostatic-latent-image carrying body via the opening portion.

The plurality of transport electrodes are provided along the developer transport surface such that they face the latent-image forming surface. These transport electrodes are arrayed along the sub-scanning direction. The transport electrodes are configured in such a manner as to be able to transport the developer in a predetermined developer transport direction on the developer transport surface upon application of traveling-wave voltages.

The developer vibrating section is configured to be able to vibrate the developer (which is contained in the developer containing casing and which is to be transported on the developer transport surface) from the outside of the developer containing casing.

The image forming apparatus of the present invention having such a configuration operates as described below in formation of an image.

An electrostatic latent image in the form of an electric-potential distribution is formed on the latent-image forming surface of the electrostatic-latent-image carrying body. The latent-image forming surface on which the electrostatic latent image is formed moves along the sub-scanning direction.

Meanwhile, the developer which is contained (stored) in the developer containing casing and which is to be transported on the developer transport surface is vibrated by the developer vibrating section from the outside of the developer containing casing. Thus, a satisfactory fluidity is imparted to the developer.

Further, predetermined traveling-wave voltages are applied to the plurality of transport electrodes arrayed along the sub-scanning direction. As a result, a traveling-wave electric field which travels in the developer transport direction along the sub-scanning direction is formed in the vicinity of the developer transport surface of the developer transport body.

A portion of the developer within the developer containing casing having been satisfactorily fluidized as described above, the portion being located near the developer transfer surface, is transported on the developer transport surface in the predetermined developer transport direction by means of the traveling-wave electric field. That portion of the developer is supplied to a position (the developing position) where the latent-image forming surface and the developer transport surface (which are parallel with each other) face in the closest proximity to each other.

In this manner, the developer supply apparatus supplies the developer in a charged state to the latent-image forming surface on which the electrostatic latent image is formed. Thus, the electrostatic latent image is developed (rendered visible) with the developer.

According to the image forming apparatus of the present invention having such a configuration, the developer (which is to be transported on the developer transport surface) is effectively fluidized by use of a simple apparatus structure. By virtue of this, on the developer transport surface, the developer can be transported as uniformly as possible. At that time, application of large stresses, such as aggregation force and shearing force, on the developer can be suppressed to the greatest possible extent.

Thus, according to the image forming apparatus of the present invention having such a configuration, the transport and supply of the developer by means of the traveling-wave electric field can be performed more uniformly by use of a simple apparatus structure. Therefore, according to the present invention, generation of density non-uniformity is effectively suppressed, and a satisfactory image can be formed.

The developer vibrating section may be disposed to be able to vibrate the developer at a bottom portion of the space inside the developer containing casing.

In the image forming apparatus of the present invention having such a configuration, the developer at the bottom portion of the space is vibrated by the developer vibrating section. Thus, a satisfactory fluidity can be imparted to the developer stored within the developer containing casing.

According to the image forming apparatus of the present invention having such a configuration, fluidization of the developer stored within the developer containing casing by the vibration body can be performed more reliably.

The developer vibration section may include a vibration body and a vibration-body vibrating section. The vibration body is disposed in the space inside the developer containing casing. The vibration-body vibrating section is configured to be able to vibrate the vibration body. This vibration-body vibrating section is provided outside the developer containing casing at a position corresponding to the vibration body.

In the image forming apparatus of the present invention having such a configuration, at that time, the vibration body is vibrated by the vibration-body vibrating section. Thus, the developer contained (stored) in the developer containing casing is vibrated. As a result, a satisfactory fluidity can be imparted to the developer (which is to be transported on the developer transport surface) within the developer containing casing.

Therefore, accordingly the image forming apparatus of the present invention having such a configuration, fluidization of the developer contained (stored) in the developer containing casing by the vibration body can be performed more reliably by use of a simple apparatus structure.

The image forming apparatus may be configured as follows: the developer supply apparatus is configured such that it can be attached to and detached from the main body of the image forming apparatus. The vibration-body vibrating section is provided on the main body. The vibration-body vibrating section is provided such a position that, when the developer supply apparatus is attached to the main body, the vibration-body vibrating section is located at a position outside the developer containing casing and corresponding to the vibration body.

In the image forming apparatus of the present invention having such a configuration, the vibration body provided in the space inside the developer containing casing is vibrated by the vibration-body vibrating section provided on the main body. As a result, a satisfactory fluidity can be imparted to the developer contained (stored) in the developer containing casing.

Therefore, on the developer transport surface, the developer can be transported as uniformly as possible. At that time, application of large stresses, such as aggregation force and shearing force, on the developer can be suppressed to the greatest possible extent.

Thus, according to the image forming apparatus of the present invention having such a configuration, the transport and supply of the developer to the developing position by means of the traveling-wave electric field can be performed more uniformly by use of a simple apparatus structure. Therefore, generation of density non-uniformity is effectively suppressed, and a satisfactory image can be formed.

The developer vibrating section may be configured to be able to vibrate the developer while suppressing direct transmission of vibration to the developer containing casing.

In such a configuration, when the developer vibrating section vibrates the developer contained (stored) in the developer containing casing, direct transmission of vibration to the developer containing casing can be suppressed. Thus, there is prevented, to the greatest possible extent, a change in the predetermined positional relation between the latent-image forming surface and the developer transport surface at the developing position, which change would otherwise result from the vibration.

Therefore, by virtue of such a configuration, generation of noise due to vibration of the developer containing casing can be suppressed to the greatest possible extent. Further, by virtue of such a configuration, it is possible to suppress, to the greatest possible extent, a distortion of a formed image, which distortion would otherwise occur when the predetermined positional relation changes due to the vibration.

The developer vibrating section may be configured to be able to vibrate the entirety of the developer stored in the developer containing casing. Alternatively, the developer vibrating section may be configured to be able to vibrate at least the developer transport start area of the developer pool.

In these configurations, by means of vibration of the vibration body, a satisfactory fluidity is imparted to the developer (which is to be transported on the developer transport surface) in the developer transport start area, at which transfer of the developer starts.

Thus, according to these configurations, the developer in the developer transport start area can be satisfactorily fluidized within the developer containing casing of the developer supply apparatus which can be attached to and detached from the main body.

(3) The above-described image forming apparatuses may be configured as follows.

The vibration body may be provided within the space of the developer containing casing such that the vibration body is separated from an inner wall surface of the developer containing casing. Further, the vibration body may be supported by the developer containing casing such that it can oscillate. This vibration body may be formed of a wire-shaped or rod-shaped member.

In the image forming apparatus of the present invention having such a configuration, the vibration body is separated from the inner wall surface. Therefore, when the developer contained (stored) in the developer containing casing is vibrated by means of vibration of the vibration body, direct transmission of the vibration from the vibration body to the developer containing casing can be suppressed.

Therefore, according to the image forming apparatus of the present invention having such a configuration, generation of noise due to vibration of the developer containing casing can be suppressed to the greatest possible extent. Further, it is possible to suppress, to the greatest possible extent, a distortion of a formed image, which distortion would otherwise occur when the predetermined positional relation between the latent-image forming surface and the developer transport surface at the developing position changes due to the vibration.

The vibration body may be a vibration rod, which is a rod-shaped member which extends along the main scanning direction. Opposite end portions of the vibration rod with respect to the main scanning direction may be supported on the developer containing casing via an elastic member.

In the image forming apparatus of the present invention having such a configuration, when the developer contained (stored) in the developer containing casing is vibrated by means of vibration of the vibration rod, direct transmission of the vibration from the vibration body to the developer containing casing can be suppressed by the elastic member.

Therefore, according to the image forming apparatus of the present invention having such a configuration, direct transmission of vibration from the vibration rod to the developer containing casing can be suppressed more effectively.

The vibration-body vibrating section may be magnetically coupled with the vibration rod at one end of the vibration rod with respect to the main scanning direction.

According to the image forming apparatus of the present invention, through use of a simple apparatus structure, there can be realized a structure in which the vibration rod provided within the developer containing casing of the developer supply apparatus can be vibrated by the vibration-body vibrating section provided outside the developer containing casing of the developer supply apparatus, which can be attached to and detached from the image forming apparatus.

(4) A developer supply apparatus of the present invention is configured to be able to supply a developer in a charged state to a developer carrying surface of a developer carrying body along a predetermined developer transport direction. The developer carrying surface is a surface which is parallel to a predetermined main scanning direction and which can carry the developer thereon.

The developer carrying body has the developer carrying surface and is configured such that the developer carrying surface can move along a sub-scanning direction orthogonal to the main scanning direction. The developer carrying body may be an electrostatic-latent-image carrying body having a latent-image forming surface configured to be able to form an electrostatic latent image thereon by means of electric-potential distribution. Alternatively, the developer carrying body may be a recording medium (paper) which is transported along the sub-scanning direction. Alternatively, the developer carrying body may be a roller, a sleeve, or a belt member (a developing roller, a developing sleeve, an intermediate transfer belt, etc.) which is configured and disposed so as to be able to transfer the developer onto the recording medium or the electrostatic-latent-image carrying body by means of facing the recording medium or the electrostatic-latent-image carrying body.

The developer supply apparatus of the present invention comprises a developer containing casing, a developer transport body, a plurality of transport electrodes, and a vibration body.

The developer containing casing is a box-like member, and is configured to be able to contain the developer therein. The developer containing casing has an opening portion formed at a position where the casing faces the developer carrying body.

The developer transport body has a developer transport surface parallel with the main scanning direction. This developer transport body is disposed within the developer containing casing such that the developer transport surface faces the developer carrying body via the opening portion.

The plurality of transport electrodes are provided along the developer transport surface such that they face the developer carrying surface. These transport electrodes are arrayed along the sub-scanning direction. The transport electrodes are configured in such a manner as to be able to transport the developer in the developer transport direction on the developer transport surface upon application of traveling-wave voltages.

The vibration body is disposed in a space inside the developer containing casing.

In the developer supply apparatus of the present invention having such a configuration, the developer within the developer containing casing is vibrated as a result of the vibration body vibrating. With this, the developer can be fluidized.

Further, predetermined traveling-wave voltages are applied to the plurality of transport electrodes arrayed along the sub-scanning direction. As a result, a predetermined electric field is formed in the vicinity of the developer transport surface of the developer transport body. This electric field is a traveling-wave electric field which travels in a direction along the sub-scanning direction.

A portion of the developer within the developer containing casing having been fluidized as described above, the portion being located near the developer transfer surface, is transported on the developer transport surface in the predetermined developer transport direction by means of the traveling-wave electric field. That portion of the developer is supplied to a position (facing position) where the developer carrying surface and the developer transport surface (which are parallel with each other) face in the closest proximity to each other.

In this manner, the developer supply apparatus supplies the developer in a charged state to the developer carrying surface, which moves along the sub-scanning direction. Thus, the developer is carried on the developer carrying surface.

According to the developer supply apparatus of the present invention, the developer which is to be transported on the developer transport surface is effectively fluidized. At that time, application of large stresses, such as aggregation force and shearing force, on the developer can be suppressed to the greatest possible extent.

Thus, according to the developer supply apparatus of the present invention, the transport and supply of the developer to the facing position by means of the traveling-wave electric field can be performed more uniformly.

The developer supply apparatus may be configured as follows: the vibration body is disposed at a bottom portion of the space inside the developer containing casing. This vibration body is configured to be able to vibrate the developer which is to be transported on the developer transport surface.

In the developer supply apparatus of the present invention having such a configuration, the vibration body is vibrated at the bottom portion of the space inside the developer containing casing. Due to the vibration of the vibration body, the developer which is stored in the developer containing casing and is to be transported on the developer transport surface is vibrated at the bottom portion of the space.

Therefore, according to the developer supply apparatus of the present invention having such a configuration, fluidization of the developer stored within the developer containing casing by the vibration body can be performed more reliably.

The developer supply apparatus may be configured as follows: the vibration body is provided such that the vibration body is separated from the inner wall surface of the developer containing casing. Further, the vibration body is supported by the developer containing casing such that it can oscillate.

In the developer supply apparatus of the present invention having such a configuration, the vibration body is separated from the inner wall surface. Therefore, when the developer contained (stored) in the developer containing casing is vibrated by means of vibration of the vibration body, direct transmission of the vibration from the vibration body to the developer containing casing can be suppressed.

Therefore, according to the developer supply apparatus of the present invention having such a configuration, generation of noise due to vibration of the developer containing casing can be suppressed to the greatest possible extent. Further, it is possible to suppress, to the greatest possible extent, a distortion of a formed image, which distortion would otherwise occur when the predetermined positional relation between the developer carrying surface and the developer transport surface at the facing position changes due to the vibration.

The vibration body may be formed of a wire-shaped or rod-shaped member.

The developer supply apparatus may be configured as follows: the vibration body is a vibration rod, which is a rod-shaped member which extends along the main scanning direction. Opposite end portions of the vibration rod with respect to the main scanning direction are supported on the developer containing casing via an elastic member.

In the developer supply apparatus of the present invention having such a configuration, when the developer contained (stored) in the developer containing casing is vibrated by means of vibration of the vibration rod, direct transmission of the vibration from the vibration body to the developer containing casing can be suppressed by the elastic member.

Therefore, according to the developer supply apparatus of the present invention having such a configuration, direct transmission of vibration from the vibration rod to the developer containing casing can be suppressed more effectively.

[2] In the conventional electric-field curtain mechanism as described above, the quality (density or uniformity) of a formed image may change with a change in the amount of the developer within the container. Such a change in image quality occurs due to a change in the amount of the developer transported on the plate-shaped member.

That is, the amount of the developer transported on the plate-shaped member changes in accordance with the amount of the developer within the container. As a result, the amount of the developer supplied to the developing section changes. Due to this change in the supply amount, density change and/or density non-uniformity occurs.

In particular, when the amount of the developer contained in the container (storage amount) decreases, the developer stored at the bottom portion of the container may not be supplied to the plate-shaped member properly. In such a case, the lack of the supply amount of the developer to the developing section proceeds rapidly, so that density insufficiency and/or density non-uniformity may occur suddenly.

The present invention has been accomplished in order to solve such problems. That is, an object of the present invention is to provide a developer supply apparatus and an image forming apparatus which can suppress change in image quality to the greatest possible extent, which change occurs due to change in the contained amount (storage amount) of the developer.

(1) An image forming apparatus of the present invention comprises an electrostatic-latent-image carrying body and a developer supply apparatus.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction.

The electrostatic-latent-image carrying body is configured such that the latent-image forming surface can move along a sub-scanning direction orthogonal to the main scanning direction.

The developer supply apparatus is disposed in such a manner as to face the electrostatic-latent-image carrying body. The developer supply apparatus is configured to be able to supply the latent-image forming surface with a developer in a charged state.

Specifically, the developer supply apparatus of the image forming apparatus of the present invention comprises a developer containing casing, a developer transport body, a plurality of first transport electrodes, and a plurality of second transport electrodes.

The developer containing casing is a box-like member, and is configured to be able to contain the developer therein. The developer containing casing includes a top plate and a bottom plate provided such that it faces the top plate. The top plate of the developer containing casing has an opening portion formed at a position where the top plate faces the electrostatic-latent-image carrying body.

The developer transport body has a developer main transport surface parallel with the main scanning direction. This developer transport body is disposed within the developer containing casing such that the developer main transport surface faces the electrostatic-latent-image carrying body via the opening portion of the top plate.

The plurality of first transport electrodes are provided along the developer main transport surface such that they face the latent-image forming surface. These first transport electrodes are arrayed along the sub-scanning direction. The first transport electrodes are configured in such a manner as to be able to transport the developer in a predetermined developer main transport direction on the developer main transport surface upon application of traveling-wave voltages.

The plurality of second transport electrodes are provided along a sloped developer sub-transport surface and along the bottom plate of the developer containing casing. These second transport electrodes are arrayed along the sub-scanning direction. The second transport electrodes are configured in such a manner as to be able to transport the developer in a predetermined developer sub-transport direction on the developer sub-transport surface upon application of traveling-wave voltages.

In the image forming apparatus of the present invention, the developer sub-transport surface is formed into the form of a flat surface which intersects with a horizontal plane so that the developer sub-transport surface forms a constant angle in relation to the horizontal plane. For example, the developer sub-transport surface may be formed so that the angle formed between the developer sub-transport surface and the horizontal plane always becomes 30 degree or less.

Further, the developer sub-transport surface may form a slope which ascends toward an upstream end portion of the developer main transport surface with respect to the developer main transport direction. In this case, the developer sub-transport direction is a direction in which the developer moves up along the developer sub-transport surface toward the upstream end portion of the developer main transport surface with respect to the developer main transport direction.

The image forming apparatus of the present invention having such a configuration operates as described below in formation of an image.

An electrostatic latent image in the form of an electric-potential distribution is formed on the latent-image forming surface of the electrostatic-latent-image carrying body. The latent-image forming surface on which the electrostatic latent image is formed moves along the sub-scanning direction.

Meanwhile, predetermined traveling-wave voltages are applied to the plurality of first transport electrodes arrayed along the sub-scanning direction. As a result, a predetermined electric field is formed along the developer main transport surface of the developer transport body. This electric field is a traveling-wave electric field which travels in the developer main transport direction along the sub-scanning direction.

Further, predetermined traveling-wave voltages are applied to the plurality of second transport electrodes arrayed along the sub-scanning direction. As a result, a predetermined electric field is formed along the developer sub-transport surface. This electric field is a traveling-wave electric field which travels in the developer sub-transport direction along the sub-scanning direction.

The developer contained within the developer containing casing is transported on the developer sub-transport surface in the developer sub-transport direction by means of the traveling-wave electric field. This transfer of the developer on the developer sub-transport surface starts from a predetermined developer transport start area.

This developer transport start area refers to an area near a position at which the uppermost end portion of a developer pool within the developer containing casing and the developer sub-transport surface are in the closest proximity to each other. The developer pool refers to an ensemble of the developer stored in a space at the bottom portion of the developer containing casing.

Further, the developer is transported on the developer main transport surface in the developer main transport direction by means of the traveling-wave electric field. The developer is supplied to a position (the developing position) where the latent-image forming surface and the developer main transport surface (which are parallel with each other) face each other.

After that, the developer having passed through the developing position returns to the developer pool, while being transported on the developer main transport surface in the developer main transport direction.

In this manner, the developer supply apparatus supplies the developer in a charged state to the latent-image forming surface on which the electrostatic latent image is formed. Thus, the electrostatic latent image is developed (rendered visible) with the developer.

In the image forming apparatus of the present invention having such a configuration, the angle between the top surface of the developer pool and the developer sub-transport surface at the above-described developer transport start area (hereinafter referred to as the "developer contact angle") becomes substantially constant.

When the developer contact angle changes with change in the contained amount (storage amount) of the developer within the developer containing casing, the state of supply of the developer to the developer sub-transport surface in the developer transport start area and the state of transport of the developer from the developer transport start area to the downstream side with respect to the developer sub-transport direction change.

In contrast, according to the present invention, as described above, change in the developer contact angle with change in the contained amount (storage amount) of the developer within the developer containing casing is suppressed to the greatest possible extent.

Thus, the state of supply of the developer to the developer sub-transport surface in the developer transport start area and the state of transport of the developer from the developer transport start area to the downstream side with respect to the developer sub-transport direction can be stabilized.

Therefore, according to the image forming apparatus of the present invention, change in image quality with change in the contained amount (storage amount) of the developer can be suppressed to the greatest possible extent.

The image forming apparatus may be configured as follows: the second transport electrodes are provided along the developer sub-transport surface and a developer auxiliary transport surface. A downstream end portion of the developer sub-transport surface with respect to the developer sub-transport direction is connected to the developer auxiliary transport surface. The plurality of second transport electrodes is configured to be able to transport the developer toward a predetermined position.

The developer auxiliary transport surface includes at least a surface along an inner wall surface of the top plate of the developer containing casing, the inner wall surface being located on the upstream side of the opening portion with respect to the developer main transport direction. Further, the predetermined position is a position at which an upstream end portion of the developer main transport surface with respect to the developer main transport direction and the developer sub-transport surface or the developer auxiliary transport surface face in the closest proximity to each other.

In such a configuration, on the developer sub-transport surface, the developer is transported in the developer sub-transport direction. As a result, the developer reaches the developer auxiliary transport surface located downstream of the developer sub-transport surface with respect to the developer sub-transport direction.

After that, on the developer auxiliary transport surface, the developer is transported to the above-described predetermined position. Thus, the developer reaches the developer main transport surface. The developer is then transported on the developer main transport surface in the developer main transport direction, whereby the developer is supplied to the developing position.

According to such a configuration, the developer is reliably transported from the developer sub-transport surface to the developer main transport surface. Therefore, the state of supply of the developer to the developer main transport surface and the developing position are stabilized further.

The image forming apparatus may further comprise a developer vibrating section.

The developer vibrating section is configured to be able to vibrate the developer (the developer pool) contained (stored) in the developer containing casing. Preferably, the developer vibrating section is configured to be able to vibrate at least the developer in the developer transport start area.

In such a configuration, the developer stored in the developer containing casing (which is to be transported on the developer main transport surface) is vibrated by the developer vibrating section. Thus, a satisfactory fluidity is imparted to the developer (preferably, in the developer transport start area).

By virtue of such a configuration, the amount of the developer supplied from the developer pool (the developer transport start area) to the developer sub-transport surface can be rendered uniform to the greatest possible extent in the main scanning direction and the sub-scanning direction.

As a result, the amount of the developer transported from the developer pool (the developer transport start area) to the downstream side with respect to the developer sub-transport direction can be rendered uniform to the greatest possible extent in the main scanning direction and the sub-scanning direction.

Further, application of large stresses, such as aggregation force and shearing force, on the developer in the developer pool can be suppressed to the greatest possible extent.

Accordingly, by virtue of such a configuration, generation of density non-uniformity is suppressed effectively, and a satisfactory image can be formed.

The developer vibration section may include a vibration element and a vibration-element drive section.

The vibration element is disposed within the developer containing casing such that the vibration element is separated from the developer sub-transport surface. This vibration element is supported by the developer containing casing such that the vibration element can oscillate.

Further, the vibration-element drive section is configured to be able to vibrate the vibration element from the outside of the developer containing casing. This vibration-element drive section is disposed outside the developer containing casing.

In such a configuration, the vibration element vibrates in a state in which the vibration element is separated from the developer containing casing and the developer transport body. Thus, the vibration generated by the vibration element is not transmitted directly to the developer containing casing and the developer transport body.

Therefore, by virtue of this configuration, there is prevented, to the greatest possible extent, a change in a predetermined positional relation between the latent-image forming surface of the electrostatic-image carrying body and the developer main transport surface of the developer transport body, which change would otherwise result from vibration of the vibration element.

Thus, it is possible to satisfactorily fluidize the developer to thereby render uniform the state of transport of the developer on the developer main transport surface and the developer sub-transport surface, while suppressing adverse influence on development of the electrostatic latent image to the greatest possible extent.

(2) An image forming apparatus of the present invention comprises an electrostatic-latent-image carrying body and a developer supply apparatus. The electrostatic-latent-image carrying body is configured in the same manner as described in section (1) above.

The developer supply apparatus is disposed in such a manner as to face the electrostatic-latent-image carrying body. The developer supply apparatus is configured to be able to supply the latent-image forming surface with a developer in a charged state.

Specifically, the developer supply apparatus comprises a developer containing casing, a developer transport body, a plurality of first transport electrodes, and a plurality of second transport electrodes.

The developer containing casing is a box-like member, and is configured to be able to contain the developer therein. The developer containing casing includes a top plate and a bottom plate provided such that it faces the top plate. The top plate of the developer containing casing has an opening portion formed at a position where the top plate faces the electrostatic-latent-image carrying body.

The developer transport body has a developer main transport surface parallel with the main scanning direction. This developer transport body is disposed within the developer containing casing such that the developer main transport surface faces the electrostatic-latent-image carrying body via the opening portion of the top plate.

The plurality of first transport electrodes are provided along the developer main transport surface such that they face the latent-image forming surface. These first transport electrodes are arrayed along the sub-scanning direction. The first transport electrodes are configured in such a manner as to be able to transport the developer in a predetermined developer main transport direction on the developer main transport surface upon application of traveling-wave voltages.

The plurality of second transport electrodes are provided along a sloped developer sub-transport surface. These second transport electrodes are arrayed along the sub-scanning direction. The second transport electrodes are configured in such a manner as to be able to transport the developer in a predetermined developer sub-transport direction on the developer sub-transport surface upon application of traveling-wave voltages.

In the image forming apparatus of the present invention, the developer sub-transport surface is a surface extending along the upper surface of the bottom plate of the developer containing casing, and is formed such that the angle formed between the developer sub-transport surface and the horizontal plane always becomes 30 degree or less.

The developer sub-transport surface may form a slope which ascends toward an upstream end portion of the developer main transport surface with respect to the developer main transport direction. In this case, the developer sub-transport direction is a direction in which the developer moves up along the developer sub-transport surface toward the upstream end portion of the developer main transport surface with respect to the developer main transport direction.

The image forming apparatus of the present invention having such a configuration operates as described below in formation of an image.

The above-described electrostatic latent image is formed on the latent-image forming surface. The latent-image forming surface on which the electrostatic latent image is formed moves along the sub-scanning direction.

Meanwhile, predetermined traveling-wave voltages are applied to the plurality of first transport electrodes arrayed along the sub-scanning direction. As a result, a traveling-wave electric field which travels in the developer main transport direction is formed along the developer main transport surface of the developer transport body.

Further, predetermined traveling-wave voltages are applied to the plurality of second transport electrodes arrayed along the sub-scanning direction. As a result, a traveling-wave electric field which travels in the developer sub-transport direction is formed along the developer sub-transport surface.

The developer contained within the developer containing casing is transported on the developer sub-transport surface in the developer sub-transport direction by means of the traveling-wave electric field. This transport of the developer starts from a predetermined developer transport start area.

This developer transport start area refers to an area near a position at which the uppermost end portion of a developer pool within the developer containing casing and the developer sub-transport surface are in the closest proximity to each other. The developer pool refers to an ensemble of the developer stored in a space at the bottom portion of the developer containing casing.

The developer is transported on the developer main transport surface in the developer main transport direction by means of the traveling-wave electric field. The developer is supplied to a position (the developing position) where the latent-image forming surface and the developer main transport surface (which are parallel with each other) face each other.

After that, the developer having passed through the developing position returns to the developer pool, while being transported on the developer main transport surface in the developer main transport direction.

In the image forming apparatus having such a configuration, the angle between the top surface of the developer pool and the developer sub-transport surface at the above-described developer transport start area (hereinafter referred to as the "developer contact angle") always becomes 30 degrees or less. Therefore, the influence of the above-described traveling-wave electric field extends over the greater portion of the developer in the developer transport start area.

Therefore, by virtue such a configuration, the amount of the developer supplied to the developer sub-transport surface in the developer transport start area can be increased to the greatest possible extent. Thus, the amount of the developer transported from the developer transport start area to the downstream side with respect to the developer sub-transport direction and the amount of the developer transported on the developer main transport surface can be secured to the greatest possible extent.

Therefore, according to the image forming apparatus of the present invention, change in image quality can be suppressed to the greatest possible extent.

The image forming apparatus may be configured as follows: the second transport electrodes are provided along the developer sub-transport surface and a developer auxiliary transport surface. A downstream end portion of the developer sub-transport surface with respect to the developer sub-transport direction is connected to the developer auxiliary transport surface. The plurality of second transport electrodes is configured to be able to transport the developer toward a predetermined position.

The developer auxiliary transport surface includes at least a surface along an inner wall surface of the top plate of the developer containing casing, the inner wall surface being located on the upstream side of the opening portion with respect to the developer main transport direction. Further, the predetermined position is a position at which an upstream end portion of the developer main transport surface with respect to the developer main transport direction and the developer sub-transport surface or the developer auxiliary transport surface face in the closest proximity to each other.

According to such a configuration, the developer can be reliably transported from the developer sub-transport surface to the developer main transport surface with the mediation of the auxiliary transport surface. Therefore, the state of supply of the developer to the developer main transport surface and the developing position can be stabilized further.

The image forming apparatus may further comprise a developer vibrating section. This developer vibrating section is configured to be able to vibrate the developer (the developer pool) contained (stored) in the developer containing casing. Preferably, the developer vibrating section is configured to be able to vibrate at least the developer in the developer transport start area.

In such a configuration, the developer stored in the developer containing casing (which is to be transported on the developer main transport surface) is vibrated by the developer vibrating section. Thus, a satisfactory fluidity is imparted to the developer (preferably, in the developer transport start area).

By virtue of such a configuration, the amount of the developer supplied from the developer pool (the developer transport start area) to the developer sub-transport surface and the amount of the developer transported from the developer pool (the developer transport start area) to the downstream side with respect to the developer sub-transport direction can be rendered uniform to the greatest possible extent in the main scanning direction and the sub-scanning direction. Further, application of large stresses, such as aggregation force and shearing force, on the developer in the developer pool can be suppressed to the greatest possible extent. Accordingly, generation of density non-uniformity is suppressed effectively, and a satisfactory image can be formed.

The developer vibration section may include a vibration element and a vibration-element drive section.

The vibration element is disposed within the developer containing casing such that the vibration element is separated from the developer sub-transport surface. This vibration element is supported by the developer containing casing such that the vibration element can oscillate.

Further, the vibration-element drive section is configured to be able to vibrate the vibration element from the outside of the developer containing casing. This vibration-element drive section is disposed outside the developer containing casing.

In such a configuration, the vibration element which vibrates is separated from the developer containing casing and the developer transport body. Therefore, there is prevented, to the greatest possible extent, a change in a predetermined positional relation between the latent-image forming surface of the electrostatic-image carrying body and the developer main transport surface of the developer transport body, which change would otherwise result from vibration of the vibration element.

Therefore, according such a configuration, it is possible to satisfactorily fluidize the developer to thereby render uniform the state of transport of the developer on the developer main transport surface and the developer sub-transport surface, while suppressing adverse influence on development of the electrostatic latent image to the greatest possible extent.

(3) A developer supply apparatus of the present invention is configured to be able to supply a developer in a charged state to a developer carrying surface of a developer carrying body along a predetermined developer transport direction. The developer carrying surface is a surface which is parallel to a predetermined main scanning direction and which can carry the developer thereon.

The developer carrying body has the developer carrying surface and is configured such that the developer carrying surface can move along a sub-scanning direction orthogonal to the main scanning direction.

The developer carrying body may be an electrostatic-latent-image carrying body having a latent-image forming surface configured to be able to form an electrostatic latent image thereon by means of electric-potential distribution.

Alternatively, the developer carrying body may be a recording medium (paper) which is transported along the sub-scanning direction.

Alternatively, the developer carrying body may be a roller, a sleeve, or a belt member (a developing roller, a developing sleeve, an intermediate transfer belt, etc.) which is configured and disposed so as to be able to transfer the developer onto the recording medium or the electrostatic-latent-image carrying body by means of facing the recording medium or the electrostatic-latent-image carrying body.

The developer supply apparatus of the present invention comprises a developer containing casing, a developer transport body, and a plurality of transport electrodes.

The developer containing casing is a box-like member, and is configured to be able to contain the developer therein. The developer containing casing includes a top plate and a bottom plate provided such that it faces the top plate. The top plate of the developer containing casing has an opening portion formed at a position where the top plate faces the developer carrying body.

The developer transport body has a developer main transport surface parallel with the main scanning direction. This developer transport body is disposed within the developer containing casing such that the developer main transport surface faces the developer carrying body via the opening portion of the top plate.

The plurality of first transport electrodes are provided along the developer main transport surface such that they face the developer carrying surface. These first transport electrodes are arrayed along the sub-scanning direction. The first transport electrodes are configured in such a manner as to be able to transport the developer in a predetermined developer main transport direction on the developer main transport surface upon application of traveling-wave voltages.

The plurality of second transport electrodes are provided along a sloped developer sub-transport surface and along the bottom plate of the developer containing casing. These second transport electrodes are arrayed along the sub-scanning direction. The second transport electrodes are configured in such a manner as to be able to transport the developer in a predetermined developer sub-transport direction on the developer sub-transport surface upon application of traveling-wave voltages.

In the developer supply apparatus of the present invention, the developer sub-transport surface is formed into the form of a flat surface which intersects with a horizontal plane so that the developer sub-transport surface forms a constant angle in relation to the horizontal plane. For example, the developer sub-transport surface may be formed so that the angle formed between the developer sub-transport surface and the horizontal plane always becomes 30 degree or less.

Further, the developer sub-transport surface may form a slope which ascends toward an upstream end portion of the developer main transport surface with respect to the developer main transport direction. In this case, the developer sub-transport direction is a direction in which the developer moves up along the developer sub-transport surface toward the upstream end portion of the developer main transport surface with respect to the developer main transport direction.

The developer supply apparatus of the present invention having such a configuration operates as described below.

The developer carrying surface of the developer carrying body moves along the sub-scanning direction.

Meanwhile, predetermined traveling-wave voltages are applied to the plurality of first transport electrodes and the plurality of second transport electrodes arrayed along the sub-scanning direction.

As a result, a traveling-wave electric field which travels in the developer main transport direction along the sub-scanning direction is formed along the developer main transport surface of the developer transport body. Further, a traveling-wave electric field which travels in the developer sub-transport direction along the sub-scanning direction is formed along the developer sub-transport surface.

The developer contained within the developer containing casing is transported on the developer sub-transport surface in the developer sub-transport direction by means of the traveling-wave electric field. This transfer of the developer on the developer sub-transport surface starts from a predetermined developer transport start area of a developer pool.

The developer pool refers to an ensemble of the developer stored in a space at the bottom portion of the developer containing casing. The developer transport start area refers to an area near a position at which the uppermost end portion of the developer pool within the developer containing casing and the developer sub-transport surface are in the closest proximity to each other.

In such a configuration, the angle between the top surface of the developer pool and the developer sub-transport surface at the above-described developer transport start area (hereinafter referred to as the "developer contact angle") becomes substantially constant.

That is, according to such a configuration, change in the developer contact angle changes with change in the contained amount (storage amount) of the developer within the developer containing casing is suppressed to the greatest possible extent.

Thus, the state of supply of the developer to the developer sub-transport surface in the developer transport start area and the state of transport of the developer from the developer transport start area to the downstream side with respect to the developer sub-transport direction can be stabilized.

After that, the developer is transported on the developer main transport surface in the developer main transport direction by means of the traveling-wave electric field. The developer is then supplied to a position (developer carrying position) where the developer carrying surface and the developer main transport surface (which are parallel with each other) face each other.

The developer having passed through the developer carrying position returns to the developer pool, while being transported on the developer main transport surface in the developer main transport direction.

As described above, according to the developer supply apparatus of the present invention, change in the transport amount of the developer with change in the contained amount (storage amount) of the developer can be suppressed to the greatest possible extent.

The developer supply apparatus may be configured as follows: the second transport electrodes are provided along the developer sub-transport surface and a developer auxiliary transport surface. A downstream end portion of the developer sub-transport surface with respect to the developer sub-transport direction is connected to the developer auxiliary transport surface. The plurality of second transport electrodes are configured to be able to transport the developer toward a predetermined position.

The developer auxiliary transport surface includes at least a surface along an inner wall surface of the top plate of the developer containing casing, the inner wall surface being located on the upstream side of the opening portion with respect to the developer main transport direction. Further, the predetermined position is a position at which the above-described end portion of the developer main transport surface and the developer sub-transport surface or the developer auxiliary transport surface face in the closest proximity to each other.

In such a configuration, when the developer is transported on the developer sub-transport surface in the developer sub-transport direction, the developer reaches the developer auxiliary transport surface. After that, on the developer auxiliary transport surface, the developer is transported to the above-described predetermined position.

Thus, the developer reaches the developer main transport surface. The developer is then transported on the developer main transport surface in the developer main transport direction, whereby the developer is supplied to the developer carrying position.

According to such a configuration, the developer can be reliably transported from the developer sub-transport surface to the developer main transport surface. Therefore, the state of supply of the developer to the developer main transport surface and the developer carrying position are stabilized further.

The developer supply apparatus may further comprise a developer vibrating section. The developer vibrating section is configured to be able to vibrate the developer (the developer pool) contained (stored) in the developer containing casing. Preferably, the developer vibrating section is configured to be able to vibrate at least the developer in the developer transport start area.

In such a configuration, the developer stored in the developer containing casing is vibrated by the developer vibrating section. Thus, a satisfactory fluidity is imparted to the developer.

By virtue of such a configuration, the amount of the developer supplied from the developer pool (the developer transport start area) to the developer sub-transport surface can be rendered uniform to the greatest possible extent in the main scanning direction and the sub-scanning direction. As a result, the amount of the developer transported from the developer pool to the downstream side with respect to the developer sub-transport direction can be rendered uniform to the greatest possible extent.

Further, application of large stresses, such as aggregation force and shearing force, on the developer in the developer pool can be suppressed to the greatest possible extent.

The developer vibration section may include a vibration element and a vibration-element drive section.

The vibration element is disposed within the developer containing casing such that the vibration element is separated from the developer sub-transport surface. This vibration element is supported by the developer containing casing such that the vibration element can oscillate.

Further, the vibration-element drive section is configured to be able to vibrate the vibration element from the outside of the developer containing casing. This vibration-element drive section is disposed outside the developer containing casing.

In such a configuration, the vibration element vibrates in a state in which the vibration element is separated from the developer containing casing and the developer transport body. Thus, the vibration generated by the vibration element is not transmitted directly to the developer containing casing and the developer transport body.

Therefore, by virtue of this configuration, there is prevented, to the greatest possible extent, a change in a predetermined positional relation between the developer carrying surface of the developer carrying body and the developer main transport surface of the developer transport body, which change would otherwise result from vibration of the vibration element.

(4) A developer supply apparatus of the present invention is configured to be able to supply a developer in a charged state to a developer carrying surface of a developer carrying body along a predetermined developer transport direction. The developer carrying surface is a surface which is parallel to a predetermined main scanning direction and which can carry the developer thereon.

The developer carrying body has the developer carrying surface and is configured such that the developer carrying surface can move along a sub-scanning direction orthogonal to the main scanning direction.

The developer carrying body may be an electrostatic-latent-image carrying body having a latent-image forming surface configured to be able to form an electrostatic latent image thereon by means of electric-potential distribution.

Alternatively, the developer carrying body may be a recording medium (paper) which is transported along the sub-scanning direction.

Alternatively, the developer carrying body may be a roller, a sleeve, or a belt member (a developing roller, a developing sleeve, an intermediate transfer belt, etc.) which is configured and disposed so as to be able to transfer the developer onto the recording medium or the electrostatic-latent-image carrying body by means of facing the recording medium or the electrostatic-latent-image carrying body.

The developer supply apparatus of the present invention comprises a developer containing casing, a developer transport body, and a plurality of transport electrodes.

The developer containing casing is a box-like member, and is configured to be able to contain the developer therein. The developer containing casing includes a top plate and a bottom plate provided such that it faces the top plate. The top plate of the developer containing casing has an opening portion formed at a position where the top plate faces the electrostatic-latent-image carrying body.

The developer transport body has a developer main transport surface parallel with the main scanning direction. This developer transport body is disposed within the developer containing casing such that the developer main transport surface faces the developer carrying body via the opening portion of the top plate.

The plurality of first transport electrodes are provided along the developer main transport surface such that they face the developer carrying surface. These first transport electrodes are arrayed along the sub-scanning direction. The first transport electrodes are configured in such a manner as to be able to transport the developer in a predetermined developer main transport direction on the developer main transport surface upon application of traveling-wave voltages.

The plurality of second transport electrodes are provided along a sloped developer sub-transport surface. The developer sub-transport surface is a surface extending along the upper surface of the bottom plate of the developer containing casing, and is formed such that the angle formed between the developer sub-transport surface and the horizontal plane always becomes 30 degree or less.

These second transport electrodes are arrayed along the sub-scanning direction. The second transport electrodes are configured in such a manner as to be able to transport the developer in a predetermined developer sub-transport direction on the developer sub-transport surface upon application of traveling-wave voltages.

The developer sub-transport surface may form a slope which ascends toward an upstream end portion of the developer main transport surface with respect to the developer main transport direction. In this case, the developer sub-transport direction is a direction in which the developer moves up along the developer sub-transport surface toward the upstream end portion of the developer main transport surface with respect to the developer main transport direction.

The developer supply apparatus of the present invention having such a configuration operates as described below.

The developer carrying surface of the developer carrying body moves along the sub-scanning direction.

Meanwhile, predetermined traveling-wave voltages are applied to the plurality of first transport electrodes. As a result, a traveling-wave electric field which travels in the developer main transport direction is formed along the developer main transport surface of the developer transport body.

Further, predetermined traveling-wave voltages are applied to the plurality of second transport electrodes. As a result, a traveling-wave electric field which travels in the developer sub-transport direction is formed along the developer sub-transport surface.

The developer contained within the developer containing casing is transported on the developer sub-transport surface in the developer sub-transport direction by means of the traveling-wave electric field. This transfer of the developer on the developer sub-transport surface starts from a predetermined developer transport start area.

The developer transport start area refers to an area near a position at which the uppermost end portion of a developer pool within the developer containing casing and the developer sub-transport surface are in the closest proximity to each other. The developer pool refers to an ensemble of the developer stored in a space at the bottom portion of the developer containing casing.

The developer is transported on the developer main transport surface in the developer main transport direction by means of the traveling-wave electric field. The developer is then supplied to a position (the developer carrying position) where the developer carrying surface and the developer main transport surface (which are parallel with each other) face each other. After that, the developer having passed through the developer carrying position returns to the developer pool, while being transported on the developer main transport surface in the developer main transport direction.

In such a configuration, the angle between the top surface of the developer pool and the developer sub-transport surface at the above-described developer transport start area (hereinafter referred to as the "developer contact angle") always becomes 30 degrees or less. Therefore, the influence of the above-described traveling-wave electric field extends over the greater portion of the developer in the developer transport start area.

Therefore, by virtue such a configuration, the amount of the developer supplied to the developer sub-transport surface in the developer transport start area can be increased to the greatest possible extent. Thus, the amount of the developer transported from the developer transport start area to the downstream side with respect to the developer sub-transport direction and the amount of the developer transported on the developer main transport surface can be secured to the greatest possible extent.

Therefore, according to the developer supply apparatus of the present invention, occurrence of lack of the transport amount of the developer can be suppressed to the greatest possible extent.

The developer supply apparatus may be configured as follows: the second transport electrodes are provided along the developer sub-transport surface and a developer auxiliary transport surface. A downstream end portion of the developer sub-transport surface with respect to the developer sub-transport direction is connected to the developer auxiliary transport surface. The plurality of second transport electrodes are configured to be able to transport the developer toward a predetermined position.

The developer auxiliary transport surface includes at least a surface along an inner wall surface of the top plate of the developer containing casing, the inner wall surface being located on the upstream side of the opening portion with respect to the developer main transport direction. Further, the predetermined position is a position at which the above-described end portion of the developer main transport surface and the developer sub-transport surface or the developer auxiliary transport surface face in the closest proximity to each other.

In such a configuration, when the developer is transported on the developer sub-transport surface in the developer sub-transport direction, the developer reaches the developer auxiliary transport surface. After that, on the developer auxiliary transport surface, the developer is transported to the above-described predetermined position.

Thus, the developer reaches the developer main transport surface. The developer is then transported on the developer main transport surface in the developer main transport direction, whereby the developer is supplied to the developer carrying position.

According to such a configuration, the developer can be reliably transported from the developer sub-transport surface to the developer main transport surface. Therefore, the state of supply of the developer to the developer main transport surface and the developer carrying position can be stabilized further.

The developer supply apparatus may further comprise a developer vibrating section. The developer vibrating section is configured to be able to vibrate the developer (the developer pool) contained (stored) in the developer containing casing. Preferably, the developer vibrating section is configured to be able to vibrate at least the developer in the developer transport start area.

In such a configuration, the developer stored in the developer containing casing is vibrated by the developer vibrating section, whereby a satisfactory fluidity is imparted to the developer. At that time, application of large stresses, such as aggregation force and shearing force, on the developer in the developer pool can be suppressed to the greatest possible extent.

By virtue of such a configuration, the amount of the developer supplied to the developer sub-transport surface can be rendered uniform to the greatest possible extent in the main scanning direction and the sub-scanning direction. As a result, the amount of the developer transported from the developer pool to the downstream side with respect to the developer sub-transport direction can be rendered uniform to the greatest possible extent.

The developer vibration section may include a vibration element and a vibration-element drive section.

The vibration element is disposed within the developer containing casing such that the vibration element is separated from the developer sub-transport surface. This vibration element is supported by the developer containing casing such that the vibration element can oscillate.

Further, the vibration-element drive section is configured to be able to vibrate the vibration element from the outside of the developer containing casing. This vibration-element drive section is disposed outside the developer containing casing.

In such a configuration, the vibration element vibrates in a state in which the vibration element is separated from the developer containing casing and the developer transport body. Therefore, there is prevented, to the greatest possible extent, a change in a predetermined positional relation between the developer carrier surface of the developer carrying body and the developer main transport surface of the developer transport body, which change would otherwise result from vibration of the vibration element.

BEST MODE FOR CARRYING OUT THE INVENTION

Embodiments of the present invention (embodiments which the applicant contemplated as the best at the time of filing the present application) will next be described with reference to the drawings.

Notably, the following description of the embodiments merely describes a concrete example of the present invention specifically to the greatest possible extent so as to satisfy requirements regarding a specification (requirement regarding description and requirement regarding practicability) required under the law. Therefore, as described below, the present invention is not limited to the specific structures of the embodiments and modifications which will be described below. That is, those component elements which partially constitute the means for solving the problems to be solved by the invention and are described operationally and functionally include not only the specific structures disclosed in the following embodiments and modifications but also any other structures that can implement the operations and functions of the elements.

For example, application of the present invention is not limited to a so-called monochromatic laser printer which can form a monochromatic image. For example, the present invention can be preferably applied to so-called electrophotographic image forming apparatus, such as color laser printers which form a multi-color (full color) image and monochromatic and color copying machines.

Also, the present invention can be preferably applied to image forming apparatus of other than the above-mentioned electrophotographic system (for example, toner jet image forming apparatus, ion flow image forming apparatus, etc. which do not use a photosensitive body).

[1-1]

<Overall Configuration of First Laser Printer>

Figure 1:
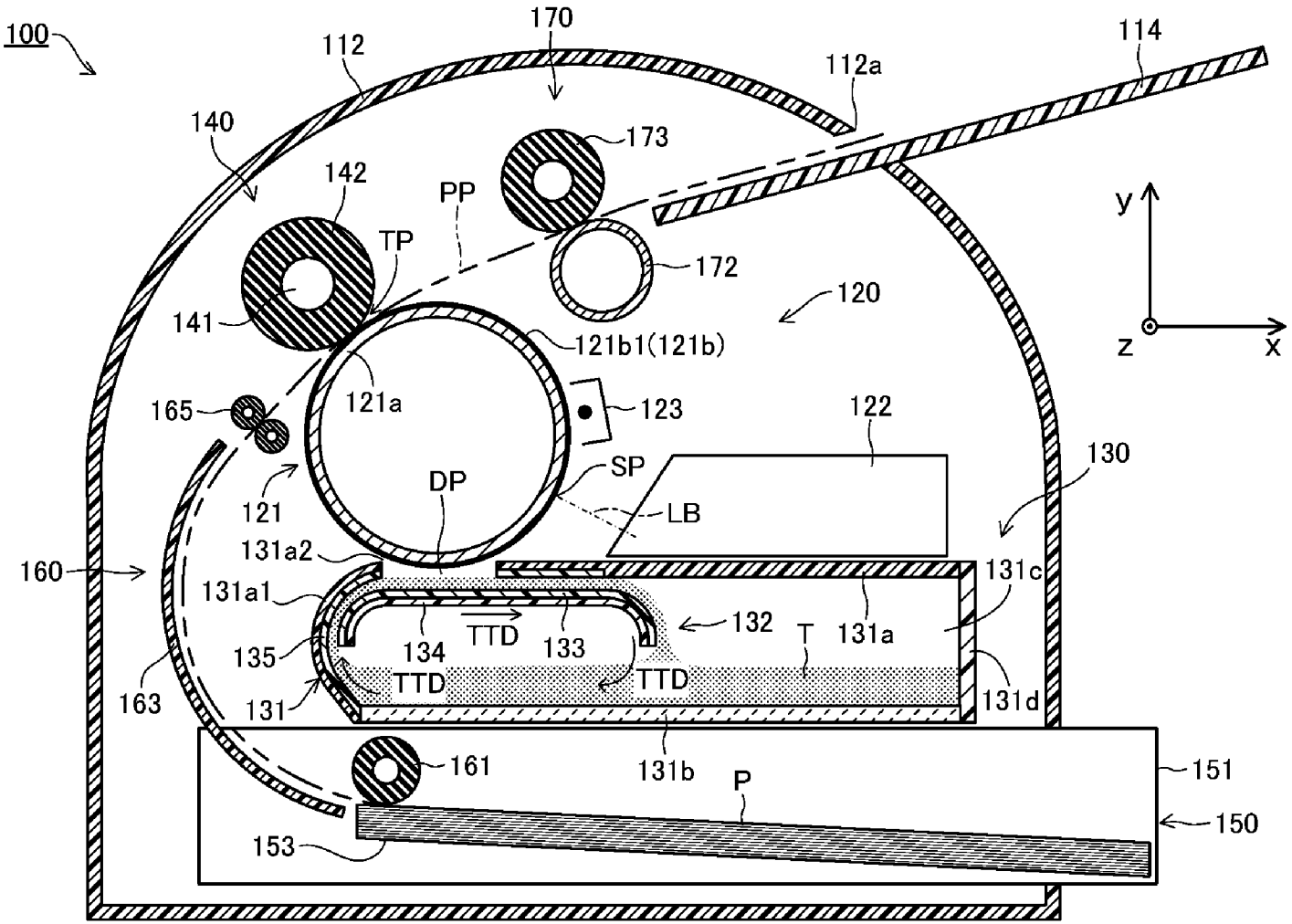
FIG. 1 is a side sectional view showing the schematic configuration of a laser printer to which a first embodiment of the present invention is applied.

FIG. 1 is a side sectional view showing the schematic configuration of a laser printer 100 to which the first embodiment of the present invention is applied.

In FIG. 1, the alternate-long-and-two-short-dashes line indicates a paper path PP along which a paper P is transported. The paper P serves as a recording medium on which an image is formed. A direction tangent to the paper path PP is called the paper transport direction.

In FIG. 1, an x-axis direction is called the front-rear direction. With respect to the front-rear direction, a side toward one end of the laser printer 100 (right side in FIG. 1) is called the "front" side. A side toward the other end, opposite the one end, of the laser printer 100 (left side in FIG. 1) is called the "rear" side.

Furthermore, a direction orthogonal to a height direction (the y-axis direction in FIG. 1) of the laser printer 100, to the paper transport direction, and to the front-rear direction is called the paper width direction (the z-axis direction in FIG. 1).

<<Body Section>>

Referring to FIG. 1, the laser printer 100, which corresponds to the image forming apparatus of the present invention, includes a body casing 112. The body casing 112 is a member which constitutes an outer cover of the laser printer 100. The body casing 112 is integrally formed from a synthetic resin plate.

The body casing 112 has a paper ejection port 112*a* in the form of a slit-like through-hole located at an upper front portion thereof.

A catch tray 114 is attached to an upper front portion of the body casing 112 at a position corresponding to the paper ejection port 112*a*. The catch tray 114 is configured to receive the paper P which is ejected through the paper ejection port 112*a* and on which an image has been formed.

<<Electrostatic-Latent-Image Forming Section>>

The body casing 112 houses an electrostatic-latent-image forming section 120. The electrostatic-latent-image forming section 120 includes a photoconductor drum 121, which corresponds to the electrostatic-latent-image carrying body and the developer carrying body of the present invention.

The photoconductor drum 121 is a generally cylindrical member and is disposed such that its center axis of rotation is in parallel with the paper width direction. The photoconductor drum 121 is configured to be able to be rotatably driven clockwise in FIG. 1.

Specifically, the photoconductor drum 121 includes a drum body 121*a* and a photoconductor layer 121*b*.

The drum body 121*a* is a metal tube of an aluminum alloy or the like. The photoconductor layer 121*b* is a positively chargeable photoconductive layer which exhibits electrical conductivity upon irradiation with light having a predetermined wavelength. This photoconductor layer 121*b* is formed on the outer circumference of the drum body 121*a*.

The photoconductor drum 121 has an image carrying surface 121*b*1, which corresponds to the latent-image forming surface and the developer carrying surface of the present invention. The circumferential surface of the photoconductor layer 121*b* serves as the image carrying surface 121*b*1.

The image carrying surface 121*b*1 is formed in parallel with the paper width direction and a main scanning direction, which will be described later. The image carrying surface 121*b*1 is configured such that an electrostatic latent image can be formed by electric-potential distribution.

That is, the photoconductor drum 121 is configured such that the image carrying surface 121*b*1 can move along a sub-scanning direction, which is orthogonal to the main scanning direction and will be described later.

The electrostatic-latent-image forming section 120 includes a scanner unit 122 and a charger 123.

The scanner unit 122 is configured and disposed such that the image carrying surface 121*b*1 can be irradiated at a predetermined scanning position SP with a laser beam LB having the above-described predetermined wavelength and modulated on the basis of image information. The laser beam LB is caused to sweep along the main scanning direction (the z-axis direction in FIG. 1) parallel to the paper width direction.

The charger 123 is disposed upstream of the scanning direction SP with respect to the direction of movement of the image carrying surface 121*b*1 (direction of rotation of the photoconductor drum 121). The charger 123 is configured and disposed so as to be able to uniformly, positively charge the image carrying surface 121*b*1 at a position located upstream of the scanning position SP with respect to the above-mentioned direction.

The electrostatic-latent-image forming section 120 is configured such that the scanner unit 122 irradiates, with the laser beam LB, the image carrying surface 121*b*1 which is uniformly, positively charged by the charger 123, whereby an electrostatic latent image by electric-potential distribution (charge distribution) can be formed on the image carrying surface 121*b*1.

The electrostatic-latent-image forming section 120 is configured to be able to move the image carrying surface 121*b*1 on which an electrostatic latent image is formed, along the sub-scanning direction, which will be described later.

The "sub-scanning direction" is an arbitrary direction orthogonal to the main scanning direction. Usually, the sub-scanning direction is a direction which intersects with a vertical line. Typically, the sub-scanning direction may be a direction along the front-rear direction of the laser printer 100 (the x-axis direction in FIG. 1).

<<Developing Apparatus>>

The body casing 112 houses a developing apparatus 130, which corresponds to the developer supply apparatus of the present invention. The developing apparatus 130 is disposed in such a manner as to face the photoconductor drum 121 at a developing position DP.

The developing apparatus 130 is configured such that it stores a toner T, which is a dry developer in the form of fine particles (powder developer), and can transport the toner T while circulating it along a toner transport direction TTD, as indicated by arrows in FIG. 1.

That is, the toner transport direction TTD, which corresponds to the developer transport direction of the present invention, is a direction tangent to a circulating transport path at an arbitrary point. The circulating transport path is formed within the developing apparatus 130 such that the path assumes a generally oval (elliptical) shape as viewed in a side sectional view, and the toner T circulates along the circulating transport path.

The developing apparatus 130 is configured and disposed as described below so as to be able to supply the image carrying surface 121*b*1 on which an electrostatic latent image is formed, with the toner T in a charged state in the vicinity of the developing position DP. Notably, the toner T used in the present embodiment is a non-magnetic 1-component developer for use in electrophotography.

Figure 2:
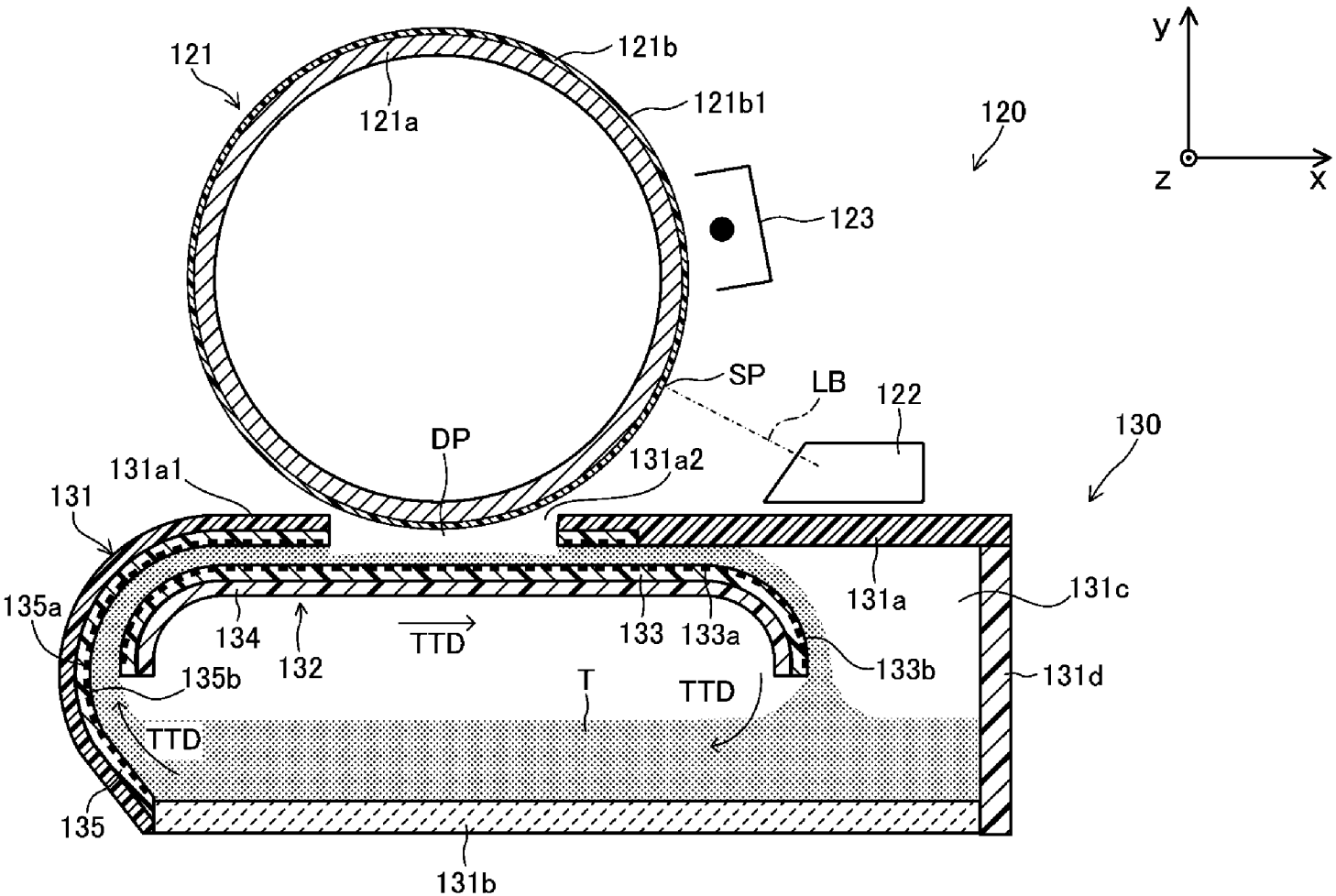
FIG. 2 is an enlarged side sectional view showing an electrostatic-latent-image forming section and a developing apparatus shown in FIG. 1.

FIG. 2 is an enlarged side sectional view showing the electrostatic-latent-image forming section 120 and the developing apparatus 130 shown in FIG. 1.

Referring to FIGS. 1 and 2, the developing apparatus 130 is disposed below the photoconductor drum 121 in such a manner as to face the image carrying surface 121*b*1 at a position located downstream of the scanning position SP with respect to the direction of movement of the image carrying surface 121*b*1.

<<<Developing Casing>>>

Referring to FIGS. 1 and 2, a developing casing 131 is a box-like member and is configured to be able to contain the toner T therein without leaking the toner T to the outside. The developing casing 131 corresponds to the developer containing casing of the present invention.

A developing-section counter plate 131*a*1 is a rear portion of a casing top cover 131*a*, which serves as the top plate of the developing casing 131. The developing-section counter plate 131*a*1 is formed to have a generally J-like shape in a side sectional view. That is, the developing-section counter plate 131*a*1 is composed of a flat plate portion which is located below the photoconductor drum 121 and disposed generally horizontally, and a half-pipe portion connected to a rear end of the flat plate portion. A lower end portion of the half-pipe portion is formed to have a slope which slopes downward toward the front side.

The developing-section counter plate 131*a*1 is thinner than the remaining portion of the casing top cover 131*a*. That is, a recess is formed on an inner surface of the casing top cover 131*a* at a position corresponding to the developing-section counter plate 131*a*1.

A developing opening portion 131*a*2, which corresponds to the opening portion of the present invention, is formed in the flat plate portion of the developing-section counter plate 131*a*1. The developing opening portion 131*a*2 is provided in the developing-section counter plate 131*a*1 at a position facing the image carrying surface 121*b*1 such that the developing opening portion 131*a*2 surrounds the developing position DP.

A casing bottom plate 131*b* is a flat-plate-like member which serves as the bottom plate of the developing casing 131. A rear end portion of the casing bottom plate 131*b* is connected to the lower end of the half-pipe portion of the casing top cover 131*a*.

That is, the casing bottom plate 131*b* and the developing-section counter plate 131*a* are formed integrally with each other in such a manner as to have a cross-sectional shape resembling the letter U at the rear end portion of the developing casing 131.

A pair of casing side plates 131*c* is closingly attached to the opposite ends, with respect to the paper width direction, of the casing top cover 131*a* and to those of the casing bottom plate 131*b*. Also, a casing front closing plate 131*d* is closingly attached to the front end of the casing top cover 131*a*, to that of the casing bottom plate 131*b*, and to those of the paired casing side plates 131*c*.

In the present embodiment, the casing bottom plate 131*b*, which corresponds to the developer vibrating section of the present invention, is formed by a laminate composed of a piezoelectric ceramic and electrode films. That is, in the present embodiment, the developer vibrating section of the present invention is provided in the casing bottom plate 131*b*, which serves as the bottom plate of the developing casing 131.

The casing bottom plate 131*b* is configured such that the casing bottom plate 131*b* can vibrate upon application of an AC voltage output from an unillustrated power supply unit. That is, the casing bottom plate 131*b* is configured such that the casing bottom plate 131*b* can vibrate the toner T stored within the developing casing 131.

Referring to FIG. 2, in the present embodiment, a rear end portion (a left end portion in FIG. 2) of the casing bottom plate 131*b* is provided substantially immediately under a furthest upstream portion (an end portion located at the lower left side in FIG. 2), with respect to the toner transport direction TTD, of a transport wiring substrate 133 to be described later provided on a toner electric-field transport body 132 to be described later. Further, the rear end portion of the casing bottom plate 131*b* is provided such that it is located adjacent to a furthest upstream portion, with respect to the toner transport direction TTD, of a counter wiring substrate 135 to be described later.

That is, in the present embodiment, the rear end portion (a left end portion in FIG. 2) of the casing bottom plate 131*b* is provided in the vicinity of a furthest upstream portion of a region in which the toner T is transported in the toner transport direction TTD by means of traveling-wave electric fields generated on the counter wiring substrate 135 and the transport wiring substrate 133.

In other words, in the present embodiment, the casing bottom plate 131*b* adapted to vibrate the toner T stored in the developing casing 131 is provided to correspond to the furthest upstream portion of the region in which the toner T is transported by means of the counter wiring substrate 135 and the transport wiring substrate 133.

The rear end portion of the casing bottom plate 131*b* is provided such that it can fluidize, by means of vibration, a portion of the toner T to be transported by means of the transport wiring substrate 133 (a toner transport surface 133*b* to be described later).

Further, the rear end portion of the casing bottom plate 131*b* is provided such that it can fluidize, by means of vibration, a portion of the toner T which faces the furthest upstream portion, with respect to the toner transport direction TTD, of the counter wiring substrate 135 (a toner transport surface 135*b* to be described later).

Moreover, the casing bottom plate 131*b* is configured and disposed such that it can fluidize, by means of vibration, substantially the entirety of the toner T stored at a bottom portion of the inner space of the developing casing 131.

<<<Developer Electric-Field Transport Body>>>

Referring to FIG. 2, the developing casing 131 houses a toner electric-field transport body 132, which corresponds to the developer transport body of the present invention. That is, the toner electric-field transport body 132 is enclosed within the developing casing 131.

The toner electric-field transport body 132 is disposed in the inner space of the developing casing 131 at a rearward position, in such a manner as to face the image carrying surface 121*b*1 with the developing opening portion 131*a*2 therebetween. That is, the toner electric-field transport body 132 is provided such that the photoconductor drum 121 and the toner electric-field transport body 132 face each other with the developing opening portion 131*a*2 therebetween.

The opposite ends of the toner electric-field transport body 132 are supported by the paired casing side plates 131*c* in such a manner that the toner electric-field transport body 132 is supported at a position located above the casing bottom plate 131*b* while facing the developing-section counter plate 131*a*1 with a predetermined gap therebetween.

Figure 3:
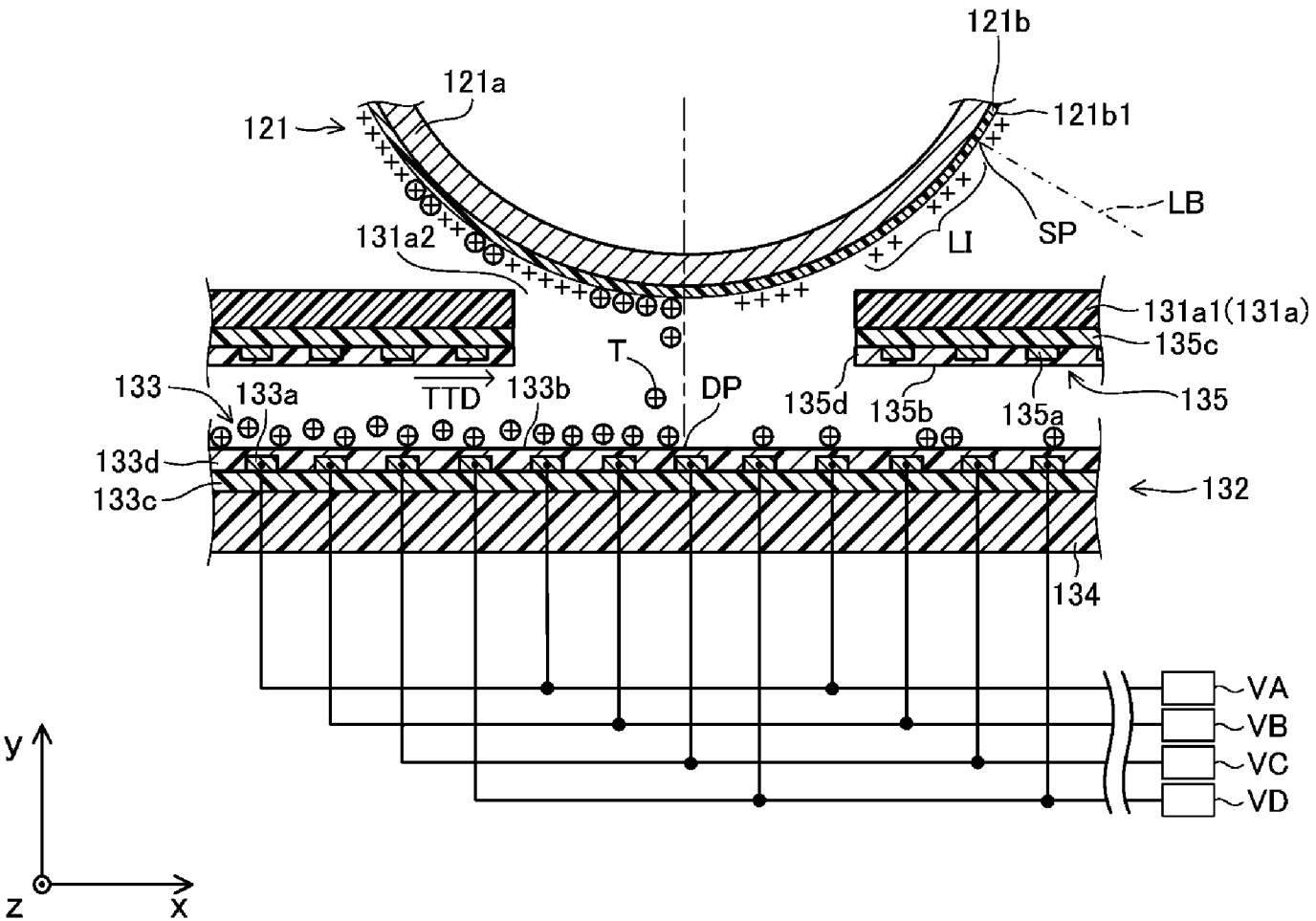
FIG. 3 is an enlarged side sectional view showing a developing opening portion and its periphery of a developer electric-field transport body shown in FIG. 2.

FIG. 3 is an enlarged side sectional view showing a portion of the toner electric-field transport body 132 (shown in FIG. 2) in the vicinity of the developing opening portion 131*a*2. Referring to FIGS. 2 and 3, the toner electric-field transport body 132 includes the transport wiring substrate 133. The transport wiring substrate 133 is disposed in such a manner as to face the image carrying surface 121*b*1 with the developing opening portion 131*a*2 therebetween.

Referring to FIG. 3, the transport wiring substrate 133 has a structure similar to that of a flexible printed wiring board, and includes a plurality of transport electrodes 133*a*. The transport electrodes 133*a* are disposed along the toner transport surface 133*b*, which corresponds to the developer transport surface of the present invention.

The toner transport surface 133*b* is an upper surface of the transport wiring substrate 133 in FIG. 2, which surface faces the photoconductor drum 121. That is, the transport electrodes 133*a* are disposed in the vicinity of the toner transport surface 133*b*.

Further, the toner transport surface 133*b* is a surface of the transport wiring substrate 133, which surface faces the image carrying surface 121*b*1, and is formed in parallel with the main scanning direction (the z direction in FIG. 2). The toner transport surface 133*b* and the image carrying surface 121*b*1 are in the closest proximity to each other at the developing position DP.

The transport electrodes 133*a* are formed of a copper foil having a thickness of about several tens of micrometers. The transport electrodes 133*a* are formed in a strip-like wiring pattern such that their longitudinal direction becomes parallel with the main scanning direction (orthogonal to the sub-scanning direction). The plurality of transport electrodes 133*a* are disposed in parallel with one another.

These transport electrodes 133*a* are arrayed along the toner transport direction TTD (along the sub-scanning direction).

The large number of transport electrodes 133*a* arrayed along the sub-scanning direction are connected to power supply circuits such that every fourth transport electrode 133*a* is connected to the same power supply circuit. That is, the transport electrode 133*a* connected to a power supply circuit VA, the transport electrode 133*a* connected to a power supply circuit VB, the transport electrode 133*a* connected to a power supply circuit VC, the transport electrode 133*a* connected to a power supply circuit VD, the transport electrode 133*a* connected to the power supply circuit VA, the transport electrode 133*a* connected to the power supply circuit VB, . . . , are sequentially arrayed along the sub-scanning direction.

The transport wiring substrate 133 also includes a transport-electrode support substrate 133*c* and a transport-electrode coating layer 133*d*.

The transport-electrode support substrate 133*c* is a flexible film of an electrically insulative synthetic resin, such as polyimide resin. The transport electrodes 133*a* are provided on the upper surface of the transport-electrode support substrate 133*c*.

The transport-electrode coating layer 133*d* is provided on the upper surface of the transport-electrode support substrate 133*c* on which the transport electrodes 133*a* are formed. The transport-electrode coating layer 133*d* is provided to cover the transport electrodes 133*a*. The transport-electrode coating layer 133*d* covers the transport-electrode support substrate 133*c* and the transport electrodes 133*a*, thereby making the toner transport surface 133*b* smooth.

Referring to FIGS. 2 and 3, the toner electric-field transport body 132 includes a transport-substrate support member 134. The transport-substrate support member 134 is provided so as to support the transport wiring substrate 133 from underneath.

Referring to FIG. 2, a rear end portion of the transport-substrate support member 134 is curved downward along the casing top cover 131*a* of the developing casing 131. Also, a front end portion of the transport-substrate support member 134 is curved downward in a manner similar to that of the rear end portion. A portion of the transport-substrate support member 134 between the above-mentioned front and rear portions assumes the form of a generally flat plate. That is, the transport-substrate support member 134 is formed in a shape resembling the inverted letter U as viewed from the lateral direction.

Figure 4:
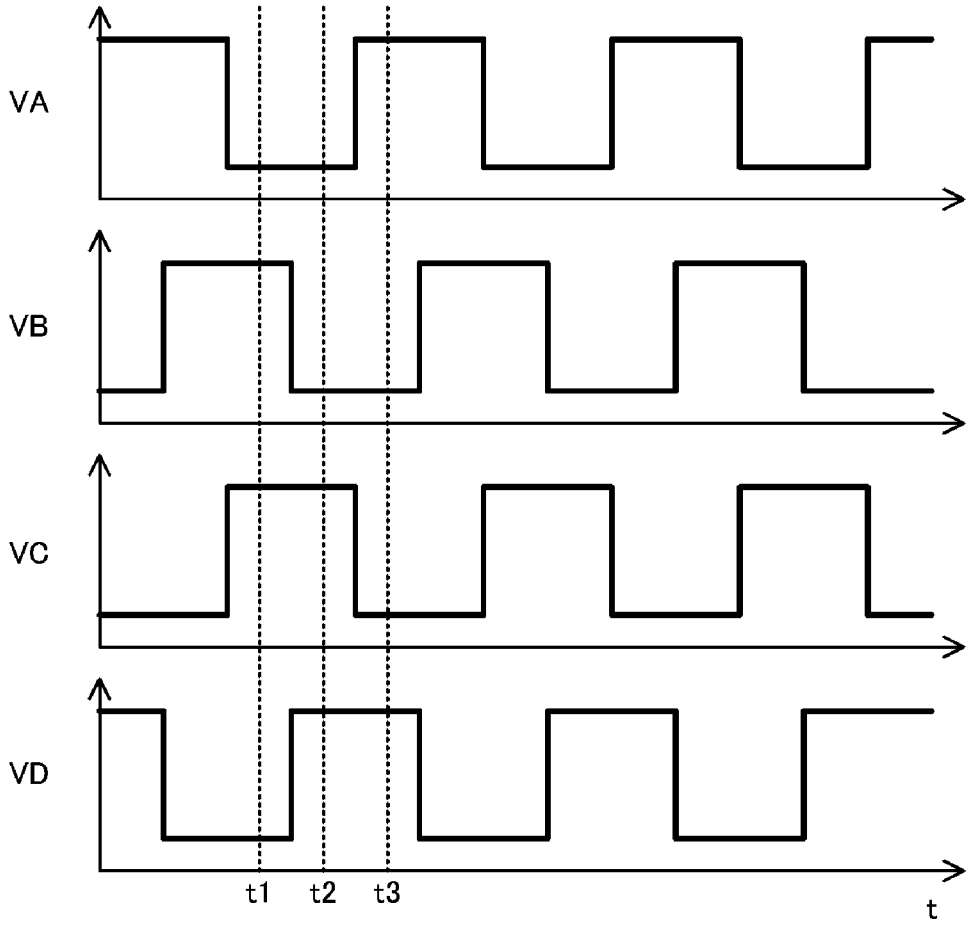
FIG. 4 is a set of graphs showing waveforms of voltages generated by power supply circuits shown in FIG. 3.

FIG. 4 is a set of graphs showing waveforms of voltages generated by the power supply circuits VA to VD shown in FIG. 3. As shown in FIG. 4, the power supply circuits VA to VD are configured to generate AC voltages of substantially the same waveform.

The waveforms of voltages generated by the power supply circuits VA to VD shift 90° in phase from one another. An unillustrated control circuit controls the power supply circuits VA to VD such that, in the sequence of the power supply circuits VA to VD, the phase of voltage delays in increments of 90°.

Referring to FIGS. 2 and 3, the toner electric-field transport body 132 is configured to be able to transport the toner T as follows. Transport voltages as shown in FIG. 4 are applied to the transport electrodes 133*a* of the transport wiring substrate 133, thereby generating traveling-wave electric fields along the toner transport direction TTD. By this procedure, the positively charged toner T can be transported in the toner transport direction TTD.

Referring to FIGS. 1 and 2, the counter wiring substrate 135 is attached to the above-described recess formed on the inner surface of the casing top cover 131*a* at a position corresponding to the developing-section counter plate 131*a*1. That is, the counter wiring substrate 135 is supported on the inner wall surface of the developing-section counter plate 131*a*1 having the developing opening portion 131*a*2, in such a manner as to face the toner transport surface 133*b* with a predetermined gap therebetween.

The counter wiring substrate 135 has a configuration similar to that of the above-described transport wiring substrate 133.

That is, as shown in FIG. 3, the counter electrodes 135*a* are formed of a copper foil having a thickness of about several tens of micrometers. The counter electrodes 135*a* are formed in a strip-like wiring pattern such that their longitudinal direction becomes parallel with the main scanning direction (orthogonal to the sub-scanning direction). The plurality of counter electrodes 135*a* are disposed in parallel with one another.

These counter electrodes 135*a* are arrayed along the predetermined toner transport direction TTD (along the sub-scanning direction). The counter electrodes 135*a* are connected to power supply circuits such that every fourth counter electrode 135*a* is connected to the same power supply circuit.

The counter wiring substrate 135 also includes a counter-electrode support substrate 135*c* and a counter-electrode coating layer 135*d*.

The counter-electrode support substrate 135*c* is a flexible film of an electrically insulative synthetic resin, such as polyimide resin. The counter electrodes 135*a* are provided on the lower surface of the counter-electrode support substrate 135*c* in FIG. 3.

The counter-electrode coating layer 135*d* is provided on the lower surface of the counter-electrode support substrate 135*c* on which the counter electrodes 135*a* are formed.

The counter-electrode coating layer 135*d* is provided to cover the counter electrodes 135*a*. The counter-electrode coating layer 135*d* covers the counter-electrode support substrate 135*c* and the counter electrodes 135*a*, thereby making the toner transport surface 135*b* smooth.

Like the above-described transport wiring substrate 133, the counter wiring substrate 135 is configured to be able to transport the toner T as follows. Predetermined voltages are applied to the plurality of counter electrodes 135*a*, thereby generating traveling-wave electric fields along the toner transport direction TTD. By this procedure, the positively charged toner T can be transported in the toner transport direction TTD.

<<Transfer Section>>

Referring again to FIG. 1, a transfer section 140 is provided in such a manner as to face the image carrying surface 121*b*1 at a position located downstream, with respect to the direction of rotation of the photoconductor drum 121, of the position where the photoconductor drum 121 and the developing apparatus 130 face each other.

The transfer section 140 includes a rotary center shaft 141, which is a roller-like member and is made of a metal, and a semiconductive rubber layer 142, which is circumferentially provided on the rotary center shaft 141.

The rotary center shaft 141 is disposed in parallel with the main scanning direction (the z-axis direction in FIG. 1). A high-voltage power supply is connected to the rotary center shaft 141. The semiconductive rubber layer 142 is formed of a synthetic rubber containing carbon black or the like kneadingly mixed thereinto such that the rubber layer exhibits semiconductivity.

The transfer section 140 is configured to be able to transfer the toner T from the image carrying surface 121*b*1 to the paper P by means of being rotatably driven counterclockwise while a predetermined transfer voltage is applied between the transfer section 140 and the drum body 121*a* of the photoconductor drum 121.

<<Paper Feed Cassette>>

A paper feed cassette 150 is disposed under the developing apparatus 130.

A paper feed cassette case 151 is a box-like member used to form the casing of the paper feed cassette 150 and opens upward. The paper feed cassette case 151 is configured to be able to contain a large number of sheets of the paper P of up to size A4 (210 mm width×297 mm length) in a stacked state.

A paper-pressing plate 153 is disposed within the paper feed cassette case 151. The paper-pressing plate 153 is supported by the paper feed cassette case 151 in such a manner as to pivotally move on a pivot at its front end portion, so that its rear end can move vertically in FIG. 1. An unillustrated spring urges the rear end portion of the paper-pressing plate 153 upward.

<<Paper Transport Section>>

A paper transport section 160 is housed within the body casing 112. The paper transport section 160 is configured to be able to feed the paper P to a transfer position TP where the transfer section 140 and the image carrying surface 121*b*1 face each other with a smallest gap therebetween. The paper transport section 160 includes a paper feed roller 161, a paper guide 163, and paper transport guide rollers 165.

The paper feed roller 161 includes a rotary center shaft parallel to the main scanning direction and a rubber layer, which is circumferentially provided on the rotary center shaft. The paper feed roller 161 is disposed in such a manner as to face a leading end portion, with respect to the paper transport direction, of the paper P stacked on the paper-pressing plate 153 housed within the paper feed cassette case 151. The paper guide 163 and the paper transport guide rollers 165 are configured to be able to guide to the transfer position TP the paper P which has been delivered by the paper feed roller 161.

<<Fixing Section>>

A fixing section 170 is housed within the body casing 112. The fixing section 170 is disposed downstream of the transfer position TP with respect to the paper transport direction.

The fixing section 170 is configured to apply pressure and heat to the paper P which has passed the transfer position TP and bears an image in the toner T, thereby fixing the image in the toner T on the paper P. The fixing section 170 includes a heating roller 172 and a pressure roller 173.

The heating roller 172 includes a cylinder which is made of a metal and whose surface is exfoliation-treated, and a halogen lamp which is housed within the cylinder. The pressure roller 173 includes a rotary center shaft which is made of a metal, and a silicone rubber layer which is circumferentially provided on the rotary center shaft. The heating roller 172 and the pressure roller 173 are disposed in such a manner as to press against each other under a predetermined pressure.

The heating roller 172 and the pressure roller 173 are configured and disposed so as to be able to deliver the paper P toward the paper ejection port 112*a* while applying pressure and heat to the paper P.

<Outline of Image Forming Operation of the Laser Printer>

The outline of an image forming operation of the laser printer 100 having such a configuration will next be described with reference to the drawings.

<<Paper Feed Operation>>

Referring to FIG. 1, the paper-pressing plate 153 urges the paper P stacked thereon upward toward the paper feed roller 161. This causes the top paper P of a stack of the paper P on the paper-pressing plate 153 to come into contact with the circumferential surface of the paper feed roller 161.

When the paper feed roller 161 is rotatably driven clockwise in FIG. 1, a leading end portion with respect to the paper transport direction of the top paper P is moved toward the paper guide 163. Then, the paper guide 163 and the paper transport guide rollers 165 transport the paper P to the transfer position TP.

<<Formation of Toner Image on Image Carrying Surface>>

While the paper P is being transported to the transfer position TP as described above, an image in the toner T is formed as described below on the image carrying surface 121*b*1, which is the circumferential surface of the photoconductor drum 121.

<<<Formation of Electrostatic Latent Image>>>

First, the charger 123 uniformly charges a portion of the image carrying surface 121*b*1 of the photoconductor drum 121 to positive polarity.

Referring to FIG. 3, as a result of the clockwise rotation of the photoconductor drum 121, the portion of the image carrying surface 121*b*1 which has been charged by the charger 123 moves along the sub-scanning direction to the scanning position SP, where the portion of the image carrying surface 121*b*1 faces (faces straight toward) the scanner unit 122.

At the scanning position SP, the charged portion of the image carrying surface 121*b*1 is irradiated with the laser beam LB modulated on the basis of image information, while the laser beam LB sweeps along the main scanning direction. Certain positive charges are lost from the charged portion of the image carrying surface 121*b*1, according to a state of modulation of the laser beam LB. By this procedure, an electrostatic latent image LI in the form of an imagewise distribution of positive charges is formed on the image carrying surface 121*b*1.

As a result of the clockwise rotation of the photoconductor drum 121 in FIG. 3, the electrostatic latent image LI formed on the image carrying surface 121*b*1 moves toward the developing position DP.

<<<Fluidization of Toner>>>

Referring to FIG. 2, as a result of the predetermined AC voltage being output to the casing bottom plate 131*b* from the unillustrated power supply unit, the casing bottom plate 131*b* vibrates.

By means of the vibration of the casing bottom plate 131*b*, the toner T stored within the developing casing 131 is vibrated. The vibrated toner T is fluidized so that the toner T behaves like a liquid. Hereinafter, the ensemble of the fluidized toner T at a lower portion of the developing casing 131 will be referred to as the "toner pool."

<<<Transport of Charged Toner>>>

Referring to FIG. 2, predetermined voltages (similar to those shown in FIG. 4) are applied to the counter wiring substrate 135, thereby forming predetermined traveling-wave electric fields on the counter wiring substrate 135.

Thus, the sufficiently fluidized toner T at a rear end portion of the above-described toner pool (the toner T which is to be transported on the counter wiring substrate 135 and the transport wiring substrate 133) is transported, by means of the traveling-wave electric fields, from a furthest upstream portion (located at the lower left side in FIG. 2), with respect to the toner transport direction TTD, of the counter wiring substrate 135 to a position where a rear end portion of the transport wiring substrate 133 and the counter wiring substrate 135 face each other, in such a manner that the toner T moves up along the sloped portion of the toner transport surface 135*b*.

In the case where the furthest upstream portion is covered with the toner T (toner pool), the transport is started from a position where the transport wiring substrate 133 is exposed from the toner T (toner pool).

The toner T residing between the transport wiring substrate 133 and the counter wiring substrate 135 is transported toward the developing position DP (the developing opening portion 131*a*2) by the effect of traveling-wave electric fields generated along the toner transport surface 133*b* of transport wiring substrate 133 and the toner transport surface 135*b* of the counter wiring substrate 135.

The toner T having passed through the developing position DP falls down from a frontmost end portion of the toner transport surface 133*b*, so that the toner T returns to the above-described toner pool.

Toner-T-transporting operation effected by the counter wiring substrate 135 is similar to that effected by the transport wiring substrate 133. Thus, the toner-T-transporting operation effected by the transport wiring substrate 133 will be described below in detail.

Figure 5:
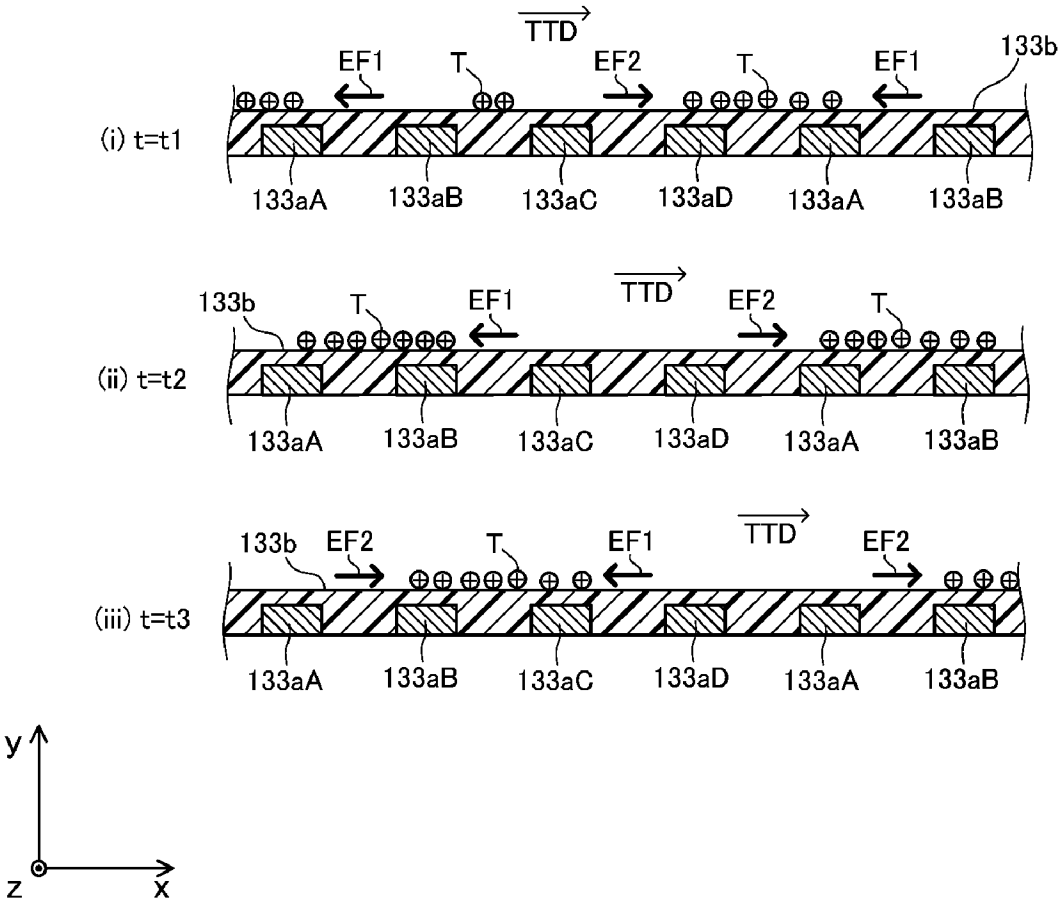
FIG. 5 is a set of side sectional views, each showing, on an enlarged scale, the vicinity of a toner transport surface of a transport wiring substrate shown in FIG. 3.

FIG. 5 is an enlarged side sectional view showing the toner transport surface 133*b* of the transport wiring substrate 133 shown in FIG. 3, and its periphery. Notably, the transport electrodes 133*a* connected to the power supply circuit VA in FIG. 3 are represented as transport electrodes 133*a*A in FIG. 5. This convention applies to transport electrodes 133*a*B through 133*a*D.

Referring to FIGS. 4 and 5, at time t1 in FIG. 4, an electric field EF1 directed opposite the toner transport direction TTD (directed opposite the x direction in FIG. 5) is formed in a section AB between the transport electrode 133*a*A and the transport electrode 133*a*B, as shown in FIG. 5(*i*).

Meanwhile, an electric field EF2 directed in the toner transport direction TTD (the x direction in FIG. 5) is formed in a section CD between the transport electrode 133*a*C and the transport electrode 133*a*D.

No electric field directed along the toner transport direction TTD is formed in a BC section between the transport electrode 133*a*B and the transport electrode 133*a*C and in a DA section between the transport electrode 133*a*D and the transport electrode 133*a*A.

That is, at time t1, the positively charged toner T in the sections AB is subjected to electrostatic force directed opposite the toner transport direction TTD. The positively charged toner T in the sections BC and DA is hardly subjected to electrostatic force directed along the toner transport direction TTD. The positively charged toner T in the CD sections is subjected to electrostatic force directed in the toner transport direction TTD.

Thus, at time t1, the positively charged toner T is collected in the DA sections.

Similarly, at time t2, the positively charged toner T is collected in the sections AB. When time t3 is reached, the positively charged toner T is collected in the sections BC.

In this manner, areas where the toner T is collected move with time in the toner transport direction TTD along the toner transport surface 133*b*.

<<<Development of Electrostatic Latent Image>>>

Referring to FIG. 3, the positively charged toner T is transported to the developing position DP as described above.

In the vicinity of the developing position DP, the toner T adheres to portions of the electrostatic latent image LI on the image carrying surface 121*b*1 at which positive charges are lost. That is, the electrostatic latent image LI on the image carrying surface 121*b*1 of the photoconductor drum 121 is developed with the toner T. Thus, an image in the toner T is carried on the image carrying surface 121*b*1.

<<Transfer of Toner Image from Image Carrying Surface to Paper>>

Referring to FIG. 1, as a result of clockwise rotation of the image carrying surface 121*b*1, an image in the toner T which has been carried on the image carrying surface 121*b*1 of the photoconductor drum 121 as described above is transported toward the transfer position TP. At the transfer position TP, the image in the toner T is transferred from the image carrying surface 121*b*1 onto the paper P.

<<Fixing and Ejection of Paper>>

The paper P onto which an image in the toner T has been transferred at the transfer position TP is sent to the fixing section 170 along the paper path PP.

The paper P is nipped between the heating roller 172 and the pressure roller 173, thereby being subjected to pressure and heat. By this procedure, the image in the toner T is fixed on the paper P. Subsequently, the paper P is sent to the paper ejection port 112*a* and is then ejected onto the catch tray 114 through the paper ejection port 112*a*.

<Actions and Effects Achieved by the Configuration of the Embodiment>

According to the configuration of the present embodiment, the toner T within the developing casing 131 to be transported on the toner transport surface 133*b* is vibrated by means of vibrating the casing bottom plate 131*b*. As a result, the toner T is fluidized. Stresses, such as compressive force and shearing force, acting on the toner T at that time are very small.

Therefore, by virtue of such a configuration, the toner T to be transported on the toner transport surface 133*b* is fluidized more satisfactorily within the developing casing 131. As a result, the toner T can be supplied to the toner transport surface 133*b* more uniformly. Thus, the toner T can be transported more uniformly on the toner transport surface 133*b*.

As described above, the configuration of the present embodiment renders more uniform the transport of the toner T on the toner transport surface 133*b* by means of the traveling-wave electric fields and the supply of the toner T to the developing position DP. Accordingly, generation of density non-uniformity can be effective suppressed, whereby satisfactory image formation becomes possible.

In the configuration of the present embodiment, the structure for vibrating the toner T within the developing casing 131 is provided at least at a position near the furthest upstream portion of the toner transport surface 133*b* with respect to the toner transport direction TTD.

By virtue of such a configuration, the toner T near the furthest upstream portion of the toner transport surface 133*b* with respect to the toner transport direction TTD is fluidized satisfactorily. Thus, the satisfactorily-fluidized toner T is supplied to the furthest upstream portion. Therefore, the transport of the toner T on the toner transport surface 133*b* can be performed as uniformly as possible.

In the configuration of the present embodiment, the structure for vibrating the toner T within the developing casing 131 corresponds not only to a position near the furthest upstream portion of the toner transport surface 133*b* with respect to the toner transport direction TTD, but also to substantially the entire space in which the toner T can be stored within the developing casing 131.

By virtue of such a configuration, substantially the entirety of the toner T within the developing casing 131 is fluidized satisfactorily by means of vibration. Therefore, the toner T within the developing casing 131 is uniformly provided for transport on the toner transport surface 133*b*.

Accordingly, it is possible to suppress, to the greatest possible extent, deterioration of a portion of the toner T which portion would otherwise be frequently transported on the toner transport surface 133*b*.

In the configuration of the present embodiment, the structure for vibrating the toner T within the developing casing 131 is formed by the casing bottom plate 131*b*, which serves as the bottom plate of the developing casing 131.

Therefore, in the present embodiment, the toner T within the developing casing 131 can be fluidized satisfactorily by employment of a very simple apparatus structure.

In the configuration of the present embodiment, the structure for vibrating the toner T within the developing casing 131 is provided at a position corresponding to the lowest portion of the developing casing 131.

By virtue of such a configuration, even when the storage amount of the toner T within the developing casing 131 decreases, the toner T at the bottom portion of the developing casing 131 can be vibrated satisfactorily. Thus, even in such a case, the transfer of the toner T to the developing position DP can be performed satisfactorily.

Accordingly, by virtue of such a configuration, even when the storage amount of the toner T within the developing casing 131 decreases, satisfactory formation of an image by the toner T can be performed.

In the configuration of the present embodiment, the structure (the casing bottom plate 131*b*) for vibrating the toner T within the developing casing 131 is located adjacent to the furthest upstream portion of the counter wiring substrate 135 with respect to the toner transport direction TTD.

By virtue of such a configuration, the transport state of the toner T can be made more uniform at the beginning of the transport of the toner T performed by the counter wiring substrate 135 through use of the traveling-wave electric fields.

Moreover, in the configuration of the present embodiment, the structure for vibrating the toner T within the developing casing 131 is located adjacent to the furthest upstream portion of a region in which the toner T is transported by the transport wiring substrate 133 and the counter wiring substrate 135 through use of the traveling-wave electric fields.

By virtue of such a configuration, the transport state of the toner T can be made more uniform at the beginning of the transport of the toner T performed by use of the traveling-wave electric fields.

<Modifications>

As mentioned previously, the above-described embodiment is a mere example of a typical embodiment of the present invention which the applicant contemplated as the best at the time of filing the present application. The present invention is not limited to the above-described embodiment. Various modifications to the above-described embodiment are possible, so long as the invention is not modified in essence.

Various modifications will next be exemplified. In the following description of the modifications, members similar in structure and function to those used in the above-described embodiment are denoted by the same reference numerals as those of the above-described embodiment. As for the description of these members, an associated description appearing in the description of the above embodiment can be cited, so long as no technical inconsistencies are involved.

Needless to say, modifications are not limited to those exemplified below. Also, the plurality of modifications can be combined as appropriate, so long as no technical inconsistencies are involved.

The above-described embodiment and the following modifications should not be construed as limiting the present invention (particularly, those components which partially constitute the means for solving the problems to be solved by the invention and are described operationally and functionally).

Such limiting construal unfairly impairs the interests of an applicant (who is motivated to file as quickly as possible under the first-to-file system) while unfairly benefiting imitators, is contrary to the purpose of the patent law which promotes protection and utilization of inventions, and is thus impermissible.

(1) No particular limitation is imposed on the configurations of the toner electric-field transport body 132, the transport wiring substrate 133, and the counter wiring substrate 135 in the above-described embodiment.

For example, the transport electrodes 133*a* can be embedded in the transport-electrode support substrate 133*c* so as not to project from the surface of the transport-electrode support substrate 133*c*. The transport-electrode coating layer 133*d* can be omitted. The transport electrodes 133*a* can be formed directly on the transport-substrate support member 134.

The counter electrodes 135*a* can also be, for example, embedded in the counter-electrode support substrate 135*c* so as not to project from the surface of the counter-electrode support substrate 135*c*. The counter-electrode coating layer 135*d* can be omitted. The counter electrodes 135*a* can be formed directly on the inner wall surface of the developing casing 131.

The longitudinal direction of the transport electrodes 133*a* and that of the counter electrodes 135*a* may be in parallel with the main scanning direction as in the case of the above-described embodiment or may intersect with the main scanning direction. The direction of arraying the transport electrodes 133*a* and that of arraying the counter electrodes 135*a* may be in parallel with the sub-scanning direction as viewed in plane as in the case of the above-described embodiment or may intersect with the sub-scanning direction as viewed in plane.

No particular limitation is imposed on the transport electrodes 133*a* and the counter electrodes 135*a* with respect to shape and the configuration of electrical connections. For example, in place of the form of a straight line as in the case of the above-described embodiment, the transport electrodes 133*a* and the counter electrodes 135*a* can assume various other forms, such as V-shaped, arc, waves, and serrated.

The pattern of connecting the electrodes is not limited to that of connecting every fourth electrode as in the case of the above-described embodiment. For example, every other electrode or every third electrode may be connected. In this case, the corresponding power circuits are not of four kinds, but can be modified as appropriate such that the phase shift of voltage waveforms is 180°, 120°, etc. Furthermore, the voltage waveform can be rectangular waves, sine waves, and waves of various other shapes.

(2) The present invention is not limited to the configuration of the above-described embodiment in which the entire casing bottom plate 131*b* vibrates.

For example, a portion for vibrating the toner T (the developer vibrating section of the present invention) may be provided at least at a position facing the toner electric-field transport body 132.

Figure 6:
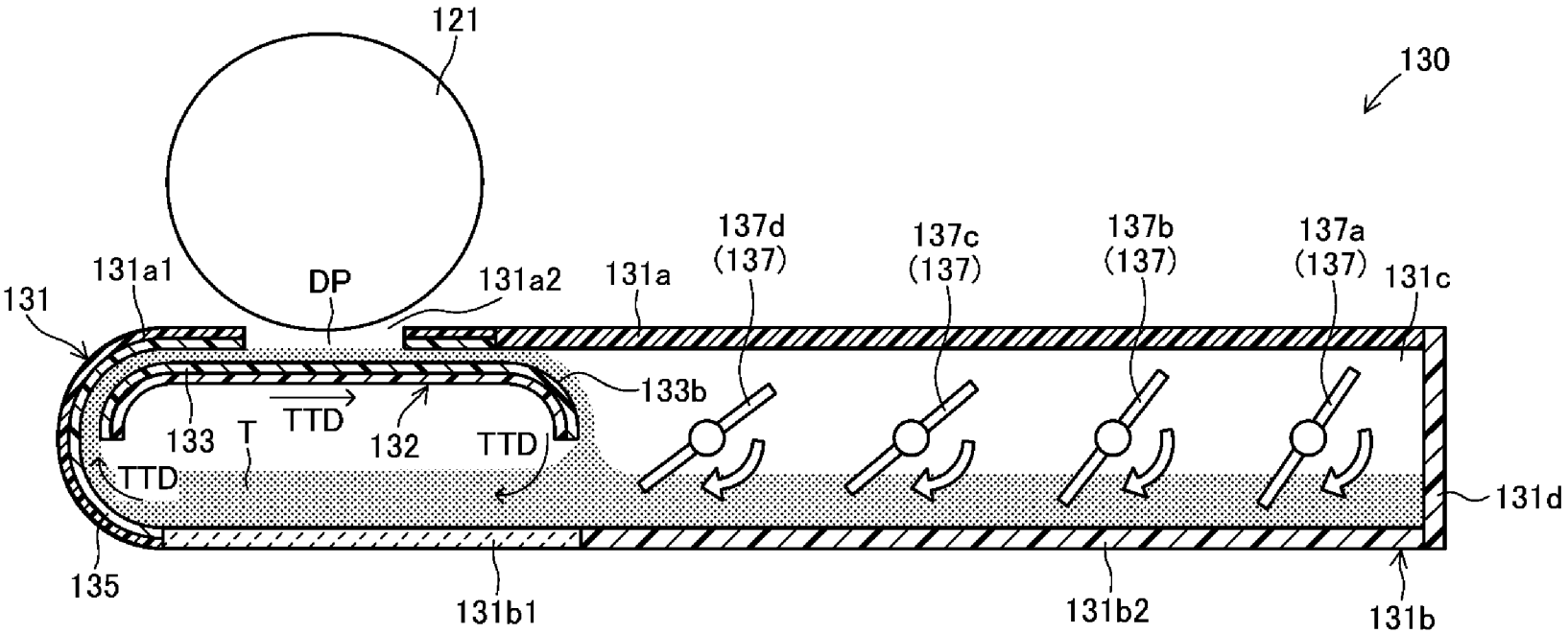
FIG. 6 is a side sectional view showing the configuration of one modification of the developing apparatus shown in FIG. 2.

FIG. 6 is a side sectional view showing one modification of the developing apparatus 130 shown in FIG. 2.

Referring to FIG. 6, in the present modification, the above-described half-pipe portion, which is the rear end portion of the casing top cover 131*a* (the developing-section counter plate 131*a*1), is formed into a generally semi-cylindrical shape.

Further, a vibrating section 131*b*1, which corresponds to the developer vibrating section of the present invention, is formed in a rear portion of the casing bottom plate 131*b* such that the vibrating section 131*b*1 faces the toner electric-field transport body 132. As in the case of the above-described embodiment, the vibrating section 131*b*1 is formed from a piezoelectric ceramic.

In the present modification, a front end portion of the vibrating section 131*b*1 is provided at a position corresponding to a front end portion of the toner electric-field transport body 132. Further, a rear end portion of the vibrating section 131*b*1 is provided at a position slightly separated from the furthest upstream portion of the toner transport surface 133*b* with respect to the toner transport direction TTD.

The length of the vibrating section 131*b*1 as measured along the front-rear direction is set such that the length becomes approximately equal to that of the toner electric-field transport body 132. That is, the vibrating section 131*b*1 is provided below the toner electric-field transport body 132.

The remaining portion (a front portion) of the casing bottom plate 131*b* in which the vibrating section 131*b*1 is not provided serves as a non-vibrating section 131*b*2.

By virtue of such a configuration, the vibrating section 131*b*1 vibrates the toner T in the vicinity of the toner electric-field transport body 132. As a result, the toner T to be transported on the toner transport surface 133*b* is fluidized satisfactorily by means of vibration generated by the vibrating section 131*b*1. Thus, the satisfactorily fluidized toner T can be supplied to the furthest upstream portion of the toner transport surface 133*b* with respect to the toner transport direction TTD. Accordingly, the transport of the toner T on the toner transport surface 133*b* can be rendered uniform satisfactorily.

Figure 7:
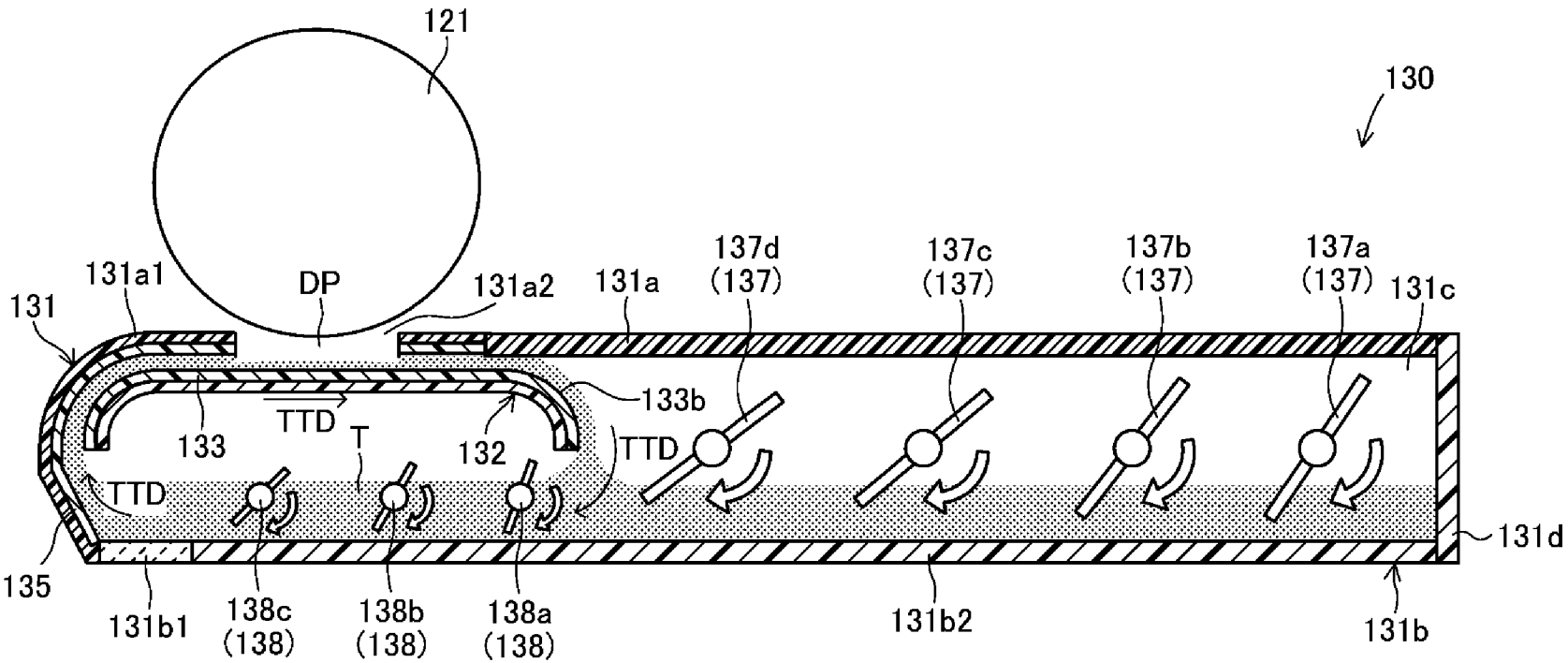
FIG. 7 is a side sectional view showing the configuration of another modification of the developing apparatus shown in FIG. 2.
Figure 8:
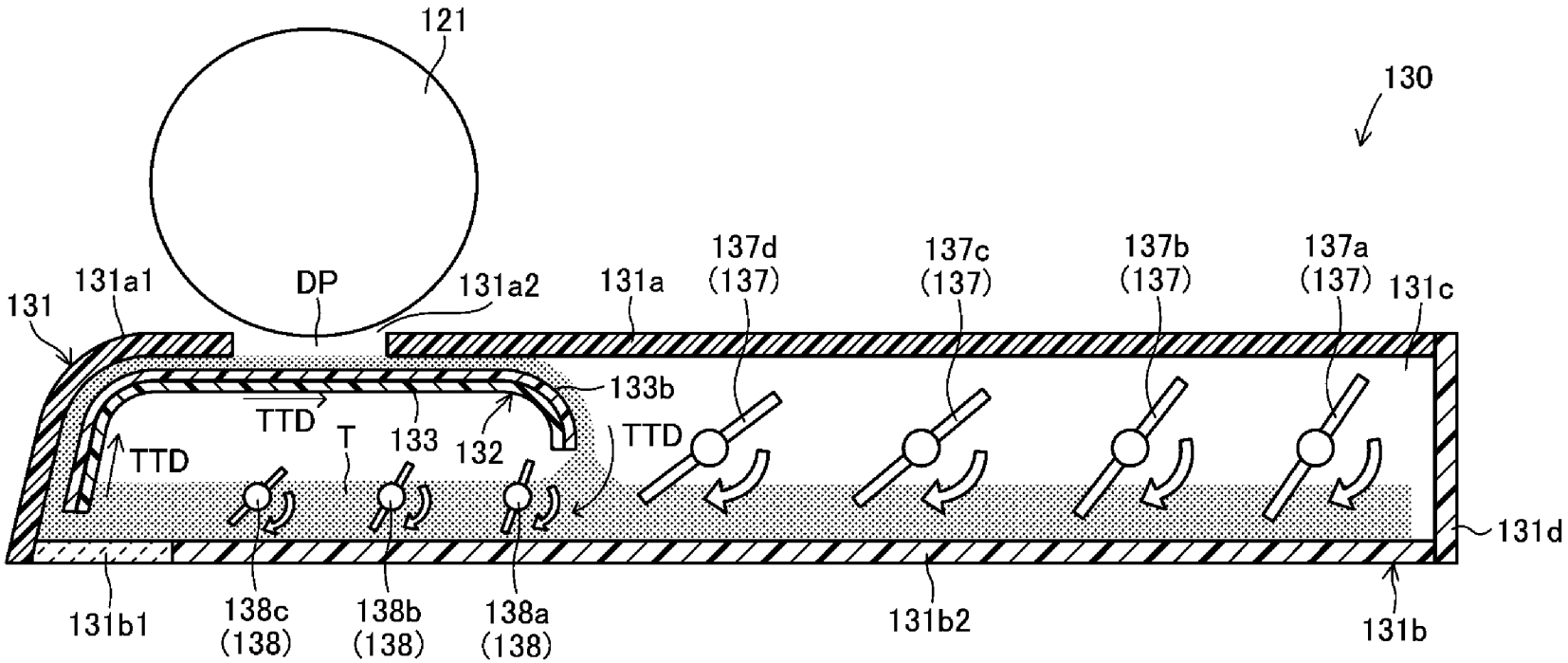
FIG. 8 is a side sectional view showing the configuration of another modification of the developing apparatus shown in FIG. 2.

FIGS. 7 and 8 are side sectional views showing other modifications of the developing apparatus 130 shown in FIG. 2.

In the modification shown in FIG. 7, like the structure of the above-described embodiment shown in FIG. 2, a lower end portion of the rear side of the casing top cover 131*a* is formed to have a slope which slopes downward toward the front side and toward the rear end portion of the casing bottom plate 131*b*, as viewed in the side sectional view.

Further, the vibrating section 131*b*1 is provided at a rearmost end portion of the casing bottom plate 131*b* such that the vibrating section 131*b*1 is connected to the lower end portion of the rear side of the casing top cover 131*a*.

In the modification shown in FIG. 8, the lower end portion of the rear side of the casing top cover 131*a* is formed to have a slope which slopes downward toward the rear side and toward the rear end portion of the casing bottom plate 131*b*, as viewed in the side sectional view. As in the above-described modification, the vibrating section 131*b*1 is provided at the rearmost end portion of the casing bottom plate 131*b* such that the vibrating section 131*b*1 is connected to the lower end portion of the rear side of the casing top cover 131*a*.

That is, as shown in FIGS. 7 and 8, in these modifications, the vibrating section 131*b*1 is provided only at a position near the furthest upstream portion (a left-side lower end portion in these drawings) of the toner electric-field transport body 132 (the transport wiring substrate 133) with respect to the toner transport direction TTD. Specifically, the vibrating section 131*b*1 is provided immediately below the furthest upstream portion of the toner electric-field transport body 132 (the transport wiring substrate 133) with respect to the toner transport direction TTD.

Further, in FIG. 8, the vibrating section 131*b*1 is provided such that, with respect the horizontal direction, it overlaps the furthest upstream portion of the toner transport surface 133*b* with respect to the toner transport direction TTD.

Further, in FIG. 8, the vibrating section 131*b*1 is provided such that it faces the furthest upstream portion of the toner transport surface 133*b* with respect to the toner transport direction TTD.

In these configurations, the toner T at a position corresponding to the furthest upstream portion of the toner transport surface 133*b* with respect to the toner transport direction TTD is fluidized satisfactorily. The satisfactorily fluidized toner T is supplied to the furthest upstream portion of the toner transport surface 133*b*. As a result, the transport of the toner T at the furthest upstream portion of the toner transport surface 133*b* can be made uniform. Accordingly, the transport of the toner T on the toner transport surface 133*b* and the supply of the toner T to the developing position DP can be performed uniformly with the non-uniformity being reduced further.

Notably, in the configurations shown in FIGS. 6 to 8, the vibrating section 131*b*1 may be provided such that the vibrating section 131*b*1 corresponds (is located in close proximity or adjacent) only to the furthest upstream portion of the counter wiring substrate 135 (the toner transport surface 135*b*) with respect to the toner transport direction TTD. That is, the vibrating section 131*b*1 may be provided at a position (e.g., a position located diagonally in relation to the toner electric-field transport body 132 and the toner transport surface 133*b*) separated from the toner electric-field transport body 132 (the toner transport surface 133*b*), and also provided such that the vibrating section 131*b*1 corresponds to the counter wiring substrate 135 (the toner transport surface 135*b*).

(3) As shown in FIG. 6, at least one agitator 137, which serves as an agitating member, may be provided within the developing casing 131. The agitator 137 is rotatably supported within the developing casing 131.

In such a configuration, even when the agitator 137 is not rotated violently, fluidization of the toner T within the developing casing 131 can be performed satisfactorily.

In the case where the casing bottom plate 131*b* has the non-vibrating section 131*b*2, the agitator 137 is preferably provided at a position corresponding to the non-vibrating section 131*b*2, as shown in FIG. 6.

By virtue of such a configuration, when the amount of the toner pool on the vibrating section 131*b*1 decreases, the toner T can be added to the toner pool in a small amount at a time by means of rotating the agitator 137. Since the excess toner T continuously stored within the developing casing 131 is agitated, deterioration of the toner T can be suppressed to the greatest possible extent.

Notably, in order to decrease the frequency of maintenance by increasing the amount of the excess toner T, the developing casing 131 may be formed such that its length as measured along the front-rear direction becomes sufficiently greater than that of the toner electric-field transport body 132 (e.g., at least two times that of the toner electric-field transport body 132). In such a case, a plurality of agitators 137 may be provided.

In the configuration of FIG. 6, four agitators 137 are provided; i.e., an upstream agitator 137*a*, a first intermediate agitator 137*b*, a second intermediate agitator 137*c*, and a downstream agitator 137*d*.

In such a configuration, the drive states of the upstream agitator 137*a*, the first intermediate agitator 137*b*, the second intermediate agitator 137*c*, and the downstream agitator 137*d* are properly controlled in accordance with the degree of consumption of the toner T within the developing casing 131.

For example, when the degree of consumption of the toner T is small (in an initial stage), the upstream agitator 137*a*, the first intermediate agitator 137*b*, and the second intermediate agitator 137*c* are stopped continuously; and only the downstream agitator 137*d* is properly rotated in accordance with the degree of decrease in the amount of the toner pool.

As the degree of consumption of the toner T within the developing casing 131 increases, the number of the agitators 137, which are rotated in response to a decrease in the amount of the toner pool, is increased. That is, the number of the rotated agitators 137 is increased in such a manner that in a second stage the second intermediate agitator 137*c* and the downstream agitator 137*d* are rotated; in a third stage the first intermediate agitator 137*b*, the second intermediate agitator 137*c*, and the downstream agitator 137*d* are rotated; and in a final stage all the agitators 137 are rotated.

(4) The agitating members such as agitators may be provided at positions located away from the toner electric-field transport body 132 as shown in FIG. 6, or at positions corresponding to the toner electric-field transport body 132 (below the toner electric-field transport body 132).

Further, as shown in FIG. 7, in addition to the agitators 137 provided at positions located away from the toner electric-field transport body 132, a sub-agitator 138, which is smaller in size than the agitators 137, may be provided at a position corresponding to the toner electric-field transport body 132 (below the toner electric-field transport body 132).

In this case, preferably, the sub-agitator 138 is provided below a downstream portion of the toner electric-field transport body 132 with respect to the toner transport direction TTD.

By virtue of this configuration, a portion of the toner T returned from the downstream portion of the toner electric-field transport body 132 with respect to the toner transport direction TTD can be agitated satisfactorily. Thus, that portion of the toner T is supplied satisfactorily to the furthest upstream portion (the lower end portion in FIG. 7) of the counter wiring substrate 135 with respect to the toner transport direction TTD.

Further, a plurality of sub-agitators 138 may be provided, as shown in FIG. 7.

In the configuration of FIG. 7, three sub-agitators 138 are provided; i.e., an upstream sub-agitator 138*a*, an intermediate sub-agitator 138*b*, and a downstream sub-agitator 138*c*. These sub-agitators 138 are properly rotated in accordance with the degree of decrease in the amount of the toner pool in a manner similar to that in the above-described example.

Further, in the case where, as shown in FIG. 7, the vibrating section 131*b*1 of the casing bottom plate 131*b* is formed only in a region corresponding to an upstream portion of the toner electric-field transport body 132 with respect to the toner transport direction TTD, a sub-agitator 138 (or a plurality of sub-agitators 138) is provided above a portion of the non-vibrating section 131*b*2, the portion being located below the toner electric-field transport body 132; and an agitator 137 (a plurality of agitators 137) is provided above a portion of the non-vibrating section 131*b*2, which portion does not correspond to the toner electric-field transport body 132.

By virtue of such a configuration, through fine control of rotations of the agitators 137 and the sub-agitators 138 in accordance with the amount of the toner T within the developing casing 131 and the amount of the toner pool, the state of supply of the toner T to the toner electric-field transport body 132 can be optimized further.

(5) The material of the casing bottom plate 131*b* (the vibrating section 131*b*1) is not limited to piezoelectric ceramic. For example, a synthetic resin or a like material which exhibits piezoelectric properties may be preferably used.

(6) The counter wiring substrate 135 may be omitted partially or entirely. FIG. 8 is a side sectional view showing such a modification (or a modification of the developing apparatus 130 of the modification shown in FIG. 7).

In this case, as shown in FIG. 8, preferably, the end portion (the left-side lower end portion in FIG. 8) of the toner electric-field transport body 132 (the transport wiring substrate 133) located on the furthest upstream side with respect to the toner transport direction TTD extends downward to such a position that the end portion is immersed into the toner pool substantially at all times.

(7) The developer transport body of the present invention should not be construed as being limited to the toner electric-field transport body 132. That is, for example, depending on the structure of the developing apparatus 130, the counter wiring substrate 135 may serve as the developer transport body of the present invention.

Figure 9:
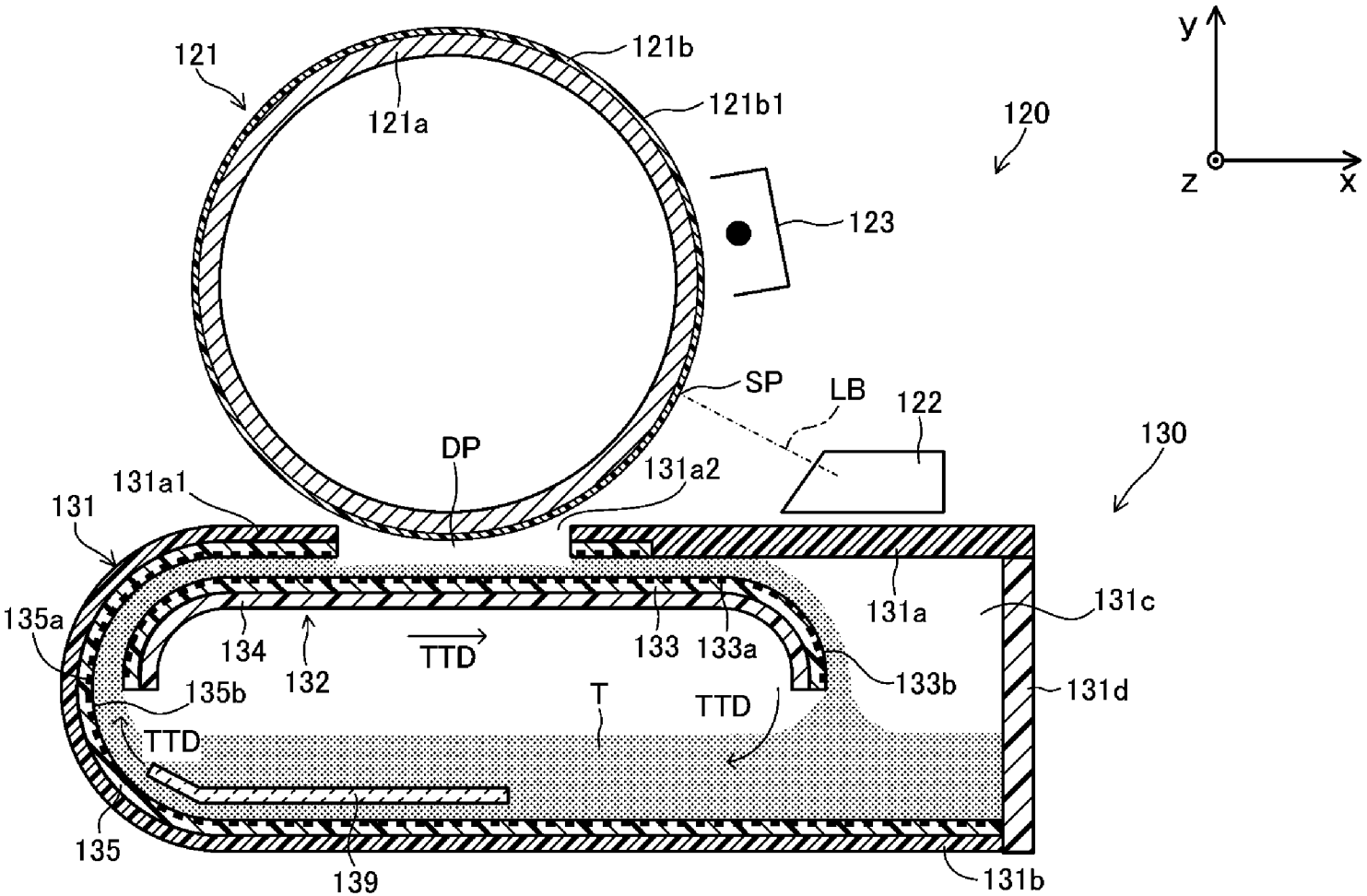
FIG. 9 is a side sectional view showing the configuration of another modification of the developing apparatus shown in FIG. 2.

(8) FIG. 9 is a side sectional view showing another modification of the developing apparatus 130 shown in FIG. 2.

As shown in FIG. 9, a vibration plate 139, which is a vibration member, may be disposed within the developing casing 131. The vibration plate 139 is configured such that the vibration plate 139 vibrates upon application of an AC voltage being output from an unillustrated power supply unit. The vibration plate 139 is separated from the toner electric-field transport body 132 and the inner wall surface (the toner transport surface 135*b* of the counter wiring substrate 135) at the bottom portion of the developing casing 131.

As shown in FIG. 9, a rear end portion (a left end portion in FIG. 9) of the vibration plate 139 may be provided at a position near the furthest upstream portion of the toner transport surface 133*b* with respect to the toner transport direction TTD. That is, the rear end portion of the vibration plate 139 may be provided at a position corresponding to the furthest upstream portion of the toner transport surface 133*b* with respect to the toner transport direction TTD.

Further, as shown in FIG. 9, the vibration plate 139 may be provided such that the vibration plate 139 faces a rear (about half) portion, with respect to the front-rear direction, of the casing bottom plate 131*b* (which does not constitute the developer vibrating section in the present modification).

In such a configuration, the vibration plate 139, which vibrates, is separated from the developing casing 131 and the toner electric-field transport body 132. Therefore, vibration generated by the vibration plate 139 is not transmitted directly to the developing casing 131 and the toner electric-field transport body 132.

Accordingly, such a configuration can suppress, to the greatest possible extent, change in a predetermined positional relation between the image carrying surface 121*b*1 and the toner transport surface 133*b* at the developing position DP, which change would otherwise occur due to vibration of the vibration plate 139. Thus, adverse influence on development of an electrostatic latent image by the operation of rendering uniform the state of transport of toner on the toner transport surface 133*b* can be suppressed to the greatest possible extent.

[1-2]

<Overall Configuration of Second Laser Printer>

Figure 10:
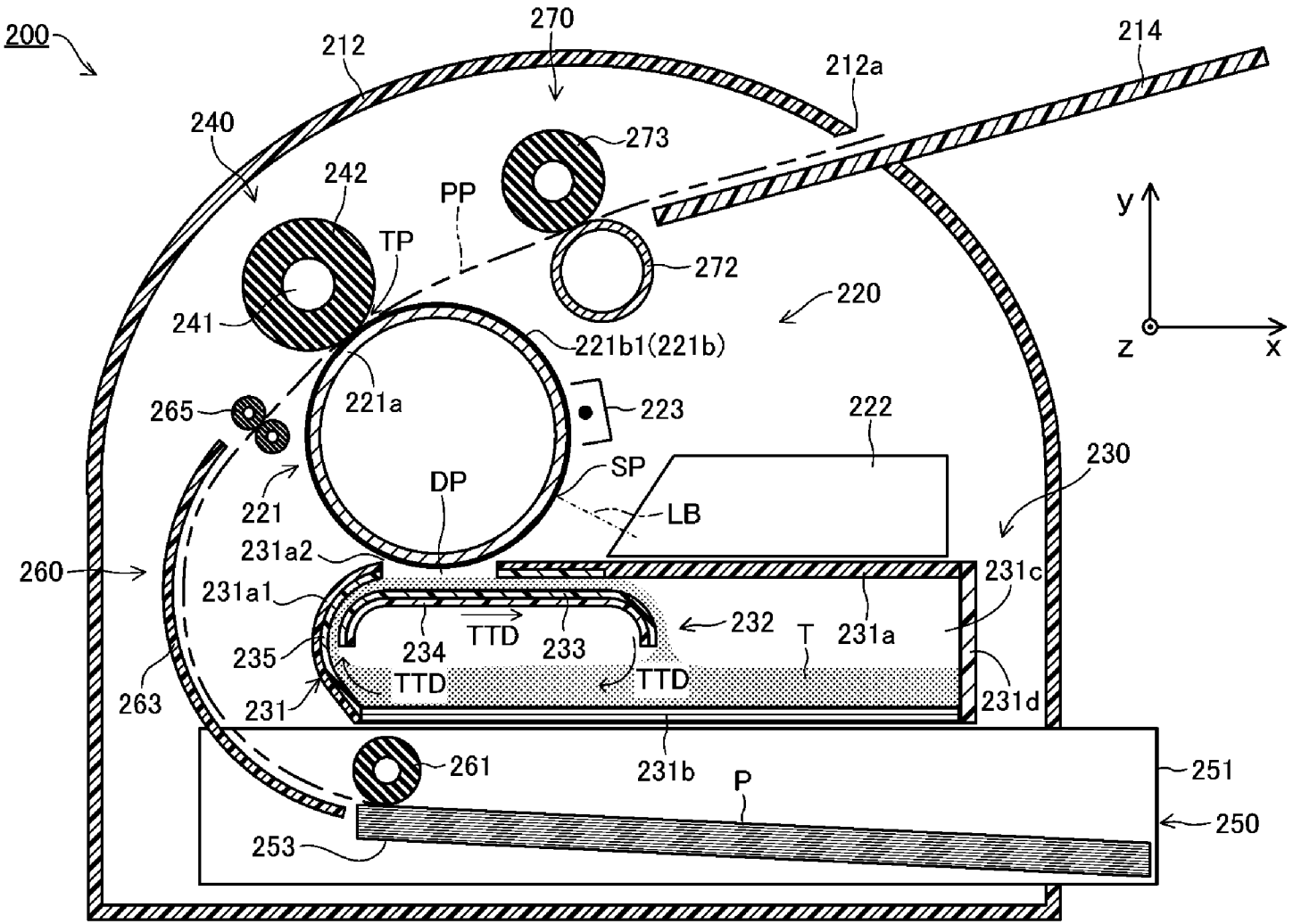
FIG. 10 is a side sectional view showing the schematic configuration of a laser printer to which a second embodiment of the present invention is applied.

FIG. 10 is a side sectional view showing the schematic configuration of a laser printer 200 to which the second embodiment of the present invention is applied.

<<Body Section>>

Referring to FIG. 10, the laser printer 200, which corresponds to the image forming apparatus of the present invention, includes a body casing 212. The body casing 212 is a member which constitutes an outer cover of the laser printer 200, and is integrally formed from a synthetic resin plate. The body casing 212 has a paper ejection port 212*a* in the form of a slit-like through-hole located at an upper front portion thereof.

A catch tray 214 is attached to an upper front portion of the body casing 212 at a position corresponding to the paper ejection port 212*a*. The catch tray 214 is configured to receive the paper P which is ejected through the paper ejection port 212*a* and on which an image has been formed.

<<Electrostatic-Latent-Image Forming Section>>

The body casing 212 houses an electrostatic-latent-image forming section 220. The electrostatic-latent-image forming section 220 includes a photoconductor drum 221, which corresponds to the electrostatic-latent-image carrying body and the developer carrying body of the present invention.

The photoconductor drum 221 is a generally cylindrical member and is disposed such that its center axis of rotation is in parallel with the paper width direction. The photoconductor drum 221 is configured to be able to be rotatably driven clockwise in FIG. 10.

Specifically, the photoconductor drum 221 includes a drum body 221*a* and a photoconductor layer 221*b*.

The drum body 221*a* is a metal tube of an aluminum alloy or the like. The photoconductor layer 221*b* is a positively chargeable photoconductive layer, and is formed on the outer circumference of the drum body 221*a*.

The photoconductor drum 221 has an image carrying surface 221*b*1, which corresponds to the latent-image forming surface and the developer carrying surface of the present invention. The circumferential surface of the photoconductor layer 221*b* serves as the image carrying surface 221*b*1.

The image carrying surface 221*b*1 is formed in parallel with the paper width direction and a main scanning direction, which will be described later. The image carrying surface 221*b*1 is configured such that an electrostatic latent image can be formed by electric-potential distribution.

That is, the photoconductor drum 221 is configured such that the image carrying surface 221*b*1 can move along a sub-scanning direction, which is orthogonal to the main scanning direction and will be described later.

The electrostatic-latent-image forming section 220 includes a scanner unit 222 and a charger 223.

The scanner unit 222 is configured and disposed such that the image carrying surface 221*b*1 can be irradiated at a predetermined scanning position SP with a laser beam LB having the above-described predetermined wavelength and modulated on the basis of image information. The laser beam LB is caused to sweep along the main scanning direction (the z-axis direction in FIG. 10) parallel to the paper width direction.

The charger 223 is disposed upstream of the scanning direction SP with respect to the direction of movement of the image carrying surface 221*b*1 (direction of rotation of the photoconductor drum 221). The charger 223 is configured and disposed so as to be able to uniformly, positively charge the image carrying surface 221*b*1 at a position located upstream of the scanning position SP with respect to the above-mentioned direction.

The electrostatic-latent-image forming section 220 is configured such that the scanner unit 222 irradiates, with the laser beam LB, the image carrying surface 221*b*1 which is uniformly, positively charged by the charger 223, whereby an electrostatic latent image by electric-potential distribution (charge distribution) can be formed on the image carrying surface 221*b*1.

The electrostatic-latent-image forming section 220 is configured to be able to move the image carrying surface 221*b*1 on which an electrostatic latent image is formed, along the sub-scanning direction, which will be described later.

The "sub-scanning direction" is an arbitrary direction orthogonal to the main scanning direction. Usually, the sub-scanning direction is a direction which intersects with a vertical line. Typically, the sub-scanning direction may be a direction along the front-rear direction of the laser printer 200 (the x-axis direction in FIG. 10).

<<Developing Apparatus>>

The body casing 212 houses a developing apparatus 230, which corresponds to the developer supply apparatus of the present invention. The developing apparatus 230 is disposed in such a manner as to face the photoconductor drum 221 at a development facing position DP (developing position).

The developing apparatus 230 is configured such that it stores a toner T, which is a dry developer in the form of fine particles (powder developer), and can transport the toner T while circulating it along a toner transport direction TTD, as indicated by arrows in FIG. 10.

That is, the toner transport direction TTD is a direction tangent to a circulating transport path at an arbitrary point. The circulating transport path is formed within the developing apparatus 230 such that the path assumes a generally oval shape as viewed in a side sectional view, and the toner T circulates along the circulating transport path.

The developing apparatus 230 is configured and disposed as described below so as to be able to supply the image carrying surface 221*b*1 on which an electrostatic latent image is formed, with the toner T in a charged state in the vicinity of the development facing position DP. Notably, the toner T used in the present embodiment is a non-magnetic 1-component developer for use in electrophotography.

Figure 11:
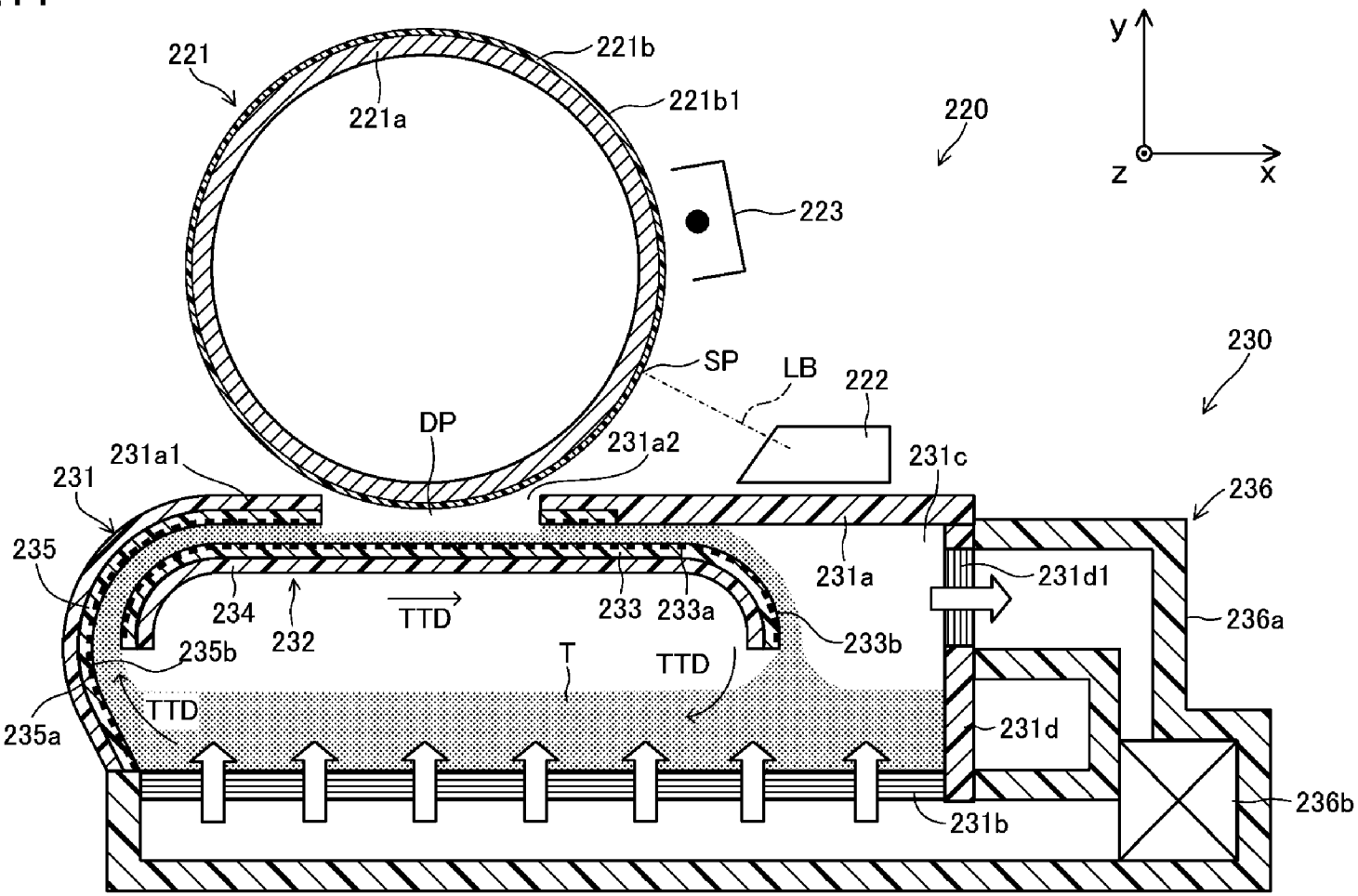
FIG. 11 is an enlarged side sectional view showing an electrostatic-latent-image forming section and a developing apparatus shown in FIG. 10.

FIG. 11 is an enlarged side sectional view showing the electrostatic-latent-image forming section 220 and the developing apparatus 230 shown in FIG. 10.

Referring to FIGS. 10 and 11, the developing apparatus 230 is disposed below the photoconductor drum 221 in such a manner as to face the image carrying surface 221*b*1 at a position located downstream of the scanning position SP with respect to the direction of movement of the image carrying surface 221*b*1.

<<<Developing Casing>>>

A developing casing 231, which corresponds to the developer containing casing of the present invention, is a box-like member and is configured to be able to contain the toner T therein without leaking the toner T to the outside.

A developing-section counter plate 231*a*1 is a rear portion of a casing top cover 231*a*, which serves as the top plate of the developing casing 231. The developing-section counter plate 231*a*1 is formed to have a generally J-like shape in a side sectional view.

That is, the developing-section counter plate 231*a*1 is composed of a flat plate portion which is located below the photoconductor drum 221 and disposed generally horizontally, and a half-pipe portion connected to a rear end of the flat plate portion. A lower end portion of the half-pipe portion is formed to have a slope which slopes downward toward the front side.

The developing-section counter plate 231*a*1 is thinner than the remaining portion of the casing top cover 231*a*. That is, a recess is formed on an inner surface of the casing top cover 231*a* at a position corresponding to the developing-section counter plate 231*a*1.

A developing opening portion 231*a*2, which corresponds to the opening portion of the present invention, is formed in the flat plate portion of the developing-section counter plate 231*a*1. The developing opening portion 231*a*2 is provided in the developing-section counter plate 231*a*1 at a position facing the image carrying surface 221*b*1 such that the developing opening portion 231*a*2 surrounds the development facing position DP.

A casing bottom plate 231*b*, which corresponds to the gas-permeable bottom plate of the present invention, is a flat-plate-like member which serves as the bottom plate of the developing casing 231. This casing bottom plate 231*b* is configured to prevent passage of the toner T therethrough and permit passage of air therethrough. Specifically, the casing bottom plate 231*b* is formed of a porous ceramic.

The average diameter of openings of the porous ceramic that constitutes the casing bottom plate 231*b* is set to be smaller than a $-2\sigma$, where "a" is a number-average particle size of the toner T and $\sigma$ is a standard deviation.

That is, the casing bottom plate 231*b* is configured such that, under the assumption that the particle size distribution of the toner T is Gaussian, the amount of the toner T which can pass through the casing bottom plate 231*b* is very small (less than about 2.28% of the total amount of the toner T (on calculation)).

(Notably, it is generally rare that pores of the porous ceramic penetrate straight the porous ceramic in the thickness direction thereof. Therefore, even when the porous ceramic has the above-described opening diameter, in actuality, the toner T hardly leaks downward through the casing bottom plate 231*b*.)

A rear end portion (a left end portion in FIG. 11) of the casing bottom plate 231*b* is connected to the lower end of the half-pipe portion of the casing top cover 231*a*. That is, the casing bottom plate 231*b* and the casing top cover 231*a* are formed integrally with each other in such a manner as to have a cross-sectional shape resembling the letter U at the rear end portion of the developing casing 231.

A pair of casing side plates 231*c* are closingly attached to the opposite ends, with respect to the paper width direction, of the casing top cover 231*a* and to those of the casing bottom plate 231*b*. Also, a casing front closing plate 231*d* is closingly attached to the front end of the casing top cover 231*a*, to that of the casing bottom plate 231*b*, and to those of the paired casing side plates 231*c*.

Referring to FIG. 11, a gas-permeable closing plate 231*d*1, which is an upper portion of the casing front closing plate 231*d*, is formed from a porous ceramic plate. A lower portion of the casing front closing plate 231*d* in which the gas-permeable closing plate 231*d*1 is not provided is formed from a non-porous synthetic rein plate.

That is, the exhaust port of the present invention is constituted by the gas-permeable closing plate 231*d*1, which is the porous ceramic portion formed in the upper portion of the casing front closing plate 231*d*. The gas-permeable closing plate 231*d*1 is formed in the upper portion of the developing casing 231 at a position most separated from the developing opening portion 231*a*2.

<<<Developer Electric-Field Transport Body>>>

Referring to FIG. 11, the developing casing 231 houses a toner electric-field transport body 232, which corresponds to the developer transport body of the present invention. That is, the toner electric-field transport body 232 is enclosed within the developing casing 231.

The toner electric-field transport body 232 is disposed in the inner space of the developing casing 231 at a rearward position, in such a manner as to face the image carrying surface 221*b*1 with the developing opening portion 231*a*2 therebetween. That is, the toner electric-field transport body 232 is provided such that the photoconductor drum 221 and the toner electric-field transport body 232 face each other with the developing opening portion 231*a*2 therebetween.

The opposite ends of the toner electric-field transport body 232 are supported by the paired casing side plates 231*c* in such a manner that the toner electric-field transport body 232 is supported at a position located above the casing bottom plate 231*b* while facing the developing-section counter plate 231*a*1 with a predetermined gap therebetween.

Figure 12:
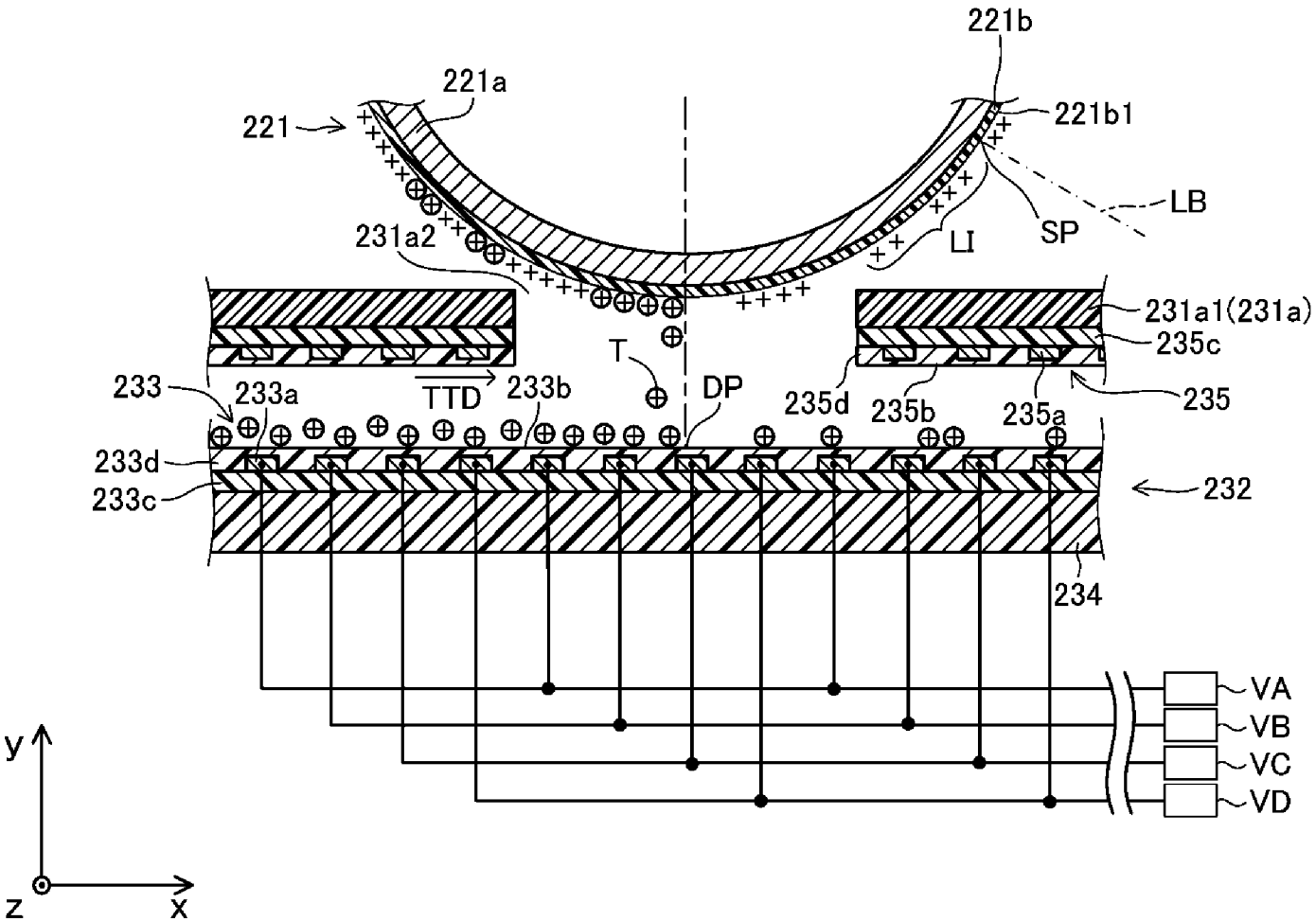
FIG. 12 is an enlarged side sectional view showing a developing opening portion and its periphery of a developer electric-field transport body shown in FIG. 11.

FIG. 12 is an enlarged side sectional view showing a portion of the toner electric-field transport body 232 (shown in FIG. 11) in the vicinity of the developing opening portion 231*a*2. Referring to FIGS. 11 and 12, the toner electric-field transport body 232 includes the transport wiring substrate 233. The transport wiring substrate 233 is disposed in such a manner as to face the image carrying surface 221*b*1 with the developing opening portion 231*a*2 therebetween.

Referring to FIG. 12, the transport wiring substrate 233 has a structure similar to that of a flexible printed wiring board, and includes a plurality of transport electrodes 233*a*.

The transport electrodes 233*a* are disposed along the toner transport surface 233*b*, which corresponds to the developer transport surface of the present invention.

The toner transport surface 233*b* is an upper surface of the transport wiring substrate 233 in FIG. 12, which surface faces the photoconductor drum 221. Further, the toner transport surface 233*b* is a surface of the transport wiring substrate 233, which surface faces the image carrying surface 221*b*1.

The toner transport surface 233*b* is formed in parallel with the main scanning direction (the z-direction in FIG. 12). The toner transport surface 233*b* and the image carrying surface 221*b*1 are in the closest proximity to each other at the development facing position DP.

The transport electrodes 233*a* are disposed in the vicinity of the toner transport surface 233*b*.

The transport electrodes 233*a* are formed of a copper foil having a thickness of about several tens of micrometers. The transport electrodes 233*a* are formed in a strip-like wiring pattern such that their longitudinal direction becomes parallel with the main scanning direction (orthogonal to the sub-scanning direction).

The plurality of transport electrodes 233*a* are disposed in parallel with one another. These transport electrodes 233*a* are arrayed along the toner transport direction TTD (along the sub-scanning direction).

The large number of transport electrodes 233*a* arrayed along the sub-scanning direction are connected to power supply circuits such that every fourth transport electrode 233*a* is connected to the same power supply circuit.

That is, the transport electrode 233*a* connected to a power supply circuit VA, the transport electrode 233*a* connected to a power supply circuit VB, the transport electrode 233*a* connected to a power supply circuit VC, the transport electrode 233*a* connected to a power supply circuit VD, the transport electrode 233*a* connected to the power supply circuit VA, the transport electrode 233*a* connected to the power supply circuit VB, . . . , are sequentially arrayed along the sub-scanning direction.

The transport wiring substrate 233 also includes a transport-electrode support substrate 233*c* and a transport-electrode coating layer 233*d*.

The transport-electrode support substrate 233*c* is a flexible film of an electrically insulative synthetic resin, such as polyimide resin. The transport electrodes 233*a* are provided on the upper surface of the transport-electrode support substrate 233*c*.

The transport-electrode coating layer 233*d* is provided on the upper surface of the transport-electrode support substrate 233*c* on which the transport electrodes 233*a* are formed.

The transport-electrode coating layer 233*d* is provided to cover the transport electrodes 233*a*. The transport-electrode coating layer 233*d* covers the transport-electrode support substrate 233*c* and the transport electrodes 233*a*, thereby making the toner transport surface 233*b* smooth.

Referring to FIGS. 11 and 12, the toner electric-field transport body 232 includes a transport-substrate support member 234. The transport-substrate support member 234 is provided so as to support the transport wiring substrate 233 from underneath.

Referring to FIG. 11, a rear end portion of the transport-substrate support member 234 is curved downward along the casing top cover 231*a* of the developing casing 231. Also, a front end portion of the transport-substrate support member 234 is curved downward in a manner similar to that of the rear end portion. A portion of the transport-substrate support member 234 between the above-mentioned front and rear portions assumes the form of a generally flat plate.

That is, the transport-substrate support member 234 is formed in a shape resembling the inverted letter U as viewed from the lateral direction.

Referring to FIGS. 11 and 12, the toner electric-field transport body 232 is configured to be able to transport the toner T as follows. Transport voltages as shown in FIG. 4 are applied to the transport electrodes 233*a* of the transport wiring substrate 233, thereby generating traveling-wave electric fields along the toner transport direction TTD. By this procedure, the positively charged toner T can be transported in the toner transport direction TTD.

Referring to FIGS. 10 and 11, the counter wiring substrate 235 is attached to the above-described recess formed on the inner surface of the casing top cover 231*a* at a position corresponding to the developing-section counter plate 231*a*1. That is, the counter wiring substrate 235 is supported on the inner wall surface of the developing-section counter plate 231*a*1 having the developing opening portion 231*a*2, in such a manner as to face the toner transport surface 233*b* with a predetermined gap therebetween.

The counter wiring substrate 235 has a configuration similar to that of the above-described transport wiring substrate 233.

That is, as shown in FIG. 12, the counter electrodes 235*a* are formed of a copper foil having a thickness of about several tens of micrometers. The counter electrodes 235*a* are formed in a strip-like wiring pattern such that their longitudinal direction becomes parallel with the main scanning direction (orthogonal to the sub-scanning direction). The plurality of counter electrodes 235*a* are disposed in parallel with one another.

These counter electrodes 235*a* are arrayed along the toner transport direction TTD (along the sub-scanning direction). The counter electrodes 235*a* are connected to power supply circuits such that every fourth counter electrode 235*a* is connected to the same power supply circuit.

The counter wiring substrate 235 also includes a counter-electrode support substrate 235*c* and a counter-electrode coating layer 235*d*.

The counter-electrode support substrate 235*c* is a flexible film of an electrically insulative synthetic resin, such as polyimide resin. The counter electrodes 235*a* are provided on the lower surface of the counter-electrode support substrate 235*c* in FIG. 12.

The counter-electrode coating layer 235*d* is provided on the lower surface of the counter-electrode support substrate 235*c* on which the counter electrodes 235*a* are formed.

The counter-electrode coating layer 235*d* is provided to cover the counter electrodes 235*a*. The counter-electrode coating layer 235*d* covers the counter-electrode support substrate 235*c* and the counter electrodes 235*a*, thereby making the toner transport surface 235*b* smooth.

Like the above-described transport wiring substrate 233, the counter wiring substrate 235 is configured to be able to transport the toner T as follows. Predetermined voltages are applied to the plurality of counter electrodes 235*a*, thereby generating traveling-wave electric fields along the toner transport direction TTD. By this procedure, the positively charged toner T can be transported in the toner transport direction TTD.

Referring to FIG. 11, in the present embodiment, the furthest upstream portion of the counter wiring substrate 235 with respect to the toner transport direction TTD is provided adjacent to the casing bottom plate 231*b* having gas permeability.

That is, in the present embodiment, the casing bottom plate 231*b* having gas permeability is provided such that it corresponds to the furthest upstream portion of a region in which the toner T is transported by the transport wiring substrate 233 and the counter wiring substrate 235 through use of the traveling-wave electric fields.

<<<Air Circulation Apparatus>>>

Referring to FIG. 11, the developing apparatus 230 includes an air circulation apparatus 236, which serves as the gas supply section and exhaust section of the present invention.

The air circulation apparatus 236 is configured in such a manner as to fluidize the toner T within the developing casing 231 by blowing air into the developing casing 231 via the gas-permeable casing bottom plate 231*b*.

Further, the air circulation apparatus 236 is configured in such a manner as to exhaust air within the developing casing 231.

Specifically, the air circulation apparatus 236 is composed of an air circulation passage 236*a* and a pump 236*b*.

The air circulation passage 236*a*, which serves as the gas circulation passage of the present invention, is configured to air-tightly connect the gas-permeable closing plate 231*d*1 and the casing bottom plate 231*b* together externally of the developing casing 231. The pump 236*b* is interposed in the air circulation passage 236*a*.

The air circulation apparatus 236 is configured such that, when the pump 236*b* is driven, air within the developing casing 231 is exhausted via the gas-permeable closing plate 231*d*1, and is returned to the interior of the developing casing 231 via the casing bottom plate 231*b* having gas permeability.

<<Transfer Section>>

Referring again to FIG. 10, a transfer section 240 is provided in such a manner as to face the image carrying surface 221*b*1 at a position located downstream, with respect to the direction of rotation of the photoconductor drum 221, of the position where the photoconductor drum 221 and the developing apparatus 230 face each other.

The transfer section 240 includes a rotary center shaft 241, which is a roller-like member and is made of a metal, and a semiconductive rubber layer 242, which is circumferentially provided on the rotary center shaft 241.

The rotary center shaft 241 is disposed in parallel with the main scanning direction (the z-axis direction in FIG. 10). A high-voltage power supply is connected to the rotary center shaft 241. The semiconductive rubber layer 242 is formed of a synthetic rubber containing carbon black or the like kneadingly mixed thereunto such that the rubber layer exhibits semiconductivity.

The transfer section 240 is configured to be able to transfer the toner T from the image carrying surface 221*b*1 to the paper P by means of being rotatably driven counterclockwise while a predetermined transfer voltage is applied between the transfer section 240 and the drum body 221*a* of the photoconductor drum 221.

<<Paper Feed Cassette>>

A paper feed cassette 250 is disposed under the developing apparatus 230.

A paper feed cassette case 251 is a box-like member used to form the casing of the paper feed cassette 250 and opens upward. The paper feed cassette case 251 is configured to be able to contain a large number of sheets of the paper P of up to size A4 (210 mm width×297 mm length) in a stacked state.

A paper-pressing plate 253 is disposed within the paper feed cassette case 251. The paper-pressing plate 253 is supported by the paper feed cassette case 251 in such a manner as to pivotally move on a pivot at its front end portion, so that its rear end can move vertically in FIG. 10. An unillustrated spring urges the rear end portion of the paper-pressing plate 253 upward.

<<Paper Transport Section>>

A paper transport section 260 is housed within the body casing 212.

The paper transport section 260 is configured to be able to feed the paper P to a transfer position TP where the transfer section 240 and the image carrying surface 221*b*1 face each other with a smallest gap therebetween. The paper transport section 260 includes a paper feed roller 261, a paper guide 263, and paper transport guide rollers 265.

The paper feed roller 261 includes a rotary center shaft parallel to the main scanning direction and a rubber layer, which is circumferentially provided on the rotary center shaft. The paper feed roller 261 is disposed in such a manner as to face a leading end portion, with respect to the paper transport direction, of the paper P stacked on the paper-pressing plate 253 housed within the paper feed cassette case 251.

The paper guide 263 and the paper transport guide rollers 265 are configured to be able to guide to the transfer position TP the paper P which has been delivered by the paper feed roller 261.

<<Fixing Section>>

A fixing section 270 is housed within the body casing 212. The fixing section 270 is disposed downstream of the transfer position TP with respect to the paper transport direction.

The fixing section 270 is configured to apply pressure and heat to the paper P which has passed the transfer position TP and bears an image in the toner T, thereby fixing the image in the toner T on the paper P. The fixing section 270 includes a heating roller 272 and a pressure roller 273.

The heating roller 272 includes a cylinder which is made of a metal and whose surface is exfoliation-treated, and a halogen lamp which is housed within the cylinder.

The pressure roller 273 includes a rotary center shaft which is made of a metal, and a silicone rubber layer which is circumferentially provided on the rotary center shaft. The heating roller 272 and the pressure roller 273 are disposed in such a manner as to press against each other under a predetermined pressure.

The heating roller 272 and the pressure roller 273 are configured and disposed so as to be able to deliver the paper P toward the paper ejection port 212*a* while applying pressure and heat to the paper P.

<Outline of Image Forming Operation of the Laser Printer>

The outline of an image forming operation of the laser printer 200 having such a configuration will next be described with reference to the drawings.

<<Paper Feed Operation>>

Referring to FIG. 10, the paper-pressing plate 253 urges the paper P stacked thereon upward toward the paper feed roller 261. This causes the top paper P of a stack of the paper P on the paper-pressing plate 253 to come into contact with the circumferential surface of the paper feed roller 261.

When the paper feed roller 261 is rotatably driven clockwise in FIG. 10, a leading end portion with respect to the paper transport direction of the top paper P is moved toward the paper guide 263. Then, the paper guide 263 and the paper transport guide rollers 265 transport the paper P to the transfer position TP.

<<Formation of Toner Image on Image Carrying Surface>>

While the paper P is being transported to the transfer position TP as described above, an image in the toner T is formed as described below on the image carrying surface 221*b*1, which is the circumferential surface of the photoconductor drum 221.

<<<Formation of Electrostatic Latent Image>>>

First, the charger 223 uniformly charges a portion of the image carrying surface 221*b*1 of the photoconductor drum 221 to positive polarity.

Referring to FIG. 12, as a result of the clockwise rotation of the photoconductor drum 221, the portion of the image carrying surface 221*b*1 which has been charged by the charger 223 moves along the sub-scanning direction to the scanning position SP, where the portion of the image carrying surface 221*b*1 faces (faces straight toward) the scanner unit 222.

At the scanning position SP, the charged portion of the image carrying surface 221*b*1 is irradiated with the laser beam LB modulated on the basis of image information, while the laser beam LB sweeps along the main scanning direction. Certain positive charges are lost from the charged portion of the image carrying surface 221*b*1, according to a state of modulation of the laser beam LB. By this procedure, an electrostatic latent image LI in the form of an imagewise distribution of positive charges is formed on the image carrying surface 221*b*1.

As a result of the clockwise rotation of the photoconductor drum 221 in FIG. 12, the electrostatic latent image LI formed on the image carrying surface 221*b*1 moves toward the development facing position DP.

<<<Fluidization of Toner>>>

Referring to FIG. 11, as a result of the pump 236*b* of the air circulation apparatus 236 being driven, a flow of air is formed within the air circulation passage 236*a* such that air flows from the gas-permeable closing plate 231*d*1 toward the casing bottom plate 231*b*.

As a result, a negative pressure is generated in a space on the front side (the right side in FIG. 11) of the gas-permeable closing plate 231*d*1; that is, at the furthest upstream portion of the air circulation passage 236*a* with respect to the air flow direction. Due to this negative pressure, air within the developing casing 231 is exhausted to the air circulation passage 236*a* via the gas-permeable closing plate 231*d*1.

Meanwhile, the pump 236*b* feeds air into a space under the casing bottom plate 231*b*; that is, the furthest downstream portion of the air circulation passage 236*a*. As a result, air is blown into the lowest portion of the internal space of the developing casing 231 via the casing bottom plate 231*b*.

When air is blown from the lower side of the casing bottom plate 231*b* by means of the air circulation apparatus 236 as described above, the toner T stored in a lower portion of the internal space of the developing casing 231 is fluidized so that the toner T behaves like a liquid. Hereinafter, the ensemble of the fluidized toner T at the lower portion of the developing casing 231 will be referred to as the "toner pool."

<<<Transport of Charged Toner>>>

Referring to FIG. 11, predetermined voltages (similar to those shown in FIG. 4) are applied to the counter wiring substrate 235, thereby forming predetermined traveling-wave electric fields on the counter wiring substrate 235. Thus, the sufficiently fluidized toner T at a rear end portion of the above-described toner pool is transported, by means of the electric fields, from a furthest upstream portion (located at the lower left side in FIG. 11), with respect to the toner transport direction TTD, of the counter wiring substrate 235 to a position where a rear end portion of the transport wiring substrate 233 and the counter wiring substrate 235 face each other, in such a manner that the toner T moves up along the sloped portion of the toner transport surface 235*b*.

In the case where the furthest upstream portion is covered with the toner T (toner pool), the transport is started from a position where the transport wiring substrate 233 is exposed from the toner T (toner pool).

The toner T residing between the transport wiring substrate 233 and the counter wiring substrate 235 is transported toward the development facing position DP by the effect of traveling-wave electric fields generated along the toner transport surface 233*b* of transport wiring substrate 233 and the toner transport surface 235*b* of the counter wiring substrate 235.

The toner T having passed through the development facing position DP falls down from a frontmost end portion of the toner transport surface 233*b*, so that the toner T returns to the above-described toner pool.

<<<Development of Electrostatic Latent Image>>>

Referring to FIG. 12, the positively charged toner T is transported to the development facing position DP as described above.

In the vicinity of the development facing position DP, the toner T adheres to portions of the electrostatic latent image LI on the image carrying surface 221*b*1 at which positive charges are lost. That is, the electrostatic latent image LI on the image carrying surface 221*b*1 of the photoconductor drum 221 is developed with the toner T. Thus, an image in the toner T is carried on the image carrying surface 221*b*1.

<<Transfer of Toner Image from Image Carrying Surface to Paper>>

Referring to FIG. 10, as a result of clockwise rotation of the image carrying surface 221*b*1, an image in the toner T which has been carried on the image carrying surface 221*b* of the photoconductor drum 221 as described above is transported toward the transfer position TP.

At the transfer position TP, the image in the toner T is transferred from the image carrying surface 221*b*1 onto the paper P.

<<Fixing and Ejection of Paper>>

The paper P onto which an image in the toner T has been transferred at the transfer position TP is sent to the fixing section 270 along the paper path PP.

The paper P is nipped between the heating roller 272 and the pressure roller 273, thereby being subjected to pressure and heat. By this procedure, the image in the toner T is fixed on the paper P.

Subsequently, the paper P is sent to the paper ejection port 212*a* and is then ejected onto the catch tray 214 through the paper ejection port 212*a*.

<Actions and Effects Achieved by the Configuration of the Embodiment>

According to the configuration of the present embodiment, air is blown from the bottom portion of the developing casing 231 into the interior of the developing casing 231 via the gas-permeable casing bottom plate 231*b*.

As a result, the toner T is fluidized. Stresses, such as compressive force and shearing force, acting on the toner T at that time are very small.

By virtue of such a configuration, the toner T is fluidized more satisfactorily within the developing casing 231. Thus, the toner T can be supplied to the toner transport surface 233*b* more uniformly. The, the toner T can be transported on the transport surface 233*b* more uniformly.

As described above, the configuration of the present embodiment enables more uniform performance of the transport of the toner T on the toner transport surface 233*b* and the supply of the toner T to the development facing position DP by means of the traveling-wave electric fields. Accordingly, generation of density non-uniformity can be suppressed effectively, whereby satisfactory image formation becomes possible.

In the configuration of the present embodiment, the rear end portion of the gas-permeable casing bottom plate 231*b* is located at a position near the furthest upstream portion of the toner transport surface 233*b* with respect to the toner transport direction TTD. That is, in the configuration of the present embodiment, the gas-permeable casing bottom plate 231*b* is provided such that it corresponds to the furthest upstream portion of the toner transport surface 233*b* with respect to the toner transport direction TTD.

By virtue of such a configuration, the transport state of the toner T can be made uniform at the beginning of transport of the toner T on the toner transport surface 233*b* by means of traveling-wave electric fields.

Further, in the configuration of the present embodiment, the rear end portion of the casing bottom plate 231*b* is located adjacent to the furthest upstream portion of the counter wiring substrate 235 with respect to the toner transport direction TTD.

By virtue of such a configuration, the transport state of the toner T can be made uniform at the beginning of transport of the toner T on the toner transport surface 235*b* by means of traveling-wave electric fields.

Moreover, in the configuration of the present embodiment, the rear end portion of the gas-permeable casing bottom plate 231*b* is located adjacent to the furthest upstream portion of a region in which the toner T is transported by the transport wiring substrate 233 and the counter wiring substrate 235 through use of the traveling-wave electric fields.

By virtue of such a configuration, the transport state of the toner T can be made more uniform at the beginning of the transport of the toner T performed by use of the traveling-wave electric fields.

In the configuration of the present embodiment, the gas-permeable casing bottom plate 231*b* corresponds not only to a position near the furthest upstream portion of the toner transport surface 233*b* with respect to the toner transport direction TTD, but also to substantially the entire space in which the toner T can be stored within the developing casing 231.

By virtue of such a configuration, substantially the entirety of the toner T within the developing casing 231 is fluidized satisfactorily by means of blowing of air. Therefore, the toner T within the developing casing 231 is uniformly provided for transport on the toner transport surface 233*b*. Accordingly, it is possible to suppress, to the greatest possible extent, deterioration of a portion of the toner T which portion would otherwise be frequently transported on the toner transport surface 233*b*.

In the configuration of the present embodiment, by means of the air circulation apparatus 236, air is blown into the developing casing 231 via the casing bottom plate 231*b*, and air is exhausted from the developing casing 231 via the gas-permeable closing plate 231*d*1 provided at a location different from that of the developing opening portion 231*a*2.

By virtue of such a configuration, a negative pressure is generated within the developing casing 231 at a position separated from the developing opening portion 231*a*2.

Thus, when gas is blown into the developing casing 231 via the casing bottom plate 231*b*, spouting of the toner T from the developing opening portion 231*a*2 together with air can be suppressed effectively. That is, accidental leakage of the toner T from the developing casing 231 can be suppressed to the greatest possible extent.

<Modifications>

(1) No particular limitation is imposed on the configurations of the toner electric-field transport body 232, the transport wiring substrate 233, and the counter wiring substrate 235 in the above-described embodiment.

For example, the transport electrodes 233*a* can be embedded in the transport-electrode support substrate 233*c* so as not to project from the surface of the transport-electrode support substrate 233*c*. The transport-electrode coating layer 233*d* can be omitted. The transport electrodes 233*a* can be formed directly on the transport-substrate support member 234.

The counter electrodes 235*a* can also be, for example, embedded in the counter-electrode support substrate 235*c* so as not to project from the surface of the counter-electrode support substrate 235*c*. The counter-electrode coating layer 235*d* can be omitted. The counter electrodes 235*a* can be formed directly on the inner wall surface of the developing casing 231.

The longitudinal direction of the transport electrodes 233*a* and that of the counter electrodes 235*a* may be in parallel with the main scanning direction as in the case of the above-described embodiment or may intersect with the main scanning direction. The direction of arraying the transport electrodes 233*a* and that of arraying the counter electrodes 235*a* may be in parallel with the sub-scanning direction as viewed in plane as in the case of the above-described embodiment or may intersect with the sub-scanning direction as viewed in plane.

No particular limitation is imposed on the transport electrodes 233*a* and the counter electrodes 235*a* with respect to shape and the configuration of electrical connections. For example, in place of the form of a straight line as in the case of the above-described embodiment, the transport electrodes 233*a* and the counter electrodes 235*a* can assume various other forms, such as V-shaped, arc, waves, and serrated.

The pattern of connecting the electrodes is not limited to that of connecting every fourth electrode as in the case of the above-described embodiment. For example, every other electrode or every third electrode may be connected. In this case, the corresponding power circuits are not of four kinds, but can be modified as appropriate such that the phase shift of voltage waveforms is 180°, 120°, etc. Furthermore, the voltage waveform can be rectangular waves, sine waves, and waves of various other shapes.

(2) The entire casing bottom plate 231*b* is not required to have gas permeability.

For example, a gas-permeable portion may be formed at least at a position facing the toner electric-field transport body 232.

Figure 13:
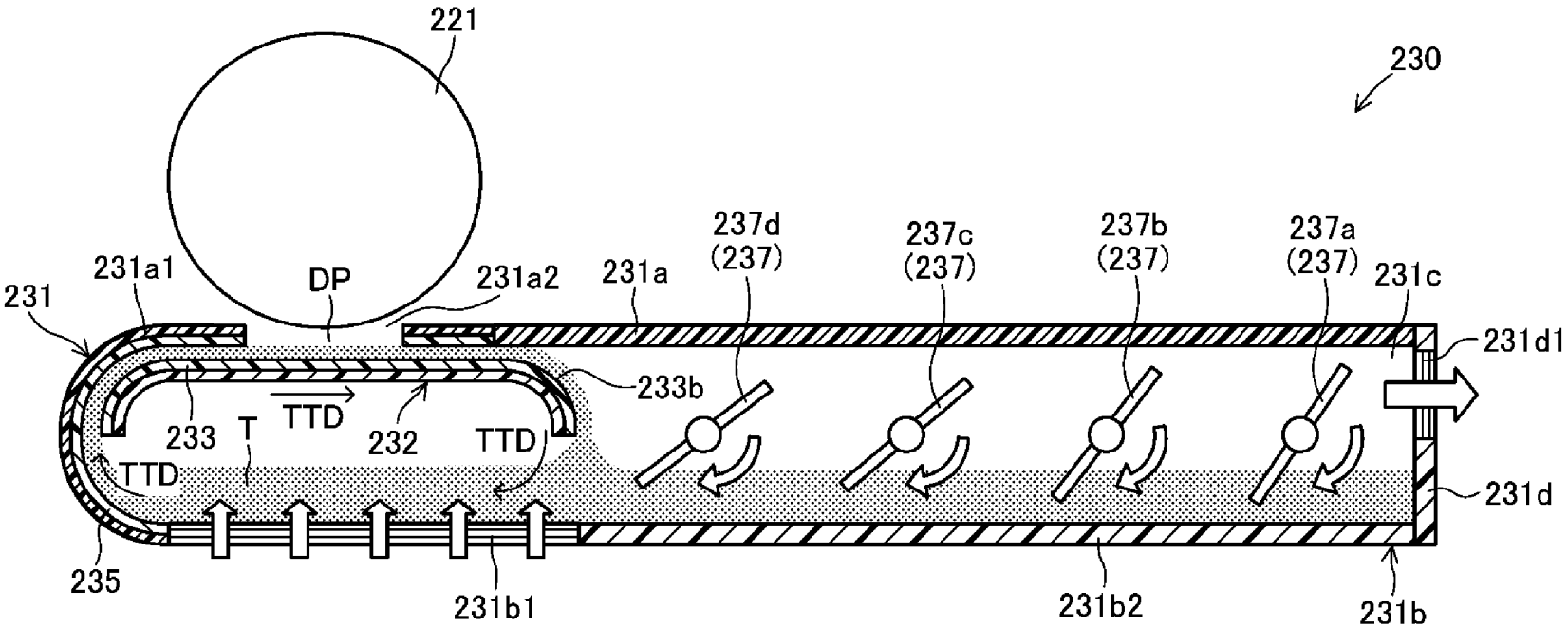
FIG. 13 is a side sectional view showing the configuration of one modification of the developing apparatus shown in FIG. 11.

FIG. 13 is a side sectional view showing one modification of the developing apparatus 230 shown in FIG. 11 (in FIG. 13, the air circulation apparatus 236 shown in FIG. 11 is omitted. Similarly, the air circulation apparatus 236 is omitted in FIGS. 14 and 15, which will be later).

Referring to FIG. 13, in the present modification, the above-described half-pipe portion, which is the rear end portion of the casing top cover 231*a* (the developing-section counter plate 231*a*1), is formed into a generally semi-cylindrical shape.

Further, a ventilating section 231*b*1 is formed in a rear portion of the casing bottom plate 231*b* at a position facing the toner electric-field transport body 232. A non-ventilating section 231*b*2 is provided in a front portion of the casing bottom plate 231*b* in which the ventilating section 231*b*1 is not provided.

As in the above-described embodiment, the ventilating section 231*b*1 is formed of a porous ceramic. A front end portion of the ventilating section 231*b*1 is provided at a position corresponding to a front end portion of the toner electric-field transport body 232. That is, the ventilating section 231*b*1 is provided below the toner electric-field transport body 232.

Further, a rear end portion of the ventilating section 231*b*1 is located at a position slightly separated from the furthest upstream portion of the toner transfer surface 233*b* with respect to the toner transport direction TTD.

Figure 14:
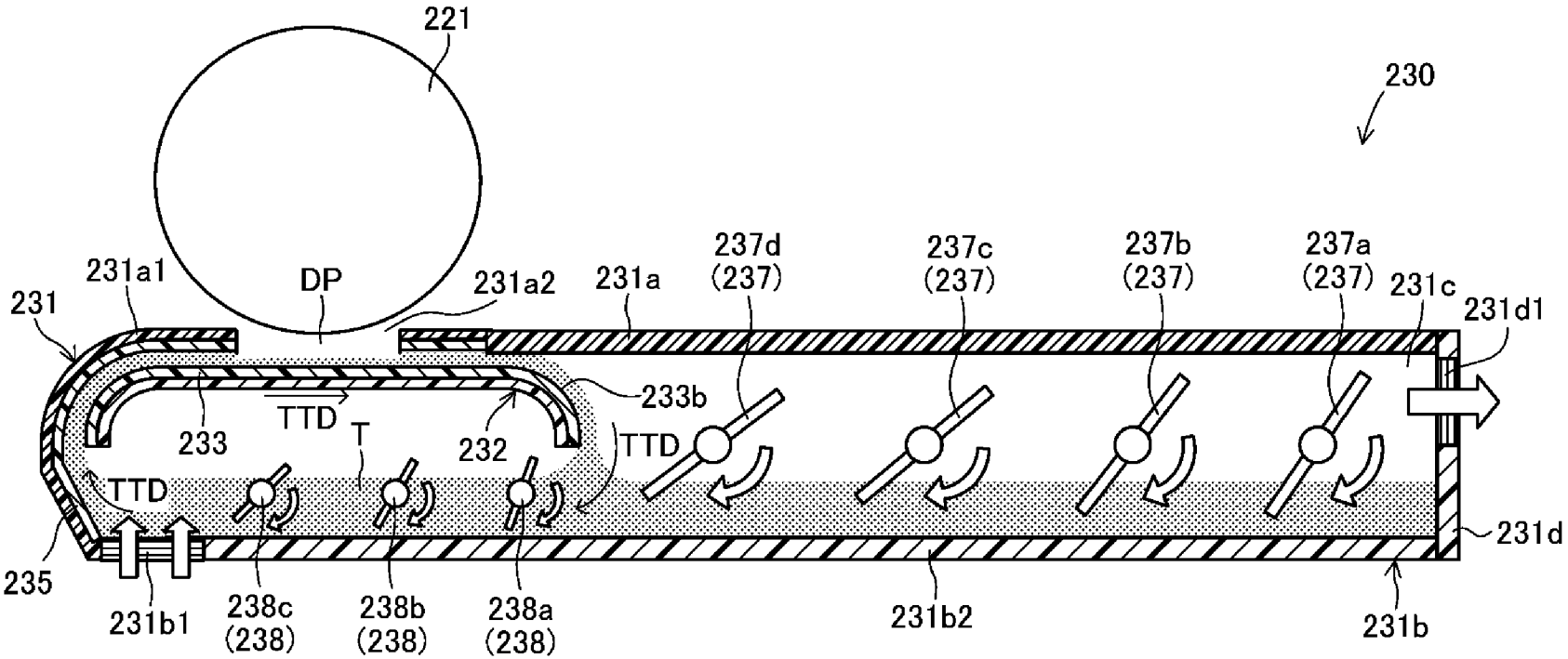
FIG. 14 is a side sectional view showing the configuration of another modification of the developing apparatus shown in FIG. 11.

FIG. 14 is a side sectional view showing another modification of the developing apparatus 230 shown in FIG. 11.

In the modification shown in FIG. 14, a lower end portion of the rear side of the casing top cover 231*a* is formed to have a slope which slopes downward toward the front side and toward the rear end portion of the casing bottom plate 231*b*, as viewed in the side sectional view. Further, the ventilating section 231*b*1 is provided at the rearmost end portion of the casing bottom plate 231*b* such that the ventilating section 231*b*1 is connected to the lower end portion of the rear side of the casing top cover 231*a*.

Figure 15:
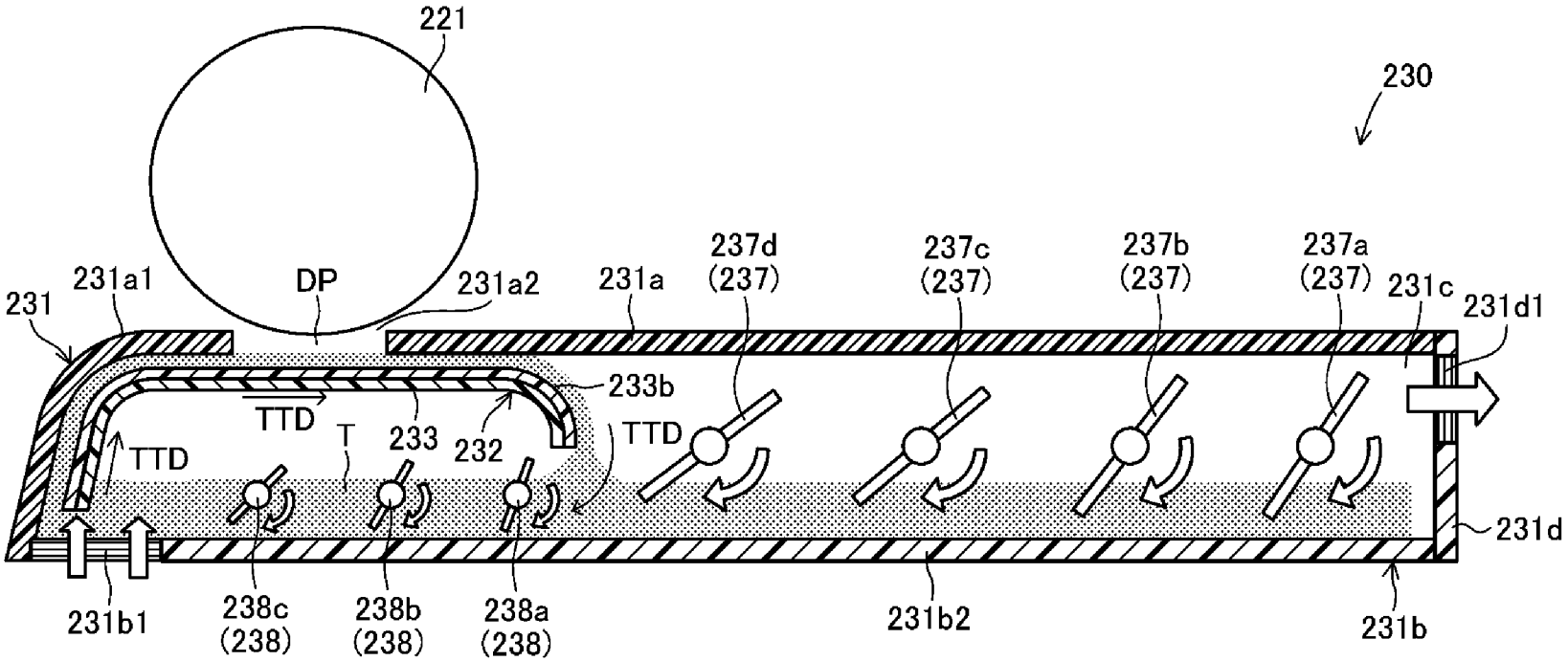
FIG. 15 is a side sectional view showing the configuration of another modification of the developing apparatus shown in FIG. 11.

In the modification shown in FIG. 15, the lower end portion of the rear side of the casing top cover 231*a* is formed to have a slope which slopes downward toward the rear side and toward the rear end portion of the casing bottom plate 231*b*, as viewed in the side sectional view. Further, as in the above-described case, the ventilating section 231*b*1 is provided at the rearmost end portion of the casing bottom plate 231*b* such that the ventilating section 231*b*1 is connected to the lower end portion of the rear side of the casing top cover 231*a*.

That is, as shown in FIGS. 14 and 15, in these modifications, the ventilating section 231*b*1 is provided only at a position (a left-side lower end portion in these drawings) corresponding to the furthest upstream portion of the toner electric-field transport body 232 (the transport wiring substrate 233) with respect to the toner transport direction TTD.

Specifically, the ventilating section 231*b*1 is provided immediately below the furthest upstream portion of the toner electric-field transport body 232 (the transport wiring substrate 233) with respect to the toner transport direction TTD. Further, in FIG. 15, the ventilating section 231*b*1 is provided such that, with respect the horizontal direction, it overlaps the furthest upstream portion of the toner transport surface 233*b* with respect to the toner transport direction TTD. Moreover, in FIG. 15, the ventilating section 231*b*1 is provided such that it faces the furthest upstream portion of the toner transport surface 233*b* with respect to the toner transport direction TTD.

In these configurations, the toner T at a position corresponding to the furthest upstream portion of the toner transport surface 233*b* with respect to the toner transport direction TTD is fluidized satisfactorily. The satisfactorily fluidized toner T is supplied to the furthest upstream portion of the toner transport surface 233*b*. As a result, the transport of the toner T at the furthest upstream portion of the toner transport surface 233*b* can be made uniform. Accordingly, the transport of the toner T on the toner transport surface 233*b* and the supply of the toner T to the development facing position DP can be performed uniformly with the non-uniformity being reduced further.

Further, in the configurations of the modifications shown in FIGS. 13 and 14, the ventilating section 231*b*1 and the gas-permeable closing plate 231*d*1 are provided at diagonally opposite positions. That is, in the configurations shown in FIGS. 13 and 14, while the gas-permeable closing plate 231*d*1 is provided at an upper right position in a side sectional view of the developing casing 231, the ventilating section 231*b*1 is provided at a lower left position in the view.

By virtue of the configurations of these modifications, a negative pressure is generated within the developing casing 231 at a position more separated from the developing opening portion 231*a*2. Thus, when air is blown into the developing casing 231 via the casing bottom plate 231*b*, spouting of the toner T from the developing opening portion 231*a*2 together with air can be suppressed more effectively.

Notably, the ventilating section 231*b*1 may be provided at a position which is separated from the toner transport surface 233*b* (for example, a position diagonally located in relation to the toner transport surface 233*b*) and is located adjacent to the toner transport surface 235*b*.

(3) As shown in FIG. 13, at least one agitator 237, which serves as an agitating member, may be provided within the developing casing 231. The agitator 237 is rotatably supported within the developing casing 231.

In such a configuration, even when the agitator 237 is not rotated violently, fluidization of the toner T within the developing casing 231 can be performed satisfactorily.

In the case where the casing bottom plate 231*b* has the non-ventilating section 231*b*2, the agitator 237 may be preferably provided at a position corresponding to the non-ventilating section 231*b*2, as shown in FIG. 13.

By virtue of such a configuration, when the amount of the toner pool on the ventilating section 231*b*1 decreases, the toner T can be added to the toner pool in a small amount at a time by means of rotating the agitator 237. Since the excess toner T continuously stored within the developing casing 231 is agitated, deterioration of the toner T can be suppressed to the greatest possible extent.

Notably, in order to decrease the frequency of maintenance by increasing the amount of the excess toner T, the developing casing 231 may be formed such that its length as measured along the front-rear direction becomes sufficiently greater than that of the toner electric-field transport body 232 (e.g., at least two times that of the toner electric-field transport body 232). In such a case, a plurality of agitators 237 may be provided.

In the configuration of FIG. 13, four agitators 237 are provided; i.e., an upstream agitator 237*a*, a first intermediate agitator 237*b*, a second intermediate agitator 237*c*, and a downstream agitator 237*d*.

In such a configuration, the drive states of the upstream agitator 237*a*, the first intermediate agitator 237*b*, the second intermediate agitator 237*c*, and the downstream agitator 237*d* are properly controlled in accordance with the degree of consumption of the toner T within the developing casing 231.

For example, when the degree of consumption of the toner T is small (in an initial stage), the upstream agitator 237*a*, the first intermediate agitator 237*b*, and the second intermediate agitator 237*c* are stopped continuously; and only the downstream agitator 237*d* is properly rotated in accordance with the degree of decrease in the amount of the toner pool.

As the degree of consumption of the toner T within the developing casing 231 increases, the number of the agitators 237, which are rotated in response to a decrease in the amount of the toner pool, is increased.

That is, the number of the rotated agitators 237 is increased in such a manner that in a second stage the second intermediate agitator 237*c* and the downstream agitator 237*d* are rotated; in a third stage the first intermediate agitator 237*b*, the second intermediate agitator 237*c*, and the downstream agitator 237*d* are rotated; and in a final stage all the agitators 237 are rotated.

(4) The agitating members such as agitators may be provided at positions located away from the toner electric-field transport body 232 as shown in FIG. 13, or at positions corresponding to the toner electric-field transport body 232 (below the toner electric-field transport body 232).

Further, as shown in FIG. 14, in addition to the agitators 237 provided at positions located away from the toner electric-field transport body 232, a sub-agitator 238, which is smaller in size than the agitators 237, may be provided at a position corresponding to the toner electric-field transport body 232 (below the toner electric-field transport body 232).

In this case, preferably, the sub-agitator 238 is provided below a downstream portion of the toner electric-field transport body 232 with respect to the toner transport direction TTD.

By virtue of this configuration, a portion of the toner T returned from the downstream portion of the toner electric-field transport body 232 with respect to the toner transport direction TTD can be agitated satisfactorily. Thus, that portion of the toner T is supplied satisfactorily to the furthest upstream portion (the lower end portion in FIG. 14) of the counter wiring substrate 235 with respect to the toner transport direction TTD.

Further, a plurality of sub-agitators 238 may be provided, as shown in FIG. 14. In the configuration of FIG. 14, three sub-agitators 238 are provided; i.e., an upstream sub-agitator 238*a*, an intermediate sub-agitator 238*b*, and a downstream sub-agitator 238*c*.

These sub-agitators 238 are properly rotated in accordance with the degree of decrease in the amount of the toner pool in a manner similar to that in the above-described example.

Further, in the case where, as shown in FIG. 14, the ventilating section 231*b*1 of the casing bottom plate 231*b* is formed only in a region corresponding to an upstream portion of the toner electric-field transport body 232 with respect to the toner transport direction TTD, a sub-agitator 238 (or a plurality of sub-agitators 238) is provided above a portion of the non-ventilating section 231*b*2, the portion being located below the toner electric-field transport body 232; and an agitator 237 (a plurality of agitators 237) is provided above a portion of the non-ventilating section 231*b*2, which portion does not corresponds to the toner electric-field transport body 232.

By virtue of such a configuration, through fine control of rotations of the agitators 237 and the sub-agitators 238 in accordance with the amount of the toner T within the developing casing 231 and the amount of the toner pool, the state of supply of the toner T to the toner electric-field transport body 232 can be optimized further.

(5) The configurations of the gas-permeable bottom plate and the exhaust port of the present invention are not limited to those of the above-described embodiment and modifications.

For example, the opening diameter of the porous ceramic which constitutes the casing bottom plate 231*b* (the ventilating section 231*b*1) and the gas-permeable closing plate 231*d*1 is not limited to that employed in the above-described embodiment.

Further, the materials of the casing bottom plate 231*b* (the ventilating section 231*b*1) and the gas-permeable closing plate 231*d*1 are not limited to porous ceramic. For example, in place of the casing bottom plate 231*b* (the ventilating section 231*b*1) and the gas-permeable closing plate 231*d*1, which are made of porous ceramic, there may be used through holes formed in the developing casing 231 and filters which cover the through holes from the outside.

Moreover, the exhaust port of the present invention may be provided at a front end portion of the casing top cover 231*a*.

(6) The counter wiring substrate 235 may be omitted partially or entirely.

In this case, as shown in FIG. 15, preferably, the end portion (the left-side lower end portion in FIG. 15) of the toner electric-field transport body 232 (the transport wiring substrate 233) located on the furthest upstream side with respect to the toner transport direction TTD extends downward to such a position that the end portion is immersed into the toner pool substantially at all times.

[1-3]

<Overall Configuration of Third Laser Printer>

Figure 16:
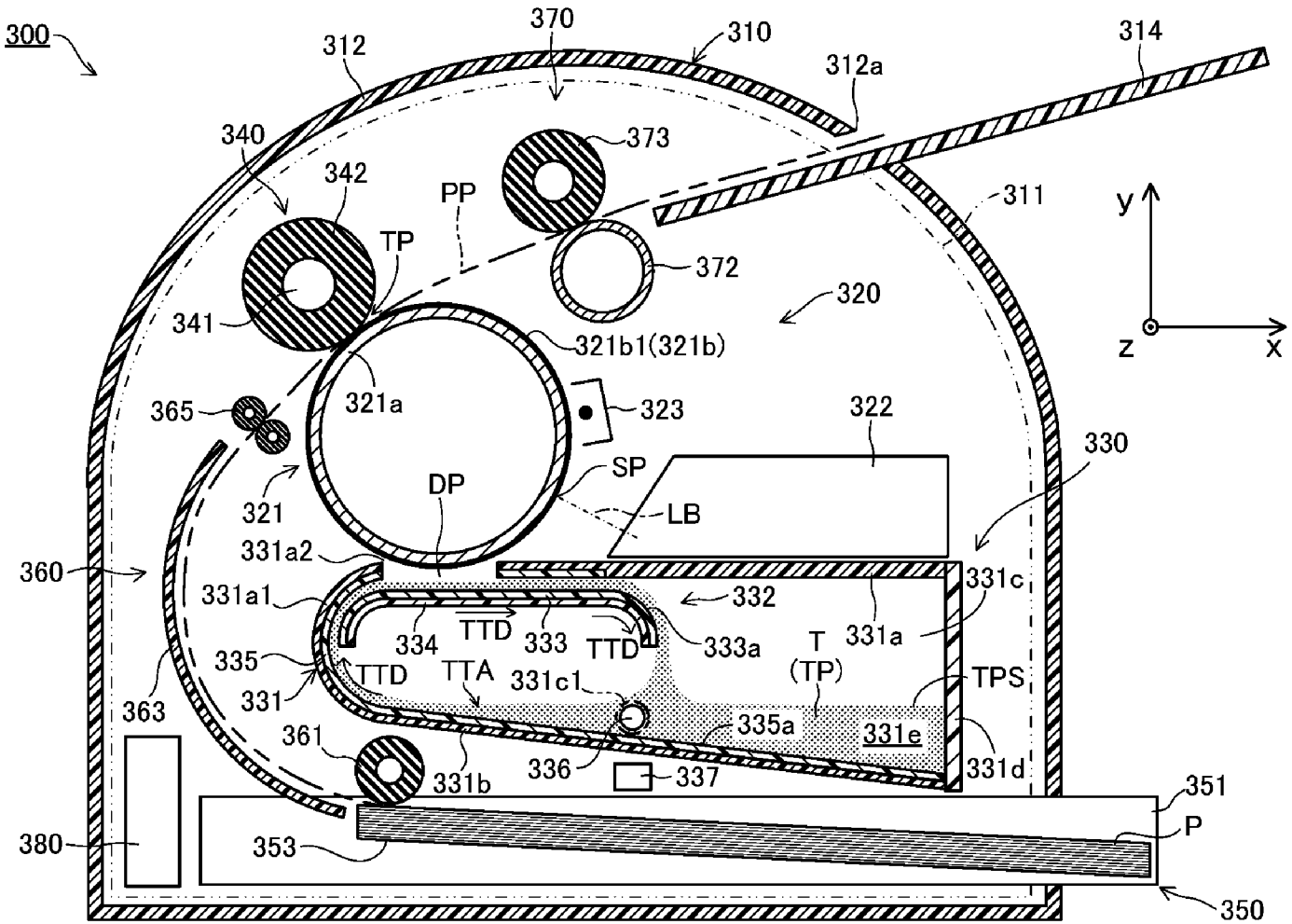
FIG. 16 is a side sectional view showing the schematic configuration of a laser printer to which a second embodiment of the present invention is applied.

FIG. 16 is a side sectional view showing the schematic configuration of a laser printer 300 to which the third embodiment of the present invention is applied.

<<Body Section>>

Referring to FIG. 16, the laser printer 300, which corresponds to the image forming apparatus of the present invention, includes a body portion 310. The body portion 310 constitutes a main part of the laser printer 300, and includes a body frame 311 and a body casing 312.

The body frame 311 is covered with the body casing 312. The body frame 311 supports various members to be described later which are provided for image forming operation of the laser printer 300. The body casing 312 is a member which constitutes an outer cover of the laser printer 300, and is integrally formed from a synthetic resin plate.

The body casing 312 has a paper ejection port 312*a* in the form of a slit-like through-hole located at an upper front portion thereof.

A catch tray 314 is attached to an upper front portion of the body casing 312 at a position corresponding to the paper ejection port 312*a*. The catch tray 314 is configured to receive the paper P which is ejected through the paper ejection port 312*a* and on which an image has been formed.

<<Electrostatic-Latent-Image Forming Section>>

The body casing 312 houses an electrostatic-latent-image forming section 320. The electrostatic-latent-image forming section 320 includes a photoconductor drum 321, which corresponds to the electrostatic-latent-image carrying body and the developer carrying body of the present invention.

The photoconductor drum 321 is a generally cylindrical member. The center axis of rotation of the photoconductor drum 321 is in parallel with the paper width direction. The photoconductor drum 321 is configured to be able to be rotatably driven clockwise in FIG. 16.

Specifically, the photoconductor drum 321 includes a drum body 321*a* and a photoconductor layer 321*b*.

The drum body 321*a* is a metal tube of an aluminum alloy or the like. The photoconductor layer 321*b* is formed on the outer circumference of the drum body 321*a*.

The photoconductor layer 321*b* is formed by a positively chargeable photoconductive layer. That is, the photoconductor layer 321*b* is formed of a substance which exhibits electrical conductivity, with holes serving as a carrier, when it is irradiated with light within a predetermined wavelength band.

The photoconductor drum 321 has an image carrying surface 321*b*1, which serves as the latent-image forming surface and the developer carrying surface of the present invention.

The circumferential surface of the photoconductor layer 321*b* serves as the image carrying surface 321*b*1. The image carrying surface 321*b*1 is formed in parallel with the paper width direction and a main scanning direction, which will be described later. The image carrying surface 321*b*1 is configured such that an electrostatic latent image can be formed by electric-potential distribution.

The photoconductor drum 321 is configured such that the image carrying surface 321*b*1 can move along a sub-scanning direction to be described later (a direction orthogonal to a main scanning direction to be described later).

The electrostatic-latent-image forming section 320 includes a scanner unit 322 and a charger 323.

The scanner unit 322 is configured to generate a laser beam LB. This laser beam LB has a wavelength band which is contained in the above-described predetermined wavelength band in which the photoconductor layer 321*b* exhibits electrical conductivity, and is modulated in accordance with image information.

The scanner unit 322 is configured such that it can sweep the laser beam LB along the main scanning direction. The main scanning direction is a direction (the z-axis direction in FIG. 16) parallel to the paper width direction.

That is, the scanner unit 322 is configured and disposed such that it can irradiate the image carrying surface 321*b*1 with the laser beam LB at a predetermined scanning position SP, while sweeping the laser beam LB along the main scanning direction.

The charger 323 is disposed upstream of the scanning direction SP with respect to the direction of movement of the image carrying surface 321*b*1 (direction of rotation of the photoconductor drum 321). The charger 323 is configured and disposed so as to be able to uniformly, positively charge the image carrying surface 321*b*1 at a position located upstream of the scanning position SP with respect to the above-mentioned direction.

The electrostatic-latent-image forming section 320 is configured such that the scanner unit 322 irradiates, with the laser beam LB, the image carrying surface 321*b*1 which is uniformly, positively charged by the charger 323, whereby an electrostatic latent image by electric-potential distribution (charge distribution) can be formed on the image carrying surface 321*b*1.

The electrostatic-latent-image forming section 320 is configured to be able to move the image carrying surface 321*b*1 on which an electrostatic latent image is formed, along the sub-scanning direction.

The "sub-scanning direction" is an arbitrary direction orthogonal to the main scanning direction. Usually, the sub-scanning direction is a direction which intersects with a vertical line. Typically, the sub-scanning direction may be a direction along the front-rear direction of the laser printer 300 (the x-axis direction in FIG. 16).

<<Developing Apparatus>>

The body casing 312 houses a developing apparatus 330, which corresponds to the developer supply apparatus of the present invention. The developing apparatus 330 is attached to the body frame 311 of the body portion 310. This developing apparatus 330 is configured such that it can be easily attached to and detached from the body frame 311.

A toner T, which is a dry developer in the form of fine particles (powder developer) is stored within the developing apparatus 330. This developing apparatus 330 is disposed in such a manner as to face the photoconductor drum 321 at a development facing position DP (developing position; facing position).

The developing apparatus 330 is configured to transport the toner T, while circulating it along a circulating transport path formed to have a generally oval (elliptical) shape as viewed in a side sectional view. That is, the toner transport direction TTD, which corresponds to the developer transport direction of the present invention, is a direction tangent to the circulating transport path at an arbitrary point in the side sectional view.

The toner transport direction TTD is set such that, when viewed from above (when viewed in a direction parallel with the y-axis direction in FIG. 16), the toner transport direction TTD becomes generally parallel with the sub-scanning direction (the x-axis direction in FIG. 16) (Notably, the toner transport direction TTD may partially extend parallel to the height direction (the y-axis direction in FIG. 16)).

The developing apparatus 330 is configured and disposed as described below such that it can transport the toner T in a charged state in the toner transport direction TTD along the above-described circulating transport path, and supply the image carrying surface 321*b*1 on which an electrostatic latent image is formed, with the toner T in the vicinity of the development facing position DP.

Notably, the toner T used in the present embodiment is a non-magnetic 1-component developer for use in electrophotography.

Figure 17:
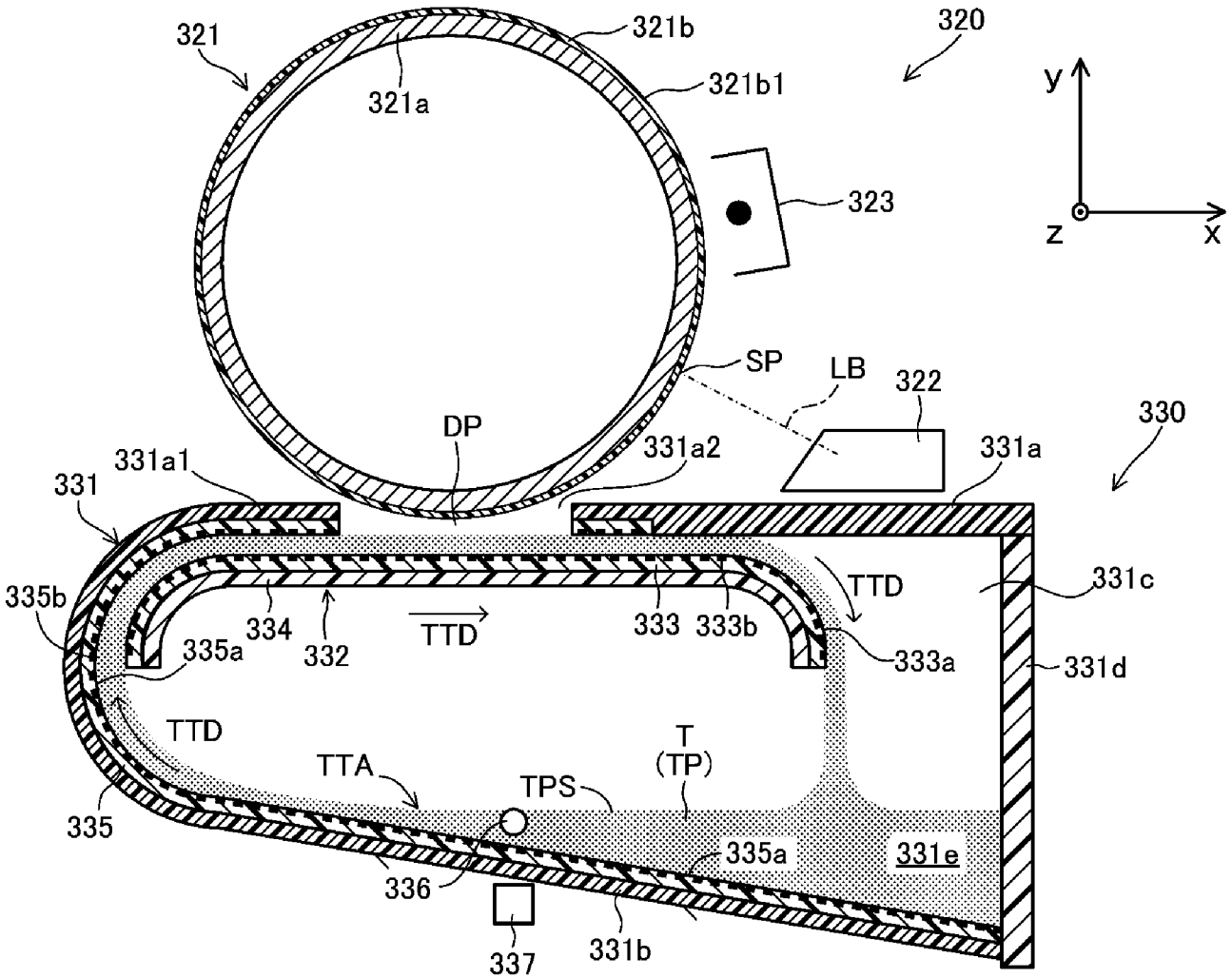
FIG. 17 is an enlarged side sectional view showing an electrostatic-latent-image forming section and a developing apparatus shown in FIG. 16.

FIG. 17 is an enlarged side sectional view showing the electrostatic-latent-image forming section 320 and the developing apparatus 330 shown in FIG. 16.

Referring to FIGS. 16 and 17, the developing apparatus 330 is disposed below the photoconductor drum 321. This developing apparatus 330 is provided in such a manner as to face the image carrying surface 321*b*1 at a position located downstream of the scanning position SP with respect to the direction of movement of the image carrying surface 321*b*1.

<<<Developing Casing>>>

Referring to FIGS. 16 and 17, a developing casing 331, which corresponds to the developer containing casing of the present invention, is a box-like member formed of a synthetic resin. This developing casing 331 is configured as described below such that it can contain (store) the toner T therein.

The developing casing 331 has a casing top cover 331*a*. The casing top cover 331*a* is formed to assume a generally J-like shape as viewed in a side sectional view. A developing-section counter plate 331*a*1, which is a rear portion of the casing top cover 331*a*, is smaller in thickness than the remaining portion.

The developing-section counter plate 331*a*1 is composed of a flat plate portion which is located below the photoconductor drum 321, and a semi-cylindrical portion connected to a rear end of the flat plate portion.

A developing opening portion 331*a*2, which corresponds to the opening portion of the present invention, is formed in the flat plate portion of the developing-section counter plate 331*a*1. The developing opening portion 331*a*2 is provided in the developing-section counter plate 331*a*1 at a position facing the image carrying surface 321*b*1 such that the developing opening portion 331*a*2 surrounds the development facing position DP.

Further, the developing casing 331 has a casing bottom plate 331*b*. The casing bottom plate 331*b* is provided to face the casing top cover 331*a*. This casing bottom plate 331*b* is formed from a flat-plate-shaped member having the same thickness as the developing-section counter plate 331*a*1.

The casing bottom plate 331*b* is provided in an inclined state such that the casing bottom plate 331*b* forms a constant angle (e.g., 30 degrees or less) in relation to a horizontal plane. That is, the casing bottom plate 331*b* is disposed in such a manner that the surface of the casing bottom plate 331*b* located on the upper side in FIG. 16 forms a (gentle) slope which ascends from the front side toward the rear side.

A rear end portion of the casing bottom plate 331*b* is connected to a lower end of the semi-cylindrical portion of the casing top cover 331*a*. That is, the casing bottom plate 331*b* and the casing top cover 331*a* are integrally formed such that they are smoothly connected at the rear end of the developing casing 331.

Further, the developing casing 331 includes a pair of casing side plates 331*c*. The casing side plates 331*c* are formed from flat plates made of a synthetic resin.

The pair of casing side plates 331*c* are closingly attached to the opposite ends, with respect to the paper width direction, of the casing top cover 331*a* and to those of the casing bottom plate 331*b*. A casing through hole 331*c*1 is formed in at least one of the paired casing side plates 331*c*. This casing through hole 331*c*1 is provided in the vicinity of the casing bottom plate 331*b*.

A casing front closing plate 331*d* is closingly attached to the front end of the casing top cover 331*a*, to that of the casing bottom plate 331*b*, and to those of the paired casing side plates 331*c*.

That is, a space surrounded by the casing top cover 331*a*, the casing bottom plate 331*b*, the paired casing side plates 331*c*, and the casing front closing plate 331*d* constitutes a toner containing space 331*e*.

When the laser printer 300 is not operated, the toner T is stored at a bottom portion of the toner containing space 331*e*. The ensemble of the toner T stored at the bottom portion of the toner containing space 331*e* will be referred to as a "toner pool TP." That is, this toner pool TP is stored at the bottom portion of the toner containing space 331*e* formed within the developing casing 331.

<<<Toner Electric-Field Transport Body>>>

Referring to FIG. 17, the developing casing 331 houses a toner electric-field transport body 332, which corresponds to the developer transport body of the present invention. The toner electric-field transport body 332 is disposed in the inner space of the developing casing 331 at a rearward position, in such a manner as to face the image carrying surface 321*b*1 with the developing opening portion 331*a*2 therebetween. That is, the toner electric-field transport body 332 is provided such that the photoconductor drum 321 and the toner electric-field transport body 332 face each other with the developing opening portion 331*a*2 therebetween.

The opposite ends of the toner electric-field transport body 332 are supported by the paired casing side plates 331*c* in such a manner that the toner electric-field transport body 332 is supported at a position located above the casing bottom plate 331*b* while facing the developing-section counter plate 331*a*1 with a predetermined gap therebetween.

The toner electric-field transport body 332 includes the transport wiring substrate 333. The transport wiring substrate 333 is disposed in such a manner as to face the image carrying surface 321*b*1 with the developing opening portion 331*a*2 therebetween.

A toner main transport surface 333*a*, which is the surface of the transport wiring substrate 333 located on the upper side (outer side) in FIG. 17 and serves as the developer transport surface of the present invention, is formed in a shape resembling the inverted letter U as viewed from the lateral direction.

That is, a rear end portion of the toner main transport surface 333*a* is curved downward along the casing top cover 331*a* of the developing casing 331.

Also, a front end portion of the toner main transport surface 333*a* is curved downward in a manner similar to that of the rear end portion. A portion of the toner main transport surface 333*a* between the above-mentioned front and rear portions assumes the form of a generally flat plate.

The toner main transport surface 333*a* is formed in parallel with the main scanning direction (the z-direction in FIG. 17). Further, the toner main transport surface 333*a* is disposed to face the image carrying surface 321*b*1 of the photoconductor drum 321. The toner main transport surface 333*a* and the image carrying surface 321*b*1 are in the closest proximity to each other at the above-described development facing position DP.

Figure 18:
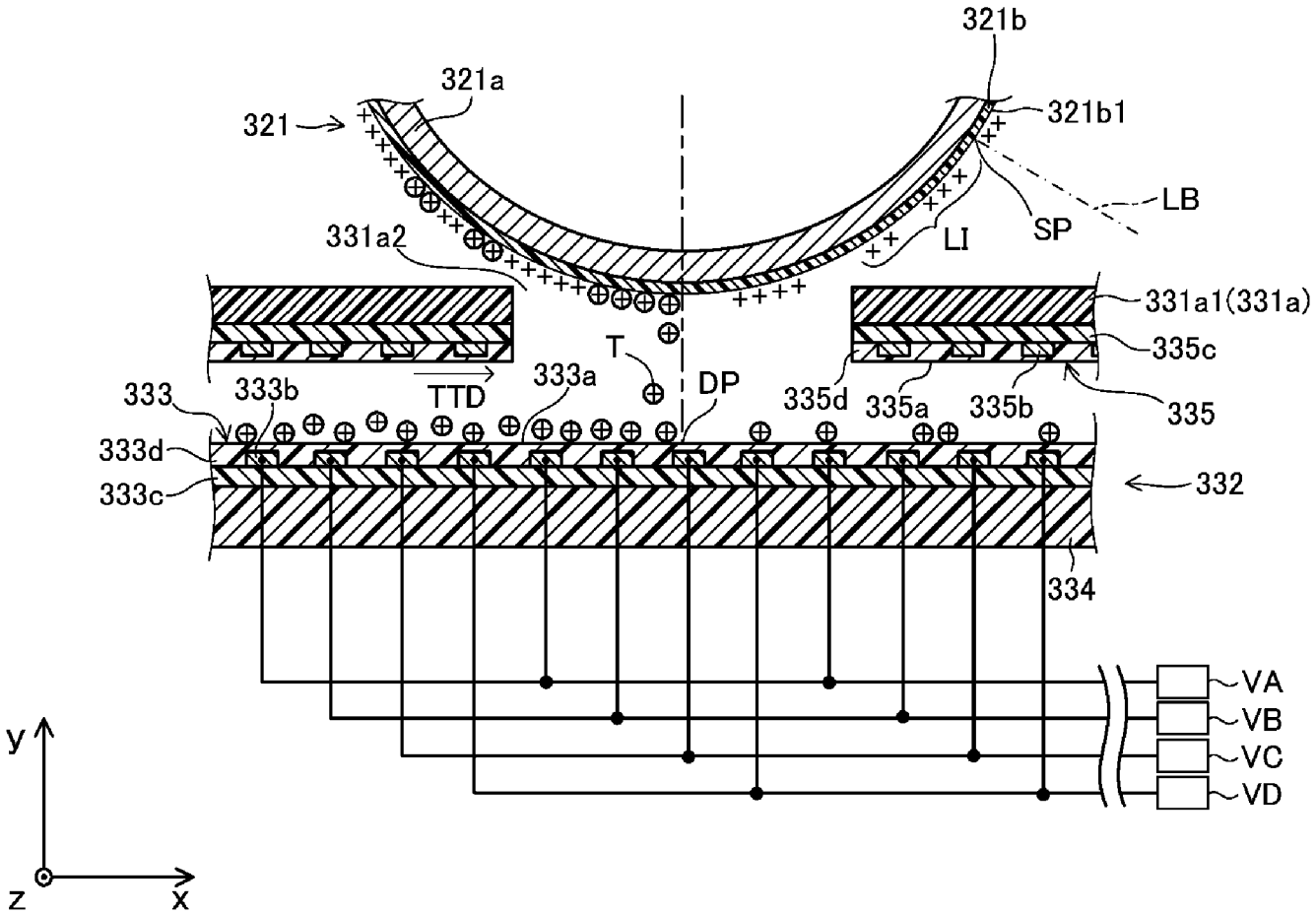
FIG. 18 is an enlarged side sectional view showing a portion of FIG. 17 in the vicinity a development facing position.

FIG. 18 is an enlarged side sectional view showing a portion of FIG. 17 in the vicinity of the development facing position DP.

Referring to FIG. 18, the transport wiring substrate 333 has a structure similar to that of a flexible printed wiring board.

Specifically, the transport wiring substrate 333 includes a plurality of transport electrodes 333*b*. These transport electrodes 333*b* are formed on the surface of a transport-electrode support film 333*c*. The transport electrodes 333*b* and the transport-electrode support film 333*c* are covered with a transport-electrode coating layer 333*d*.

The transport electrodes 333*b* are formed of a copper foil having a thickness of about several tens of micrometers. The transport electrodes 333*b* are formed in a strip-like wiring pattern such that their longitudinal direction becomes parallel with the main scanning direction (orthogonal to the sub-scanning direction).

The plurality of transport electrodes 333*b* are disposed in parallel with one another. These transport electrodes 333*b* are arrayed along the sub-scanning direction.

The large number of transport electrodes 333*b* arrayed along the sub-scanning direction are connected to power supply circuits such that every fourth transport electrodes 333*b* is connected to the same power supply circuit.

That is, the transport electrode 333*b* connected to a power supply circuit VA, the transport electrode 333*b* connected to a power supply circuit VB, the transport electrode 333*b* connected to a power supply circuit VC, the transport electrode 333*b* connected to a power supply circuit VD, the transport electrode 333*b* connected to the power supply circuit VA, the transport electrode 333*b* connected to the power supply circuit VB, . . . , are sequentially arrayed along the sub-scanning direction.

Referring to FIGS. 17 and 18, these transport electrodes 333*b* are arranged along the toner main transport surface 333*a*. That is, the transport electrodes 333*b* are arranged in the vicinity of the toner main transport surface 333*a*.

Referring to FIG. 18, the transport-electrode support substrate 333*c* is a flexible film of an electrically insulative synthetic resin, such as polyimide resin. The transport-electrode coating layer 333*d* is provided on the surface of the transport-electrode support substrate 333*c* on which the transport electrodes 333*b* are formed.

The transport-electrode coating layer 333*d* is provided to cover the transport-electrode support substrate 333*c* and the transport electrodes 333*b*, thereby making the toner main transport surface 333*a* smooth.

Referring to FIGS. 17 and 18, the toner electric-field transport body 332 includes a transport-substrate support member 334. The transport-substrate support member 334 is provided so as to support the transport wiring substrate 333 from underneath.

Referring to FIG. 17, a rear end portion of the transport-substrate support member 334 is curved downward along the casing top cover 331*a* of the developing casing 331. Also, a front end portion of the transport-substrate support member 334 is curved downward in a manner similar to that of the rear end portion. A portion of the transport-substrate support member 334 between the above-mentioned front and rear portions assumes the form of a generally flat plate.

That is, the transport-substrate support member 334 is formed in a shape resembling the inverted letter U as viewed from the lateral direction. The transport wiring substrate 333 is supported by the transport-substrate support member 334 in a state in which the transport wiring substrate 333 is bent in a shape resembling the inverted letter U as viewed from the lateral direction.

Referring to FIGS. 17 and 18, the toner electric-field transport body 332 is configured to be able to transport the toner T as follows. Traveling-wave voltages (see FIG. 4) as described above are applied to the plurality of transport electrodes 333*b*, whereby traveling-wave electric fields are generated on the toner main transport surface 333*a*, whereby the positively charged toner T can be transported in the toner transport direction TTD.

<<<Counter Wiring Substrate>>>

Referring to FIGS. 16 and 17, as described above, a recess is formed on the inner surface of the casing top cover 331*a* at a position corresponding to the developing-section counter plate 331*a*1. The counter wiring substrate 335 is attached to the inner surface of the developing casing 331 such that the counter wiring substrate 335 is fitted into the recess.

That is, the counter wiring substrate 335 is supported by the inner wall surface of the developing-section counter plate 331*a*1 to face the toner main transport surface 333*a* with a predetermined gap therebetween.

In the present embodiment, the counter wiring substrate 335 is provided to correspond to substantially the entire surface of the casing bottom plate 331*b*. That is, the counter wiring substrate 335 is provided such that it extends between the highest position of the casing bottom plate 331*b* (the position at which the lower end of the semi-cylindrical portion of the developing-section counter plate 331*a*1 and the casing bottom plate 331*b* are joined) and the lowest position of the casing bottom plate 331*b* (an end portion of the casing bottom plate 331*b* located on the front side in FIG. 17).

As described above, the counter wiring substrate 335 is supported by the inner wall surface of the developing casing 331 in a state in which the counter wiring substrate 335 is curved into a generally U-like shape or a generally V-like shape.

A toner sub-transport surface 335*a*, which is the inner surface (facing the toner containing space 331*e*) of the counter wiring substrate 335, is a smooth surface formed into a generally J-like shape or a generally U-like shape as viewed in a side sectional view.

A portion of the toner sub-transport surface 335*a* which corresponds to the casing bottom plate 331*b* forms a smooth slope which forms a constant angle (e.g., 30 degrees or less) in relation to a horizontal plane. Further, the toner sub-transport surface 335*a* is formed parallel to the main scanning direction (the z-direction in FIG. 17).

That is, the portion of the toner sub-transport surface 335*a* which corresponds to the casing bottom plate 331*b* forms a slope which ascends from a lower end portion of the casing front closing plate 331*d* toward a rear end portion of the toner electric-field transport body 332 (an upstream end portion of the toner main transport surface 333*a* with respect to the toner transport direction TTD).

The counter wiring substrate 335 has a structure similar to that of the above-described transport wiring substrate 333. That is, referring to FIG. 18, the counter wiring substrate 335 includes counter electrodes 335*b*, a counter-electrode support film 335*c*, and a counter-electrode coating layer 335*d*.

The counter electrodes 335*b* are formed of a copper foil having a thickness of about several tens of micrometers. The counter electrodes 335*b* are formed on the surface of the counter-electrode support film 335*c* as a strip-like wiring pattern such that their longitudinal direction becomes parallel with the main scanning direction (orthogonal to the sub-scanning direction).

The plurality of counter electrodes 335*b* are disposed in parallel with one another. These counter electrodes 335*b* are arrayed along the sub-scanning direction. Like the above-described transport electrodes 333*b*, the counter electrodes 335*b* are connected to power supply circuits such that every fourth counter electrodes 335*b* is connected to the same power supply circuit.

The plurality of counter electrodes 335*b* are arranged along the above-described toner sub-transport surface 335*a*. That is, the counter electrodes 335*b* are provided along the inner wall surfaces of the developing-section counter plate 331*a*1 and the casing bottom plate 331*b* of the developing casing 331.

The counter-electrode support substrate 335*c* is a flexible film of an electrically insulative synthetic resin, such as polyimide resin.

The counter electrodes 335*b* and the surface of the counter-electrode support film 335*c* on which the counter electrodes 335*b* are formed are covered with the counter-electrode coating layer 335*d*.

As a result of the counter-electrode coating layer 335*d* covering the counter-electrode support substrate 335*c* and the counter electrodes 335*b*, the above-described toner sub-transport surface 335*a* forms a smooth slope which has a constant angle in relation to a horizontal plane.

Like the above-described transport wiring substrate 333, the counter wiring substrate 335 is configured to be able to transport the toner T as follows. Traveling-wave voltages (see FIG. 4) as described above are applied to the plurality of counter electrodes 335*b*, whereby traveling-wave electric fields are generated on the toner sub transport surface 335*a*, whereby the positively charged toner T can be transported in the toner transport direction TTD.

<<<Developer Vibrating Section>>>

Referring to FIGS. 16 and 17, the developing apparatus 330 of the present embodiment includes a vibration body 336 and a vibration-body vibrating section 337.

The vibration body 336 and the vibration-body vibrating section 337, which constitute the developer vibrating section of the present invention, are provided near the casing bottom plate 331*b*.

The vibration body 336 is disposed in the toner containing space 331*e* within the developing casing 331. This vibration body 336 is provided such that it corresponds to substantially the entirety of the toner containing space 331*e* with respect to the paper width direction.

In the present embodiment, the vibration body 336 is supported by the paired casing side plates 331*c* such that the vibration body 336 can oscillate at least in the paper width direction. At least one end portion of the vibration body 336 with respect to the paper width direction projects outward from the developing casing 331 via the casing through hole 331*c*1 such that the end portion faces the vibration-body vibrating section 337.

The vibration-body vibrating section 337 is provided on the body frame 311. Further, the vibration-body vibrating section 337 is disposed at such a position that, when the development apparatus 330 is attached to the body portion 310 (the body frame 311), the vibration-body vibrating section 337 is located at a position outside the developing casing 331 and corresponding to the vibration body 336 (the vibration-body vibrating section 337 faces the vibration body 336 via the developing casing 331). This vibration-body vibrating section 337 is configured such that it can vibrate the vibration body 336 from the outside of the developing casing 331.

As described above, the vibration body 336 and the vibration-body vibrating section 337, which constitute the developer vibrating section of the present invention, are configured and disposed such that the vibration-body vibrating section 337 can vibrate the toner pool TP (the toner T stored at the bottom portion of the toner containing space 331*e* within the developing casing 331) substantially from the outside of the developing casing 331, by vibrating the vibration body 336 from the outside of the developing casing 331.

Example 1

Figure 19:
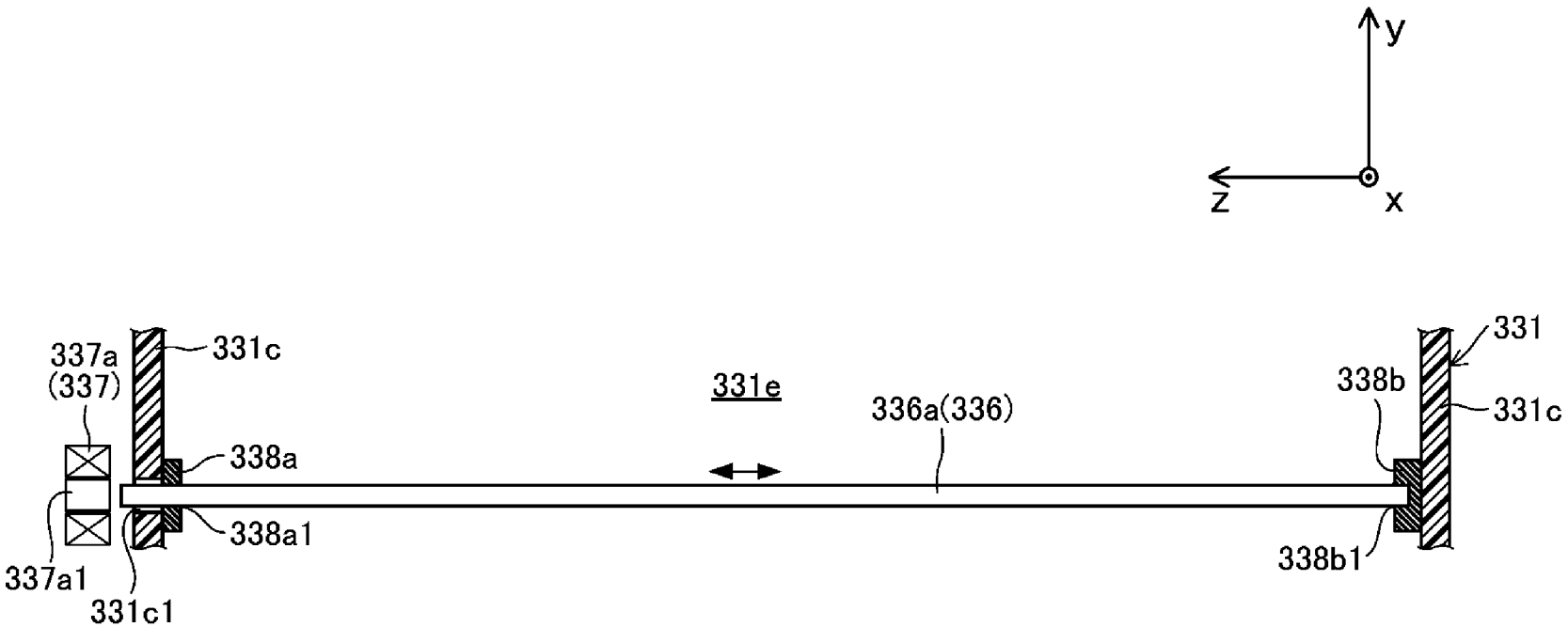
FIG. 19 is a sectional view, as viewed from a front side, showing the configuration of one example of a vibration body and a vibration-body drive section shown in FIG. 17.

FIG. 19 is a sectional view, as viewed from the front side, showing the configuration of one example of the vibration body 336 and the vibration-body vibrating section 337 shown in FIG. 17.

Referring to FIGS. 17 and 19, a vibration rod 336*a*, which serves as the vibration body 336 of the present example, is a rod-like member formed of a magnetic material, and is disposed to extend along the paper width direction (the z-axis direction in these drawings). The vibration rod 336*a* is disposed such that it is separated from the toner sub-transport surface 335*a* and faces the toner sub-transport surface 335*a*.

In the present example, the casing through hole 331*c*1 is formed only one casing side plate 331*c*. The vibration rod 336*a* has a diameter slightly smaller than the diameter of the casing through hole 331*c*1. One end portion of the vibration rod 336*a* with respect to the paper width direction is exposed to the outside of the developing casing 331 via the casing through hole 331*c*1.

A coil 337*a*, which serves as the vibration-body vibrating section 337, is disposed such that an iron core 337*a*1 at the center thereof is in close proximity to (faces) the one end portion of the vibration rod 336*a* with a predetermined gap formed therebetween. This coil 337*a* is configured such that it vibrates the vibration rod 336*a* when electricity is supplied to the coil 337*a* from an AC power supply.

That is, the coil 337*a* is magnetically coupled with the vibration rod 336*a* at the end portion of the vibration rod 336*a* with respect to the paper width direction (the main scanning direction).

An elastic seal 338*a*, which serves as the elastic member of the present invention, is bonded to the inner surface of the above-described one casing side plate 331*c* (the surface facing the toner containing space 331*e*). The elastic seal 338*a* is provided at a position corresponding to the casing through hole 331*c*1.

The elastic seal 338*a* is a disk-shaped member formed of a synthetic rubber. A seal through hole 338*a*1 is provided at an approximately central portion of the elastic seal 338*a*.

The elastic seal 338*a* is disposed such that the center axis of the casing through hole 331*c*1 extending in the paper width direction (the z-axis direction in FIG. 19) and the center axis of the seal through hole 338*a*1 extending in the paper width direction generally coincide with each other.

The one end portion of the vibration rod 336*a* is inserted into the seal through hole 338*a*1. The seal through hole 338*a*1 is slightly smaller in diameter than the vibration rod 336*a*. That is, the wall surface of the seal through hole 338*a*1 is in close contact with the outer circumferential surface of the one end portion of the vibration rod 336*a*.

As described above, the elastic seal 338*a* is configured such that it can suppress leakage of the toner T through the seal through hole 338*a*1, while supporting the one end portion of the vibration rod 336*a* in an oscillatable manner.

An elastic damper 338*b*, which serves as the elastic member of the present invention, is bonded to the inner surface of the other casing side plate 331*c* (in which the casing through hole 331*c*1 is not provided).

The elastic damper 338*b* is a disk-shaped member formed of a synthetic rubber. A depression 338*b*1 is provided at an approximately central portion of the elastic damper 338*b*.

The depression 338*b*1 is slightly smaller in diameter than the other end portion of the vibration rod 336*a*, opposite the one end portion thereof. The other end portion of the vibration rod 336*a* is inserted into to the depression 338*b*1. Thus, the other end portion is supported by the elastic damper 338*b* in an oscillatable manner.

As described above, the vibration rod 336*a* is oscillatably supported by the paired casing side plates 331*c* via the elastic seal 338*a* and the elastic damper 338*b*.

<<Transfer Section>>

Referring again to FIG. 16, a transfer section 340 is provided in such a manner as to face the image carrying surface 321*b*1 at a position located downstream, with respect to the direction of rotation of the photoconductor drum 321, of the position where the photoconductor drum 321 and the developing apparatus 330 face each other.

The transfer section 340 includes a rotary center shaft 341, which is a roller-like member and is made of a metal, and a semiconductive rubber layer 342, which is circumferentially provided on the rotary center shaft 341. The rotary center shaft 341 is disposed in parallel with the main scanning direction (the z-axis direction in FIG. 16). A high-voltage power supply is connected to the rotary center shaft 341. The semiconductive rubber layer 342 is formed of a synthetic rubber containing carbon black or the like kneadingly mixed thereinto such that the rubber layer exhibits semiconductivity.

The transfer section 340 is configured to be able to transfer the toner T from the image carrying surface 321*b*1 to the paper P by means of being rotatably driven counterclockwise while a predetermined transfer voltage is applied between the transfer section 340 and the drum body 321*a* of the photoconductor drum 321.

<<Paper Feed Cassette>>

A paper feed cassette 350 is disposed under the developing apparatus 330. A paper feed cassette case 351 is a box-like member used to form the casing of the paper feed cassette 350 and opens upward. The paper feed cassette case 351 is configured to be able to contain a large number of sheets of the paper P of up to size A4 (210 mm width×297 mm length) in a stacked state.

A paper-pressing plate 353 is disposed within the paper feed cassette case 351. The paper-pressing plate 353 is supported by the paper feed cassette case 351 in such a manner as to pivotally move on a pivot at its front end portion, so that its rear end can move vertically in FIG. 16. An unillustrated spring urges the rear end portion of the paper-pressing plate 353 upward.

<<Paper Transport Section>>

A paper transport section 360 is housed within the body casing 312.

The paper transport section 360 is configured to be able to feed the paper P to a transfer position TRP where the transfer section 340 and the image carrying surface 321*b*1 face each other with a smallest gap therebetween. The paper transport section 360 includes a paper feed roller 361, a paper guide 363, and paper transport guide rollers 365.

The paper feed roller 361 includes a rotary center shaft parallel to the main scanning direction and a rubber layer, which is circumferentially provided on the rotary center shaft. The paper feed roller 361 is disposed in such a manner as to face a leading end portion, with respect to the paper transport direction, of the paper P stacked on the paper-pressing plate 353 housed within the paper feed cassette case 351. The paper guide 363 and the paper transport guide rollers 365 are configured to be able to guide to the transfer position TRP the paper P which has been delivered by the paper feed roller 361.

<<Fixing Section>>

A fixing section 370 is housed within the body casing 312. The fixing section 370 is disposed downstream of the transfer position TRP with respect to the paper transport direction.

The fixing section 370 is configured to apply pressure and heat to the paper P which has passed the transfer position TRP and bears an image in the toner T, thereby fixing the image in the toner T on the paper P. The fixing section 370 includes a heating roller 372 and a pressure roller 373.

The heating roller 372 includes a cylinder which is made of a metal and whose surface is exfoliation-treated, and a halogen lamp which is housed within the cylinder. The pressure roller 373 includes a rotary center shaft which is made of a metal, and a silicone rubber layer which is circumferentially provided on the rotary center shaft. The heating roller 372 and the pressure roller 373 are disposed in such a manner as to press against each other under a predetermined pressure.

The heating roller 372 and the pressure roller 373 are configured and disposed so as to be able to deliver the paper P toward the paper ejection port 312*a* while applying pressure and heat to the paper P.

<<Control Section>>

A control section 380 is accommodated within the body casing 312. The control section 380 includes a ROM, a CPU, a RAM, a re-writable ROM, and an interface.

The ROM stores various routines executed by the CPU for operation of the laser printer 300, tables, etc. The CPU is configured such that it can read out a routine or the like from the ROM, and execute the routine while storing data in the RAM and the re-writable ROM when necessary.

The CPU is connected via the interface to various sensors and switches provided in the laser printer 300. Further, the CPU is configured to control the operations of various sections, such as the electrostatic-latent-image forming section 320, developing apparatus 330, and the transfer section 340, via the interface.

<Outline of Image Forming Operation of the Laser Printer of the Present Embodiment>

The outline of an image forming operation of the laser printer 300 of the present embodiment (example) having such a configuration will next be described with reference to the drawings. Notably, various operations as described below are performed under the control by the CPU of the control section 380.

<<Paper Feed Operation>>

Referring to FIG. 16, the paper-pressing plate 353 urges the paper P stacked thereon upward toward the paper feed roller 361. This causes the top paper P of a stack of the paper P on the paper-pressing plate 353 to come into contact with the circumferential surface of the paper feed roller 361.

When the paper feed roller 361 is rotatably driven clockwise in FIG. 16, a leading end portion with respect to the paper transport direction of the top paper P is moved toward the paper guide 363. Then, the paper guide 363 and the paper transport guide rollers 365 transport the paper P to the transfer position TRP.

<<Formation of Toner Image on Image Carrying Surface>>

While the paper P is being transported to the transfer position TRP as described above, an image in the toner T is formed as described below on the image carrying surface 321*b*1, which is the circumferential surface of the photoconductor drum 321.

<<<Formation of Electrostatic Latent Image>>>

First, the charger 323 uniformly charges a portion of the image carrying surface 321*b*1 of the photoconductor drum 321 to positive polarity.

Referring to FIG. 18, as a result of the clockwise rotation of the photoconductor drum 321, the portion of the image carrying surface 321*b*1 which has been charged by the charger 323 moves along the sub-scanning direction to the scanning position SP, where the portion of the image carrying surface 321*b*1 faces (faces straight toward) the scanner unit 322.

At the scanning position SP, the charged portion of the image carrying surface 321*b*1 is irradiated with the laser beam LB modulated on the basis of image information, while the laser beam LB sweeps along the main scanning direction. Certain positive charges are lost from the charged portion of the image carrying surface 321*b*1, according to a state of modulation of the laser beam LB. By this procedure, an electrostatic latent image LI in the form of an imagewise distribution of positive charges is formed on the image carrying surface 321*b*1.

As a result of the clockwise rotation of the photoconductor drum 321 in FIG. 16, the electrostatic latent image LI formed on the image carrying surface 321*b*1 moves toward the development facing position DP.

<<<Fluidization of Toner>>>

Referring to FIG. 17, the vibration body 336 is vibrated by the vibration-body vibrating section 337.

That is, referring to FIG. 19, in the prevent embodiment, electricity is supplied from the unillustrated AC power supply to the coil 337*a*. As a result, an alternating magnetic field is generated at the iron core 337*a*1. By means of the alternating magnetic field, the vibration rod 336*a* is vibrated.

Referring to FIG. 17, by mean of such vibration of the vibration body 336, the toner pool TP (the toner T stored at the bottom portion of the toner containing space 331*e* of the developing casing 331) is vibrated. This vibrated toner pool TP is fluidized such that the toner pool TP behaves like a liquid.

<<<Transport of Charged Toner>>>

Referring to FIG. 17, predetermined voltages (similar to those shown in FIG. 4) are applied to the counter wiring substrate 335. Thus, predetermined traveling-wave electric fields are formed on the counter wiring substrate 335 (the toner sub-transfer surface 335*a*).

As a result, the above-described traveling-wave electric fields generated along the toner sub-transfer surface 335*a* acts on the toner T in a region (a toner transport start area TTA) located at a rear end portion of the sufficiently fluidized toner pool TP and near the toner sub-transfer surface 335*a*.

Thus, the toner T is transported in the toner transport direction TTD from the toner transport start area TTA such that the toner T moves up along a cylindrical inner surface portion of the toner sub-transfer surface 335*a*.

Notably, the toner transport start area TTA moves frontward and downward along the toner sub-transfer surface 335*a* as the highest position of the toner pool TP (a toner pool top surface TPS) lowers as a result of consumption of the toner.

The toner T having moved up along the cylindrical inner surface portion of the toner sub-transfer surface 335*a* is guided to a position where the counter wiring substrate 335 faces the furthest upstream portion (a left-side lower end portion in FIG. 17) of the transport wiring substrate 333 with respect to the toner transport direction TTD.

The toner T having being guided to a position between the transport wiring substrate 333 and the counter wiring substrate 335 is transported to the development facing position DP by means of the traveling-wave electric fields generated along the toner main transport surface 333*a* of transport wiring substrate 333 and the toner sub-transport surface 335*a* of the counter wiring substrate 335.

The toner T having passed through the development facing position DP falls down from a frontmost end portion of the toner main transport surface 333*a*, so that the toner T returns to the above-described toner pool TP.

<<<Development of Electrostatic Latent Image>>>

Referring to FIG. 18, the positively charged toner T is transported to the development facing position DP as described above.

In the vicinity of the development facing position DP, the toner T adheres to portions of the electrostatic latent image LI on the image carrying surface 321*b*1 at which positive charges are lost. That is, the electrostatic latent image LI on the image carrying surface 321*b*1 of the photoconductor drum 321 is developed with the toner T.

Thus, an image in the toner T is carried on the image carrying surface 321*b*1.

<<Transfer of Toner Image from Image Carrying Surface to Paper>>

Referring to FIG. 16, as a result of clockwise rotation of the image carrying surface 321*b*1, an image in the toner T which has been carried on the image carrying surface 321*b*1 of the photoconductor drum 321 as described above is transported toward the transfer position TRP.

At the transfer position TRP, the image in the toner T is transferred from the image carrying surface 321*b*1 onto the paper P.

<<Fixing and Ejection of Paper>>

The paper P onto which an image in the toner T has been transferred at the transfer position TRP is sent to the fixing section 370 along the paper path PP.

The paper P is nipped between the heating roller 372 and the pressure roller 373, thereby being subjected to pressure and heat. By this procedure, the image in the toner T is fixed on the paper P.

Subsequently, the paper P is sent to the paper ejection port 312*a* and is then ejected onto the catch tray 314 through the paper ejection port 312*a*.

<Actions and Effects Achieved by the Configuration of the Embodiment and Example>

According to the configuration of the present embodiment, there are provided the vibration body 336 and the vibration-body vibrating section 337, which serve as the developer vibrating section for vibrating the toner T contained (stored) within the developing casing 331.

By virtue of such a configuration, the toner T stored in the developing casing 331 (the toner pool TP) is fluidized satisfactorily. Stresses, such as aggregation force and shearing force, acting on the toner T at that time are very small.

Therefore, by virtue of such a configuration, the state of supply of the toner T to the toner sub-transport surface 335*a* and the toner main transport surface 333*a* can be made uniform satisfactorily. Accordingly, the state of transport of the toner T on the toner sub-transport surface 335*a* and the toner main transport surface 333*a* can be made uniform satisfactorily.

As described above, the configuration of the present embodiment enables more uniform performance of the transport of the toner T and the supply of the toner T to the development facing position DP by means of the traveling-wave electric fields. Accordingly, generation of density non-uniformity can be suppressed effectively, whereby satisfactory image formation becomes possible.

In the configuration of the present embodiment, the vibration body 336 is disposed within the developing casing 331 of the developing apparatus 330 which can be attached to and detached from the body portion 310. When the developing apparatus 330 is attached to the body portion 310, the vibration body 336 is located at a position corresponding to the vibration-body vibrating section 337. The vibration-body vibrating section 337 vibrates the vibration body 336 from the outside of the developing casing 331.

By virtue of such a configuration, fluidization of the toner T within the developing casing 331 can be performed satisfactorily when the developing apparatus 330, which can be attached to and detached from the body portion 310, is attached to the body portion 310.

In the configuration of the present embodiment, the vibration body 336 is disposed at a bottom portion of the toner containing space 331*e*, which is the internal space of the developing casing 331.

By virtue of such a configuration, the vibration body 336 is vibrated at the bottom portion of the toner containing space 331*e*. By means of vibration of the vibration body 336, the toner T at the bottom portion of the toner containing space 331*e* is vibrated.

As a result, a satisfactory fluidity can be imparted to the toner T stored within the developing casing 331. Thus, fluidization of the toner T stored within the developing casing 331 by the vibration body 336 can be performed more reliably.

In the configuration of the present embodiment, the vibration body 336 is separated from the inner wall surface of the developing casing 331. Further, the vibration body 336 is supported by the developing casing 331 for free oscillating movement. This configuration can suppress direct transmission of vibration from the vibration body 336 to the developing casing 331 and the toner electric-field transport body 332 supported by the developing casing 331.

Therefore, such a configuration can suppress generation of noise to the greatest possible extent, which noise would otherwise be generated as a result of vibration of the developing casing 331 or the toner electric-field transport body 332.

Further, such a configuration can suppress, to the greatest possible extent, change in a predetermined positional relation at the development facing position DP between the image carrying surface 321*b*1 and the toner main transport surface 333*a* of the toner electric-field transport body 332 supported by the developing casing 331, which change would otherwise occur due to vibration of the vibration body 336. Therefore, generation of a distortion of a formed image, which distortion would otherwise occur due to a change in the positional relation, can be suppressed to the greatest possible extent.

In the configuration of the present embodiment, the vibration rod 336*a* is disposed within the toner containing space 331*e* of the developing casing 331. Further, the he vibration rod 336*a* is magnetically coupled with the coil 337*a* disposed outside the developing casing 331 at an end portion of the vibration rod 336*a* with respect to the sheet width direction (the main scanning direction).

By virtue of such a configuration, through use of a simple apparatus structure, there can be realized a structure for vibrating the vibration rod 336*a* provided within the toner containing space 331*e*, which is the inner space of the developing casing 331, from the outside of the developing casing 331 of the developing apparatus 330, which can be attached to and detached from the body portion 310.

In the configuration of the present embodiment, the casing bottom plate 331*b* is formed in the shape of a flat plate which intersects with a horizontal plane at a constant angle. Further, the toner sub-transport surface 335*a* is formed as a flat surface which intersects with the horizontal plane at a constant angle.

Figure 20:
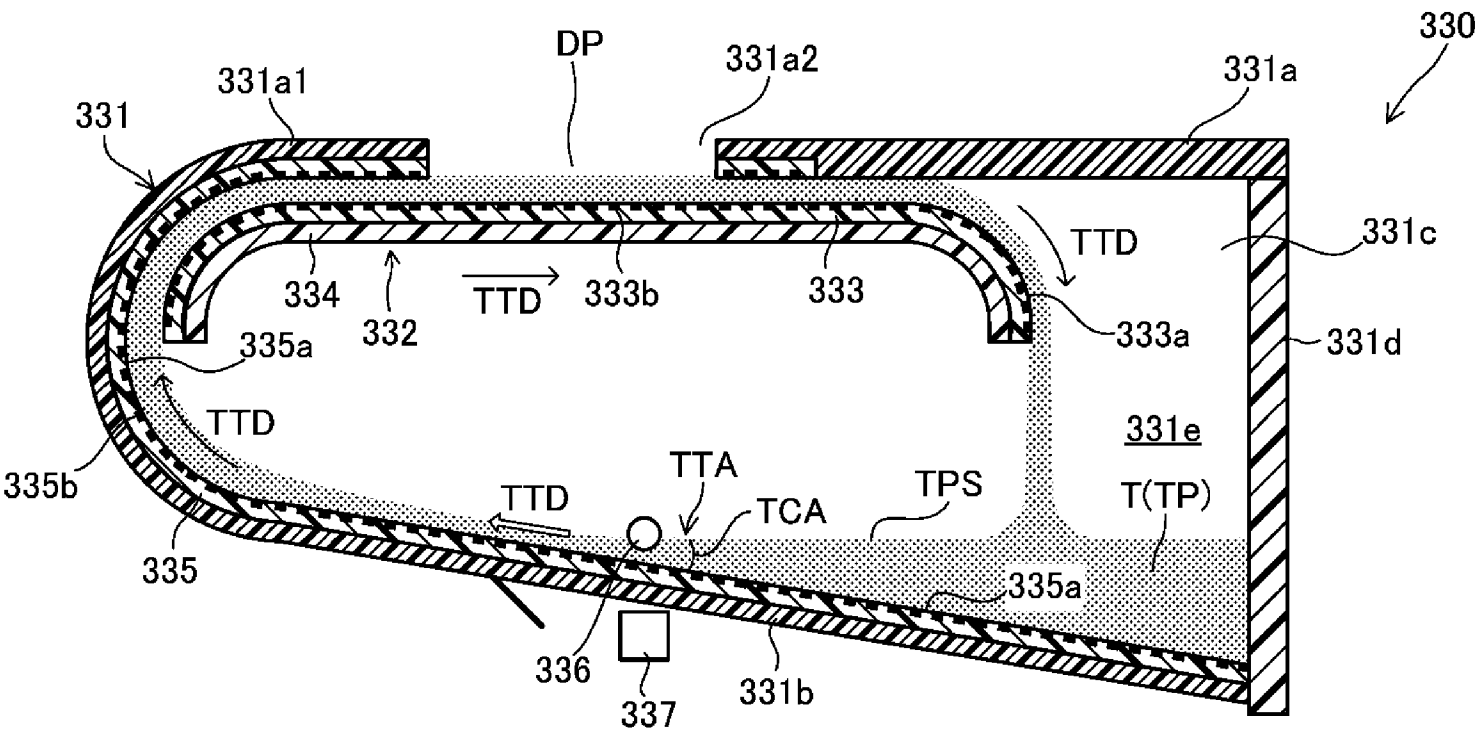
FIG. 20 is a side sectional view of the development apparatus shown in FIG. 17 showing a state in which the storage amount of toner within a developing casing (the amount of toner pool) has decreased.
Figure 21:
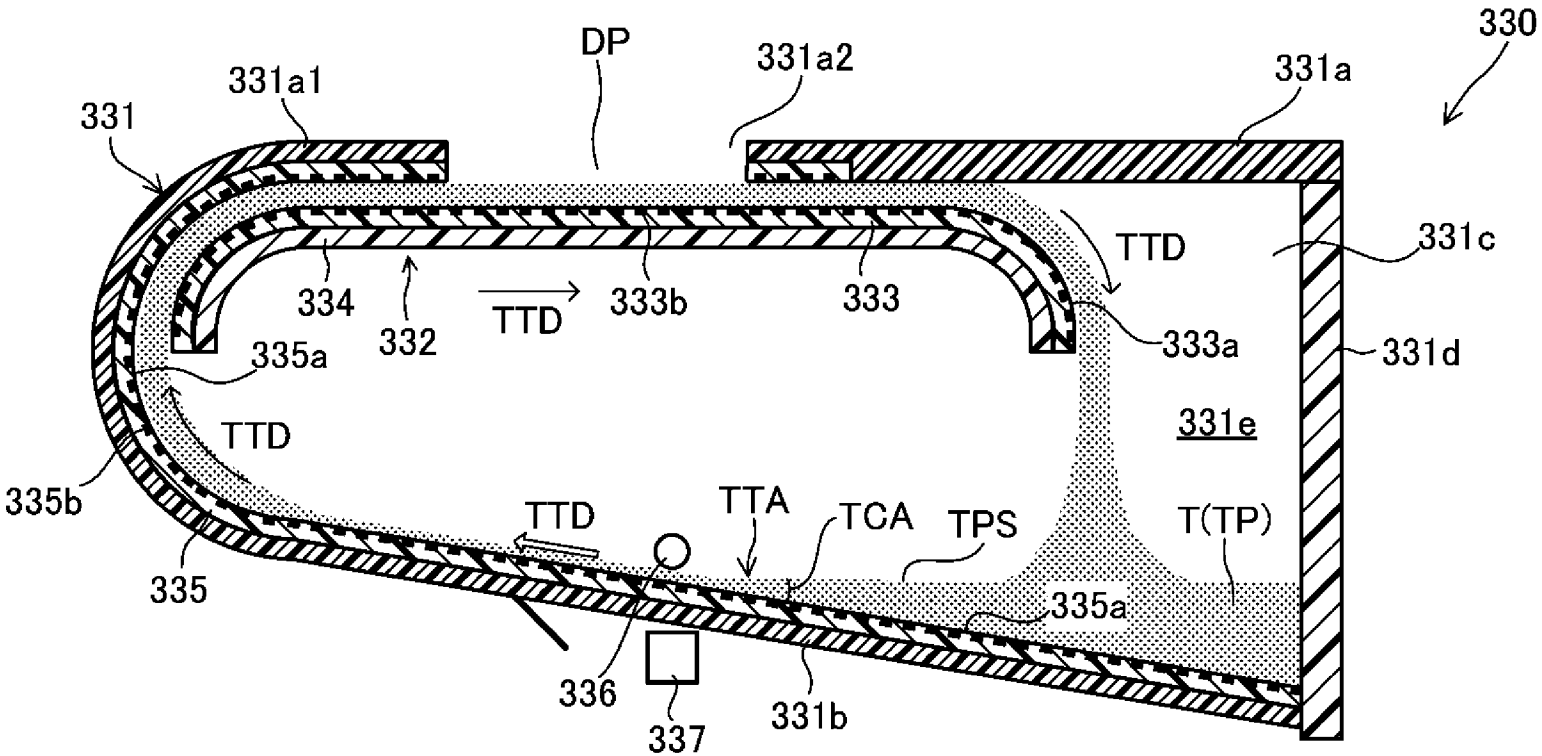
FIG. 21 is a side sectional view of the development apparatus shown in FIG. 17 showing a state in which the toner storage amount has decreased further, as compared with the state shown in FIG. 20.

FIG. 20 is a side sectional view of the development apparatus 330 shown in FIG. 17 showing a state in which the storage amount of the toner T within the developing casing 331 (the amount of toner pool TP) has decreased. FIG. 21 is a side sectional view of the development apparatus 330 shown in FIG. 17 showing a state in which the toner storage amount has decreased further, as compared with the state shown in FIG. 20.

As shown in FIGS. 20 and 21, the above-described toner pool top surface TPS gradually lowers as the storage amount of the toner T within the developing casing 331 decreases.

In such a case, according to the configuration of the present embodiment, the angle (toner contact angle TCA) between the toner pool top surface TPS and the toner sub-transport surface 335*a* in the toner transport start area TTA becomes substantially constant.

Referring to FIGS. 20 and 21, in the present embodiment, even when the storage amount of the toner T decreases (in particular, even when the storage amount of the toner T within the developing casing 331 decreases), the toner contact angle TCA becomes substantially constant.

Thus, in the present embodiment, the state of transport of the toner T from the toner transport start area TTA toward the downstream side with respect to the toner transport direction TTD becomes substantially constant. That is, the transport state of the toner T is stabilized.

Therefore, the configuration of the present embodiment can effectively suppress generation of a transport failure of the toner T (e.g., an extreme decrease in the transport amount), which failure would otherwise occur when the storage amount of the toner T within the developing casing 331 (the storage amount of the toner T at the bottom portion of the toner containing space 331*e*) decreases.

In the configuration of the present embodiment, the casing bottom plate 331*b* is formed in the shape of a flat plate which intersects with a horizontal plane at a small angle (30 degrees or less). Further, the toner sub-transport surface 335*a* is formed as a flat surface which intersects with the horizontal plane at a small angle (30 degrees or less).

By virtue of such a configuration, the greater part portion of the toner T in the toner transport start area TTA receives the action of the traveling-wave electric fields on the toner sub-transport surface 335*a* (in particular, when the storage amount of the toner T within the developing casing 331 decreases).

Therefore, (even in a case as described above), the supply of the toner T from the toner transport start area TTA to a portion of the toner sub-transport surface 335*a* located at the downstream side with respect to the toner transport direction TTD can be performed satisfactorily.

Further, the size of the developing casing 331 in the height direction decreases. Thus, the thickness of the developing apparatus 330 can be reduced. Therefore, a further reduction in the size of the laser printer 300 becomes possible.

<Modifications>

(1) No particular limitation is imposed on the configurations of the toner electric-field transport body 332, the transport wiring substrate 333, and the counter wiring substrate 335 in the above-described embodiment.

For example, the transport electrodes 333*b* can be embedded in the transport-electrode support substrate 333*c* so as not to project from the surface of the transport-electrode support substrate 333*c*. The transport-electrode coating layer 333*d* can be omitted.

Alternatively, the transport electrodes 333*b* can be formed directly on the transport-substrate support member 334. In this case, the transport electrodes 333*b* can be embedded in the transport-electrode support member 334 so as not to project from the upper surface of the transport-electrode support member 334. Further, in this case, the toner main transport surface 333*a* is formed by the upper surface of the transport-electrode support member 334.

The counter electrodes 335*b* can also be, for example, embedded in the counter-electrode support substrate 335*c* so as not to project from the surface of the counter-electrode support substrate 335*c*. The counter-electrode coating layer 335*d* can be omitted.

Alternatively, the counter electrodes 335*b* can be formed directly on the inner wall surface of the casing bottom plate 331*b*. In this case, the counter electrodes 335*b* can be embedded in the casing bottom plate 331*b* so as not to project from the inner wall surface of the casing bottom plate 331*b*. Further, in this case, the toner sub-transport surface 335*a* is formed by the inner wall surface of the casing bottom plate 331*b*.

The longitudinal direction of the transport electrodes 333*b* and that of the counter electrodes 335*b* may be in parallel with the main scanning direction as in the case of the above-described embodiment or may intersect with the main scanning direction.

The direction of arraying the transport electrodes 333*b* and that of arraying the counter electrodes 335*b* may be in parallel with the sub-scanning direction as viewed in plane as in the case of the above-described embodiment or may intersect with the sub-scanning direction as viewed in plane.

No particular limitation is imposed on the transport electrodes 333*b* and the counter electrodes 335*b* with respect to shape and the configuration of electrical connections. For example, in place of the form of a straight line as in the case of the above-described embodiment, the transport electrodes 333*b* and the counter electrodes 335*b* can assume various other forms, such as V-shaped, arc, waves, and serrated.

The pattern of connecting the electrodes is not limited to that of connecting every fourth electrode as in the case of the above-described embodiment. For example, every other electrode or every third electrode may be connected. In this case, the corresponding power circuits are not of four kinds, but can be modified as appropriate such that the phase shift of voltage waveforms is 180°, 120°, etc. Furthermore, the voltage waveform can be rectangular waves, sine waves, and waves of various other shapes.

(2) The arrangement and configuration of the vibration-body vibrating section 337, which constitutes the developer vibrating section of the present invention, are not limited to those of the above-described embodiment and examples.

The vibration-body vibrating section 337 may have any configuration so long as the vibration-body vibrating section 337 can vibrate the vibration body 336 in at least one direction selected from the paper width direction, the height direction, and the front-rear direction.

For example, the vibration-body vibrating section 337 may be configured to vibrate the vibration body 336 in at least two directions selected from the paper width direction, the height direction, and the front-rear direction (or in all three directions) simultaneously.

Further, in the above-described example, the vibration-body vibrating section 337 assumes the form of the coil 337*a*. However, the vibration-body vibrating section 337 may configured as follows.

Example 2

Figure 22:
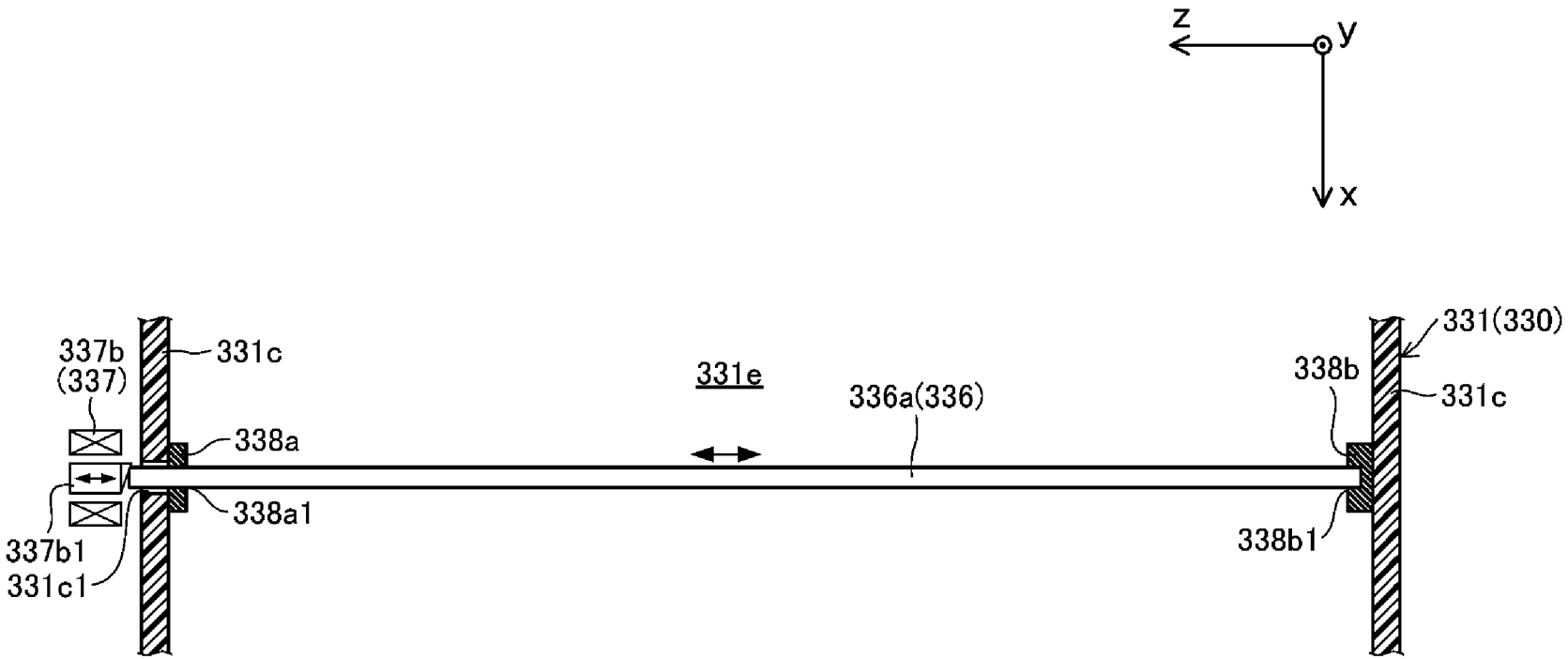
FIG. 22 is a sectional view, as viewed from above, showing the configuration of one modification of the vibration-body drive section shown in FIG. 19.

FIG. 22 is a sectional view, as viewed from the upper side, showing one modification of the vibration-body vibrating section 337 shown in FIG. 19.

Referring to FIG. 22, a solenoid 337*b*, which serves as the vibration-body vibrating section 337, includes an actuator 337*b*1. This actuator 337*b*1 vibrates in the paper width direction when electricity is supplied to the solenoid 337*b* from an AC power supply.

Further, an inclined surface is formed on an end portion of the actuator 337*b*1 on the inner side with respect to the paper width direction (an end portion which faces the above-described one end portion of the vibration rod 336*a*) such that the inclined surface projects inward toward the rearward direction (the direction opposite the x-direction in FIG. 22), which is the insertion direction of the developing apparatus 330.

In the present modification, when the developing apparatus 330 is inserted into the body portion 310 (see FIG. 16) and is placed at a predetermined position, the above-described one end portion of the vibration rod 336*a* comes into engagement with (abuts against) the inclined surface at the above-described end portion of the actuator 337*b*1.

According to the above-described configuration, when the developing apparatus 330 is placed at the predetermined position within the body portion 310 (see FIG. 16). The above-described one end portion of the vibration rod 336*a* comes into engagement with (abuts against) the inclined surface at the above-described end portion of the actuator 337*b*1.

When electricity is supplied to the solenoid 337*b* in this state, the actuator 337*b*1 vibrates. The vibration of the actuator 337*b*1 is transmitted directly to the vibration rod 336*a*, so that the vibration rod 336*a* is vibrated. At that time, the vibration rod 336*a* is elastically supported by the elastic seal 338*a* and the elastic damper 338*b*. Therefore, direct transmission of vibration of the vibration rod 336*a* to the developing casing 331 can be suppressed to the greatest possible extent.

Example 3

Figure 23:
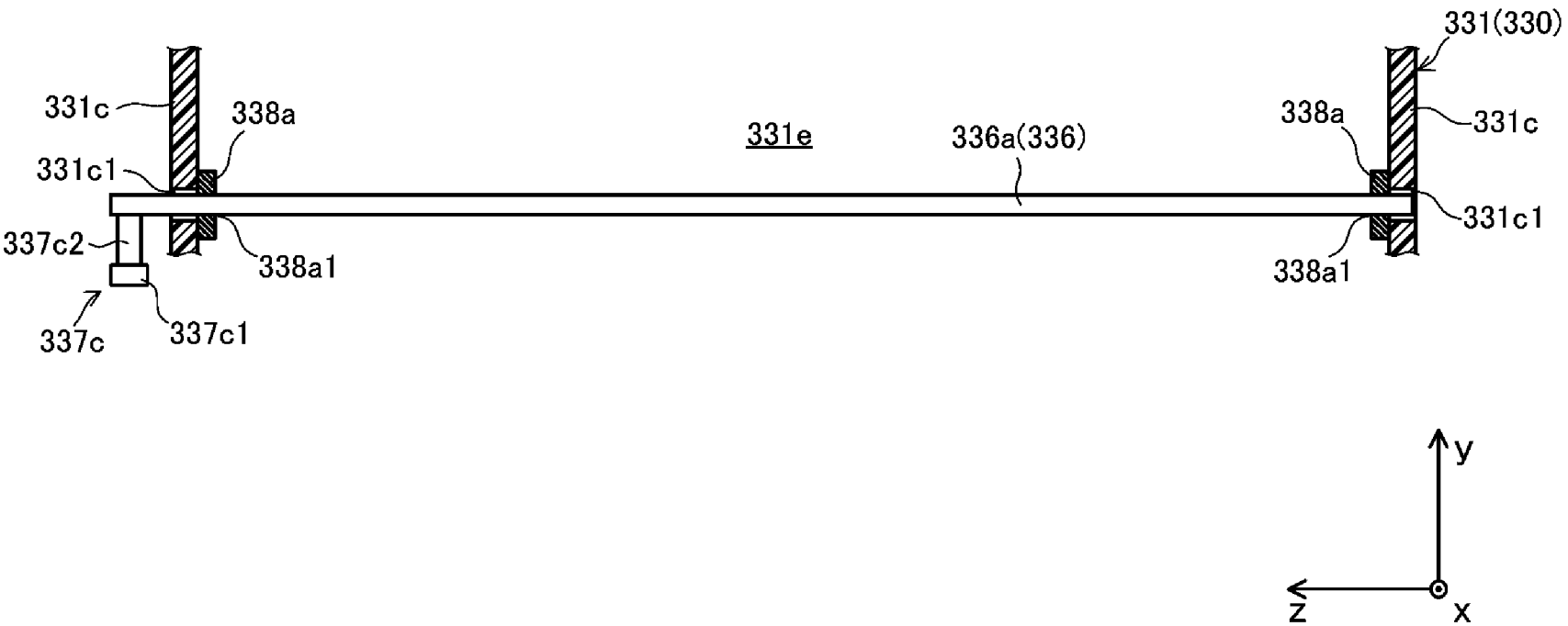
FIG. 23 is a sectional view, as viewed from the front side, showing the configuration of another modification of the vibration-body drive section shown in FIG. 19.

FIG. 23 is a sectional view, as viewed from the front side, showing another modification of the vibration-body vibrating section 337 shown in FIG. 19.

Referring to FIG. 23, in the present modification, casing through holes 331*c*1 are provided for both the paired casing side plates 331*c*. Paired elastic seals 338*a* are provided for these casing through holes 331*c*1. The elastic seals 338*a* have the same configuration as in the above-described example.

Such a configuration can also suppress leakage of the toner T (see FIG. 17) through the casing through holes 331*c*1 to the greatest possible extent, and elastically support the vibration rod 336*a* in an oscillatable manner.

Example 4

Referring to FIG. 23, as in the case of the above-described Example 3, the vibration rod 336*a* is elastically supported at opposite ends thereof by the paired elastic seals 338*a* such that the vibration rod 336*a* can oscillate.

In the present modification, the vibration rod 336*a* is a rod-like member formed of a metal. Further, a rod vibrating section 337*c*, which serves as the vibration-body vibrating section 337 of the present modification, includes a piezoelectric element 337*c*1 and a vibration transmission section 337*c*2.

The piezoelectric element 337*c*1 is configured such that it generates vibration when electricity is supplied thereto. The vibration transmission section 337*c*2 is a rod-like member formed of a metal, and is disposed such that it comes into contact with the vibration body 336 and the piezoelectric element 337*c*1.

This vibration transmission section 337*c*2 is configured so as to transmit the vibration generated by the piezoelectric element 337*c*1 to one end portion of the vibration body 336. That is, in the present modification, when the developing apparatus 330 is inserted into the body portion 310 (see FIG. 16) and is placed at a predetermined position, the above-described one end portion of the vibration rod 336*a* comes into engagement with (abuts against) an upper end portion of the vibration transmission section 337*c*2.

In such a configuration, a predetermined (AC) voltage is supplied from an unillustrated power supply unit to the piezoelectric element 337*c*1. As a result, the piezoelectric element 337*c*1 vibrates. The vibration of the piezoelectric element 337*c*1 is transmitted to the vibration rod 336*a* via the vibration transmission section 337*c*2. Thus, the vibration rod 336*a* vibrates within the developing casing 331 while being supported by the paired elastic seals 338*a*.

According to such a modification, through use of a simple apparatus structure, there can be realized the structure for vibrating the vibration rod 336*a* provided within the toner containing space 331*e*, which is the inner space of the developing casing 331, from the outside of the developing casing 331 of the developing apparatus 330, which can be attached to and detached from the body portion 310 (see FIG. 16).

(3) The arrangement and configuration of the vibration body 336, which constitutes the developer vibrating section of the present invention, are not limited to these of the above-described embodiment and examples.

Figure 24A:
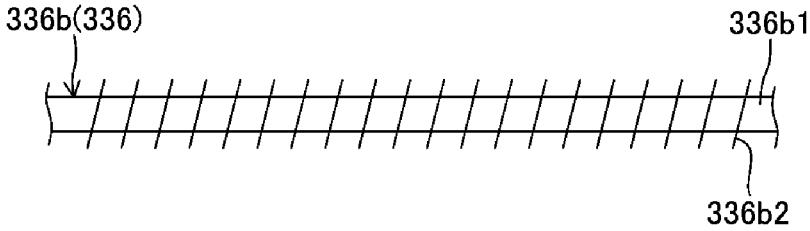
FIG. 24A is an enlarged fragmental plan view showing the configuration of a modification of the vibration body shown in FIG. 19.
Figure 24B:
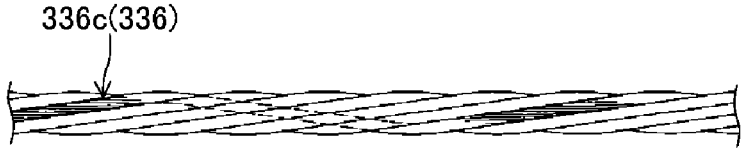
FIG. 24B is an enlarged fragmental plan view showing the configuration of another modification of the vibration body shown in FIG. 19.
Figure 24C:
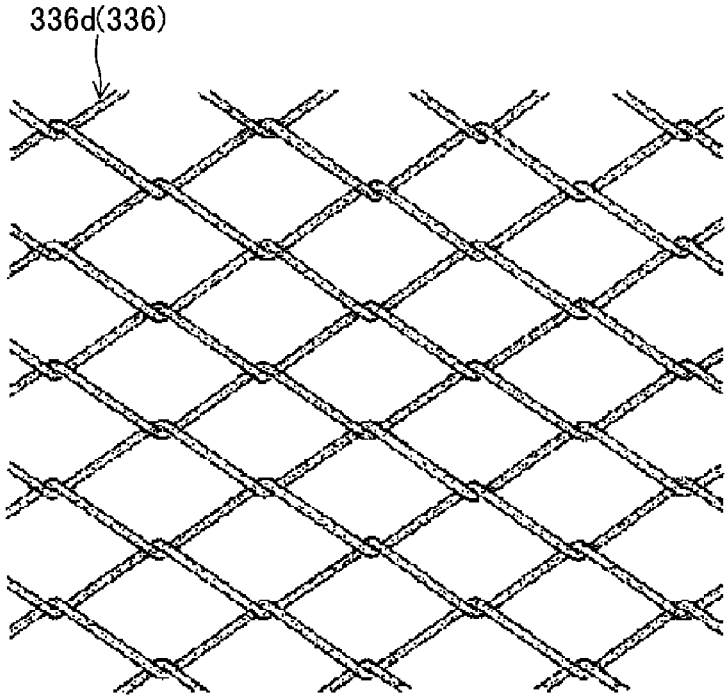
FIG. 24C is an enlarged fragmental plan view showing the configuration of another modification of the vibration body shown in FIG. 19.

FIGS. 24A to 24C are enlarged fragmental plan views showing the configurations of modifications of the vibration body 336 of the example shown in FIG. 19.

For example, as shown in FIG. 24A, a vibration rod 336*b*, which serves as the vibration body 336 of the modification, includes a bar-shaped rod body 336*b*1 and a (plurality of) projecting blades 336*b*2 provided on the rod body 336*b*1.

By virtue of the vibration rod 336*b* having such a configuration, the toner T (see FIG. 17) at the bottom portion of the toner containing space 331*e* (see FIG. 17) can be more effectively fluidized by means of vibration of the vibration rod 336*b* along the longitudinal direction (the paper width direction).

Further, as shown in FIG. 24B, a vibration wire 336*c*, which serves as the vibration body 336 of the modification, is formed by twining a plurality of (e.g., six) thin wires.

Fine projections and depressions are formed on the surface of the vibration wire 336*c*. The toner T (see FIG. 17) at the bottom portion of the toner containing space 331*e* (see FIG. 17) can be more effectively fluidized by means of the fine projections and depressions.

Further, as shown in FIG. 24C, a vibration mesh 336*d*, which serves as the vibration body 336 of the modification, is formed by a plurality of thin wires.

By virtue of the vibration mesh 336*d* having such a configuration, the toner T (see FIG. 17) at the bottom portion of the toner containing space 331*e* (see FIG. 17) can be more effectively fluidized by means of vibration of the vibration mesh 336*d*.

(4) A plurality of sets each including the vibration body 336 and the vibration-body vibrating section 337, which constitute the developer vibrating section of the present invention, may be provided.

Figure 25:
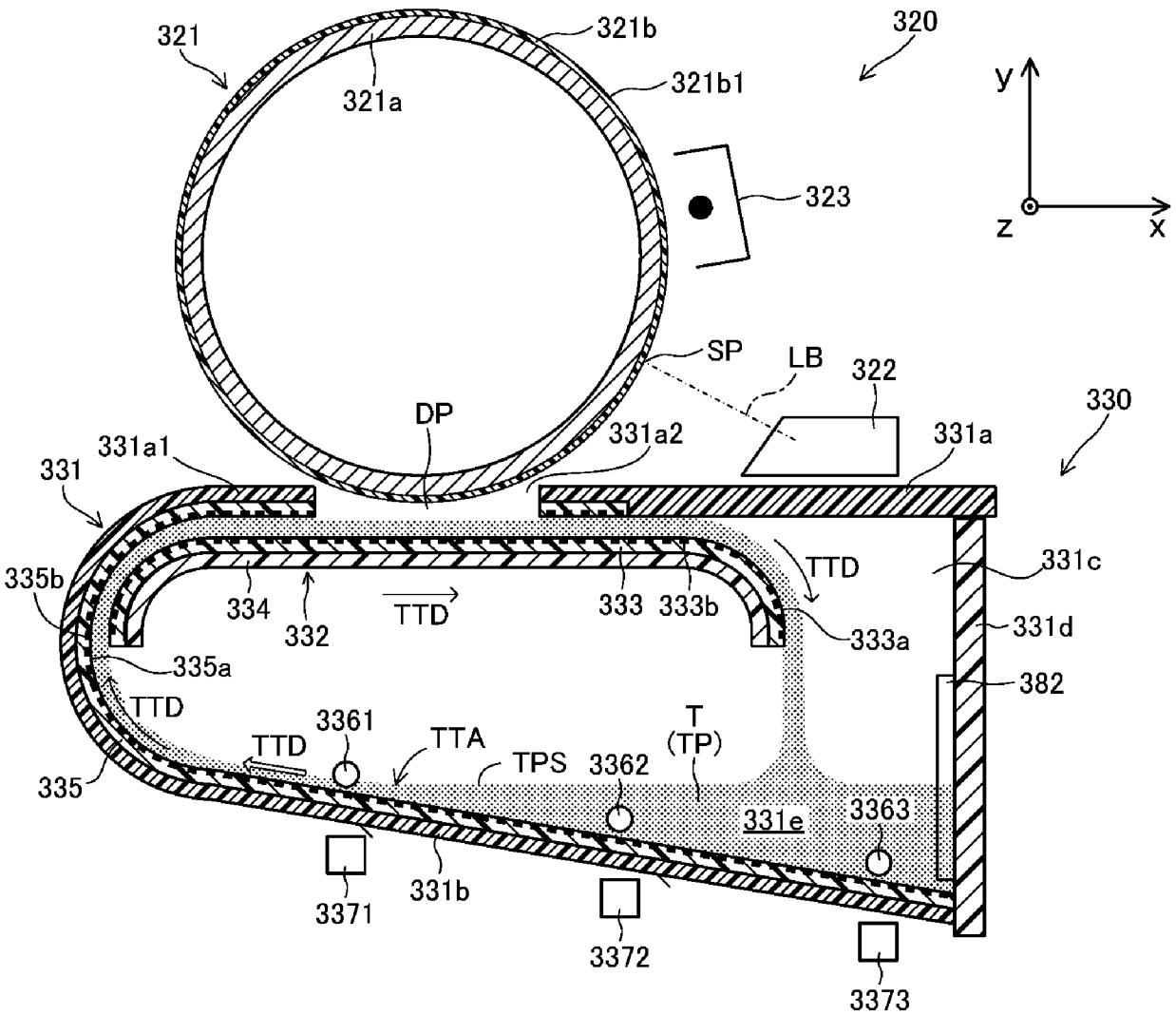
FIG. 25 is a side sectional view showing the configuration of one modification of the laser printer shown in FIG. 16.

FIG. 25 is a side sectional view showing the configuration of one modification of the laser printer 300 shown in FIG. 16.

As shown in FIG. 25, a downstream vibration body 3361, an intermediate vibration body 3362, and an upstream vibration body 3363 are provided within the developing casing 331 (the toner containing space 331*e*).

The downstream vibration body 3361 is provided downstream of the center of the toner sub-transport surface 335*a* with respect to the toner transport direction TTD. The upstream vibration body 3363 is provided upstream of the center of the toner sub-transport surface 335*a* with respect to the toner transport direction TTD. The intermediate vibration body 3362 is provided between the downstream vibration body 3361 and the upstream vibration body 3363.

Outside the developing casing 331 (the toner containing space 331*e*), a downstream-vibration-body vibration section 3371 is provided such that the downstream-vibration-body vibration section 3371 corresponds to the downstream vibration body 3361. Further, an intermediate-vibration-body vibration section 3372 is provided such that the intermediate-vibration-body vibration section 3372 corresponds to the intermediate vibration body 3362. Moreover, an upstream-vibration-body vibration section 3373 is provided such that the upstream-vibration-body vibration section 3373 corresponds to the upstream vibration body 3363.

Notably, the intermediate vibration body 3362 may be omitted. Alternatively, the intermediate body 3362 may be provided at a plurality of locations. Moreover, the downstream-vibration-body vibration section 3371 to the upstream-vibration-body vibration section 3373 may be integrated.

(5) The developer vibrating section of the present invention may be configured such that it can vibrate the entire toner pool TP even when the storage amount of the toner T within the developing casing 331 (the amount of the toner pool TP) decreases. Alternatively, the developer vibrating section of the present invention is preferably configured such that it can vibrate at least the toner within the toner transport start area TTA.

For example, referring to FIG. 25, a toner amount sensor 382 may be provided within the developing casing 331 (the toner containing space 331*e*).

The toner amount sensor 382 is configured to output a signal corresponding to the position of the toner pool top surface TPS; i.e., the amount of the toner T within the toner containing space 331*e*. This toner amount sensor 382 is electrically connected to the control section 380.

In such a configuration, the states of vibrations of the plurality of vibration bodies (the downstream vibration body 3361, etc.) are controlled by the control section 380 in accordance with the position of the toner pool top surface TPS.

For example, when the position of the toner pool top surface TPS is high, all the downstream vibration body 3361 to the upstream vibration body 3363 are vibrated. When the position of the toner pool top surface TPS becomes lower than the downstream vibration body 3361, the intermediate vibration body 3362 and the upstream vibration body 3363 are vibrated. When the position of the toner pool top surface TPS becomes lower than the intermediate vibration body 3362, the upstream vibration body 3363 is vibrated.

Alternatively, for example, when the position of the toner pool top surface TPS is high, only the downstream vibration body 3361 is vibrated. When the position of the toner pool top surface TPS becomes lower than the downstream vibration body 3361, only the intermediate vibration body 3362 vibrated. When the position of the toner pool top surface TPS becomes lower than the intermediate vibration body 3362, only the upstream vibration body 3363 is vibrated.

(6) In place of the above-described configuration including the vibration body 336, there may be used a configuration in which a wall-like or plate-like member surrounding the toner containing space 331*e* (facing the toner containing space 331*e*) is vibrated.

Figure 26:
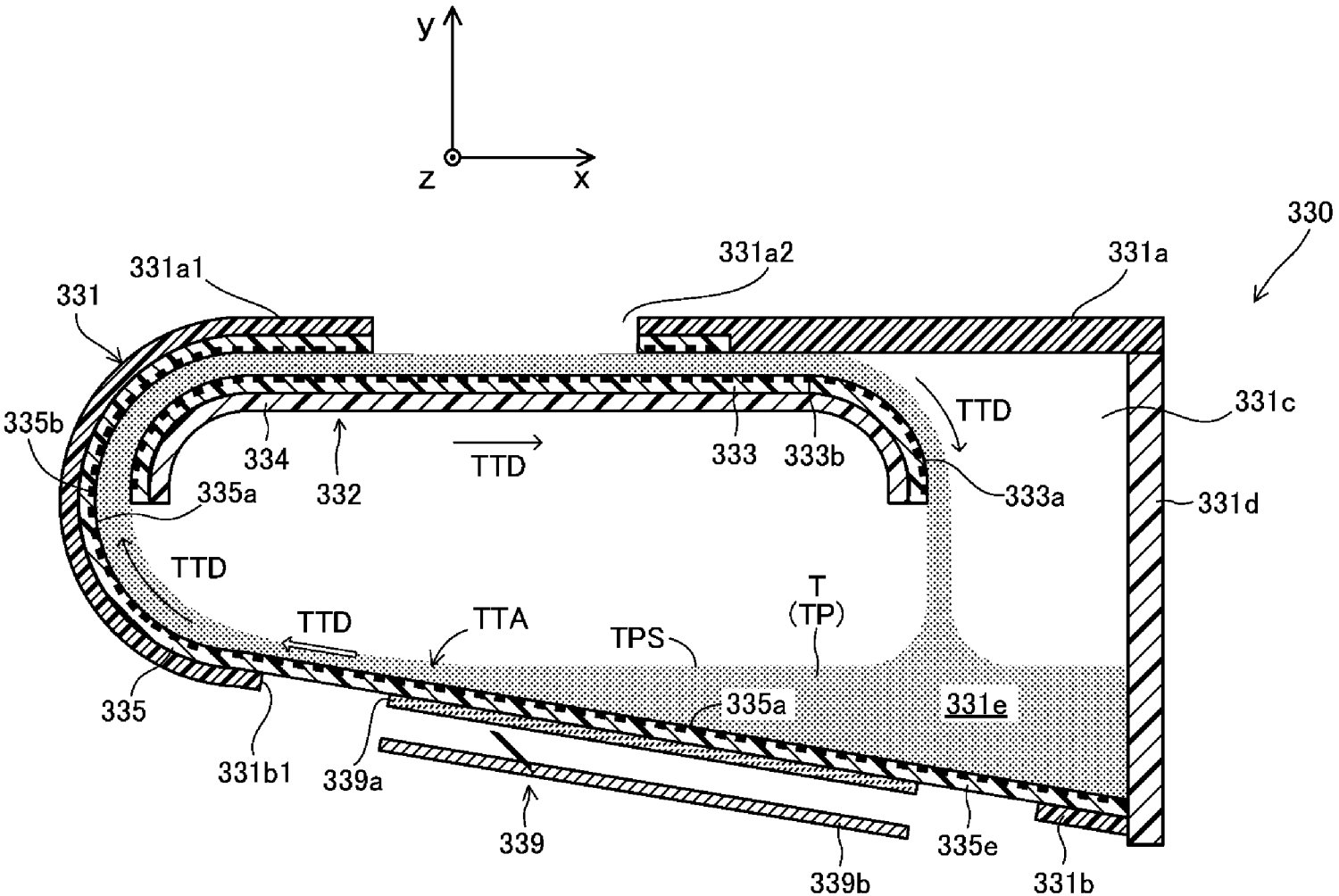
FIG. 26 is a side sectional view showing the configuration of one modification of the developing apparatus shown in FIG. 17.

FIG. 26 is a side sectional view showing the configuration of one modification of the developing apparatus 330 shown in FIG. 17.

Referring to FIG. 26, a bottom plate opening portion 331*b*1 is provided at the center of the casing bottom plate 331*b*. The bottom plate opening portion 331*b*1 is formed as a through hole that penetrates the casing bottom plate 331*b*. The bottom plate opening portion 331*b*1 may be formed to assume a generally rectangular shape or an (elliptical) circular shape.

A portion of the counter wiring substrate 335 corresponding to the bottom plate opening portion 331*b*1 forms a diaphragm section 335*e*, which constitutes the developer vibrating section of the present invention. The edge portion of the diaphragm section 335*e* is supported by the casing bottom plate 331*b*. The diaphragm section 335*e* is configured to vibrate in the thickness direction of the counter wiring substrate 335 with the above-described edge portion serving as a fixed end.

A diaphragm vibrating section 339, which constitutes the developer vibrating section of the present invention, is provided to face the outer surface of the diaphragm section 335*e* (the surface opposite the surface facing the toner containing space 331*e*).

The diaphragm vibrating section 339 shown in FIG. 26 includes a polarized film 339*a* and a polarized-film drive electrode plate 339*b*.

The polarized film 339*a* is a ferroelectric film polarized in the thickness direction and formed into the form of a flat plate. This polarized film 339*a* is fixed to the outer surface of the diaphragm section 335*e*.

The polarized-film drive electrode plate 339*b* is a thin plate formed of a metal. This polarized-film drive electrode plate 339*b* is provided to face the polarized film 339*a* with a predetermined narrow gap therebetween. Further, the polarized-film drive electrode plate 339*b* is disposed parallel to the polarized film 339*a*. Moreover, the polarized-film drive electrode plate 339*b* is electrically connected to output terminals of an unillustrated AC power supply.

In such a configuration, the potential of the polarized-film drive electrode plate 339*b* and the electric field in the vicinity of the polarized-film drive electrode plate 339*b* change in accordance with the output from the AC power supply. Due to this change in the electric field, the polarized film 339*a* is vibrated in the thickness direction thereof.

As a result, the diaphragm section 335*e* is vibrated in the thickness direction thereof. By means of the vibration of the diaphragm section 335*e*, the toner T within the toner containing space 331*e* is fluidized satisfactorily.

As shown in FIG. 26, preferably, the diaphragm section 335*e* is formed over substantially the entirety of the casing bottom plate 331*b*. By virtue of this configuration, the entire toner pool TP can be vibrated satisfactorily. As a result, the toner T in the toner transport start area TTA is fluidized satisfactorily.

Figure 27:
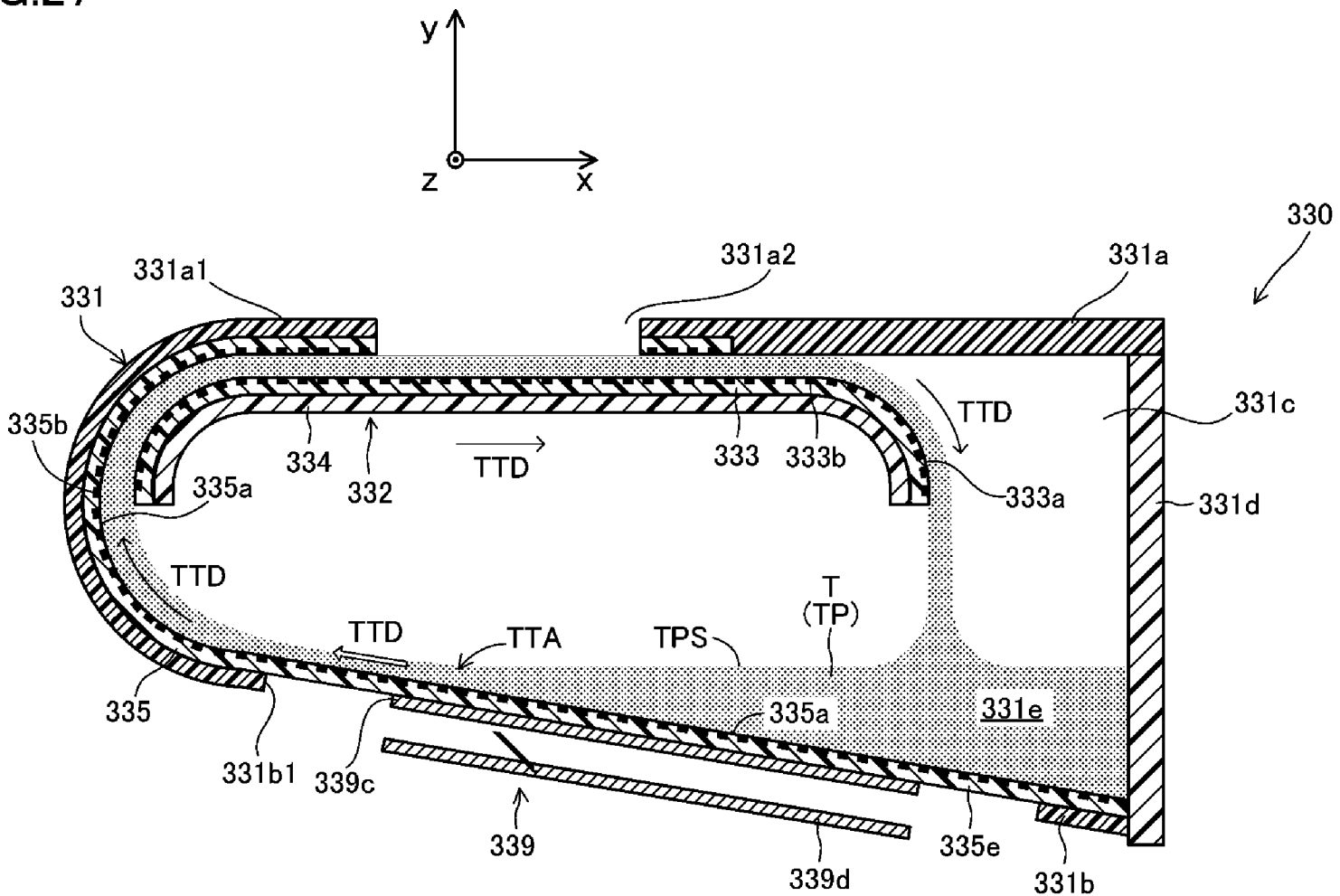
FIG. 27 is a side sectional view showing the configuration of another modification of the developing apparatus shown in FIG. 17 (a modification of the developing apparatus shown in FIG. 26).

FIG. 27 is a side sectional view showing the configuration of another modification of the developing apparatus 330 shown in FIG. 17 (a modification of the developing apparatus 330 shown in FIG. 26).

Referring to FIG. 27, the diaphragm vibrating section 339 of the present modification includes a diaphragm-side electrode plate 339*c* and a diaphragm counter electrode plate 339*d*.

The diaphragm-side electrode plate 339*c* is formed from a flat-plate like member made of a metal. This diaphragm-side electrode plate 339*c* is fixed to the outer surface of the diaphragm section 335*e*.

The polarized-film drive electrode plate 339*b* is formed from a flat-plate like member made of a metal. This polarized-film drive electrode plate 339*b* is provided to face the diaphragm-side electrode plate 339*c* with a predetermined narrow gap therebetween. Further, the polarized-film drive electrode plate 339*b* is disposed parallel to the diaphragm-side electrode plate 339*c*.

The diaphragm-side electrode plate 339*c* and the diaphragm counter electrode plate 339*d* are respectively connected to output terminals of an unillustrated AC power supply. That is, an AC voltage can be applied between the diaphragm-side electrode plate 339*c* and the diaphragm counter electrode plate 339*d*.

In such a configuration, the force (attraction forth or repulsive force) generated between the diaphragm-side electrode plate 339*c* and the diaphragm counter electrode plate 339*d* changes in accordance with the output from the AC power supply. As a result, the diaphragm section 335*e* is vibrated in the thickness direction thereof. By means of the vibration of the diaphragm section 335*e*, the toner T within the toner pool TP (the toner transport start area TTA) can be fluidized satisfactorily.

Figure 28:
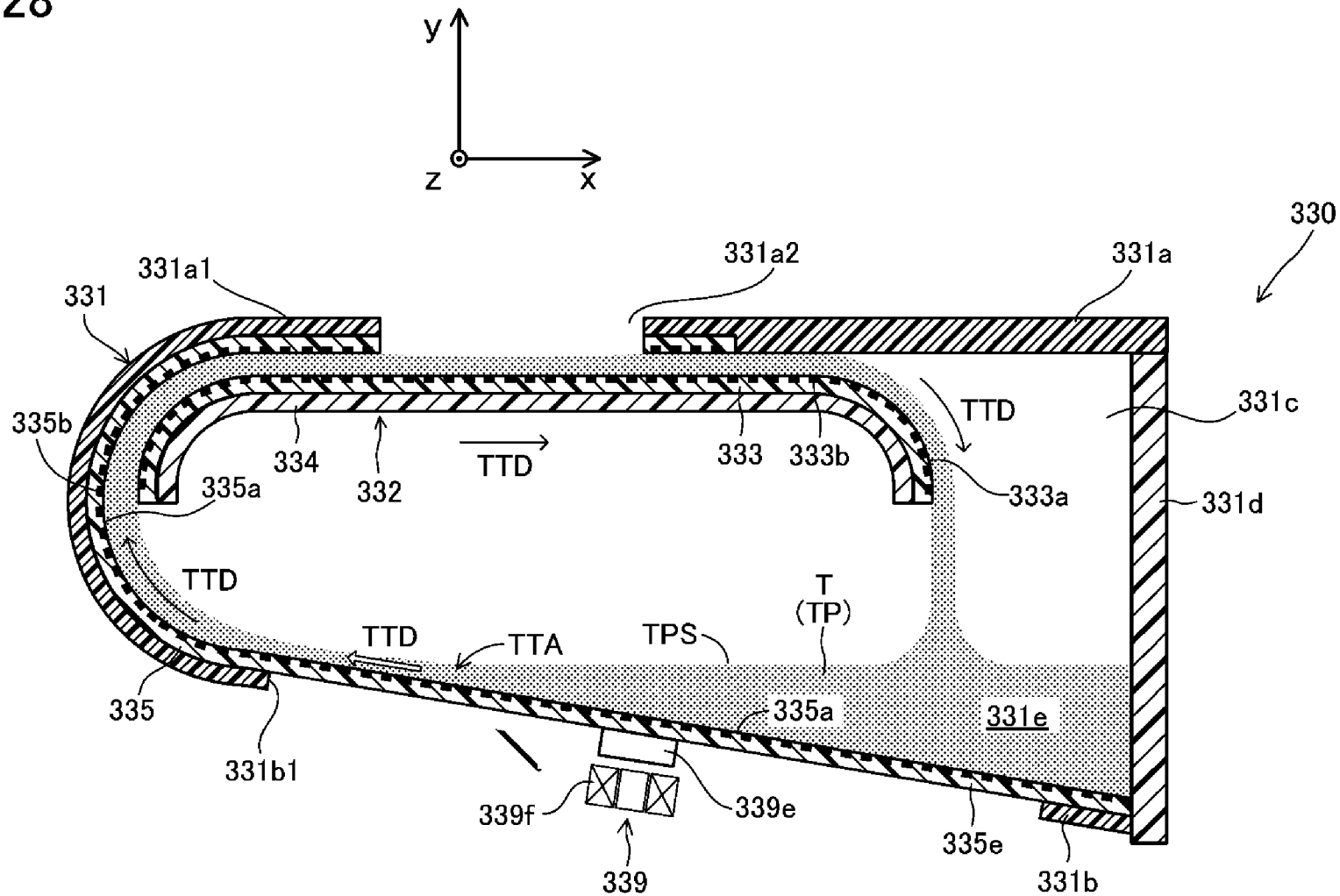
FIG. 28 is a side sectional view showing the configuration of another modification of the developing apparatus shown in FIG. 17.

FIG. 28 is a side sectional view showing the configuration of another modification of the developing apparatus 330 shown in FIG. 17.

Referring to FIG. 28, the diaphragm vibrating section 339 of the present modification includes a diaphragm-side actuator 339*e* and a coil 339*f*.

The diaphragm-side actuator 339*e* is formed of a block-shaped or a plate-shaped magnetic body. This diaphragm-side actuator 339*e* is fixed to the outer surface of the diaphragm section 335*e*.

The coil 339*f* is provided to face the diaphragm-side actuator 339*e* with a predetermined narrow gap therebetween. This coil 339*f* is configured such that it can vibrate the diaphragm-side actuator 339*e* in the thickness direction of the diaphragm section 335*e* when electricity is supplied thereto by an AC power supply. That is, the coil 339*f* is magnetically coupled with the diaphragm-side actuator 339*e*.

In such a configuration, electricity is supplied to the coil 339*f* by the unillustrated AC power supply. As a result, the coil 339*f* generates an alternating magnetic field. Due to this alternating magnetic field, the diaphragm-side actuator 339*e* vibrates.

The vibration of the diaphragm-side actuator 339*e* causes the diaphragm section 335*e* to vibrate in the thickness direction thereof. By means of the vibration of the diaphragm section 335*e*, the toner T within the toner pool TP (the toner transport start area TTA) can be fluidized satisfactorily.

Figure 29:
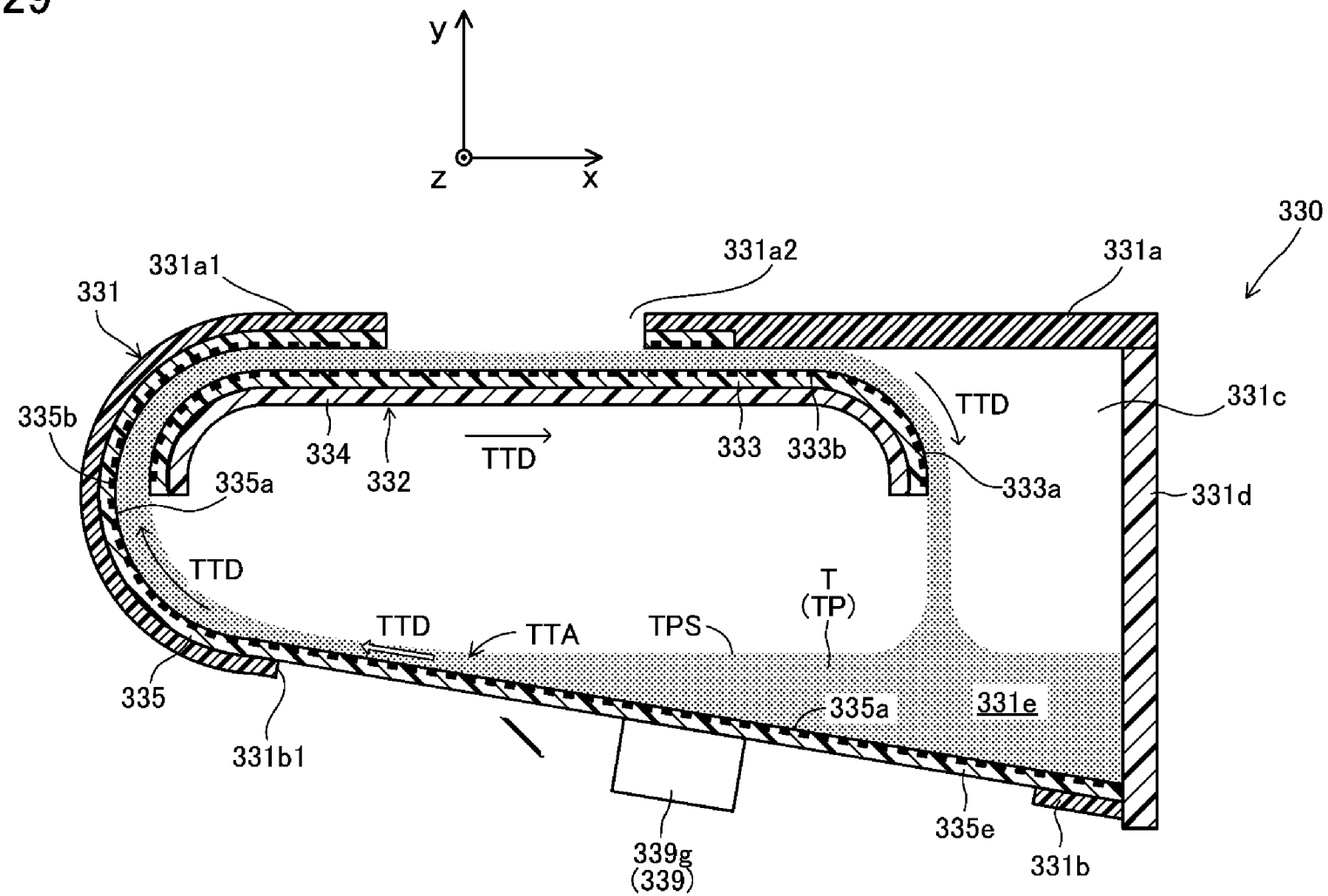
FIG. 29 is a side sectional view showing the configuration of another modification of the developing apparatus shown in FIG. 17.

FIG. 29 is a side sectional view showing the configuration of another modification of the developing apparatus 330 shown in FIG. 17.

Referring to FIG. 29, the diaphragm vibrating section 339 of the present modification includes a diaphragm direct vibrator 339*g*. This diaphragm direct vibrator 339*g* is provided at an approximately central portion of the outer surface of the diaphragm section 335*e*.

The diaphragm direct vibrator 339*g* is configured such that it can directly vibrate the diaphragm section 335*e*. A vibrator or acoustic wave generator may be used as the diaphragm direct vibrator 339*g*.

In such a configuration, the approximately central portion (a portion where the maximum amplitude is attained) of the diaphragm section 335*e* is directly vibrated by means of vibration generated by the diaphragm direct vibrator 339*g*. As a result, the diaphragm section 335*e* vibrates in the thickness direction thereof. By means of the vibration of the diaphragm section 335*e*, the toner T within the toner pool TP (the toner transport start area TTA) can be fluidized satisfactorily.

(7) The casing bottom plate 331*b* and the toner sub-transport surface 335*a* may be provided to form an angle of 60 degrees or greater in relation to a horizontal plane.

Such a configuration reduces the size of the developing casing 331 (the developing apparatus 330) as measured in the front-rear direction. Thus, the size of an apparatus in which a plurality of developing apparatus 330 are arranged in the front-rear direction can be reduced. That is, the size of an image forming apparatus which can form a multicolor image can be reduced.

Further, by virtue of such a configuration, when the storage amount of the toner T within the developing casing 331 (the amount of the toner pool TP) decreases, the toner pool top surface TPS can become horizontal due to the weight of the toner T itself, even if the toner pool TP is not vibrated.

That is, since the toner sub-transport surface 335*a* is a steep slant surface which forms an angle of 60 degrees or greater in relation to a horizontal plane, the toner contact angle TCA is stably maintained at a substantially constant angle due to the weight of the toner T itself, even if the toner pool TP is not vibrated.

(8) Further, a vibration generation source such as a piezoelectric element may be directly provided on the vibration body 336 in FIG. 17 (the downstream vibration body 3361, etc. in FIG. 25). In such a case, the vibration-body vibrating section 337 (the downstream-vibration-body vibrating section 3371, etc. in FIG. 25) can be omitted.

(9) The counter wiring substrate 335 may be partially or entirely omitted.

(10) The developing apparatus 330 may be configured in such a manner that the toner pool top surface TPS is always lower than the rear end portion of the casing bottom plate 331*b* as in the above-described embodiment and modifications.

By virtue of this configuration, the toner contact angle TCA in the toner transport start area TTA can always be maintained in a predetermined state. For example, the toner contact angle TCA can be maintained at a substantially constant angle. Alternatively, the toner contact angle TCA can always be maintained at a small angle of 30 degrees or less.

By virtue of such a configuration, supply of the toner T from the toner pool TP to the toner sub-transport surface 335*a* and the toner main transport surface 333*a* can be performed stably (and satisfactorily) irrespective of the progress of consumption of the toner T.

[2]

<Overall Configuration of Fourth Laser Printer>

Figure 30:
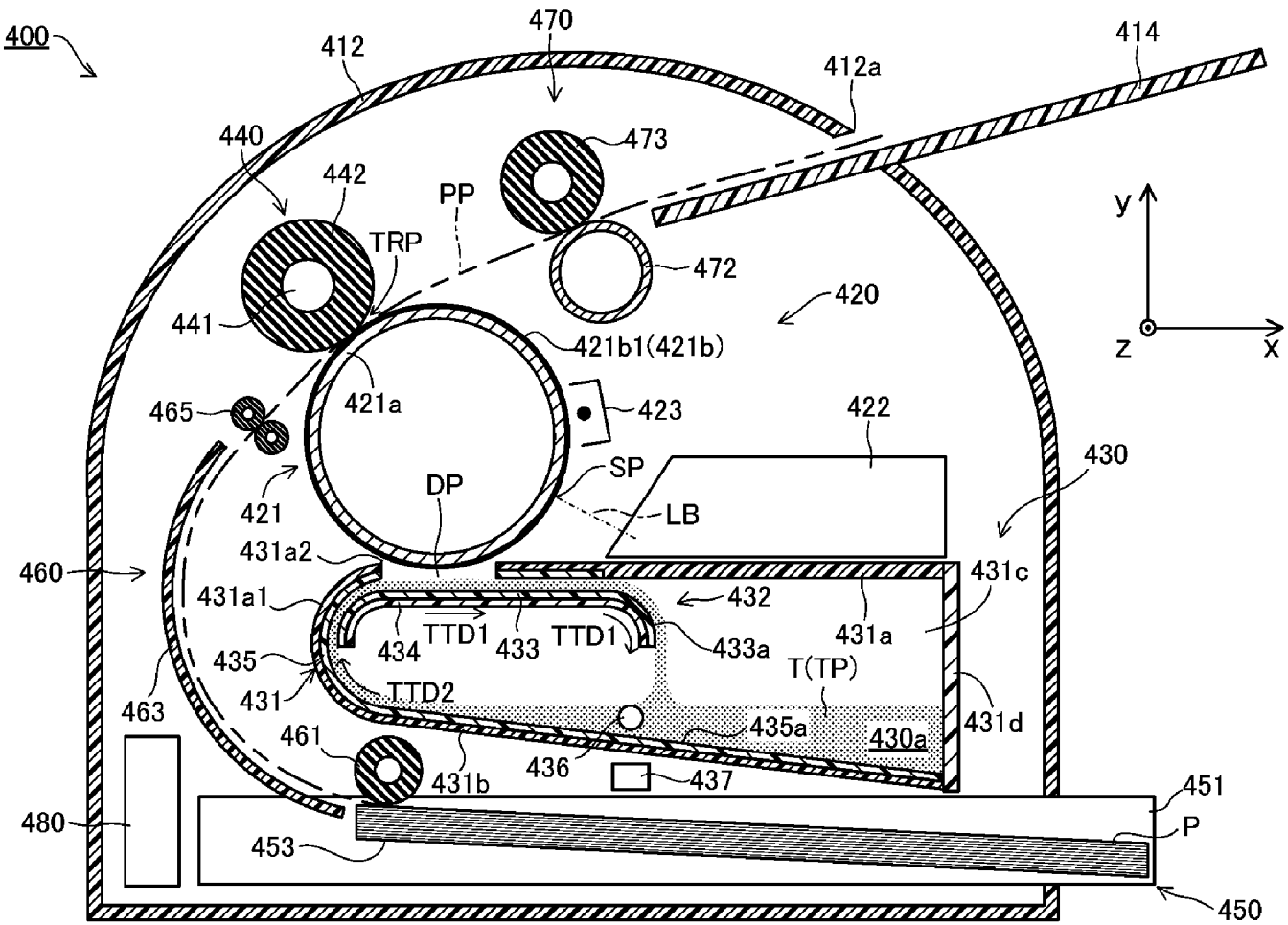
FIG. 30 is a side sectional view showing the schematic configuration of a laser printer to which one embodiment of the present invention is applied.

FIG. 30 is a side sectional view showing the schematic configuration of a laser printer 400 to which the fourth embodiment of the present invention is applied.

<<Body Section>>

Referring to FIG. 30, the laser printer 400, which corresponds to the image forming apparatus of the present invention, includes a body casing 412. The body casing 412 is a member which constitutes an outer cover of the laser printer 400. The body casing 412 is integrally formed from a synthetic resin plate.

The body casing 412 has a paper ejection port 412*a* in the form of a slit-like through-hole located at an upper front portion thereof.

A catch tray 414 is attached to an upper front portion of the body casing 412 at a position corresponding to the paper ejection port 412*a*. The catch tray 414 is configured to receive the paper P which is ejected through the paper ejection port 412*a* and on which an image has been formed.

<<Electrostatic-Latent-Image Forming Section>>

The body casing 412 houses an electrostatic-latent-image forming section 420. The electrostatic-latent-image forming section 420 includes a photoconductor drum 421, which corresponds to the electrostatic-latent-image carrying body and the developer carrying body of the present invention.

The photoconductor drum 421 is a generally cylindrical member. The center axis of rotation of the photoconductor drum 421 is in parallel with the paper width direction. The photoconductor drum 421 is configured to be able to be rotatably driven clockwise in FIG. 30.

Specifically, the photoconductor drum 421 includes a drum body 421*a* and a photoconductor layer 421*b*.

The drum body 421*a* is a metal tube of an aluminum alloy or the like. The photoconductor layer 421*b* is formed on the outer circumference of the drum body 421*a*.

The photoconductor layer 421*b* is formed by a positively chargeable photoconductive layer. That is, the photoconductor layer 421*b* is formed of a substance which exhibits electrical conductivity, with holes serving as a carrier, when it is irradiated with light within a predetermined wavelength band.

The photoconductor drum 421 has an image carrying surface 421*b*1, which serves as the latent-image forming surface and the developer carrying surface of the present invention.

The circumferential surface of the photoconductor layer 421*b* serves as the image carrying surface 421*b*1. The image carrying surface 421*b*1 is formed in parallel with the paper width direction and a main scanning direction, which will be described later. The image carrying surface 421*b*1 is configured such that an electrostatic latent image can be formed by electric-potential distribution.

The photoconductor drum 421 is configured such that the image carrying surface 421*b*1 can move along a sub-scanning direction to be described later (a direction orthogonal to a main scanning direction to be described later).

The electrostatic-latent-image forming section 420 includes a scanner unit 422 and a charger 423.

The scanner unit 422 is configured to generate a laser beam LB. This laser beam LB has a wavelength which is contained in the above-described predetermined wavelength band in which the photoconductor layer 421*b* exhibits electrical conductivity, and is modulated in accordance with image information.

The scanner unit 422 is configured such that it can sweep the laser beam LB along the main scanning direction. The main scanning direction is a direction (the z-axis direction in FIG. 30) parallel to the paper width direction.

That is, the scanner unit 422 is configured and disposed such that it can irradiate the image carrying surface 421*b*1 can be irradiated with the laser beam LB at a predetermined scanning position SP, while sweeping the laser beam LB along the main scanning direction.

The charger 423 is disposed upstream of the scanning direction SP with respect to the direction of movement of the image carrying surface 421*b*1 (direction of rotation of the photoconductor drum 421). The charger 423 is configured and disposed so as to be able to uniformly, positively charge the image carrying surface 421*b*1 at a position located upstream of the scanning position SP with respect to the above-mentioned direction.

The electrostatic-latent-image forming section 420 is configured such that the scanner unit 422 irradiates, with the laser beam LB, the image carrying surface 421*b*1 which is uniformly, positively charged by the charger 423, whereby an electrostatic latent image by electric-potential distribution (charge distribution) can be formed on the image carrying surface 421*b*1.

The electrostatic-latent-image forming section 420 is configured to be able to move the image carrying surface 421*b*1 on which an electrostatic latent image is formed, along the sub-scanning direction, which will be described later.

The "sub-scanning direction" is an arbitrary direction orthogonal to the main scanning direction. Usually, the sub-scanning direction is a direction which intersects with a vertical line. Typically, the sub-scanning direction may be a direction along the front-rear direction of the laser printer 400 (the x-axis direction in FIG. 30).

<<Developing Apparatus>>

The body casing 412 houses a developing apparatus 430, which corresponds to the developer supply apparatus of the present invention. The developing apparatus 430 is disposed such that the developing apparatus 430 faces the photoconductor drum 421 at a developing position DP (developer carrying position).

A toner containing area 430*a* is formed within the developing apparatus 430. This toner containing area 430*a* is a space for containing (storing) a toner T, which is a dry developer in the form of fine particles (powder developer).

When the laser printer 400 is not operated, the toner T is stored at a bottom portion of the toner containing area 430*a*. The ensemble of the toner T stored at the bottom portion of the toner containing area 430*a* will be referred to as a "toner pool TP."

The developing apparatus 430 is configured to transport the toner T along a toner main transport direction TTD1 and a toner sub-transport direction TTD2 as indicated by arrows in FIG. 30.

The toner main transport direction TTD1, which corresponds to the developer main transport direction of the present invention, is a transport direction of the toner T on a toner main transport surface 433*a* to be described later.

The toner main transport direction TTD1 is set such that, when viewed from above (when viewed in a direction parallel with the y-axis direction in FIG. 30), the toner main transport direction TTD1 becomes generally parallel with the sub-scanning direction (the x-axis direction in FIG. 30) (Notably, the toner main transport direction TTD1 may partially extend parallel to the height direction (the y-axis direction in FIG. 30)).

Further, the toner sub-transport direction TTD2, which corresponds to the developer sub-transport direction of the present invention, is a transport direction of the toner T on a toner sub-transport surface 435*a* to be described later.

The toner sub-transport direction TTD2 is also set such that, when viewed from above, the toner sub-transport direction TTD2 becomes generally parallel with the sub-scanning direction (the x-axis direction in FIG. 30) (Notably, the toner sub-transport direction TTD2 also may partially extend parallel to the height direction (the y-axis direction in FIG. 30)).

The developing apparatus 430 is configured to transport the toner T, while circulating it along a circulating transport path formed to have a generally oval (elliptical) shape as viewed in a side sectional view. That is, each of the toner main transport direction TTD1 and the toner sub-transport direction TTD2 is a direction tangent to the circulating transport path at an arbitrary point in the side sectional view.

The developing apparatus 430 is configured and disposed as described below such that it can supply the toner T in a charged state to the image carrying surface 421*b*1, on which an electrostatic latent image is formed, in the vicinity of the developing position DP.

Notably, the toner T used in the present embodiment is a non-magnetic 1-component developer for use in electrophotography.

Figure 31:
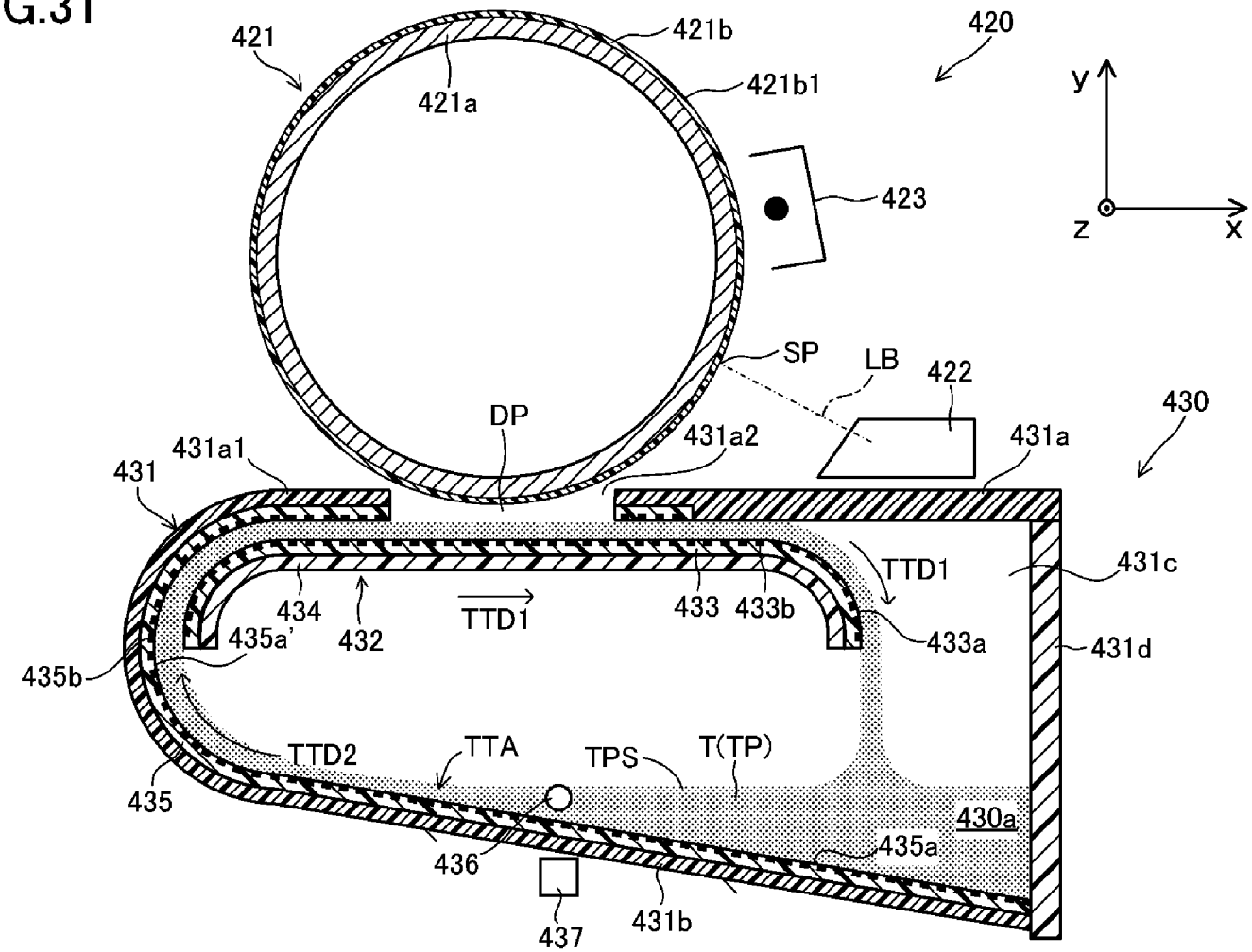
FIG. 31 is an enlarged side sectional view showing an electrostatic-latent-image forming section and a developing apparatus shown in FIG. 30.

FIG. 31 is an enlarged side sectional view showing the electrostatic-latent-image forming section 420 and the developing apparatus 430 shown in FIG. 30.

Referring to FIGS. 30 and 31, the developing apparatus 430 is disposed below the photoconductor drum 421 in such a manner as to face the image carrying surface 421*b*1 at a position located downstream of the scanning position SP with respect to the direction of movement of the image carrying surface 421*b*1.

<<<Developing Casing>>>

Referring to FIGS. 30 and 31, a developing casing 431, which corresponds to the developer containing casing of the present invention, is a box-like member formed of a synthetic resin, and is configured such that it can store the toner T therein. That is, the above-described toner pool TP is stored at the bottom portion of the toner containing area 430*a* formed within the developing casing 431.

A casing top cover 431*a*, which corresponds to the top plate of the developer containing casing of the present invention, is formed to assume a generally J-like shape as viewed in a side sectional view. A developing-section counter plate 431*a*1, which is a rear portion of the casing top cover 431*a*, is smaller in thickness than the remaining portion.

The developing-section counter plate 431*a*1 is composed of a flat plate portion which is located below the photoconductor drum 421, and a semi-cylindrical portion connected to a rear end of the flat plate portion.

A developing opening portion 431*a*2, which corresponds to the opening portion of the present invention, is formed in the flat plate portion of the developing-section counter plate 431*a*1. The developing opening portion 431*a*2 is provided in the developing-section counter plate 431*a*1 at a position facing the image carrying surface 421*b*1 such that the developing opening portion 431*a*2 surrounds the developing position DP.

A casing bottom plate 431*b*, which corresponds to the bottom plate of the developer containing casing of the present invention, is provided to face the casing top cover 431*a*. This casing bottom plate 431*b* is formed from a flat-plate-shaped member having the same thickness as the developing-section counter plate 431*a*1.

The casing bottom plate 431*b* is provided in an inclined state such that the casing bottom plate 431*b* forms a constant angle of 30 degrees or less in relation to a horizontal plane. That is, the casing bottom plate 431*b* is disposed in such a manner that the surface of the casing bottom plate 431*b* located on the upper side in FIG. 30 forms a gentle slope which ascends from the front side toward the rear side.

A rear end portion of the casing bottom plate 431*b* is connected to a lower end of the semi-cylindrical portion of the casing top cover 431*a*. That is, the casing bottom plate 431*b* and the casing top cover 431*a* are integrally formed such that they are smoothly connected at the rear end of the developing casing 431.

Further, the developing casing 431 includes a pair of casing side plates 431*c*. The pair of casing side plates 431*c* are closingly attached to the opposite ends, with respect to the paper width direction, of the casing top cover 431*a* and to those of the casing bottom plate 431*b*.

A casing front closing plate 431*d* is closingly attached to the front end of the casing top cover 431*a*, to that of the casing bottom plate 431*b*, and to those of the paired casing side plates 431*c*.

That is, a space surrounded by the casing top cover 431*a*, the casing bottom plate 431*b*, the paired casing side plates 431*c*, and the casing front closing plate 431*d* constitutes the toner containing area 430*a*.

<<<Toner Electric-Field Transport Body>>>

Referring to FIG. 31, the developing casing 431 houses a toner electric-field transport body 432, which corresponds to the developer transport body of the present invention. That is, the toner electric-field transport body 432 is covered with the developing casing 431.

The toner electric-field transport body 432 is disposed in the inner space of the developing casing 431 at a rearward position, in such a manner as to face the image carrying surface 421*b*1 with the developing opening portion 431*a*2 therebetween. That is, the toner electric-field transport body 432 is provided such that the photoconductor drum 421 and the toner electric-field transport body 432 (the above-described toner main transport surface 433*a*) face each other with the developing opening portion 431*a*2 therebetween.

The opposite ends of the toner electric-field transport body 432 are supported by the paired casing side plates 431*c* in such a manner that the toner electric-field transport body 432 is supported at a position located above the casing bottom plate 431*b* while facing the developing-section counter plate 431*a*1 with a predetermined gap therebetween.

<<<<Transport Wiring Substrate>>>>

Figure 32:
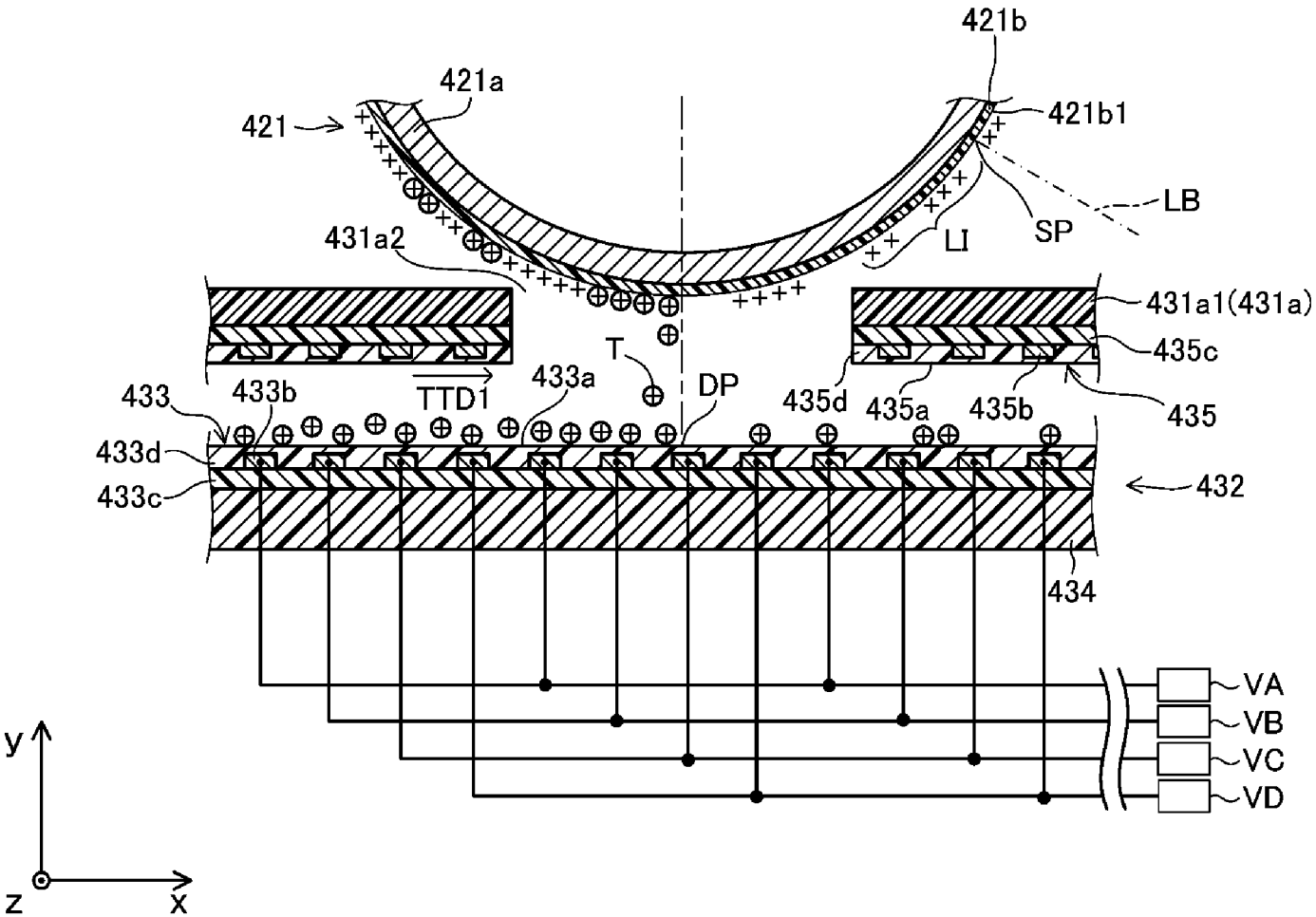
FIG. 32 is an enlarged side sectional view showing a developing opening portion and its periphery of a developer electric-field transport body shown in FIG. 31.

FIG. 32 is an enlarged side sectional view showing a portion of the developer electric-field transport body 432 shown in FIG. 31 in the vicinity of the developing opening portion 431*a*2.

Referring to FIGS. 31 and 32, the toner electric-field transport body 432 includes the transport wiring substrate 433. The transport wiring substrate 433 is disposed in such a manner as to face the image carrying surface 421*b*1 with the developing opening portion 431*a*2 therebetween.

The above-descried toner main transport surface 433*a*, which is the surface of the transport wiring substrate 433 located on the upper side in FIG. 31 is formed in a shape resembling the inverted letter U as viewed from the lateral direction. That is, a rear end portion of the toner main transport surface 433*a* is curved downward along the casing top cover 431*a* of the developing casing 431.

Also, a front end portion of the toner main transport surface 433*a* is curved downward in a manner similar to that of the rear end portion. A portion of the toner main transport surface 433*a* between the above-mentioned front and rear portions assumes the form of a generally flat plate.

The toner main transport surface 433*a*, which corresponds to the developer main transport surface of the present invention, is formed in parallel with the main scanning direction (the z-direction in FIG. 31). Further, the toner main transport surface 433*a* is disposed to face the image carrying surface 421*b*1 of the photoconductor drum 421. The toner main transport surface 433*a* and the image carrying surface 421*b*1 are in the closest proximity to each other at the developing position DP.

Referring to FIG. 32, the transport wiring substrate 433 has a structure similar to that of a flexible printed wiring board. That is, the transport wiring substrate 433 includes a plurality of transport electrodes 433*b*, which correspond to the first transport electrodes of the present invention.

These transport electrodes 433*b* are disposed along the toner main transport surface 433*a*. That is, the transport electrodes 433*b* are disposed near the toner main transport surface 433*a*.

The transport electrodes 433*b* are formed of a copper foil having a thickness of about several tens of micrometers. The transport electrodes 433*b* are formed in a strip-like wiring pattern such that their longitudinal direction becomes parallel with the main scanning direction (orthogonal to the sub-scanning direction).

The plurality of transport electrodes 433*b* are disposed in parallel with one another. These transport electrodes 433*b* are arrayed along the toner main transport direction TTD1 (along the sub-scanning direction).

The large number of transport electrodes 433*b* arrayed along the sub-scanning direction are connected to power supply circuits such that every fourth transport electrodes 433*b* is connected to the same power supply circuit.

That is, the transport electrode 433*b* connected to a power supply circuit VA, the transport electrode 433*b* connected to a power supply circuit VB, the transport electrode 433*b* connected to a power supply circuit VC, the transport electrode 433*b* connected to a power supply circuit VD, the transport electrode 433*b* connected to the power supply circuit VA, the transport electrode 433*b* connected to the power supply circuit VB, . . . , are sequentially arrayed along the sub-scanning direction.

The transport wiring substrate 433 further includes a transport-electrode support substrate 433*c* and a transport-electrode coating layer 433*d*.

The transport-electrode support substrate 433*c* is a flexible film formed of an insulative synthetic resin, such as polyimide resin. The transport electrodes 433*b* are provided on the upper surface of the transport-electrode support substrate 433*c*.

The transport-electrode coating layer 433*d* is provided on the upper surface of the transport-electrode support substrate 433*c* on which the transport electrodes 433*b* are formed. The transport-electrode coating layer 433*d* is provided to cover the transport electrodes 433*b*.

The transport-electrode coating layer 433*d* covers the transport-electrode support substrate 433*c* and the transport electrodes 433*b*, thereby making the toner main transport surface 433*a* smooth.

Referring to FIGS. 31 and 32, the toner electric-field transport body 432 includes a transport-substrate support member 434. The transport-substrate support member 434 is provided so as to support the transport wiring substrate 433 from underneath.

Referring to FIG. 31, a rear end portion of the transport-substrate support member 434 is curved downward along the casing top cover 431*a* of the developing casing 431. Also, a front end portion of the transport-substrate support member 434 is curved downward in a manner similar to that of the rear end portion. A portion of the transport-substrate support member 434 between the above-mentioned front and rear portions assumes the form of a generally flat plate.

That is, the transport-substrate support member 434 is formed in a shape resembling the inverted letter U as viewed from the lateral direction. The transport wiring substrate 433 is supported by the transport-substrate support member 434 in a state in which the transport wiring substrate 433 is bent in a shape resembling the inverted letter U as viewed from the lateral direction.

Referring to FIGS. 31 and 32, the toner electric-field transport body 432 is configured to be able to transport the toner T as follows. Traveling-wave voltages (see FIG. 4) as described above are applied to the transport electrodes 433*b* of the transport wiring substrate 433, so that traveling-wave electric fields along are generated along the toner main transport direction TTD1, whereby the positively charged toner T can be transported in the toner main transport direction TTD1.

<<<Counter Wiring Substrate>>>

Referring to FIGS. 30 and 31, as described above, a recess is formed on the inner surface of the casing top cover 431*a* at a position corresponding to the developing-section counter plate 431*a*1. The counter wiring substrate 435 is attached to the inner surface of the developing casing 431 such that the counter wiring substrate 435 is fitted into the recess.

That is, the counter wiring substrate 435 is supported by the inner wall surface of the developing-section counter plate 431*a*1 such that the counter wiring substrate 435 faces the toner main transport surface 433*a* with a predetermined gap formed therebetween.

In the present embodiment, the counter wiring substrate 435 is provided to correspond to substantially the entire surface of the casing bottom plate 431*b*. That is, the counter wiring substrate 435 is provided such that it extends between the highest position of the casing bottom plate 431*b* (the position at which the lower end of the semi-cylindrical portion of the developing-section counter plate 431*a*1 and the casing bottom plate 431*b* are joined) and the lowest position of the casing bottom plate 431*b* (an end portion of the casing bottom plate 431*b* located on the front side in FIG. 30).

As described above, the counter wiring substrate 435 is supported by the inner wall surface of the developing casing 431 in a state in which the counter wiring substrate 435 is curved into a generally U-like shape or a generally V-like shape.

The toner sub-transport surface 435*a*, which corresponds to the developer sub-transport surface of the present invention, is formed by a portion of the surface of the counter wiring substrate 435 corresponding to the casing bottom plate 431*b*. That is, the toner sub-transport surface 435*a* is a flat surface extending along the inner wall surface of the casing bottom plate 431*b* of the developing casing 431. Specifically, the toner sub-transport surface 435*a* is a flat surface parallel to the inner wall surface.

Further, the toner sub-transport surface 435*a* forms a smooth slope which always forms an angle of 30 degrees or less in relation to a horizontal plane. Further, the toner sub-transport surface 435*a* is formed parallel to the main scanning direction (the z-direction in FIG. 30).

The toner sub-transport surface 435*a* forms a slope which ascends from a lower end portion of the casing front closing plate 431*d* toward a rear end portion of the toner electric-field transport body 432 (an upstream end portion of the toner main transport surface 433*a* with respect to the toner main transport direction TTD1).

In this case, the toner sub-transfer direction TTD2 is a direction in which the toner moves up along the toner sub-transport surface 435*a* toward an upstream end portion of the toner main transport surface 433*a* with respect to the toner main transport direction TTD1.

A toner auxiliary transport surface 435*a*', which corresponds to the developer auxiliary transport surface of the present invention, is formed by a portion of the surface of the counter wiring substrate 435 corresponding to the developing-section counter plate 431*a*1.

That is, the toner auxiliary transport surface 435*a*' is formed by a surface extending along the inner wall surface of a portion (the above-described semi-cylindrical portion) of the developing-section counter plate 431*a*1 located on the upstream side of the developing opening portion 431*a*2 with respect to the toner main transport direction TTD1 and a surface extending along the inner wall surface of a portion (the above-described flat-plate portion) of the developing-section counter plate 431*a*1 located on the downstream side of the developing opening portion 431*a*2.

An upstream end portion of the toner auxiliary transport surface 435*a*' with respect to the toner sub-transport direction TTD2 (an end portion of the toner auxiliary transport surface 435*a*' corresponding to an end portion (a lower end portion in FIG. 31) of the above-described semi-cylindrical portion of the developing-section counter plate 431*a*1 located away from the developing opening portion 431*a*2) is smoothly connected to a downstream end portion of the toner sub-transport surface 435*a* with respect to the toner sub-transport direction TTD2 without formation of a step therebetween.

This toner auxiliary transport surface 435*a*' is also formed in parallel with the main scanning direction (the z-direction in FIG. 31).

The counter wiring substrate 435 has a structure similar to that of the above-described transport wiring substrate 433.

That is, referring to FIG. 32, the counter electrodes 435*b*, which correspond to the second transport electrodes of the present invention, are formed of a copper foil having a thickness of about several tens of micrometers. The counter electrodes 435*b* are formed in a strip-like wiring pattern such that their longitudinal direction becomes parallel with the main scanning direction (orthogonal to the sub-scanning direction).

The plurality of counter electrodes 435*b* are disposed in parallel with one another. These counter electrodes 435*b* are arrayed along the predetermined toner sub-transport direction TTD2 (the sub-scanning direction). The counter electrodes 435*b* are connected to power supply circuits such that every fourth counter electrodes 435*b* is connected to the same power supply circuit.

The plurality of counter electrodes is 435*b* provided along the toner sub-transport surface 435*a*. That is, the counter electrodes 435*b* are provided along the inner wall surface of the casing bottom plate 431*b* of the developing casing 431. Further, the plurality of counter electrodes 435*b* are provided along the toner auxiliary transport surface 435*a*'.

In addition to the above-described counter electrodes 435*b*, the counter wiring substrate 435 includes a counter-electrode support substrate 435*c* and a counter-electrode coating layer 435*d*.

The counter-electrode support substrate 435*c* is a flexible film of an electrically insulative synthetic resin, such as polyimide resin. The counter electrodes 435*b* are provided on the surface of the counter-electrode support substrate 435*c* located on the lower side in the drawing.

The counter-electrode coating layer 435*d* is provided on the lower surface of the counter-electrode support substrate 435*c* on which the counter electrodes 435*b* are formed. The counter-electrode coating layer 435*d* is provided to cover the counter electrodes 435*b*.

As a result of the counter-electrode coating layer 435*d* covering the counter-electrode support substrate 435*c* and the counter electrodes 435*b*, the above-described toner sub-transport surface 435*a* forms a smooth slope which always forms an angle of 30 degrees or less in relation to the horizontal plane. The toner sub-transport surface 435*a* forms a gentle slope which ascends from the front side toward the rear side.

The counter wiring substrate 435 is configured to be able to transport the toner T as follows. As in the case of the above-described transport wiring substrate 433, predetermined voltages are applied to the plurality of counter electrodes 435*b*, so that traveling-wave electric fields are generated along the toner sub-transport direction TTD2, whereby the positively charged toner T can be transported in the toner sub-transport direction TTD2.

<<<Developer Vibrating Section>>>

Referring to FIG. 31, the developing apparatus 430 of the present embodiment includes a vibration element 436 and a vibration-element drive section 437.

The vibration element 436 and the vibration-element drive section 437, which constitute the developer vibrating section of the present invention, are provided near the casing bottom plate 431*b*. That is, the vibration element 436 and the vibration-element drive section 437 are configured as follows so as to vibrate the toner pool TP (the toner T stored at the bottom portion of the toner containing area 430*a* within the developing casing 431).

Figure 33:
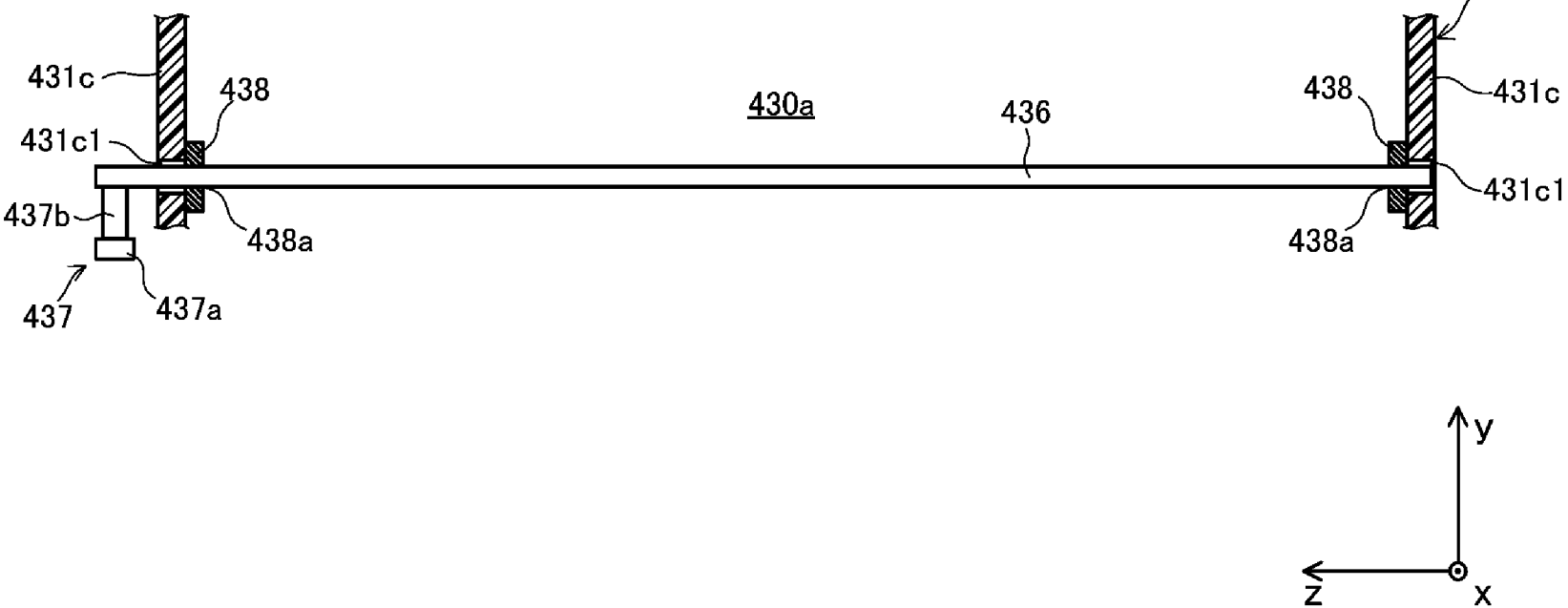
FIG. 33 is a sectional view, as viewed from a front side, of a portion of the developing casing shown in FIG. 31 in the vicinity of a vibration element.

FIG. 33 is an enlarged sectional view, as viewed from a front side, of a portion of the developing casing 431 shown in FIG. 31 in the vicinity of the vibration element 436.

Referring to FIG. 31, the vibration element 436 is a rod-like member, and is disposed to extend along the paper width direction (the z-axis direction in these drawings). This vibration element 436 is disposed within the developing casing 431 (the toner containing area 430*a*) such that it is separated from the toner sub-transport surface 435*a* and faces the toner sub-transport surface 435*a*.

That is, referring to FIGS. 31 and 33, a casing through hole 431*c*1 is formed in each of the paired casing side plates 431*c*. The casing through hole 431*c*1 is formed to have a diameter slightly larger than the diameter of the vibration element 436. The vibration element 436 is disposed such that it penetrates the paired casing through holes 431*c*1.

The vibration-element drive section 437 is disposed outside the developing casing 431 (the toner containing area 430*a*). The vibration-element drive section 437 is configured as follows in order to vibrate the vibration element 436 from the outside of the developing casing 431.

Specifically, referring to FIG. 33, the vibration-element drive section 437 includes a vibration generation section 437*a* and a vibration transmission section 437*b*.

The vibration generation section 437*a* is constituted by a piezoelectric element, a vibrator, or the like which can generate vibration upon supply of electricity thereto.

The vibration transmission section 437*b* is a rod-like member formed of a metal, and is disposed such that it comes into contact with the vibration element 436 and the vibration generation section 437*a*. This vibration transmission section 437*b* is configured so as to transmit the vibration generated by the vibration generation section 437*a* to one end portion of the vibration element 436.

Paired elastic seals 438 are bonded to the inner surfaces of the casing side plates 431*c* (the surfaces facing the toner containing area 430*a*) at positions corresponding to the casing through holes 431*c*1. The elastic seals 438 are configured in such a manner that they suppress the leakage of the toner T (see FIG. 31) to the outside of the developing casing 431 through the casing through holes 431*c*1, and support the vibration element 436.

Specifically, each of the elastic seals 438 is a disk-shaped member formed of a synthetic rubber. A seal through hole 438*a* is provided at an approximately central portion of the elastic seal 438. The seal through holes 438*a* are formed to have a diameter slightly smaller than the diameter of the vibration element 436.

The elastic seals 438 are disposed such that the center axes of the casing through holes 431*c*1 extending in the paper width direction (the z-axis direction in FIG. 33) and the center axes of the seal through holes 438*a* extending in the paper width direction generally coincide with each other. That is, the vibration element 436 is supported by the casing side plates 431*c* via the elastic seals 438 in an oscillatable manner.

<<Transfer Section>>

Referring again to FIG. 30, a transfer section 440 is provided in such a manner as to face the image carrying surface 421*b*1 at a position located downstream, with respect to the direction of rotation of the photoconductor drum 421, of the position where the photoconductor drum 421 and the developing apparatus 430 face each other.

The transfer section 440 includes a rotary center shaft 441, which is a roller-like member and is made of a metal, and a semiconductive rubber layer 442, which is circumferentially provided on the rotary center shaft 441. The rotary center shaft 441 is disposed in parallel with the main scanning direction (the z-axis direction in FIG. 30). A high-voltage power supply is connected to the rotary center shaft 441. The semiconductive rubber layer 442 is formed of a synthetic rubber containing carbon black or the like kneadingly mixed thereinto such that the rubber layer exhibits semiconductivity.

The transfer section 440 is configured to be able to transfer the toner T from the image carrying surface 421*b*1 to the paper P by means of being rotatably driven counterclockwise while a predetermined transfer voltage is applied between the transfer section 440 and the drum body 421*a* of the photoconductor drum 421.

<<Paper Feed Cassette>>

A paper feed cassette 450 is disposed under the developing apparatus 430. A paper feed cassette case 451 is a box-like member used to form the casing of the paper feed cassette 450 and opens upward. The paper feed cassette case 451 is configured to be able to contain a large number of sheets of the paper P of up to size A4 (210 mm width×297 mm length) in a stacked state.

A paper-pressing plate 453 is disposed within the paper feed cassette case 451. The paper-pressing plate 453 is supported by the paper feed cassette case 451 in such a manner as to pivotally move on a pivot at its front end portion, so that its rear end can move vertically in FIG. 30. An unillustrated spring urges the rear end portion of the paper-pressing plate 453 upward.

<<Paper Transport Section>>

A paper transport section 460 is housed within the body casing 412. The paper transport section 460 is configured to be able to feed the paper P to a transfer position TRP where the transfer section 440 and the image carrying surface 421*b*1 face each other with a smallest gap therebetween. The paper transport section 460 includes a paper feed roller 461, a paper guide 463, and paper transport guide rollers 465.

The paper feed roller 461 includes a rotary center shaft parallel to the main scanning direction and a rubber layer, which is circumferentially provided on the rotary center shaft. The paper feed roller 461 is disposed in such a manner as to face a leading end portion, with respect to the paper transport direction, of the paper P stacked on the paper-pressing plate 453 housed within the paper feed cassette case 451. The paper guide 463 and the paper transport guide rollers 465 are configured to be able to guide to the transfer position TRP the paper P which has been delivered by the paper feed roller 461.

<<Fixing Section>>

A fixing section 470 is housed within the body casing 412. The fixing section 470 is disposed downstream of the transfer position TRP with respect to the paper transport direction.

The fixing section 470 is configured to apply pressure and heat to the paper P which has passed the transfer position TRP and bears an image in the toner T, thereby fixing the image in the toner T on the paper P. The fixing section 470 includes a heating roller 472 and a pressure roller 473.

The heating roller 472 includes a cylinder which is made of a metal and whose surface is exfoliation-treated, and a halogen lamp which is housed within the cylinder. The pressure roller 473 includes a rotary center shaft which is made of a metal, and a silicone rubber layer which is circumferentially provided on the rotary center shaft. The heating roller 472 and the pressure roller 473 are disposed in such a manner as to press against each other under a predetermined pressure.

The heating roller 472 and the pressure roller 473 are configured and disposed so as to be able to deliver the paper P toward the paper ejection port 412*a* while applying pressure and heat to the paper P.

<<Control Section>>

A control section 480 is accommodated within the body casing 412. The control section 480 includes a ROM, a CPU, a RAM, a re-writable ROM, and an interface.

The ROM stores various routines executed by the CPU for operation of the laser printer 400, tables, etc. The CPU is configured such that it can read out a routine or the like from the ROM, and execute the routine while storing data in the RAM and the re-writable ROM when necessary.

The CPU is connected via the interface to various sensors and switches provided in the laser printer 400. Further, the CPU is configured to control the operations of various sections, such as the electrostatic-latent-image forming section 420, developing apparatus 430, and the transfer section 440, via the interface.

<Outline of Image Forming Operation of the Laser Printer>

The outline of an image forming operation of the laser printer 400 having such a configuration will next be described with reference to the drawings. Notably, various operations as described below are performed under the control by the CPU of the control section 480.

<<Paper Feed Operation>>

Referring to FIG. 30, the paper-pressing plate 453 urges the paper P stacked thereon upward toward the paper feed roller 461. This causes the top paper P of a stack of the paper P on the paper-pressing plate 453 to come into contact with the circumferential surface of the paper feed roller 461.

When the paper feed roller 461 is rotatably driven clockwise in FIG. 30, a leading end portion with respect to the paper transport direction of the top paper P is moved toward the paper guide 463. Then, the paper guide 463 and the paper transport guide rollers 465 transport the paper P to the transfer position TRP.

<<Formation of Toner Image on Image Carrying Surface>>

While the paper P is being transported to the transfer position TRP as described above, an image in the toner T is formed as described below on the image carrying surface 421*b*1, which is the circumferential surface of the photoconductor drum 421.

<<<Formation of Electrostatic Latent Image>>>

First, the charger 423 uniformly charges a portion of the image carrying surface 421*b*1 of the photoconductor drum 421 to positive polarity.

Referring to FIG. 32, as a result of the clockwise rotation of the photoconductor drum 421 in the drawing, the portion of the image carrying surface 421*b*1 which has been charged by the charger 423 moves along the sub-scanning direction to the scanning position SP, where the portion of the image carrying surface 421*b*1 faces (faces straight toward) the scanner unit 422.

At the scanning position SP, the charged portion of the image carrying surface 421*b*1 is irradiated with the laser beam LB modulated on the basis of image information, while the laser beam LB sweeps along the main scanning direction. Certain positive charges are lost from the charged portion of the image carrying surface 421*b*1, according to a state of modulation of the laser beam LB. By this procedure, an electrostatic latent image LI in the form of an imagewise distribution of positive charges is formed on the image carrying surface 421*b*1.

As a result of the clockwise rotation of the photoconductor drum 421 in the drawing, the electrostatic latent image LI formed on the image carrying surface 421*b*1 moves toward the developing position DP.

<<<Fluidization of Toner>>>

Referring to FIG. 33, a predetermined AC voltage is output from an unillustrated power supply unit to the vibration generation section 437*a*.

As a result, the vibration generation section 437*a* vibrates. The vibration of the vibration generation section 437*a* is transmitted to the vibration element 436 via the vibration transmission section 437*b*. Thus, the vibration element 436 vibrates within the developing casing 431 while being supported by the elastic seals 438.

Referring to FIG. 31, by mean of such vibration of the vibration element 436, the toner pool TP (the toner T stored at the bottom portion of the toner containing area 430*a* of the developing casing 431) is vibrated. This vibrated toner pool TP is fluidized such that the toner pool TP behaves like a liquid.

<<<Transport of Charged Toner>>>

Referring to FIG. 31, predetermined voltages (similar to those shown in FIG. 4) are applied to the counter wiring substrate 435. Thus, predetermined traveling-wave electric fields are formed on the counter wiring substrate 435 (the toner sub-transfer surface 435*a* and the toner auxiliary transfer surface 435*a*').

As a result, the above-described traveling-wave electric fields generated along the toner sub-transfer surface 435*a* acts on the toner T in a region (a toner transport start area TTA) located at a rear end portion of the sufficiently fluidized toner pool TP and near the toner sub-transfer surface 435*a*.

Thus, the toner T is transported in the toner sub-transport direction TTD2 from the toner transport start area TTA such that the toner T moves up along the sloped toner sub-transfer surface 435*a* having a constant inclination angle, and the cylindrical inner surface portion of the toner auxiliary transfer surface 435*a*'.

Notably, the toner transport start area TTA moves frontward and downward along the toner sub-transfer surface 435*a* and the toner auxiliary transfer surface 435*a*' as the highest position of the toner pool TP (a toner pool top surface TPS) lowers as a result of consumption of the toner.

The toner T having moved up along the toner auxiliary transfer surface 435*a*' is guided to a position where the counter wiring substrate 435 faces the furthest upstream portion (a left-side lower end portion in FIG. 31) of the transport wiring substrate 433 with respect to the toner main transport direction TTD1.

The toner T having being guided to a position between the transport wiring substrate 433 and the counter wiring substrate 435 is transported to the developing position DP by means of the traveling-wave electric fields generated along the toner main transport surface 433*a* of transport wiring substrate 433 and the toner auxiliary transport surface 435*a*' and the toner sub-transport surface 435*a* of the counter wiring substrate 435.

The toner T having passed through the developing position DP falls down from a frontmost end portion of the toner main transport surface 433*a*, so that the toner T returns to the above-described toner pool TP.

<<<Development of Electrostatic Latent Image>>>

Referring to FIG. 32, the positively charged toner T is transported to the developing position DP as described above.

In the vicinity of the developing position DP, the toner T adheres to portions of the electrostatic latent image LI on the image carrying surface 421*b*1 at which positive charges are lost. That is, the electrostatic latent image LI on the image carrying surface 421*b*1 of the photoconductor drum 421 is developed with the toner T.

Thus, an image in the toner T is carried on the image carrying surface 421*b*1.

<<Transfer of Toner Image from Image Carrying Surface to Paper>>

Referring to FIG. 30, as a result of clockwise rotation of the image carrying surface 421*b*1 in FIG. 30, an image in the toner T which has been carried on the image carrying surface 421*b* of the photoconductor drum 421 as described above is transported toward the transfer position TRP.

At the transfer position TRP, the image in the toner T is transferred from the image carrying surface 421*b*1 onto the paper P.

<<Fixing and Ejection of Paper>>

The paper P onto which an image in the toner T has been transferred at the transfer position TRP is sent to the fixing section 470 along the paper path PP.

The paper P is nipped between the heating roller 472 and the pressure roller 473, thereby being subjected to pressure and heat. By this procedure, the image in the toner T is fixed on the paper P.

Subsequently, the paper P is sent to the paper ejection port 412*a* and is then ejected onto the catch tray 414 through the paper ejection port 412*a*.

<Actions and Effects Achieved by the Configuration of the Embodiment>

In the configuration of the present embodiment, the casing bottom plate 431*b* is formed in the shape of a flat plate which intersects with a horizontal plane at a constant angle. Further, the toner sub-transport surface 435*a* is formed as a flat surface which intersects with the horizontal plane at a constant angle.

Figure 34:
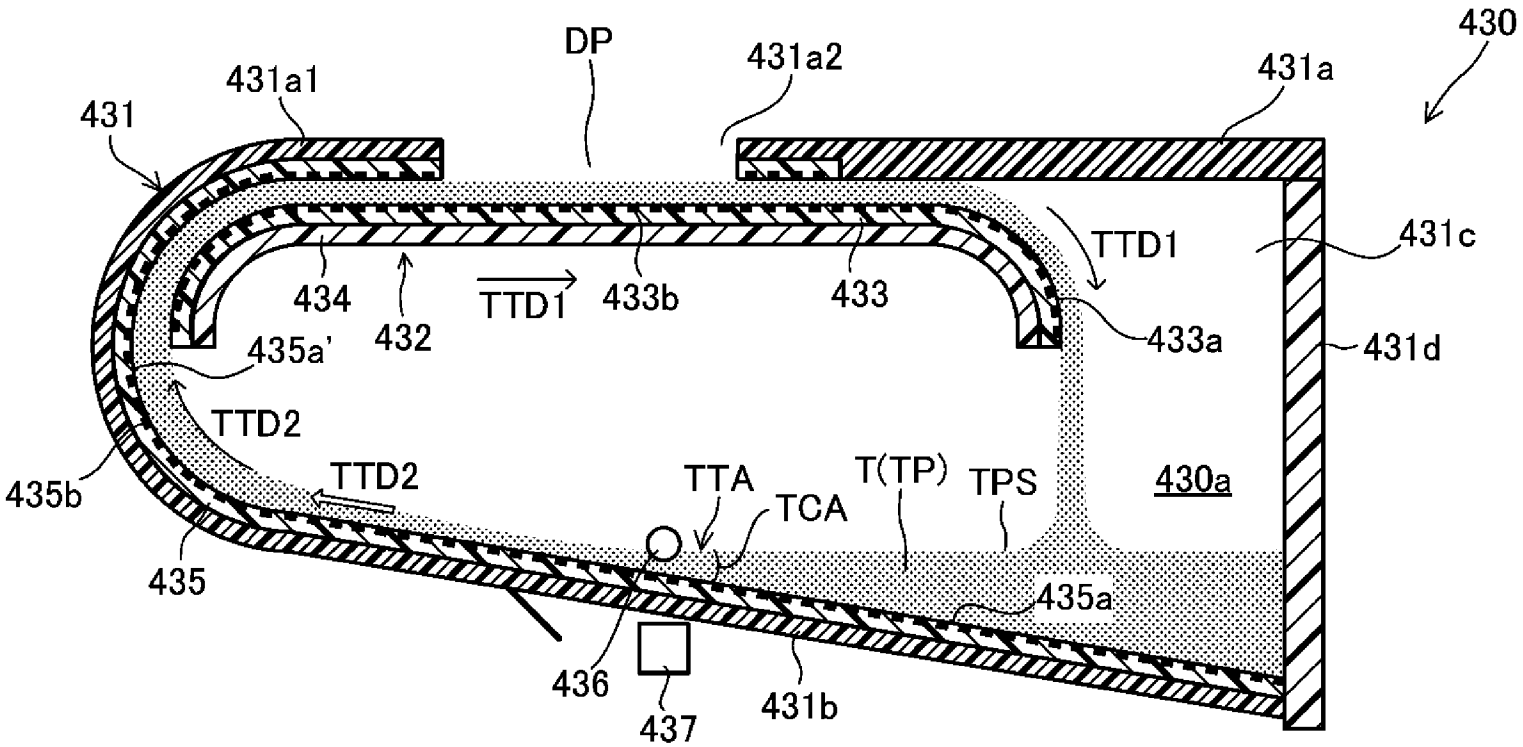
FIG. 34 is a side sectional view of the development apparatus shown in FIG. 31 showing a state in which the storage amount of toner within a developing casing (amount of toner pool) has decreased.
Figure 35:
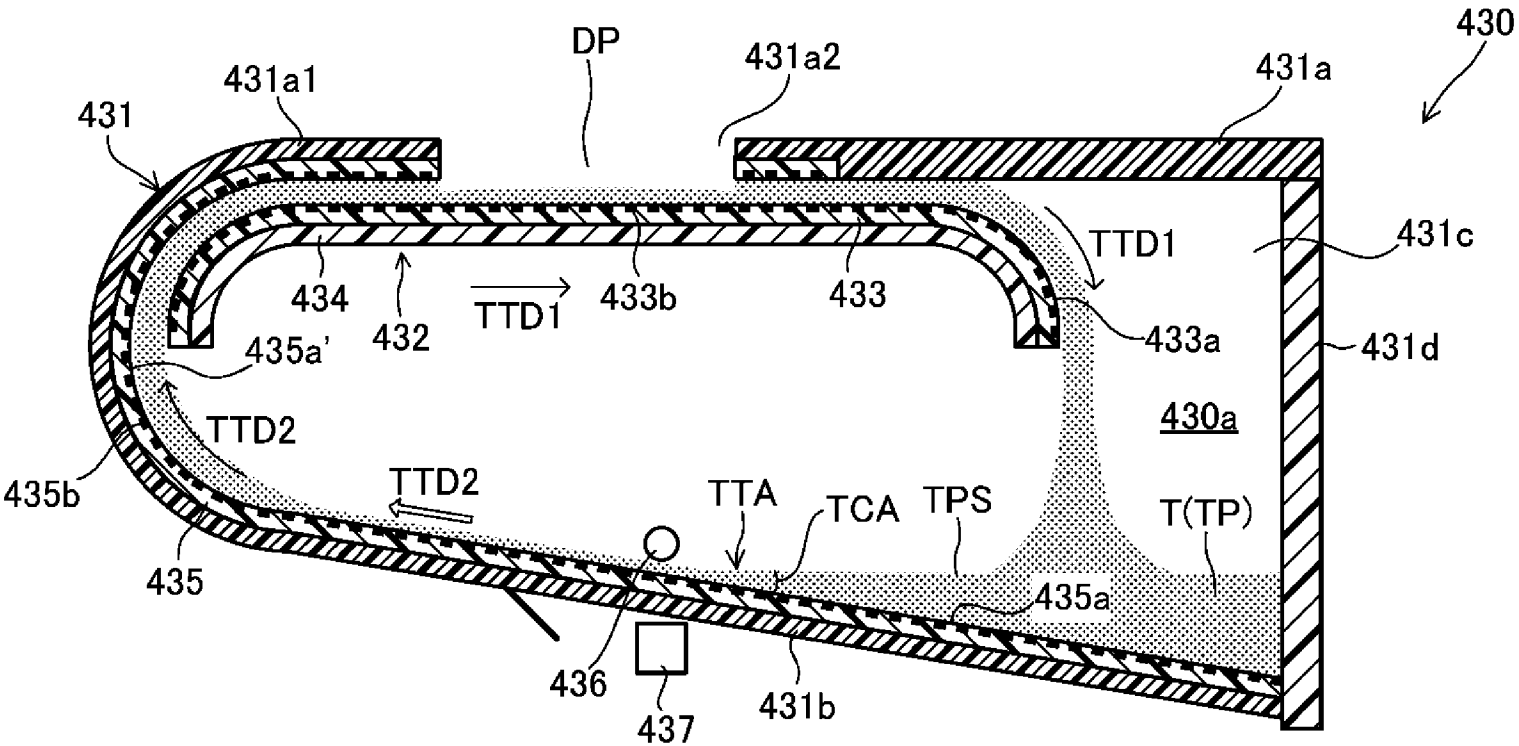
FIG. 35 is a side sectional view of the development apparatus shown in FIG. 31 showing a state in which the toner storage amount has decreased further, as compared with the state shown in FIG. 34.

FIG. 34 is a side sectional view of the development apparatus 430 shown in FIG. 31 showing a state in which the storage amount of the toner T within the developing casing 431 (the amount of toner pool TP) has decreased. FIG. 35 is a side sectional view of the development apparatus 430 shown in FIG. 31 showing a state in which the toner storage amount has decreased further, as compared with the state shown in FIG. 34.

As shown in FIGS. 34 and 35, the above-described toner pool top surface TPS gradually lowers as the storage amount of the toner T within the developing casing 431 decreases.

In such a case, according to the configuration of the present embodiment, the angle (toner contact angle TCA) between the toner pool top surface TPS and the toner sub-transport surface 435*a* in the toner transport start area TTA becomes substantially constant.

Referring to FIGS. 34 and 35, in the present embodiment, even when the storage amount of the toner T decreases, the toner contact angle TCA becomes substantially constant.

Thus, in the present embodiment, the state of transport of the toner T from the toner transport start area TTA toward the downstream side with respect to the toner sub-transport direction TTD2 becomes substantially constant. That is, the transport state of the toner T becomes stable.

Therefore, the configuration of the present embodiment can effectively suppress generation of a transport failure of the toner T (e.g., an extreme decrease in the transport amount), which failure would otherwise occur when the storage amount of the toner T within the developing casing 431 (the storage amount of the toner T at the bottom portion of the toner containing area 430*a*) decreases.

In the configuration of the present embodiment, the casing bottom plate 431*b* is formed in the shape of a flat plate which intersects with a horizontal plane at a small angle (30 degrees or less). Further, the toner sub-transport surface 435*a* is formed as a flat surface which intersects with the horizontal plane at a small angle (30 degrees or less). The angle between the toner sub-transport surface 435*a* and the flat plane becomes generally equal to the toner contact angle TCA.

By virtue of such a configuration, the toner contact angle TCA, which is the angle between the toner pool top surface TPS and the toner sub-transport surface 435*a*, becomes a small angle (30 degrees or less). Therefore, the greater part portion of the toner T in the toner transport start area TTA receives the action of the traveling-wave electric fields on the toner sub-transport surface 435*a*.

Therefore, the supply of the toner T from the toner transport start area TTA to a portion of the toner sub-transport surface 435*a* located at the downstream side with respect to the toner sub-transport direction TTD2 can be performed satisfactorily.

Further, the size of the developing casing 431 in the height direction decreases. Thus, the thickness of the developing apparatus 430 can be reduced. Therefore, a further reduction in the size of the laser printer 400 becomes possible.

In the configuration of the present embodiment, there are provided the vibration element 436 and the vibration-element drive section 437, which serve as the developer vibrating section for vibrating the toner T contained (stored) in the developing casing 431.

By virtue of such a configuration, the toner T stored in the developing casing 431 (the toner pool TP) is fluidized satisfactorily. Stresses, such as aggregation force and shearing force, acting on the toner T at that time are very small.

Therefore, by virtue of such a configuration, the state of supply of the toner T to the toner sub-transport surface 435*a*, the toner auxiliary transport surface 435*a*', and the toner main transport surface 433*a* can be made uniform satisfactorily. Accordingly, the state of transport of the toner T on the toner sub-transport surface 435*a*, the toner auxiliary transport surface 435*a*', and the toner main transport surface 433*a* can be made uniform satisfactorily As described above, the configuration of the present embodiment enables more uniform performance of the transport of the toner T and the supply of the toner T to the development facing position DP by means of the traveling-wave electric fields. Accordingly, generation of density non-uniformity can be suppressed effectively, whereby satisfactory image formation becomes possible.

In the configuration of the present embodiment, the vibration element 436 is disposed within the developing casing 431 such that the vibration element 436 is separated from the toner sub-transport surface 435*a*. This vibration element 436 is supported by the casing side plates 431*c* via the elastic seals 438 such that the vibration element 436 can oscillate.

Further, in the configuration of the present invention, the vibration-element drive section 437 is disposed outside the developing casing 431. The vibration-element drive section 437 can vibrate the vibration element 436 from the outside of the developing casing 431.

Such a configuration can suppress, to the greatest possible extent, generation of a distortion of a formed image, which distortion would otherwise occur when the predetermined positional relation at the developing position DP between the toner main transport surface 433*a* and the image carrying surface 421*b*1 changes due to vibration of the vibration element 436.

Further, it is possible to suppress, to the greatest possible extent, generation of noise which would otherwise be generated due to direct transmission of all the vibration of the vibration element 436 to the developing casing 431.

<Modifications>

(1) No particular limitation is imposed on the configurations of the toner electric-field transport body 432, the transport wiring substrate 433, and the counter wiring substrate 435 in the above-described embodiment.

For example, the transport electrodes 433*b* can be embedded in the transport-electrode support substrate 433*c* so as not to project from the surface of the transport-electrode support substrate 433*c*. The transport-electrode coating layer 433*d* can be omitted.

Alternatively, the transport electrodes 433*b* can be formed directly on the transport-substrate support member 434. In this case, the transport electrodes 433*b* can be embedded in the transport-electrode support member 434 so as not to project from the upper surface of the transport-electrode support member 434. Further, in this case, the toner main transport surface 433*a* is formed by the upper surface of the transport-electrode support member 434.

The counter electrodes 435*b* can also be, for example, embedded in the counter-electrode support substrate 435*c* so as not to project from the surface of the counter-electrode support substrate 435*c*. The counter-electrode coating layer 435*d* can be omitted.

Alternatively, the counter electrodes 435*b* can be formed directly on the inner wall surface of the casing bottom plate 431*b*. In this case, the counter electrodes 435*b* can be embedded in the casing bottom plate 431*b* so as not to project from the inner wall surface of the casing bottom plate 431*b*. Further, in this case, the toner sub-transport surface 435*a* is formed by the inner wall surface of the casing bottom plate 431*b*.

The longitudinal direction of the transport electrodes 433*b* and that of the counter electrodes 435*b* may be in parallel with the main scanning direction as in the case of the above-described embodiment or may intersect with the main scanning direction.

The direction of arraying the transport electrodes 433*b* and that of arraying the counter electrodes 435*b* may be in parallel with the sub-scanning direction as viewed in plane as in the case of the above-described embodiment or may intersect with the sub-scanning direction as viewed in plane.

No particular limitation is imposed on the transport electrodes 433*b* and the counter electrodes 435*b* with respect to shape and the configuration of electrical connections. For example, in place of the form of a straight line as in the case of the above-described embodiment, the transport electrodes 433*b* and the counter electrodes 435*b* can assume various other forms, such as V-shaped, arc, waves, and serrated.

The pattern of connecting the electrodes is not limited to that of connecting every fourth electrode as in the case of the above-described embodiment. For example, every other electrode or every third electrode may be connected. In this case, the corresponding power circuits are not of four kinds, but can be modified as appropriate such that the phase shift of voltage waveforms is 180°, 120°, etc. Furthermore, the voltage waveform can be rectangular waves, sine waves, and waves of various other shapes.

(2) The arrangement and configuration of the developer vibrating section of the present invention are not limited to those disclosed in the above-described embodiment and corresponding drawings.

For example, the vibration element 436 may be provided in the vicinity of the lowest position of the toner containing area 430*a* (a lower right end portion in FIG. 30).

Further, a plurality of vibration elements 436 may be provided within the developing casing 431 (toner containing area 430*a*).

Figure 36:
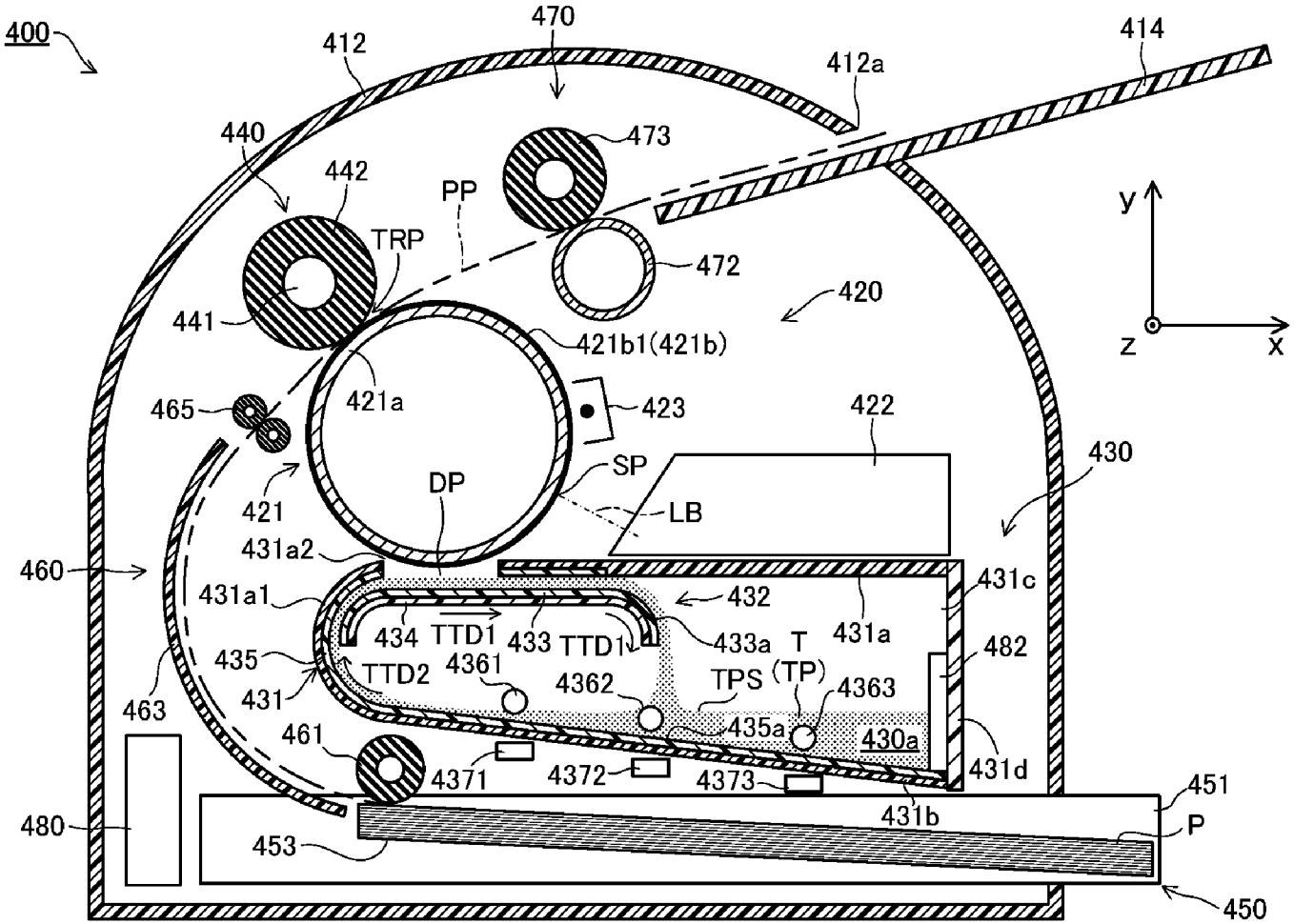
FIG. 36 is a side sectional view showing the configuration of one modification of the laser printer shown in FIG. 30.

FIG. 36 is a side sectional view showing the configuration of one modification of the laser printer 400 shown in FIG. 30.

As shown in FIG. 36, a downstream vibration element 4361, an intermediate vibration element 4362, and an upstream vibration element 4363 are provided within the developing casing 431 (the toner containing area 430*a*).

The downstream vibration element 4361 is provided downstream of the center of the toner sub-transport surface 435*a* with respect to the toner sub-transport direction TTD2. The upstream vibration element 4363 is provided upstream of the center of the toner sub-transport surface 435*a* with respect to the toner sub-transport direction TTD2. The intermediate vibration element 4362 is provided between the downstream vibration element 4361 and the upstream vibration element 4363.

Outside the developing casing 431 (the toner containing area 430*a*), a downstream-vibration-element vibration section 4371 is provided such that the downstream-vibration-element vibration section 4371 corresponds to the downstream vibration element 4361. Further, an intermediate-vibration-element vibration section 4372 is provided such that the intermediate-vibration-element vibration section 4372 corresponds to the intermediate vibration element 4362. Moreover, an upstream-vibration-element vibration section 4373 is provided such that the upstream-vibration-element vibration section 4373 corresponds to the upstream vibration element 4363.

Notably, the intermediate vibration element 4362 may be omitted. Alternatively, the intermediate vibration element 4362 may be provided at a plurality of locations. Moreover, the downstream-vibration-element drive section 4371 to the upstream-vibration-element drive section 4373 may be integrated.

Further, a vibration generation source such as a piezoelectric element may be directly provided on the vibration element 436 in FIG. 31 (the downstream vibration element 4361, etc. in FIG. 36). In such a case, the vibration-element drive section 437 (the downstream-vibration-element drive section 4371, etc. in FIG. 36) can be omitted.

Figure 37:
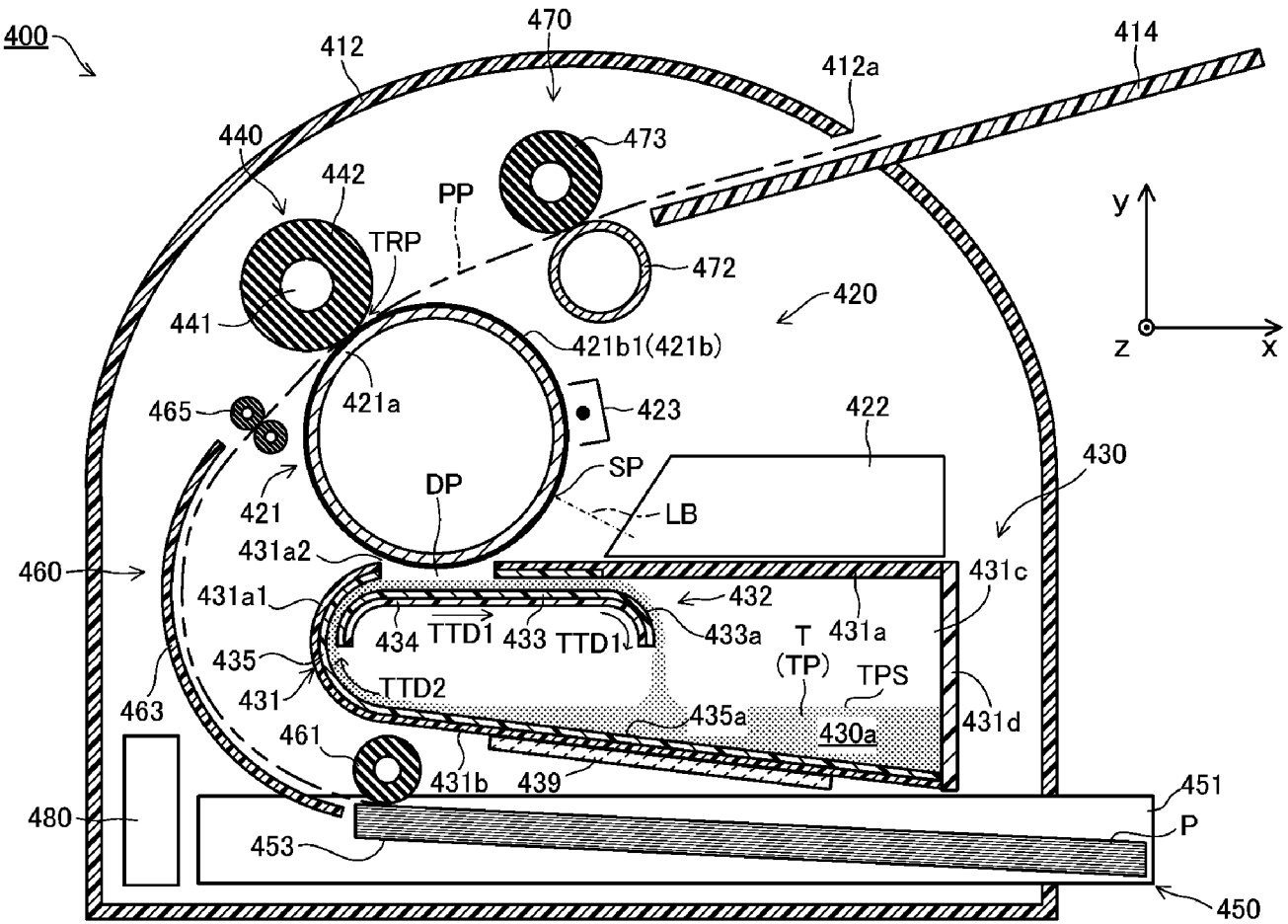
FIG. 37 is a side sectional view showing the configuration of another modification of the laser printer shown in FIG. 30.

Further, in place of the vibration element 436 and the vibration-element drive section 437 shown in FIG. 31, a vibration plate 439 may be used as shown in FIG. 37. This vibration plate 439 is formed of a piezoelectric element, a vibrator, or the like which can generate vibration upon supply of electricity thereto, as in the case of the vibration generation section 437*a* of the vibration-element drive section 437 (see FIG. 33).

As shown in FIG. 37, the vibration plate 439 may be provided on the casing bottom plate 431*b*. For example, the vibration plate 439 may be provided on the outer surface of the casing bottom plate 431*b* (the surface opposite the inner surface which faces the counter wiring substrate 435).

Alternatively, the vibration plate 439 may be provided within the developing casing 431 (the toner containing area 430*a*) such that the vibration plate 439 faces the toner sub-transport surface 435*a* with a predetermined gap therebetween.

By virtue of such a configuration, the toner pool TP within the toner containing area 430*a* can be fluidized satisfactorily by use of a very simple apparatus structure.

(3) The developer vibrating section of the present invention may be configured such that it can vibrate the entire toner pool TP even when the storage amount of the toner T within the developing casing 431 (the amount of the toner pool TP). Alternatively, the developer vibrating section of the present invention may be configured such that it can vibrate at least the toner within the toner transport start area TTA.

For example, referring to FIG. 36, a toner amount sensor 482 may be provided within the developing casing 431 (the toner containing area 430*a*).

The toner amount sensor 482 is configured to output a signal corresponding to the position of the toner pool top surface TPS; i.e., the amount of the toner T within the toner containing area 430*a*. This toner amount sensor 482 is electrically connected to the control section 480.

In such a configuration, the states of vibrations of the plurality of vibration elements (the downstream vibration element 4361, etc.) are controlled by the control section 480 in accordance with the position of the toner pool top surface TPS.

For example, when the position of the toner pool top surface TPS is high, each of the downstream vibration elements 4361 to the upstream vibration element 4363 is vibrated. When the position of the toner pool top surface TPS becomes lower than the downstream vibration element 4361, the intermediate vibration element 4362 and the upstream vibration element 4363 are vibrated. When the position of the toner pool top surface TPS becomes lower than the intermediate vibration element 4362, the upstream vibration element 4363 is vibrated.

Alternatively, for example, when the position of the toner pool top surface TPS is high, only the downstream vibration element 4361 is vibrated. When the position of the toner pool top surface TPS becomes lower than the downstream vibration element 4361, only the intermediate vibration element 4362 is vibrated. When the position of the toner pool top surface TPS becomes lower than the intermediate vibration element 4362, only the upstream vibration element 4363 is vibrated.

Alternatively, as shown in FIG. 37, in the case where the vibration plate 439 is provided such that it corresponds to the casing bottom plate 431*b*, the casing bottom plate 431*b* is vibrated by the vibration plate 439.

By virtue of this configuration, the toner T in the toner transport start area TTA (see FIG. 35) can be vibrated reliably even when the position of the toner pool top surface TPS changes with consumption of the toner T.

Figure 38:
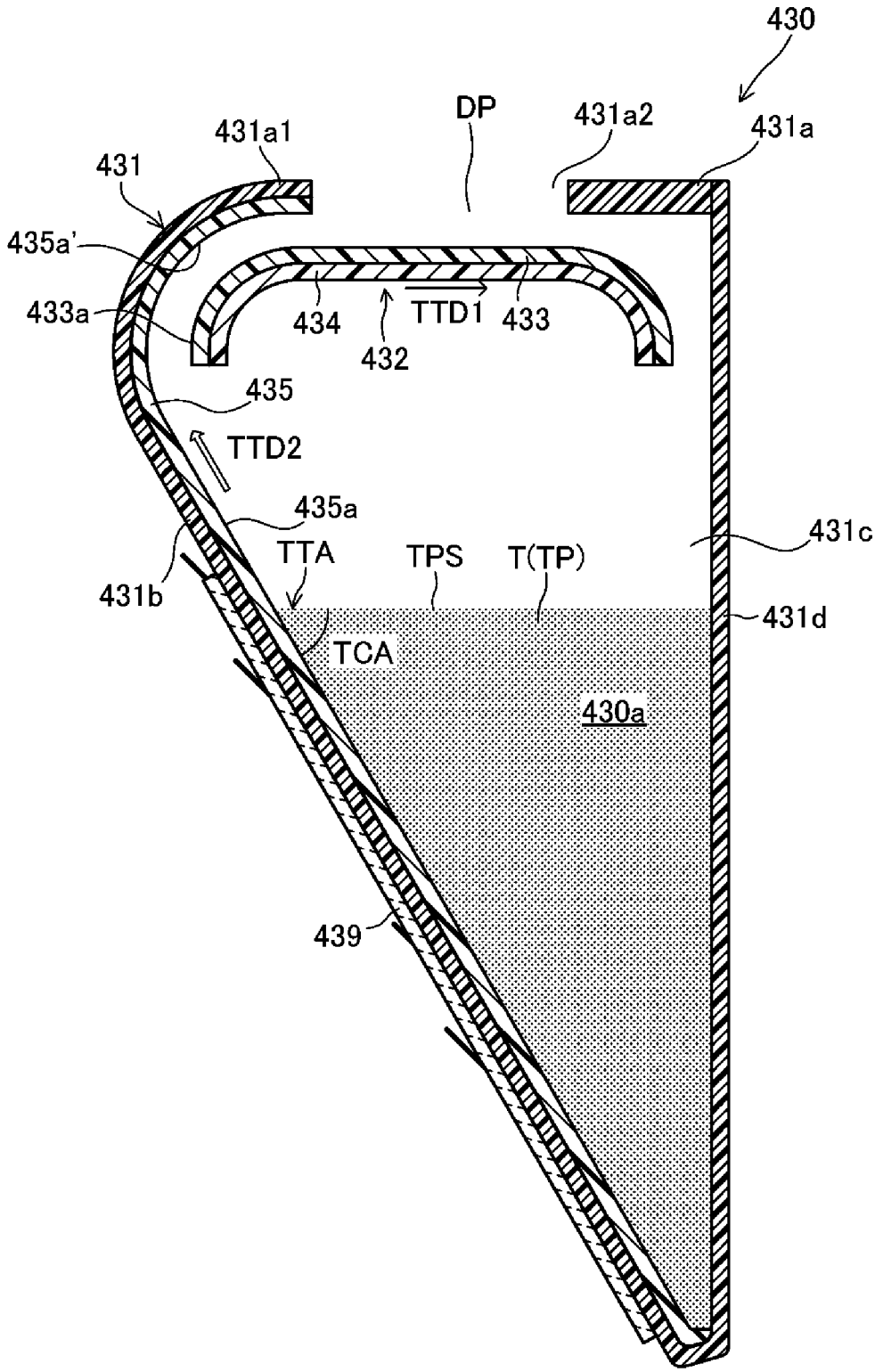
FIG. 38 is a side sectional view showing the configuration of another modification of the developing apparatus shown in FIG. 30.
Figure 39:
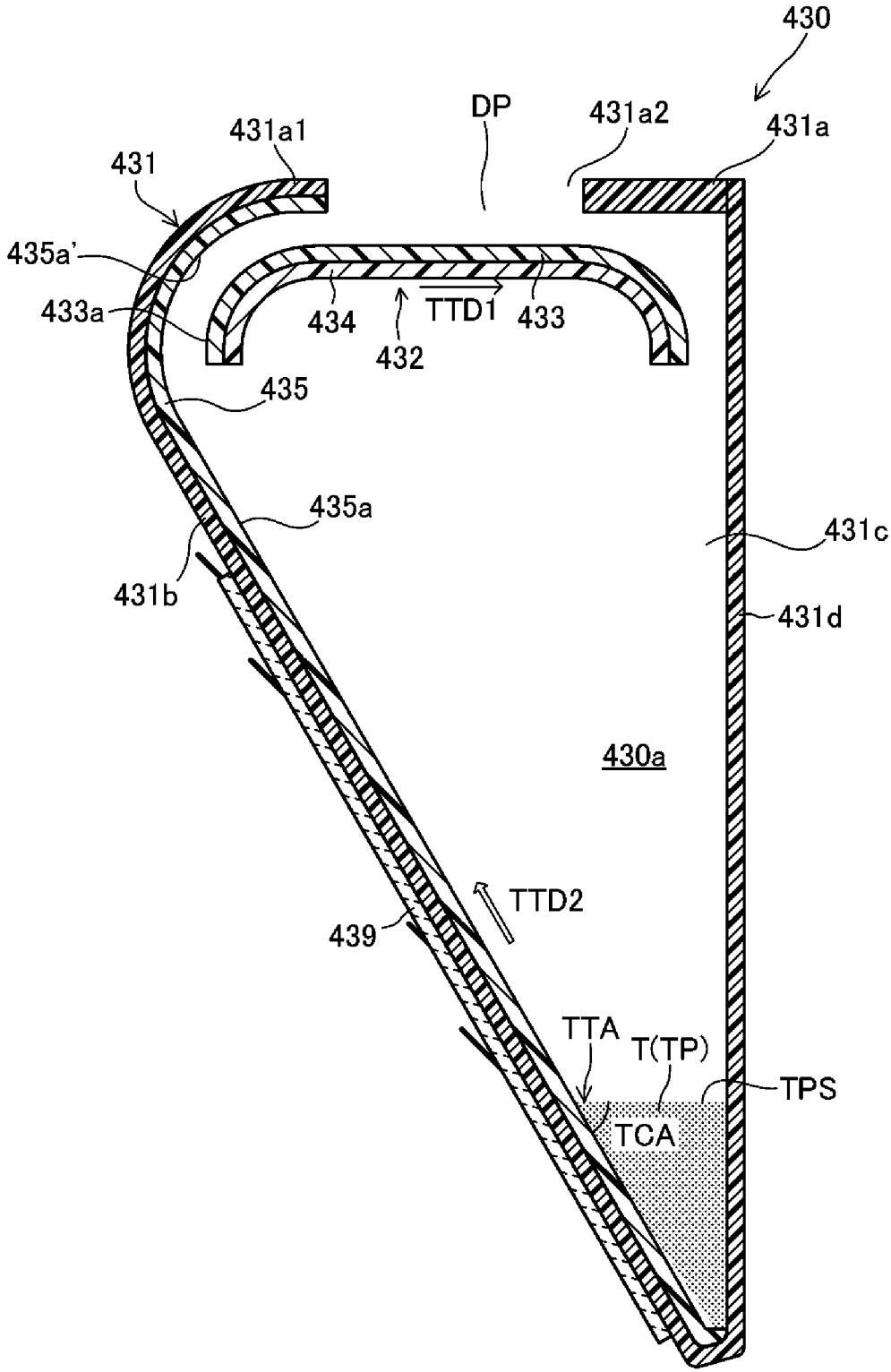
FIG. 39 is a side sectional view of the development apparatus shown in FIG. 38 showing a state in which the storage amount of toner within a developing casing (amount of toner pool) has decreased.

(4) FIG. 38 is a side sectional view showing the configuration of another modification of the developing apparatus 430 shown in FIG. 30. FIG. 39 is a side sectional view of the development apparatus 430 shown in FIG. 38 showing a state in which the storage amount of the toner T within the developing casing 431 (the amount of the toner pool TP) has decreased.

As shown in FIG. 38, the casing bottom plate 431*b* and the toner sub-transport surface 435*a* may be provided to form an angle of 60 degrees or greater in relation to a horizontal plane.

Such a configuration reduces the size of the developing casing 431 (the developing apparatus 430) as measured in the front-rear direction. Thus, the size of an apparatus in which a plurality of developing apparatus 430 is arranged in the front-rear direction can be reduced. That is, the size of an image forming apparatus which can form a multicolor image can be reduced.

Further, by virtue of such a configuration, when the storage amount of the toner T within the developing casing 431 (the amount of the toner pool TP) decreases as shown in FIG. 39, the toner pool top surface TPS can become horizontal due to the weight of the toner T itself, even if the toner pool TP is not vibrated by use of the vibration plate 439 or the like.

That is, since the toner sub-transport surface 435*a* is a steep slant surface which forms an angle of 60 degrees or greater in relation to a horizontal plane, the toner contact angle TCA is stably maintained at a substantially constant angle due to the weight of the toner T itself, even if the toner pool TP is not vibrated by use of the vibration plate 439 or the like.

Accordingly, even when the storage amount of the toner T within the developing casing 431 (the amount of the toner pool TP) decreases, the state of supply (start of transport) of the toner T from the toner transport start area TTA can be stabilized satisfactorily by employment of a very simple apparatus structure.

(5) The counter wiring substrate 435 may be partially or entirely omitted.

The invention claimed is:

1. An image forming apparatus comprising:

an electrostatic-latent-image carrying body having a latent-image forming surface formed in parallel with a predetermined main scanning direction and configured to form an electrostatic latent image thereon by electric-potential distribution, and configured such that the latent-image forming surface can move along a sub-scanning direction orthogonal to the main scanning direction; and a developer supply apparatus disposed to face the electrostatic-latent-image carrying body and configured to supply a developer in a charged state to the latent-image forming surface, wherein the developer supply apparatus includes:

a developer containing casing which is a box-like member including a bottom plate and a top plate having an opening portion at a position facing the electrostatic-latent-image carrying body, and is configured to contain the developer therein;

a developer transport body which has a developer transport surface parallel with the main scanning direction, and is disposed within the developer containing casing such that the developer transport surface faces the electrostatic-latent-image carrying body via the opening portion;

a plurality of transport electrodes which is provided along the developer transport surface to face the latent-image forming surface, is configured to transport the developer in a predetermined developer transport direction on the developer transport surface upon application of traveling-wave voltages, and is arrayed along the sub-scanning direction; and an auxiliary substrate provided on an inner surface of the bottom plate and having a plurality of auxiliary electrodes which is provided along the inner surface, wherein the auxiliary substrate is configured to transport the developer contained in the developer containing casing to the developer transport body by traveling-wave electric fields; and a vibration body disposed in a space inside the developer containing casing and configured to vibrate the developer on the auxiliary substrate, wherein the developer supply apparatus is configured to be attached to and detached from a main body of the image forming apparatus; and the main body includes a vibration-body vibrating section which is provided at such a position that, when the developer supply apparatus is attached, the vibration-body vibrating section is located at a position outside the developer containing casing and corresponding to the vibration body and which is configured to vibrate the vibration body.

2. An image forming apparatus according to claim 1, wherein the vibration body is disposed within the space of the developer containing casing such that the vibration body is separated from the inner surface of the bottom plate, and is supported by the developer containing casing such that the vibration body can oscillate.

3. An image forming apparatus according to claim 2, wherein the vibration body is formed of a wire-shaped or rod-shaped member.

4. An image forming apparatus according to claim 3, wherein the vibration body is formed of a vibration rod, which is a rod-shaped member extending along the main scanning direction; and opposite end portions of the vibration rod with respect to the main scanning direction are supported on the developer containing casing via an elastic member.

5. An image forming apparatus according to claim 4, wherein the vibration-body vibrating section is magnetically coupled with the vibration rod at one end of the vibration rod with respect to the main scanning direction.

6. A developer transport apparatus configured to transport a developer by traveling-wave electric fields, comprising:

a developer containing casing which is a box-like member including a bottom plate, and is configured to contain the developer therein and a top plate having an opening portion at a position configured to face an electrostatic-latent-image carrying body, and is configured to contain the developer therein;

a developer transport body, which has a developer transport surface parallel with a predetermined main scanning direction, is disposed within the developer containing casing such that the developer transport surface is configured to face the electrostatic-latent-image carrying body via the opening portion;

a plurality of transport electrodes, which is provided along the developer transport surface and configured to face a latent-image forming surface, is configured to transport the developer in a predetermined developer transport direction on the developer transport surface upon application of traveling-wave voltages, and is arrayed along a sub-scanning direction orthogonal to the main scanning direction;

a transport substrate provided on an inner surface of the bottom plate and having another plurality of transport electrodes which is provided along the inner surface, wherein the transport substrate is configured to generate the traveling-wave electric fields for transporting the developer contained in the developer containing casing; and a vibration body disposed in a space inside the developer containing casing and configured to vibrate the developer on the transport substrate.

7. A developer transport apparatus according to claim 6, wherein the vibration body is disposed within the space of the developer containing casing such that the vibration body is separated from the inner surface of the bottom plate, and is supported by the developer containing casing such that the vibration body can oscillate.

8. A developer transport apparatus according to claim 7, wherein the vibration body is formed of a wire-shaped or rod-shaped member.

9. A developer transport apparatus according to claim 8, wherein the vibration body is formed of a vibration rod, which is a rod-shaped member extending along the main scanning direction; and opposite end portions of the vibration rod with respect to the main scanning direction are supported on the developer containing casing via an elastic member.

10. A developer transport apparatus according to claim 9, wherein a vibration-body vibrating section is magnetically coupled with the vibration rod at one end of the vibration rod with respect to the main scanning direction.

* * * * *